US010727611B2

(12) United States Patent
Kirino et al.

(10) Patent No.: US 10,727,611 B2
(45) Date of Patent: Jul. 28, 2020

(54) WAVEGUIDE DEVICE AND ANTENNA ARRAY

(71) Applicants: Nidec Corporation, Kyoto (JP); WGR Co., Ltd., Kyoto, Kyoto (JP)

(72) Inventors: Hideki Kirino, Kyoto (JP); Hiroyuki Kamo, Kyoto (JP)

(73) Assignees: NIDEC CORPORATION, Kyoto (JP); WGR CO., LTD., Kyoto (JP)

( * ) Notice: Subject to any disclaimer, the term of this patent is extended or adjusted under 35 U.S.C. 154(b) by 0 days.

(21) Appl. No.: 16/780,944

(22) Filed: Feb. 4, 2020

(65) Prior Publication Data

US 2020/0176884 A1 Jun. 4, 2020

Related U.S. Application Data

(63) Continuation of application No. 16/150,385, filed on Oct. 3, 2018, now Pat. No. 10,594,045, which is a (Continued)

(30) Foreign Application Priority Data

Apr. 5, 2016 (JP) ..... 2016-075684

(51) Int. Cl.
*H01Q 21/06* (2006.01)
*H01P 5/12* (2006.01)

(Continued)

(52) U.S. Cl.
CPC ..... *H01Q 21/064* (2013.01); *H01P 3/123* (2013.01); *H01P 5/10* (2013.01); *H01P 5/12* (2013.01);

(Continued)

(58) Field of Classification Search
CPC ..... H01Q 21/06; H01Q 13/02; H01Q 13/10; H01Q 21/00; H01P 3/12; H01P 5/10; H01P 5/12

(Continued)

(56) References Cited

U.S. PATENT DOCUMENTS

2007/0139287 A1* 6/2007 Inomata ..... H01Q 13/02 343/786
2011/0181373 A1* 7/2011 Kildal ..... H01P 1/2005 333/239
2013/0321229 A1* 12/2013 Klefenz ..... H01Q 21/0087 343/770

OTHER PUBLICATIONS

Kirino et al., "Waveguide Device and Antenna Array", U.S. Appl. No. 16/150,385, filed Oct. 3, 2018.

* cited by examiner

*Primary Examiner* — Andrea Lindgren Baltzell
(74) *Attorney, Agent, or Firm* — Keating & Bennett

(57) ABSTRACT

An antenna array according to an embodiment includes a conductive member having a first and second slots adjacent to each other. The conductive surface on a front side of the conductive member is shaped so as to define a first and second horns respectively communicating with the first and second slots. The respective E planes of slots are on the same plane, or on a plurality of planes which are substantially parallel to each other. In an E-plane cross section of the first horn, a length from one of two intersections between the E plane and an edge of the first slot to one of two intersections between the E plane and an edge of the aperture plane of the first horn is longer than a length from the other intersection between the E plane and the edge of the first slot to the other intersection between the E plane and the edge of the aperture plane of the first horn, the lengths extending along an inner wall surface of the first horn.

20 Claims, 94 Drawing Sheets

Related U.S. Application Data continuation of application No. PCT/JP2017/014182, filed on Apr. 5, 2017.

(51) Int. Cl.

| | |
|---|---|
| ***H01Q 13/02*** | (2006.01) |
| ***H01Q 21/00*** | (2006.01) |
| ***H01P 3/123*** | (2006.01) |
| ***H01P 5/10*** | (2006.01) |
| ***H01Q 13/10*** | (2006.01) |

(52) U.S. Cl.

CPC ..... *H01Q 13/02* (2013.01); *H01Q 13/0283* (2013.01); *H01Q 13/10* (2013.01); *H01Q 21/0006* (2013.01); *H01Q 21/0087* (2013.01); *H01Q 21/06* (2013.01)

(58) Field of Classification Search

USPC ..... 343/786

See application file for complete search history.

WAVEGUIDE DEVICE AND ANTENNA ARRAY

This is a continuation of International Application No. PCT/JP2017/014182, with an international filing date of Apr. 5, 2017, which claims priority of Japanese Patent Application No. 2016-075684 filed Apr. 5, 2016, the entire contents of which are hereby incorporated by reference.

BACKGROUND

1. Technical Field

The present disclosure relates to a waveguide device and an antenna array.

2. Description of the Related Art

An antenna device including one or more antenna elements (hereinafter also referred to "radiating elements") that are arrayed on a line or a plane finds its use in various applications, e.g., radar and communication systems. In order to radiate electromagnetic waves from an antenna device, it is necessary to supply electromagnetic waves (e.g., radio-frequency signal waves) to an antenna element, from a circuit which generates electromagnetic waves. Supply of an electromagnetic wave is performed via a waveguide. A waveguide is also used to send electromagnetic waves that are received at the antenna elements to a reception circuit.

Conventionally, feed to an antenna element has often been achieved by using a microstrip line(s). However, in the case where the frequency of an electromagnetic wave to be transmitted or received is a high frequency, e.g., above gigahertz (GHz), a microstrip line will incur a large dielectric loss, thus detracting from the efficiency of the antenna. Therefore, in such a radio frequency region, an alternative waveguide to replace a microstrip line is needed.

Using a hollow waveguide, instead of a microstrip line, to feed each antenna element allows the loss to be reduced even in frequency regions exceeding 30 GHz. A hollow waveguide is a metal body having a circular or rectangular cross section. In the interior of a hollow waveguide, an electromagnetic field mode which is adapted to the shape and size of the body is created. For this reason, an electromagnetic wave is able to propagate within the body in a certain electromagnetic field mode. Since the body interior is hollow, no dielectric loss problem occurs even if the frequency of the electromagnetic wave to propagate increases. However, by using a hollow waveguide, it is difficult to dispose antenna elements with a high density, because the hollow portion of a hollow waveguide needs to have a width which is equal to or greater than a half wavelength of the electromagnetic wave to be propagated, and the body (metal wall) of the hollow waveguide itself also needs to be thick enough. An antenna device utilizing a hollow waveguide is disclosed in Patent Document 1, for example.

On the other hand, examples of waveguiding structures including an artificial magnetic conductor are disclosed in Patent Documents 2 to 4 and Non-Patent Documents 1 and 2. An artificial magnetic conductor is a structure which artificially realizes the properties of a perfect magnetic conductor (PMC), which does not exist in nature. One property of a perfect magnetic conductor is that "a magnetic field on its surface has zero tangential component". This property is the opposite of the property of a perfect electric conductor (PEC), i.e., "an electric field on its surface has zero tangential component". Although no perfect magnetic conductor exists in nature, it can be embodied by an artificial structure, e.g., an array of a plurality of electrically conductive rods. An artificial magnetic conductor functions as a perfect magnetic conductor in a specific frequency band which is defined by its structure. An artificial magnetic conductor restrains or prevents an electromagnetic wave of any frequency that is contained in the specific frequency band (propagation-restricted band) from propagating along the surface of the artificial magnetic conductor. For this reason, the surface of an artificial magnetic conductor may be referred to as a high impedance surface.

In the waveguide devices disclosed in Patent Documents 2 to 4 and Non-Patent Documents 1 and 2, an artificial magnetic conductor is realized by a plurality of electrically conductive rods which are arrayed along row and column directions. Such rods may also be referred to as posts or pins. Each of these waveguide devices includes, as a whole, a pair of opposing electrically conductive plates. One conductive plate has a ridge protruding toward the other conductive plate, and stretches of an artificial magnetic conductor extending on both sides of the ridge. An upper face (i.e., its electrically conductive face) of the ridge opposes, via a gap, a conductive surface of the other conductive plate. An electromagnetic wave of a wavelength which is contained in the propagation-restricted band of the artificial magnetic conductor propagates along the ridge, in the space (gap) between this conductive surface and the upper face of the ridge.

Patent Document 1: the specification of U.S. Pat. No. 9,136,605

Patent Document 2: International Publication No. 2010/050122

Patent Document 3: the specification of U.S. Pat. No. 8,803,638

Patent Document 4: the specification of European Patent Application Publication No. 1331688

Non-Patent Document 1: H. Kirino and K. Ogawa, "A 76 GHz Multi-Layered Phased Array Antenna using a Non-Metal Contact Metamaterial Waveguide", IEEE Transaction on Antenna and Propagation, Vol. 60, No. 2, pp. 840-853, February, 2012

Non-Patent Document 2: A. Uz. Zaman and P.-S. Kildal, "Ku Band Linear Slot-Array in Ridge Gapwaveguide Technology, EUCAP 2013, 7th European Conference on Antenna and Propagation

SUMMARY

In any waveguide device or antenna device, there is a desire to improve its performance, and permit freer positioning of constituent elements.

An antenna array according to an implementation of the present disclosure comprises an electrically conductive member having a first electrically conductive surface on a front side and a second electrically conductive surface on a rear side. The electrically conductive member has a plurality of slots forming a row along a first direction. The first electrically conductive surface of the electrically conductive member is shaped so as to define a plurality of horns each communicating with a corresponding one of the plurality of slots. E planes of the plurality of slots are on a same plane, or on a plurality of planes which are substantially parallel to one another. The plurality of slots include a first slot and a second slot which are adjacent to each other. The plurality of horns include a first horn communicating with the first slot and a second horn communicating with the second slot. In an E-plane cross section of the first horn, a length from one of two intersections between the E plane and an edge of the first slot to one of two intersections between the E plane and an edge of the aperture plane of the first horn is longer than a length from the other intersection between the E plane and the edge of the first slot to the other intersection between the E plane and the edge of the aperture plane of the first horn, the lengths extending along an inner wall surface of the first horn. In an E-plane cross section of the second horn, a length from one of two intersections between the E plane and an edge of the second slot to one of two intersections between the E plane and an edge of the aperture plane of the second horn is equal to or less than a length from the other intersection between the E plane and the edge of the second slot to the other intersection between the E plane and the edge of the aperture plane of the second horn, the lengths extending along an inner wall surface of the second horn. An axis which passes through a center of the first slot and through a center of the aperture plane of the first horn and an axis which passes through a center of the second slot and through a center of the aperture plane of the second horn are oriented in different directions.

An antenna array according to another implementation of the present disclosure comprises an electrically conductive member having a first electrically conductive surface on a front side and a second electrically conductive surface on a rear side. The electrically conductive member has a plurality of slots forming a row along a first direction. The first electrically conductive surface of the electrically conductive member is shaped so as to define a plurality of horns each communicating with a corresponding one of the plurality of slots. E planes of the plurality of slots are on a same plane, or on a plurality of planes which are substantially parallel to one another. The plurality of horns include a first horn, a second horn, and a third horn forming a row along the first direction. When electromagnetic waves are supplied to first to third slots respectively communicating with the first to third horns, three main lobes respectively radiated from the first to third horns overlap one another, center axes of the three main lobes are oriented in respectively different directions, and differences among the directions of the center axes of the three main lobes are smaller than a width of each of the three main lobes.

A waveguide device according to another implementation of the present disclosure comprises: a first electrically conductive member having a first electrically conductive surface on a front side and a second electrically conductive surface on a rear side; a waveguide member provided at the rear side of the first electrically conductive member, the waveguide member having an electrically-conductive waveguide face of a stripe shape that opposes the second electrically conductive surface, the waveguide member extending in a manner of following along the second electrically conductive surface; and a second electrically conductive member provided at the rear side of the first electrically conductive member, the second electrically conductive member supporting the waveguide member, the second electrically conductive member having a third electrically conductive surface on the front side that opposes the second electrically conductive surface, and a fourth electrically conductive surface on the rear side; and an artificial magnetic conductor extending on both sides of the waveguide member, the artificial magnetic conductor being provided on at least one of the second electrically conductive surface and the third electrically conductive surface. The second electrically conductive surface, the waveguide face, and the artificial magnetic conductor define a waveguide extending in a gap between the second electrically conductive surface and the waveguide face. The second electrically conductive member includes a port at a position adjacent to one end of the waveguide member, the port communicating from the fourth electrically conductive surface to the waveguide, and a choke structure at a position opposing the one end of the waveguide member via the port. The choke structure includes an electrically-conductive ridge at a position adjacent to the port and includes one or more electrically conductive rods provided on the third electrically conductive surface with a gap from a farther end of the ridge from the port. When an electromagnetic wave propagating in the waveguide has a central wavelength $\lambda 0$ in free space, the ridge has a length equal to or greater than $\lambda 0/16$ and less than $\lambda 0/4$ in a direction along the waveguide.

A waveguide device according to another implementation of the present disclosure comprises: a first electrically conductive member having a first electrically conductive surface on a front side and a second electrically conductive surface on a rear side; a waveguide member provided at the rear side of the first electrically conductive member, the waveguide member having an electrically-conductive waveguide face of a stripe shape that opposes the second electrically conductive surface, the waveguide member extending in a manner of following along the second electrically conductive surface; a second electrically conductive member provided at the rear side of the first electrically conductive member, the second electrically conductive member supporting the waveguide member, the second electrically conductive member having a third electrically conductive surface on the front side that opposes the second electrically conductive surface, and a fourth electrically conductive surface on the rear side; and an artificial magnetic conductor extending on both sides of the waveguide member, the artificial magnetic conductor being provided on at least one of the second electrically conductive surface and the third electrically conductive surface. The second electrically conductive surface, the waveguide face, and the artificial magnetic conductor define a waveguide extending in a gap between the second electrically conductive surface and the waveguide face. The first electrically conductive member includes a port provided at a position opposing a portion of the waveguide face adjacent to one end of the waveguide member, the port communicating from the first electrically conductive surface to the second electrically conductive surface. The second electrically conductive member includes a choke structure in a region containing the one end of the waveguide member. The choke structure comprises a waveguide member end portion and one or more electrically conductive rods, the waveguide member end portion spanning from an edge of an opening of the port to an edge of the one end of the waveguide member as projected onto the waveguide face, the one or more electrically conductive rods being provided on the third electrically conductive surface with a gap from the one end of the waveguide member. When an electromagnetic wave propagating in the waveguide has a central wavelength $\lambda 0$ in free space, the waveguide member end portion has a length equal to or greater than $\lambda 0/16$ and less than $\lambda 0/4$ in a direction along the waveguide.

A waveguide device according to another implementation of the present disclosure comprises: a first electrically conductive member having a first electrically conductive surface on a front side and a second electrically conductive surface on a rear side; a waveguide member provided at the rear side of the first electrically conductive member, the waveguide member having an electrically-conductive waveguide face of a stripe shape that opposes the second electrically conductive surface, the waveguide member extending in a manner of following along the second electrically conductive surface; a second electrically conductive member provided at the rear side of the first electrically conductive member, the second electrically conductive member supporting the waveguide member, the second electrically conductive member having a third electrically conductive surface on the front side that opposes the second electrically conductive surface, and a fourth electrically conductive surface on the rear side; and an artificial magnetic conductor extending on both sides of the waveguide member, the artificial magnetic conductor being provided on at least one of the second electrically conductive surface and the third electrically conductive surface. The second electrically conductive surface, the waveguide face, and the artificial magnetic conductor define a waveguide extending in a gap between the second electrically conductive surface and the waveguide face. The second electrically conductive member includes a port at a position adjacent to one end of the waveguide member, the port communicating from the fourth electrically conductive surface to the waveguide, and a choke structure at a position opposing the one end of the waveguide member via the port. The choke structure includes an electrically-conductive ridge at a position adjacent to the port and includes one or more electrically conductive rods provided on the third electrically conductive surface with a gap from a farther end of the ridge from the port. The ridge includes a first portion adjacent to the port and a second portion adjacent to the first portion. A distance between the first portion and the second electrically conductive surface is longer than a distance between the second portion and the second electrically conductive surface.

A waveguide device according to another implementation of the present disclosure comprises: a first electrically conductive member having a first electrically conductive surface on a front side and a second electrically conductive surface on a rear side; a waveguide member provided at the rear side of the first electrically conductive member, the waveguide member having an electrically-conductive waveguide face of a stripe shape that opposes the second electrically conductive surface, the waveguide member extending in a manner of following along the second electrically conductive surface; a second electrically conductive member provided at the rear side of the first electrically conductive member, the second electrically conductive member supporting the waveguide member, the second electrically conductive member having a third electrically conductive surface on the front side that opposes the second electrically conductive surface, and a fourth electrically conductive surface on the rear side; and an artificial magnetic conductor extending on both sides of the waveguide member, the artificial magnetic conductor being provided on at least one of the second electrically conductive surface and the third electrically conductive surface. The second electrically conductive surface, the waveguide face, and the artificial magnetic conductor define a waveguide extending in a gap between the second electrically conductive surface and the waveguide face. The first electrically conductive member includes a port provided at a position opposing a portion of the waveguide face adjacent to one end of the waveguide member, the port communicating from the first electrically conductive surface to the second electrically conductive surface. The second electrically conductive member includes a choke structure in a region containing the one end of the waveguide member. The choke structure comprises a waveguide member end portion and one or more electrically conductive rods, the waveguide member end portion spanning from an edge of an opening of the port to an edge of the one end of the waveguide member as projected onto the waveguide face, the one or more electrically conductive rods being provided on the third electrically conductive surface with a gap from the one end of the waveguide member. At a site opposing the waveguide member end portion, the second electrically conductive surface of the first electrically conductive member includes a first portion adjacent to the port and a second portion adjacent to the first portion. A distance between the first portion and the waveguide face is longer than a distance between the second portion and the waveguide face.

A waveguide device according to another implementation of the present disclosure comprises: a first electrically conductive member having a first electrically conductive surface on a front side and a second electrically conductive surface on a rear side; a waveguide member provided at the rear side of the first electrically conductive member, the waveguide member having an electrically-conductive waveguide face of a stripe shape that opposes the second electrically conductive surface, the waveguide member extending in a manner of following along the second electrically conductive surface; a second electrically conductive member provided at the rear side of the first electrically conductive member, the second electrically conductive member supporting the waveguide member, the second electrically conductive member having a third electrically conductive surface on the front side that opposes the second electrically conductive surface, and a fourth electrically conductive surface on the rear side; and an artificial magnetic conductor extending on both sides of the waveguide member, the artificial magnetic conductor being provided on at least one of the second electrically conductive surface and the third electrically conductive surface. The second electrically conductive surface, the waveguide face, and the artificial magnetic conductor define a waveguide extending in a gap between the second electrically conductive surface and the waveguide face. The second electrically conductive member includes a port communicating from the fourth electrically conductive surface to the waveguide. The waveguide member is spatially separated into a first portion and a second portion at the port. A portion of an inner wall of the port connects to one end of the first portion of the waveguide member. Another portion of the inner wall of the port connects to one end the second portion of the waveguide member. An intra-waveguide member gap defined between two opposing end faces at the one end of the first portion and the one end of the second portion of the waveguide member includes a narrow portion which is smaller in size than a gap between the portion of the inner wall of the port that connects to the first portion of the waveguide member and the other portion of the inner wall of the port that connects to the second portion of the waveguide member.

An array antenna device according to another implementation of the present disclosure comprises: a first electrically conductive member having a first electrically conductive surface on a front side and a second electrically conductive surface on a rear side, the first electrically conductive member having a plurality of slots; a waveguide member provided at the rear side of the first electrically conductive member, the waveguide member having an electrically-conductive waveguide face of a stripe shape that opposes the second electrically conductive surface, the waveguide member extending in a manner of following along the second electrically conductive surface; a second electrically conductive member provided at the rear side of the first electrically conductive member, the second electrically conductive member supporting the waveguide member, the second electrically conductive member having a third electrically conductive surface on the front side that opposes the second electrically conductive surface, and a fourth electrically conductive surface on the rear side; and an artificial magnetic conductor extending on both sides of the waveguide member, the artificial magnetic conductor being provided on at least one of the second electrically conductive surface and the third electrically conductive surface. The second electrically conductive surface, the waveguide face, and the artificial magnetic conductor define a waveguide extending in a gap between the second electrically conductive surface and the waveguide face. The second electrically conductive member includes a port communicating from the fourth electrically conductive surface to the waveguide. On the second electrically conductive surface, a first slot and a second slot which are adjacent to each other among the plurality of slots are at symmetric positions with respect to a center of the port. The waveguide member includes a pair of impedance matching structures adjoining the port, each of the pair of impedance matching structures having a flat portion adjoining the port and a dent adjoining the flat portion, and partly opposes one of the first and second slots.

An array antenna device according to another implementation of the present disclosure comprises: a first electrically conductive member having a first electrically conductive surface on a front side and a second electrically conductive surface on a rear side; a waveguide member provided at the rear side of the first electrically conductive member, the waveguide member having an electrically-conductive waveguide face of a stripe shape that opposes the second electrically conductive surface, the waveguide member extending in a manner of following along the second electrically conductive surface; a second electrically conductive member provided at the rear side of the first electrically conductive member, the second electrically conductive member supporting the waveguide member, the second electrically conductive member having a third electrically conductive surface on the front side that opposes the second electrically conductive surface, and a fourth electrically conductive surface on the rear side; and an artificial magnetic conductor extending on both sides of the waveguide member, the artificial magnetic conductor being provided on at least one of the second electrically conductive surface and the third electrically conductive surface. The second electrically conductive surface, the waveguide face, and the artificial magnetic conductor define a waveguide extending in a gap between the second electrically conductive surface and the waveguide face. The second electrically conductive member includes a port communicating from the fourth electrically conductive surface to the waveguide. The waveguide member is spatially separated into a first portion and a second portion at the port. A portion of an inner wall of the port connects to one end of the first portion of the waveguide member. Another portion of the inner wall of the port connects to one end the second portion of the waveguide member. A distance between two opposing end faces at the one end of the first portion and the one end of the second portion of the waveguide member is different from a distance between the portion of the inner wall of the port that connects to the first portion of the waveguide member and the other portion of the inner wall of the port that connects to the second portion of the waveguide member.

An array antenna device according to another implementation of the present disclosure comprises: a first electrically conductive member having a first electrically conductive surface on a front side and a second electrically conductive surface on a rear side, the first electrically conductive member having a plurality of slots; a waveguide member provided at the rear side of the first electrically conductive member, the waveguide member having an electrically-conductive waveguide face of a stripe shape that opposes the second electrically conductive surface, the waveguide member extending in a manner of following along the second electrically conductive surface; a second electrically conductive member provided at the rear side of the first electrically conductive member, the second electrically conductive member supporting the waveguide member, the second electrically conductive member having a third electrically conductive surface on the front side that opposes the second electrically conductive surface, and a fourth electrically conductive surface on the rear side; and an artificial magnetic conductor extending on both sides of the waveguide member, the artificial magnetic conductor being provided on at least one of the second electrically conductive surface and the third electrically conductive surface. The second electrically conductive surface, the waveguide face, and the artificial magnetic conductor define a waveguide extending in a gap between the second electrically conductive surface and the waveguide face. The second electrically conductive member includes a port communicating from the fourth electrically conductive surface to the waveguide. The plurality of slots opposes the waveguide face. On the second electrically conductive surface, a first slot and a second slot which are adjacent to each other among the plurality of slots are at symmetric positions with respect to a center of the port. The first electrically conductive surface of the first electrically conductive member is shaped so as to define a plurality of horns respectively communicating with the plurality of slots. Among the plurality of horns, a distance between centers of the openings of two adjacent horns is shorter than a distance on the second electrically conductive surface from a center of the first slot to a center of the second slot.

An array antenna device according to another implementation of the present disclosure comprises: a first electrically conductive member having a first electrically conductive surface on a front side and a second electrically conductive surface on a rear side; a waveguide member provided at the rear side of the first electrically conductive member, the waveguide member having an electrically-conductive waveguide face of a stripe shape that opposes the second electrically conductive surface, the waveguide member extending in a manner of following along the second electrically conductive surface; a second electrically conductive member provided at the rear side of the first electrically conductive member, the second electrically conductive member supporting the waveguide member, the second electrically conductive member having a third electrically conductive surface on the front side that opposes the second electrically conductive surface, and a fourth electrically conductive surface on the rear side; and an artificial magnetic conductor extending on both sides of the waveguide member, the artificial magnetic conductor being provided on at least one of the second electrically conductive surface and the third electrically conductive surface. The second electrically conductive surface, the waveguide face, and the artificial magnetic conductor define a waveguide extending in a gap between the second electrically conductive surface and the waveguide face. The second electrically conductive member includes a port at a position adjacent to one end of the waveguide member, the port communicating from the fourth electrically conductive surface to the waveguide, and a choke structure at a position opposing the one end of the waveguide member via the port. The choke structure includes a first portion adjacent to the port and a second portion adjacent to the first portion. A distance between the first portion and the second electrically conductive surface is longer than a distance between the second portion and the second electrically conductive surface.

An array antenna device according to another implementation of the present disclosure comprises: a first electrically conductive member having a first electrically conductive surface on a front side and a second electrically conductive surface on a rear side, the first electrically conductive member having $2^N$ (where N is an integer of 2 or greater) ports; a waveguide member at the rear side of the first electrically conductive member, the waveguide member having an electrically-conductive waveguide face opposing the second electrically conductive surface, the waveguide member extending in a manner of following along the second electrically conductive surface; a second electrically conductive member at the rear side of the first electrically conductive member, the second electrically conductive member supporting the waveguide member, and the second electrically conductive member having a third electrically conductive surface on the front side that opposes the second electrically conductive surface; and an artificial magnetic conductor extending on both sides of the waveguide member, the artificial magnetic conductor being provided on at least one of the second electrically conductive surface and the third electrically conductive surface. The second electrically conductive surface, the waveguide face, and the artificial magnetic conductor define a waveguide in a gap between the second electrically conductive surface and the waveguide face. Via combinations among a plurality of T-branching portions, the waveguide member branches from one stem into $2^N$ waveguide terminal sections, the $2^N$ ports respectively opposing the $2^N$ waveguide terminal sections, at least one of the $2^N$ waveguide terminal sections has a shape which is different from the shape of another.

An array antenna device according to another implementation of the present disclosure comprises: a first electrically conductive member having a first electrically conductive surface on a front side and a second electrically conductive surface on a rear side; a waveguide member at the rear side of the first electrically conductive member, the waveguide member having an electrically-conductive waveguide face opposing the second electrically conductive surface, the waveguide member extending in a manner of following along the second electrically conductive surface; a second electrically conductive member at the rear side of the first electrically conductive member, the second electrically conductive member supporting the waveguide member, and the second electrically conductive member having a third electrically conductive surface on the front side that opposes the second electrically conductive surface; and an artificial magnetic conductor extending on both sides of the waveguide member, the artificial magnetic conductor being provided on at least one of the second electrically conductive surface and the third electrically conductive surface. The second electrically conductive surface, the waveguide face, and the artificial magnetic conductor define a waveguide extending in a gap between the second electrically conductive surface and the waveguide face. Via combinations among a plurality of T-branching portions, the waveguide member branches from one stem into $2^N$ (where N is an integer of 2 or greater) waveguide terminal sections. On a stem portion adjacent to each of the plurality of T-branching portions, the waveguide member includes a plurality of impedance transforming sections to increase a capacitance of the waveguide. Among the plurality of impedance transforming sections, a length of a first impedance transforming section in a direction along the waveguide is shorter than a length of a second impedance transforming section in a direction along the waveguide, the first impedance transforming section being relatively far from the waveguide terminal section, the second impedance transforming section being relatively close to the waveguide terminal section.

An array antenna device according to another implementation of the present disclosure comprises: a first electrically conductive member having a first electrically conductive surface on a front side and a second electrically conductive surface on a rear side; a waveguide member at the rear side of the first electrically conductive member, the waveguide member having an electrically-conductive waveguide face opposing the second electrically conductive surface, the waveguide member extending in a manner of following along the second electrically conductive surface; a second electrically conductive member provided at the rear side of the first electrically conductive member, the second electrically conductive member supporting the waveguide member, the second electrically conductive member having a third electrically conductive surface on the front side that opposes the second electrically conductive surface, and a fourth electrically conductive surface on the rear side; and an artificial magnetic conductor extending on both sides of the waveguide member, the artificial magnetic conductor having a plurality of electrically conductive rods on the third electrically conductive surface. The second electrically conductive surface, the waveguide face, and the artificial magnetic conductor define a waveguide extending in a gap between the second electrically conductive surface and the waveguide face. The second electrically conductive member includes a rectangular hollow-waveguide at a position adjacent to one end of the waveguide member, the rectangular hollow-waveguide communicating from the fourth electrically conductive surface to the waveguide, and a choke structure at a position opposing the one end of the waveguide member via the rectangular hollow-waveguide. The plurality of electrically conductive rods include at least two rows of electrically conductive rods that are arrayed on both sides of the waveguide member and extending along the waveguide member. As viewed from a normal direction of the third electrically conductive surface, the rectangular hollow-waveguide has a rectangular shape which is defined by a pair of longer sides and a pair of shorter sides orthogonal to the longer sides, one of the pair of longer sides being in contact with the one end of the waveguide member, and a length of each longer side of the rectangular hollow-waveguide is longer than twice a shortest distance between centers of the at least two rows of electrically conductive rods, and shorter than 3.5 times the shortest distance between the centers.

An array antenna device according to another implementation of the present disclosure comprises: a first electrically conductive member having a first electrically conductive surface on a front side and a second electrically conductive surface on a rear side, the first electrically conductive member having a plurality of slots; a waveguide member at the rear side of the first electrically conductive member, having an electrically-conductive waveguide face in a stripe shape opposing the second electrically conductive surface and at least one of the plurality of slots, the waveguide member extending in a manner of following along the second electrically conductive surface; and a second electrically conductive member at the rear side of the first electrically conductive member, the second electrically conductive member supporting the waveguide member, and the second electrically conductive member having a third electrically conductive surface on the front side that opposes the second electrically conductive surface; and an artificial magnetic conductor extending on both sides of the waveguide member and being provided on the third electrically conductive surface, the artificial magnetic conductor having a plurality of electrically conductive rods on the third electrically conductive surface. The second electrically conductive surface, the waveguide face, and the artificial magnetic conductor define a waveguide extending in a gap between the second electrically conductive surface and the waveguide face. At least one of a distance from the second electrically conductive surface to the waveguide face and a width of the waveguide face varies along the waveguide. Among the plurality of electrically conductive rods, a plurality of first electrically conductive rods adjacent to the waveguide member are in a periodic array with a first period in a direction along the waveguide. Among the plurality of electrically conductive rods, a plurality of second electrically conductive rods not adjacent to the waveguide member are in a periodic array with a second period in a direction along the waveguide, the second period being longer than the first period.

An array antenna device according to another implementation of the present disclosure comprises: a first electrically conductive member having a first electrically conductive surface on a front side and a second electrically conductive surface on a rear side, the first electrically conductive member having a plurality of slots; a waveguide member at the rear side of the first electrically conductive member, having an electrically-conductive waveguide face in a stripe shape opposing the second electrically conductive surface and at least one of the plurality of slots, the waveguide member extending in a manner of following along the second electrically conductive surface; a second electrically conductive member at the rear side of the first electrically conductive member, the second electrically conductive member supporting the waveguide member, and the second electrically conductive member having a third electrically conductive surface on the front side that opposes the second electrically conductive surface; and an artificial magnetic conductor extending on both sides of the waveguide member and being provided on the third electrically conductive surface, the artificial magnetic conductor having a plurality of electrically conductive rods on the third electrically conductive surface. The second electrically conductive surface, the waveguide face, and the artificial magnetic conductor define a waveguide extending in a gap between the second electrically conductive surface and the waveguide face. In a plane which is parallel to the second electrically conductive member, a first direction is defined as a direction extending along the waveguide, and a second direction is defined perpendicular to the first direction. Among the plurality of electrically conductive rods, a group of rods adjacent to the waveguide member each have a dimension along the first direction which is larger than a dimension along the second direction.

These general and specific aspects may be implemented using a system, a method, and a computer program, and any combination of systems, methods, and computer programs.

Additional benefits and advantages of the disclosed embodiments will be apparent from the specification and Figures. The benefits and/or advantages may be individually provided by the various embodiments and features of the specification and drawings disclosure, and need not all be provided in order to obtain one or more of the same.

According to an embodiment of the present disclosure, it is possible to enhance the performance of a waveguide device or antenna device, and permit freer positioning of constituent elements thereof.

BRIEF DESCRIPTION OF THE DRAWINGS

FIG. 59A is a diagram showing a relationship between an array antenna device AA of the onboard radar system 510 and plural arriving waves k.

FIG. 59B is a diagram showing the array antenna device AA receiving the $k^{th}$ arriving wave.

FIG. 60 is a block diagram showing an exemplary fundamental construction of a vehicle travel controlling apparatus 600 according to the present disclosure.

FIG. 61 is a block diagram showing another exemplary construction for the vehicle travel controlling apparatus 600.

FIG. 62 is a block diagram showing an example of a more specific construction of the vehicle travel controlling apparatus 600.

FIG. 63 is a block diagram showing a more detailed exemplary construction of the radar system 510 according to this Application Example.

FIG. 64 is a diagram showing change in frequency of a transmission signal which is modulated based on the signal that is generated by a triangular wave generation circuit 581.

FIG. 65 is a diagram showing a beat frequency fu in an "ascent" period and a beat frequency fd in a "descent" period.

FIG. 66 is a diagram showing an exemplary implementation in which a signal processing circuit 560 is implemented in hardware including a processor PR and a memory device MD.

FIG. 67 is a diagram showing a relationship between three frequencies f1, f2 and f3.

FIG. 68 is a diagram showing a relationship between synthetic spectra F1 to F3 on a complex plane.

FIG. 69 is a flowchart showing the procedure of a process of determining relative velocity and distance.

Figure 70:
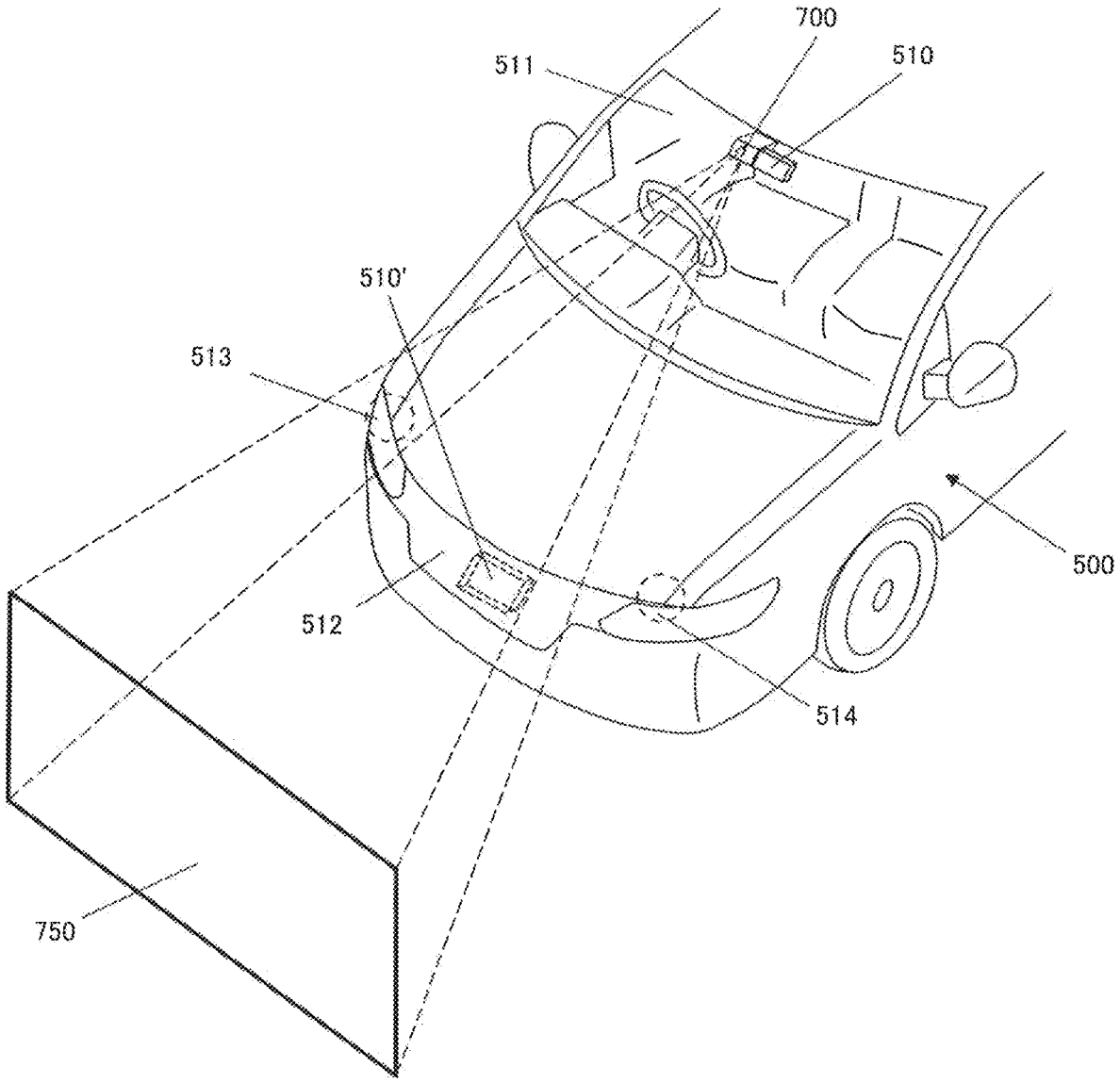

FIG. 70 is a diagram concerning a fusion apparatus in which a radar system 510 having a slot array antenna and an onboard camera system 700 are included.

Figure 71:
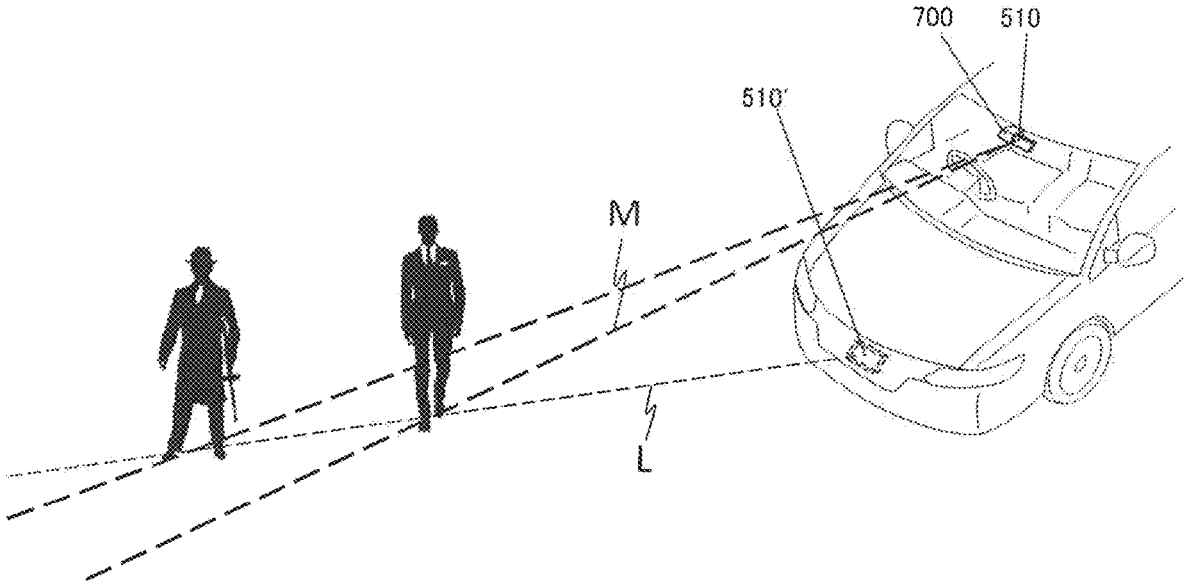

FIG. 71 is a diagram illustrating how placing a millimeter wave radar 510 and a camera at substantially the same position within the vehicle room may allow them to acquire an identical field of view and line of sight, thus facilitating a matching process.

Figure 72:
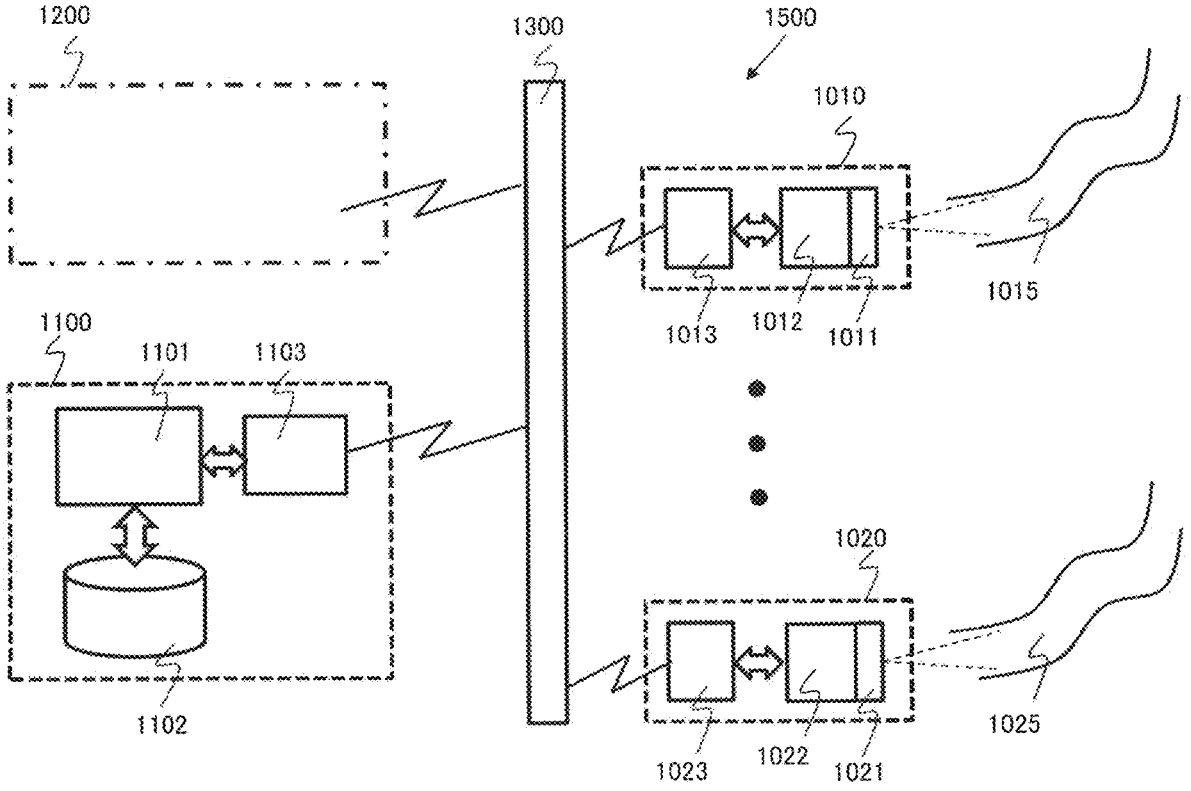

FIG. 72 is a diagram showing an exemplary construction for a monitoring system 1500 based on millimeter wave radar.

Figure 73:
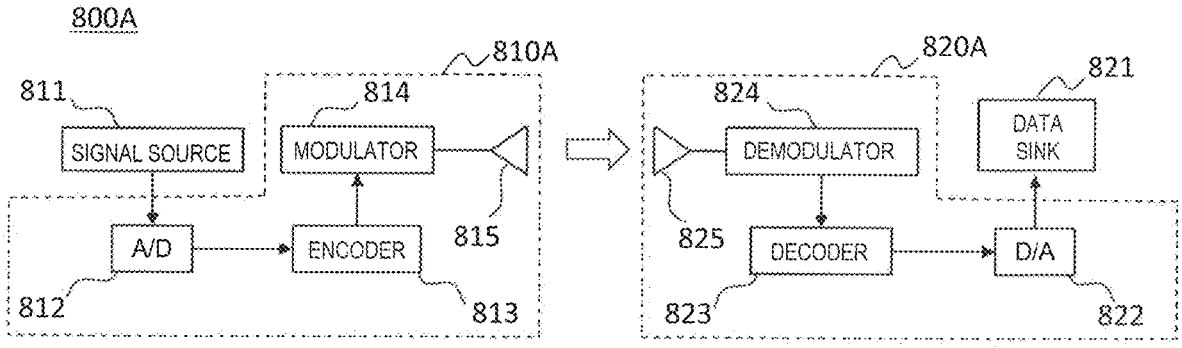

FIG. 73 is a block diagram showing a construction for a digital communication system 800A.

Figure 74:
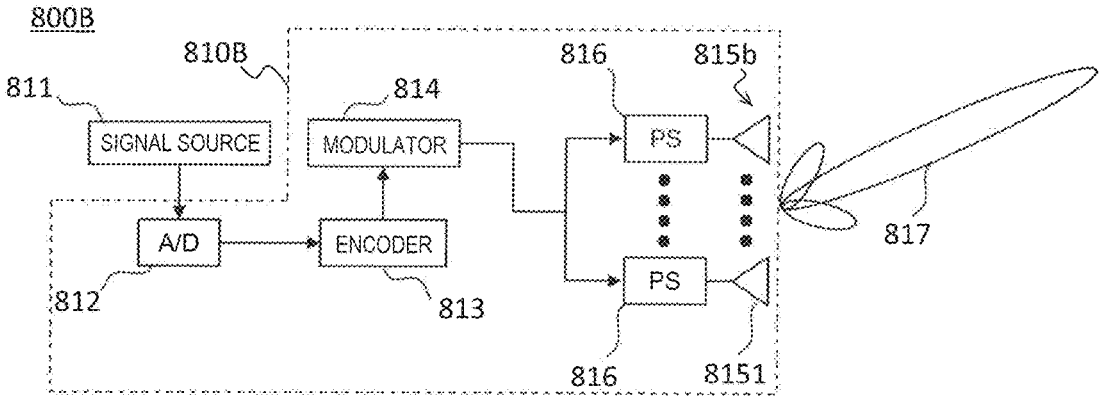

FIG. 74 is a block diagram showing an exemplary communication system 800B including a transmitter 810B which is capable of changing its radio wave radiation pattern.

Figure 75:
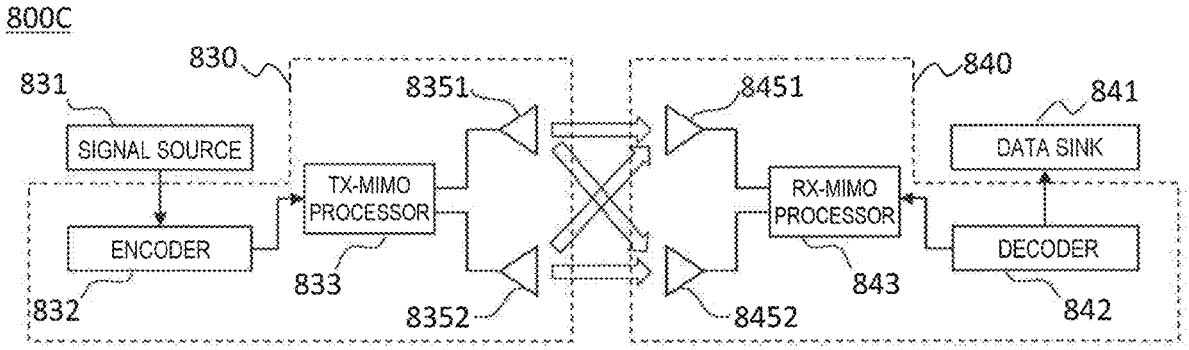

FIG. 75 is a block diagram showing an exemplary communication system 800C implementing a MIMO function.

DETAILED DESCRIPTION

Prior to describing embodiments of the present disclosure, findings that form the basis of the present disclosure will be described.

Embodiments of the present disclosure provide improvements on waveguide devices or antenna devices in which a conventional hollow waveguide(s) or a ridge waveguide(s) is utilized. First, a fundamental construction of a waveguide device in which a ridge waveguide(s) is utilized will be described.

A ridge waveguide which is disclosed in each of the aforementioned Patent Document 2 and Non-Patent Document 1, etc., is provided in a waffle iron structure which may function as an artificial magnetic conductor. A ridge waveguide in which such an artificial magnetic conductor is utilized (which hereinafter may be referred to as a WRG: Waffle-iron Ridge waveguide) according to the present disclosure is able to realize an antenna feeding network with low losses in the microwave or the millimeter wave band.

Figure 1:
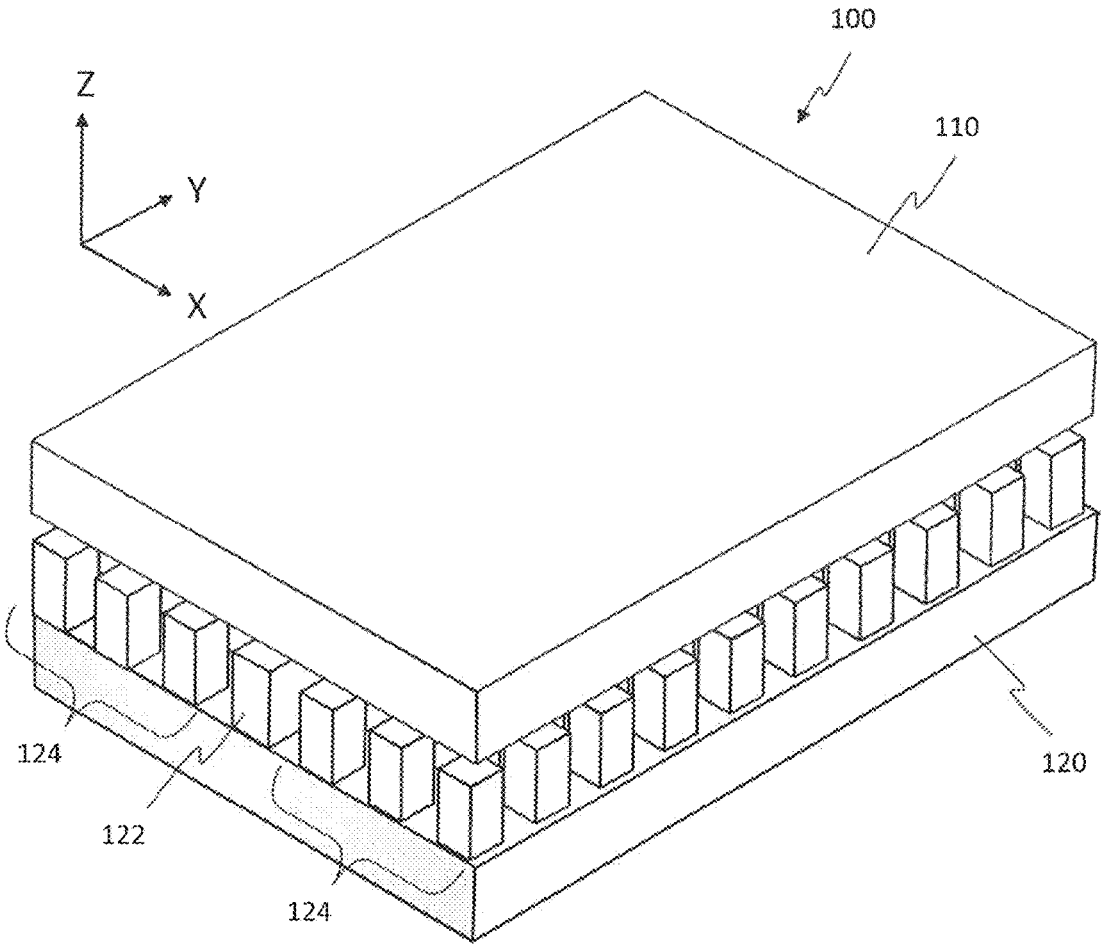
FIG. 1 is a perspective view schematically showing a non-limiting example of the fundamental construction of a waveguide device.

FIG. 1 is a perspective view schematically showing a non-limiting example of a fundamental construction of such a waveguide device. FIG. 1 shows XYZ coordinates along X, Y and Z directions which are orthogonal to one another. The waveguide device 100 shown in the figure includes a plate-like first electrically conductive member 110 and a plate-like second electrically conductive member 120, which are in opposing and parallel positions to each other. A plurality of electrically conductive rods 124 are arrayed on the second conductive member 120.

Note that any structure appearing in a figure of the present application is shown in an orientation that is selected for ease of explanation, which in no way should limit its orientation when an embodiment of the present disclosure is actually practiced. Moreover, the shape and size of a whole or a part of any structure that is shown in a figure should not limit its actual shape and size.

Figure 2A:
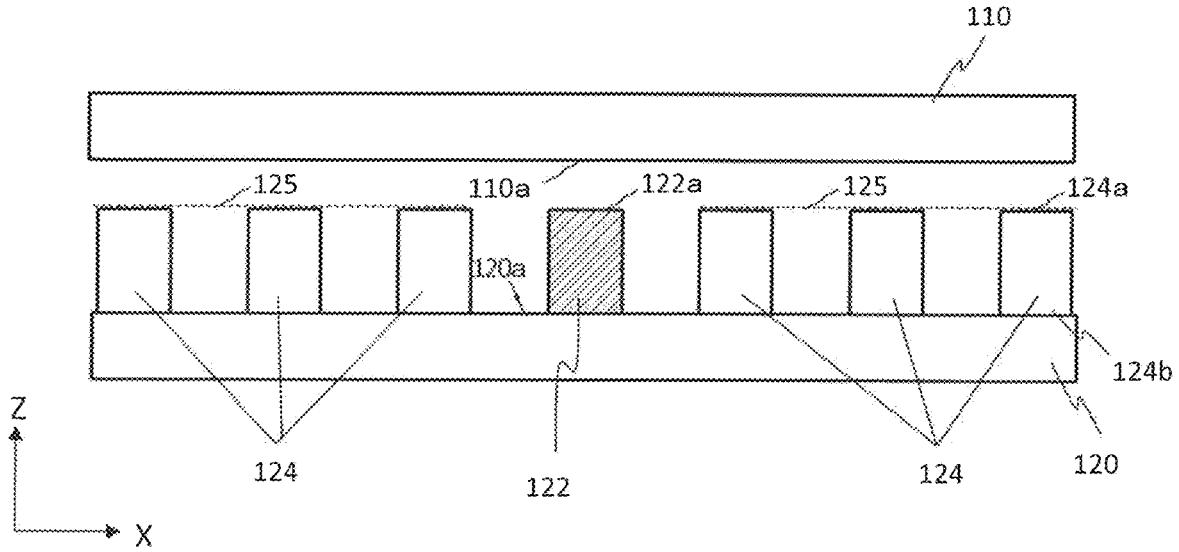
FIG. 2A is a diagram schematically showing a construction for a waveguide device 100, in a cross section parallel to the XZ plane.

FIG. 2A is a diagram schematically showing the construction of a cross section of the waveguide device 100 in FIG. 1, taken parallel to the XZ plane. As shown in FIG. 2A, the conductive member 110 has an electrically conductive surface 110*a* on the side facing the conductive member 120. The conductive surface 110*a* has a two-dimensional expanse along a plane which is orthogonal to the axial direction (Z direction) of the conductive rods 124 (i.e., a plane which is parallel to the XY plane). Although the conductive surface 110*a* is shown to be a smooth plane in this example, the conductive surface 110*a* does not need to be a plane, as will be described later.

Figure 3:
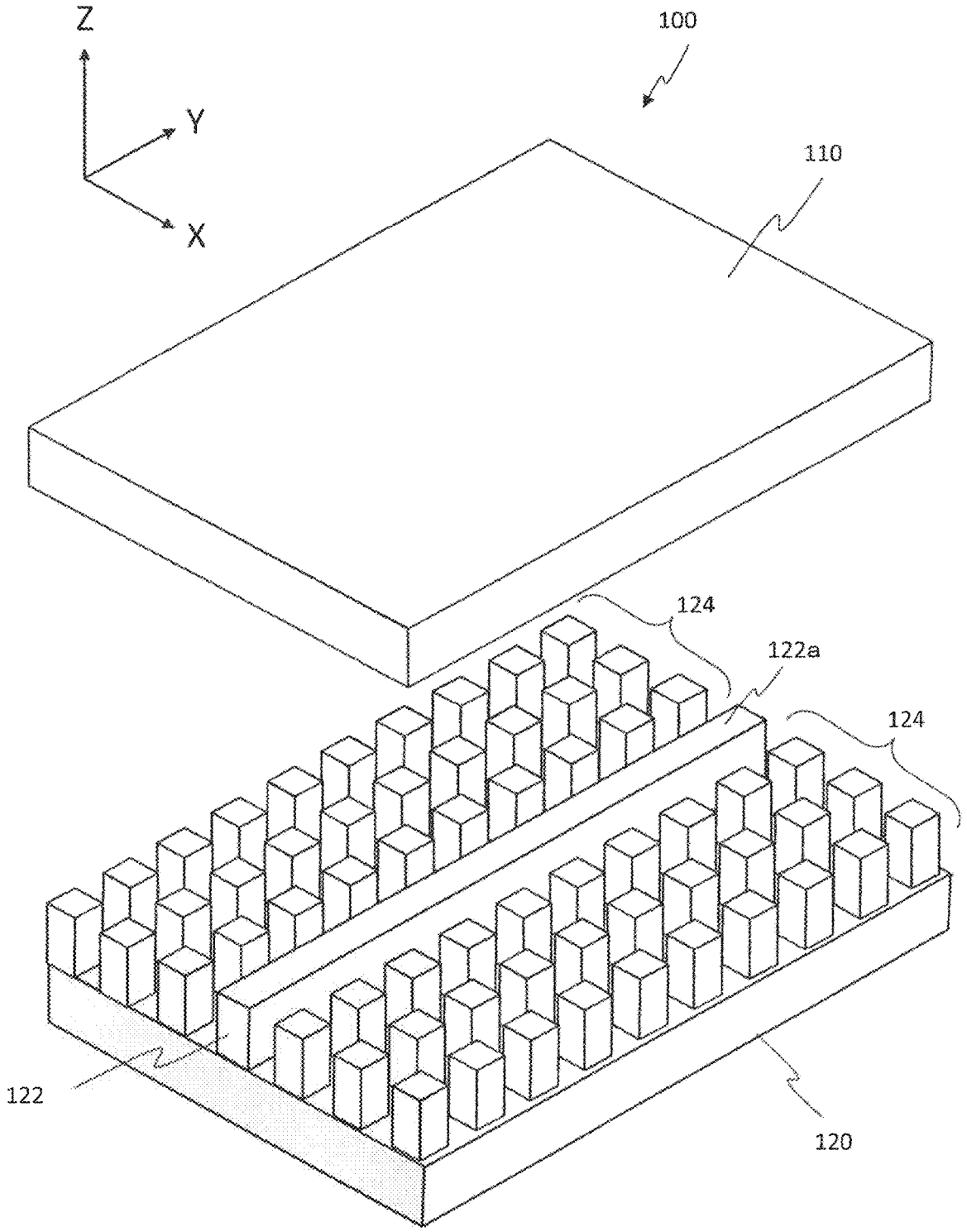
FIG. 3 is another perspective view schematically illustrating the construction of the waveguide device 100, illustrated so that the spacing between a conductive member 110 and a conductive member 120 is exaggerated for ease of understanding.

FIG. 3 is a perspective view schematically showing the waveguide device 100, illustrated so that the spacing between the conductive member 110 and the conductive member 120 is exaggerated for ease of understanding. In an actual waveguide device 100, as shown in FIG. 1 and FIG. 2A, the spacing between the conductive member 110 and the conductive member 120 is narrow, with the conductive member 110 covering over all of the conductive rods 124 on the conductive member 120.

See FIG. 2A again. The plurality of conductive rods 124 arrayed on the conductive member 120 each have a leading end 124*a* opposing the conductive surface 110*a*. In the example shown in the figure, the leading ends 124*a* of the plurality of conductive rods 124 are on the same plane. This plane defines the surface 125 of an artificial magnetic conductor. Each conductive rod 124 does not need to be entirely electrically conductive, so long as it at least includes an electrically conductive layer that extends along the upper face and the side face of the rod-like structure. Although this electrically conductive layer may be located at the surface layer of the rod-like structure, the surface layer may be composed of an insulation coating or a resin layer with no electrically conductive layer existing on the surface of the rod-like structure. Moreover, each conductive member 120 does not need to be entirely electrically conductive, so long as it can support the plurality of conductive rods 124 to constitute an artificial magnetic conductor. Of the surfaces of the conductive member 120, a face 120*a* carrying the plurality of conductive rods 124 may be electrically conductive, such that the electrical conductor electrically interconnects the surfaces of adjacent ones of the plurality of conductive rods 124. In other words, the entire combination of the conductive member 120 and the plurality of conductive rods 124 may at least present an electrically conductive layer with rises and falls opposing the conductive surface 110*a* of the conductive member 110.

On the conductive member 120, a ridge-like waveguide member 122 is provided among the plurality of conductive rods 124. More specifically, stretches of an artificial magnetic conductor are present on both sides of the waveguide member 122, such that the waveguide member 122 is sandwiched between the stretches of artificial magnetic conductor on both sides. As can be seen from FIG. 3, the waveguide member 122 in this example is supported on the conductive member 120, and extends linearly along the Y direction. In the example shown in the figure, the waveguide member 122 has the same height and width as those of the conductive rods 124. As will be described later, however, the height and width of the waveguide member 122 may have different values from those of the conductive rod 124. Unlike the conductive rods 124, the waveguide member 122 extends along a direction (which in this example is the Y direction) in which to guide electromagnetic waves along the conductive surface 110*a*. Similarly, the waveguide member 122 does not need to be entirely electrically conductive, but may at least include an electrically conductive waveguide face 122*a* opposing the conductive surface 110*a* of the conductive member 110. The conductive member 120, the plurality of conductive rods 124, and the waveguide member 122 may be portions of a continuous single-piece body. Furthermore, the conductive member 110 may also be a portion of such a single-piece body.

On both sides of the waveguide member 122, the space between the surface 125 of each stretch of artificial magnetic conductor and the conductive surface 110*a* of the conductive member 110 does not allow an electromagnetic wave of any frequency that is within a specific frequency band to propagate. This frequency band is called a "prohibited band". The artificial magnetic conductor is designed so that the frequency of an electromagnetic wave (which hereinafter may be referred to as a signal wave) to propagate in the waveguide device 100 (which may hereinafter be referred to as the "operating frequency") is contained in the prohibited band. The prohibited band may be adjusted based on the following: the height of the conductive rods 124, i.e., the depth of each groove formed between adjacent conductive rods 124; the width of each conductive rod 124; the interval between conductive rods 124; and the size of the gap between the leading end 124*a* and the conductive surface 110*a* of each conductive rod 124.

Next, with reference to FIG. 4, the dimensions, shape, positioning, and the like of each member will be described.

Figure 4:
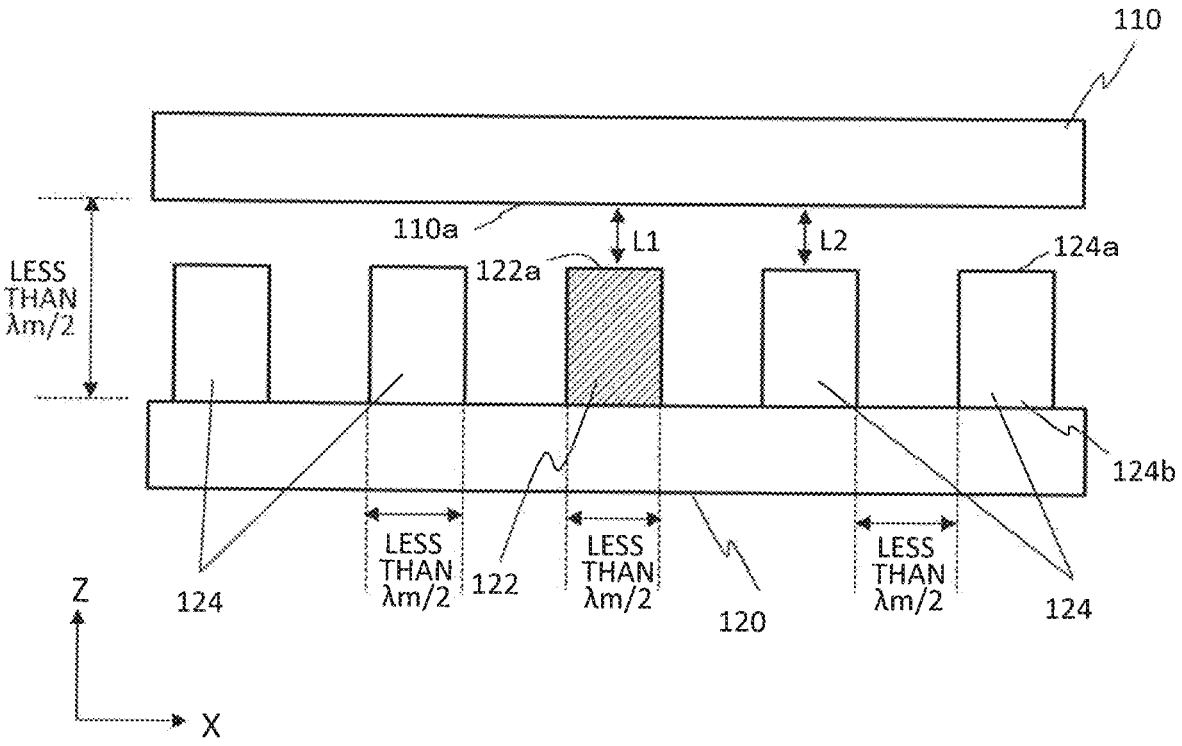
FIG. 4 is a diagram showing an exemplary range of dimension of each member in the structure shown in FIG. 2A.

FIG. 4 is a diagram showing an exemplary range of dimension of each member in the structure shown in FIG. 2A. In the present specification, λ0 denotes a representative value of wavelengths in free space (e.g., a central wavelength corresponding to a center frequency in the operating frequency band) of an electromagnetic wave (signal wave) propagating in a waveguide extending between the conductive surface 110*a* of the conductive member 110 and the waveguide face 122*a* of the waveguide member 122. Moreover, λm denotes a wavelength, in free space, of an electromagnetic wave of the highest frequency in the operating frequency band. The end of each conductive rod 124 that is in contact with the conductive member 120 is referred to as the "root". As shown in FIG. 4, each conductive rod 124 has the leading end 124*a* and the root 124*b*. Examples of dimensions, shapes, positioning, and the like of the respective members are as follows.

(1) Width of the Conductive Rod

The width (i.e., the size along the X direction and the Y direction) of the conductive rod 124 may be set to less than λm/2. Within this range, resonance of the lowest order can be prevented from occurring along the X direction and the Y direction. Since resonance may possibly occur not only in the X and Y directions but also in any diagonal direction in an X-Y cross section, the diagonal length of an X-Y cross section of the conductive rod 124 is also preferably less than λm/2. The lower limit values for the rod width and diagonal length will conform to the minimum lengths that are producible under the given manufacturing method, but is not particularly limited.

(2) Distance from the Root of the Conductive Rod to the Conductive Surface of the Conductive Member The distance from the root 124*b* of each conductive rod 124 to the conductive surface 110*a* of the conductive member 110 may be longer than the height of the conductive rods 124, while also being less than λm/2. When the distance is λm/2 or more, resonance may occur between the root 124*b* of each conductive rod 124 and the conductive surface 110*a*, thus reducing the effect of signal wave containment.

The distance from the root 124*b* of each conductive rod 124 to the conductive surface 110*a* of the conductive member 110 corresponds to the spacing between the conductive member 110 and the conductive member 120. For example, when a signal wave of 76.5±0.5 GHz (which belongs to the millimeter band or the extremely high frequency band) propagates in the waveguide, the wavelength of the signal wave is in the range from 3.8923 mm to 3.9435 mm. Therefore, λm equals 3.8923 mm in this case, so that the spacing between the conductive member 110 and the conductive member 120 may be set to less than a half of 3.8923 mm. So long as the conductive member 110 and the conductive member 120 realize such a narrow spacing while being disposed opposite from each other, the conductive member 110 and the conductive member 120 do not need to be strictly parallel. Moreover, when the spacing between the conductive member 110 and the conductive member 120 is less than λm/2, a whole or a part of the conductive member 110 and/or the conductive member 120 may be shaped as a curved surface. On the other hand, the conductive members 110 and 120 each have a planar shape (i.e., the shape of their region as perpendicularly projected onto the XY plane) and a planar size (i.e., the size of their region as perpendicularly projected onto the XY plane) which may be arbitrarily designed depending on the purpose.

Figure 2B:
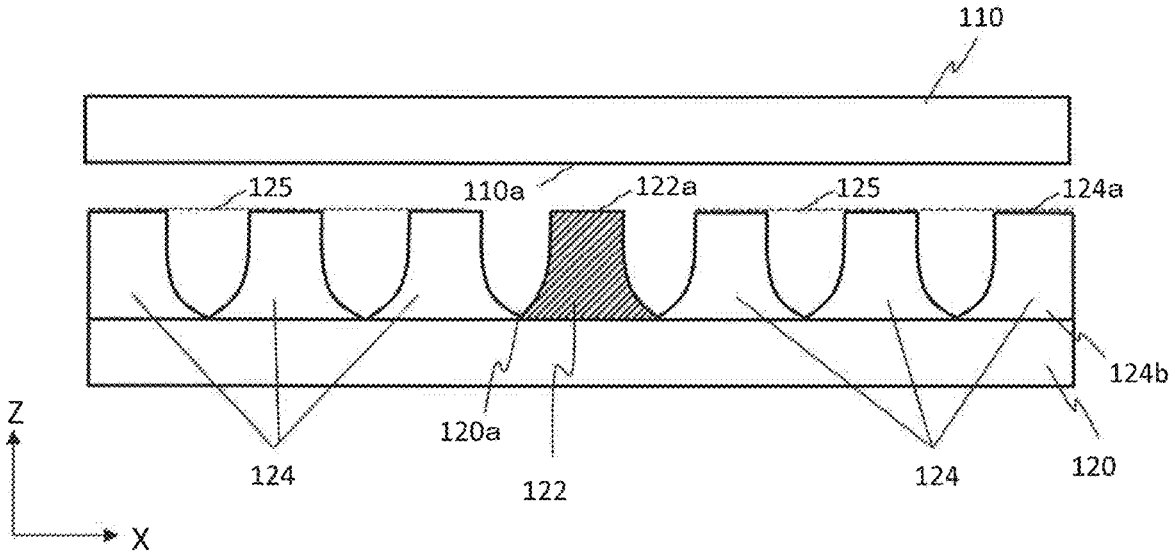
FIG. 2B is a diagram schematically showing another construction for the waveguide device 100 in FIG. 1, in a cross section parallel to the XZ plane.

Although the conductive surface 120*a* is illustrated as a plane in the example shown in FIG. 2A, embodiments of the present disclosure are not limited thereto. For example, as shown in FIG. 2B, the conductive surface 120*a* may be the bottom parts of faces each of which has a cross section similar to a U-shape or a V-shape. The conductive surface 120*a* will have such a structure when each conductive rod 124 or the waveguide member 122 is shaped with a width which increases toward the root. Even with such a structure, the device shown in FIG. 2B can function as the waveguide device according to an embodiment of the present disclosure so long as the distance between the conductive surface 110*a* and the conductive surface 120*a* is less than a half of the wavelength λm.

(3) Distance L2 from the Leading End of the Conductive Rod to the Conductive Surface The distance L2 from the leading end 124*a* of each conductive rod 124 to the conductive surface 110*a* is set to less than λm/2. When the distance is λm/2 or more, a propagation mode in which an electromagnetic wave reciprocates between the leading end 124*a* of each conductive rod 124 and the conductive surface 110*a* may occur, thus no longer being able to contain an electromagnetic wave. Note that, among the plurality of conductive rods 124, at least those which are adjacent to the waveguide member 122 do not have their leading ends in electrical contact with the conductive surface 110*a*. As used herein, the leading end of a conductive rod not being in electrical contact with the conductive surface means either of the following states: there being an air gap between the leading end and the conductive surface; or the leading end of the conductive rod and the conductive surface adjoining each other via an insulating layer which may exist in at least one of the leading end of the conductive rod or in the conductive surface.

(4) Arrangement and Shape of Conductive Rods

The interspace between two adjacent conductive rods 124 among the plurality of conductive rods 124 has a width of less than λm/2, for example. The width of the interspace between any two adjacent conductive rods 124 is defined by the shortest distance from the surface (side face) of one of the two conductive rods 124 to the surface (side face) of the other. This width of the interspace between rods is to be determined so that resonance of the lowest order will not occur in the regions between rods. The conditions under which resonance will occur are determined based by a combination of: the height of the conductive rods 124; the distance between any two adjacent conductive rods; and the capacitance of the air gap between the leading end 124*a* of each conductive rod 124 and the conductive surface 110*a*. Therefore, the width of the interspace between rods may be appropriately determined depending on other design parameters. Although there is no clear lower limit to the width of the interspace between rods, for manufacturing ease, it may be e.g. λm/16 or more when an electromagnetic wave in the extremely high frequency range is to be propagated. Note that the interspace does not need to have a constant width. So long as it remains less than λm/2, the interspace between conductive rods 124 may vary.

The arrangement of the plurality of conductive rods 124 is not limited to the illustrated example, so long as it exhibits a function of an artificial magnetic conductor. The plurality of conductive rods 124 do not need to be arranged in orthogonal rows and columns; the rows and columns may be intersecting at angles other than 90 degrees. The plurality of conductive rods 124 do not need to form a linear array along rows or columns, but may be in a dispersed arrangement which does not present any straightforward regularity. The conductive rods 124 may also vary in shape and size depending on the position on the conductive member 120.

The surface 125 of the artificial magnetic conductor that are constituted by the leading ends 124*a* of the plurality of conductive rods 124 does not need to be a strict plane, but may be a plane with minute rises and falls, or even a curved surface. In other words, the conductive rods 124 do not need to be of uniform height, but rather the conductive rods 124 may be diverse so long as the array of conductive rods 124 is able to function as an artificial magnetic conductor.

Each conductive rod 124 does not need to have a prismatic shape as shown in the figure, but may have a cylindrical shape, for example. Furthermore, each conductive rod 124 does not need to have a simple columnar shape. The artificial magnetic conductor may also be realized by any structure other than an array of conductive rods 124, and various artificial magnetic conductors are applicable to the waveguide device of the present disclosure. Note that, when the leading end 124*a* of each conductive rod 124 has a prismatic shape, its diagonal length is preferably less than λm/2. When the leading end 124*a* of each conductive rod 124 is shaped as an ellipse, the length of its major axis is preferably less than λm/2. Even when the leading end 124*a* has any other shape, the dimension across it is preferably less than λm/2 even at the longest position.

The height of each conductive rod 124, i.e., the length from the root 124*b* to the leading end 124*a*, may be set to a value which is shorter than the distance (i.e., less than λm/2) between the conductive surface 110*a* and the conductive surface 120*a*, e.g., λ0/4.

(5) Width of the Waveguide Face

The width of the waveguide face 122*a* of the waveguide member 122, i.e., the size of the waveguide face 122*a* along a direction which is orthogonal to the direction that the waveguide member 122 extends, may be set to less than λm/2 (e.g. λ0/8). If the width of the waveguide face 122*a* is λm/2 or more, resonance will occur along the width direction, which will prevent any WRG from operating as a simple transmission line.

(6) Height of the Waveguide Member

The height (i.e., the size along the Z direction in the example shown in the figure) of the waveguide member 122 is set to less than λm/2. The reason is that, if the distance is λm/2 or more, the distance between the root 124*b* of each conductive rod 124 and the conductive surface 110*a* will be λm/2 or more. Similarly, the height of the conductive rods 124 (especially those conductive rods 124 which are adjacent to the waveguide member 122) is set to less than λm/2.

(7) Distance L1 Between the Waveguide Face and the Conductive Surface

The distance L1 between the waveguide face 122*a* of the waveguide member 122 and the conductive surface 110*a* is set to less than λm/2. If the distance is λm/2 or more, resonance will occur between the waveguide face 122*a* and the conductive surface 110*a*, which will prevent functionality as a waveguide. In one example, the distance is λm/4 or less. In order to ensure manufacturing ease, when an electromagnetic wave in the extremely high frequency range is to propagate, the distance L1 is preferably λm/16 or more, for example.

The lower limit of the distance L1 between the conductive surface 110*a* and the waveguide face 122*a* and the lower limit of the distance L2 between the conductive surface 110*a* and the leading end 124*a* of each conductive rod 124 depends on the machining precision, and also on the precision when assembling the two upper/lower conductive members 110 and 120 so as to be apart by a constant distance. When a pressing technique or an injection technique is used, the practical lower limit of the aforementioned distance is about 50 micrometers (μm). In the case of using an MEMS (Micro-Electro-Mechanical System) technique to make a product in e.g. the terahertz range, the lower limit of the aforementioned distance is about 2 to about 3 μm.

In the waveguide device 100 of the above-described construction, a signal wave of the operating frequency is unable to propagate in the space between the surface 125 of the artificial magnetic conductor and the conductive surface 110*a* of the conductive member 110, but propagates in the space between the waveguide face 122*a* of the waveguide member 122 and the conductive surface 110*a* of the conductive member 110. Unlike in a hollow waveguide, the width of the waveguide member 122 in such a waveguide structure does not need to be equal to or greater than a half of the wavelength of the electromagnetic wave to propagate. Moreover, the conductive member 110 and the conductive member 120 do not need to be interconnected by a metal wall that extends along the thickness direction (i.e., in parallel to the YZ plane).

Figure 5A:
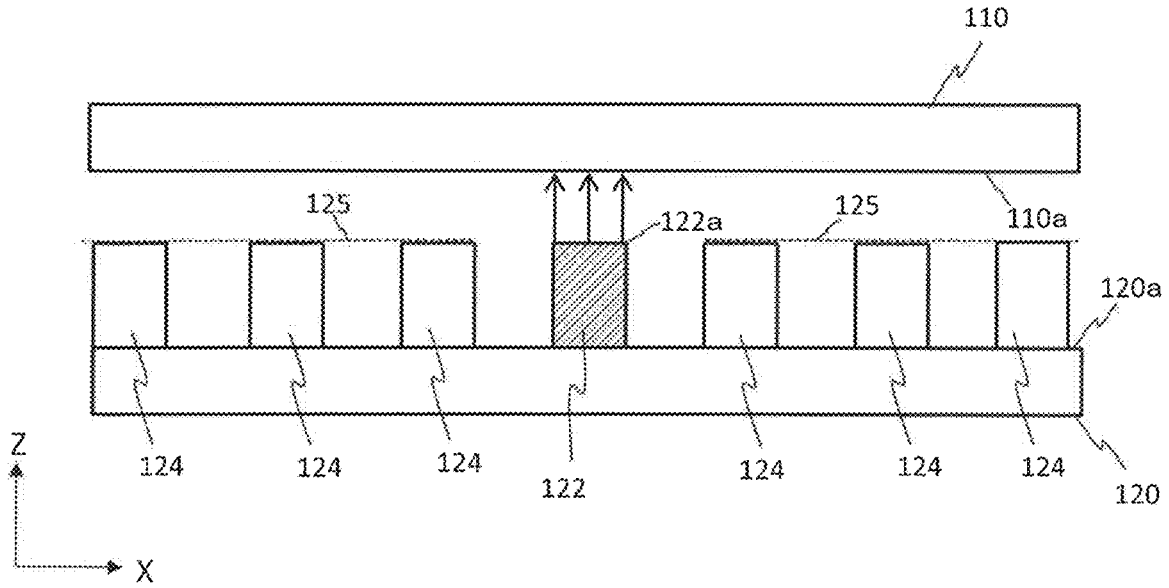
FIG. 5A is a diagram schematically showing an electromagnetic wave that propagates in a narrow space, i.e., a gap between a waveguide face 122*a* of a waveguide member 122 and a conductive surface 110*a* of the conductive member 110.

FIG. 5A schematically shows an electromagnetic wave that propagates in a narrow space, i.e., a gap between the waveguide face 122*a* of the waveguide member 122 and the conductive surface 110*a* of the conductive member 110. Three arrows in FIG. 5A schematically indicate the orientation of an electric field of the propagating electromagnetic wave. The electric field of the propagating electromagnetic wave is perpendicular to the conductive surface 110*a* of the conductive member 110 and to the waveguide face 122*a*.

On both sides of the waveguide member 122, stretches of artificial magnetic conductor that are created by the plurality of conductive rods 124 are present. An electromagnetic wave propagates in the gap between the waveguide face 122*a* of the waveguide member 122 and the conductive surface 110*a* of the conductive member 110. FIG. 5A is schematic, and does not accurately represent the magnitude of an electromagnetic field to be actually created by the electromagnetic wave. A part of the electromagnetic wave (electromagnetic field) propagating in the space over the waveguide face 122*a* may have a lateral expanse, to the outside (i.e., toward where the artificial magnetic conductor exists) of the space that is delineated by the width of the waveguide face 122*a*. In this example, the electromagnetic wave propagates in a direction (Y direction) which is perpendicular to the plane of FIG. 5A. As such, the waveguide member 122 does not need to extend linearly along the Y direction, but may include a bend(s) and/or a branching portion(s) not shown. Since the electromagnetic wave propagates along the waveguide face 122*a* of the waveguide member 122, the direction of propagation would change at a bend, whereas the direction of propagation would ramify into plural directions at a branching portion.

In the waveguide structure of FIG. 5A, no metal wall (electric wall), which would be indispensable to a hollow waveguide, exists on both sides of the propagating electromagnetic wave. Therefore, in the waveguide structure of this example, "a constraint due to a metal wall (electric wall)" is not included in the boundary conditions for the electromagnetic field mode to be created by the propagating electromagnetic wave, and the width (size along the X direction) of the waveguide face 122*a* is less than a half of the wavelength of the electromagnetic wave.

Figure 5B:
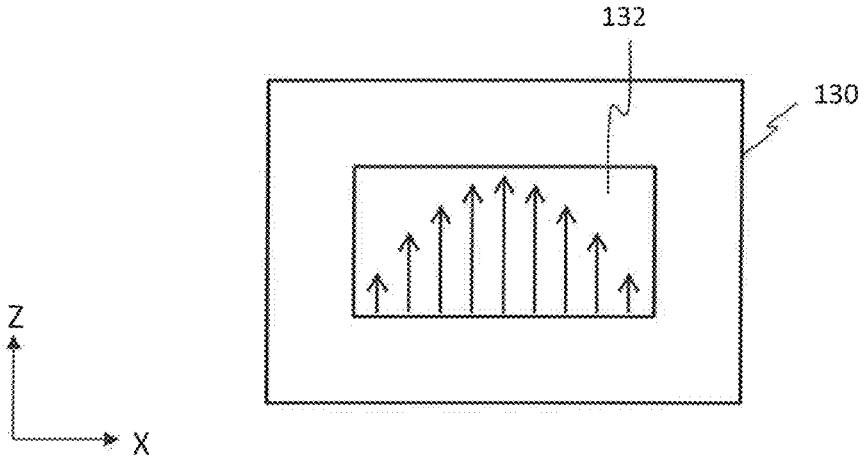
FIG. 5B is a diagram schematically showing a cross section of a hollow waveguide 130.

For reference, FIG. 5B schematically shows a cross section of a hollow waveguide 130. With arrows, FIG. 5B schematically shows the orientation of an electric field of an electromagnetic field mode (TE10) that is created in the internal space 132 of the hollow waveguide 130. The lengths of the arrows correspond to electric field intensities. The width of the internal space 132 of the hollow waveguide 130 needs to be set to be broader than a half of the wavelength. In other words, the width of the internal space 132 of the hollow waveguide 130 cannot be set to be smaller than a half of the wavelength of the propagating electromagnetic wave.

Figure 5C:
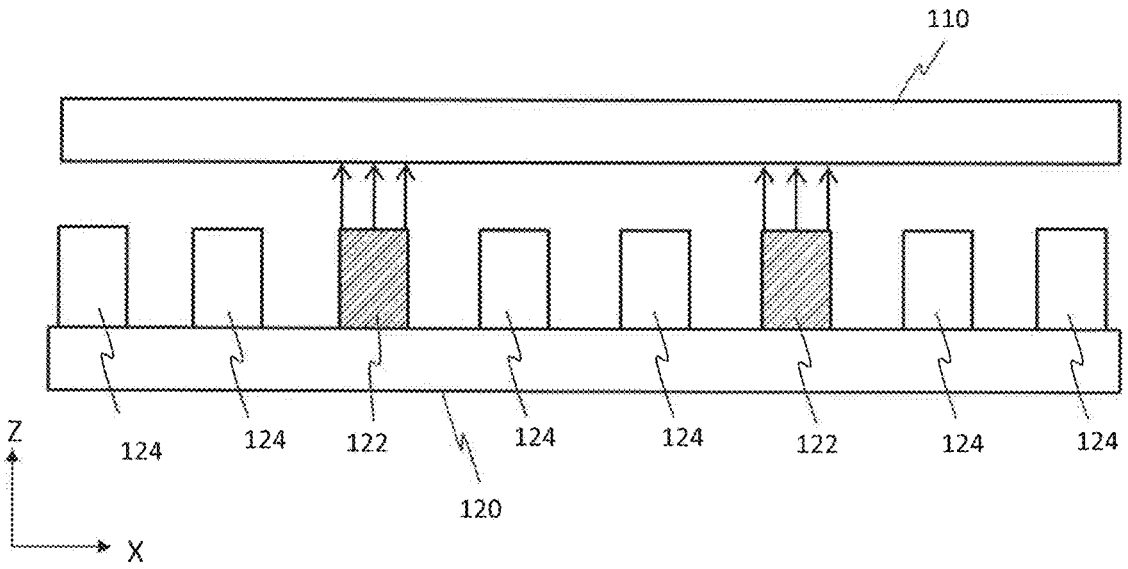
FIG. 5C is a cross-sectional view showing an implementation in which two waveguide members 122 are provided on the conductive member 120.

FIG. 5C is a cross-sectional view showing an implementation where two waveguide members 122 are provided on the conductive member 120. Thus, an artificial magnetic conductor that is created by the plurality of conductive rods 124 exists between the two adjacent waveguide members 122. More accurately, stretches of artificial magnetic conductor created by the plurality of conductive rods 124 are present on both sides of each waveguide member 122, such that each waveguide member 122 is able to independently propagate an electromagnetic wave.

Figure 5D:
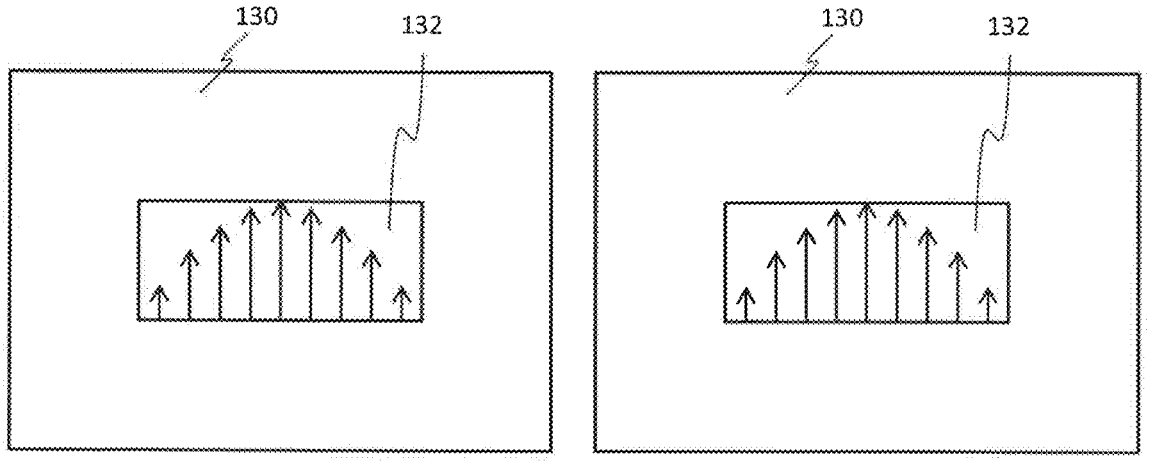
FIG. 5D is a diagram schematically showing a cross section of a waveguide device in which two hollow waveguides 130 are placed side-by-side.

For reference's sake, FIG. 5D schematically shows a cross section of a waveguide device in which two hollow waveguides 130 are placed side-by-side. The two hollow waveguides 130 are electrically insulated from each other. Each space in which an electromagnetic wave is to propagate needs to be surrounded by a metal wall that defines the respective hollow waveguide 130. Therefore, the interval between the internal spaces 132 in which electromagnetic waves are to propagate cannot be made smaller than a total of the thicknesses of two metal walls. Usually, a total of the thicknesses of two metal walls is longer than a half of the wavelength of a propagating electromagnetic wave. Therefore, it is difficult for the interval between the hollow waveguides 130 (i.e., interval between their centers) to be shorter than the wavelength of a propagating electromagnetic wave. Particularly for electromagnetic waves of wavelengths in the extremely high frequency range (i.e., electromagnetic wave wavelength: 10 mm or less) or even shorter wavelengths, a metal wall which is sufficiently thin relative to the wavelength is difficult to be formed. This presents a cost problem in commercially practical implementation.

On the other hand, a waveguide device 100 including an artificial magnetic conductor can easily realize a structure in which waveguide members 122 are placed close to one another. Thus, such a waveguide device 100 can be suitably used in an array antenna device that includes plural antenna elements in a close arrangement.

Although the present disclosure mainly describes examples of utilizing a ridge waveguide which includes an artificial magnetic conductor, conventional hollow waveguides can be utilized in some embodiments. Such embodiments will be described later as variants of Embodiment 2.

Next, an exemplary construction of a slot array antenna device utilizing the aforementioned waveguide structure will be described. A "slot array antenna device" is defined as an array antenna device which includes a plurality of slots as antenna elements. In the following description, a slot array antenna device may simply be referred to as an array antenna device.

Figure 6:
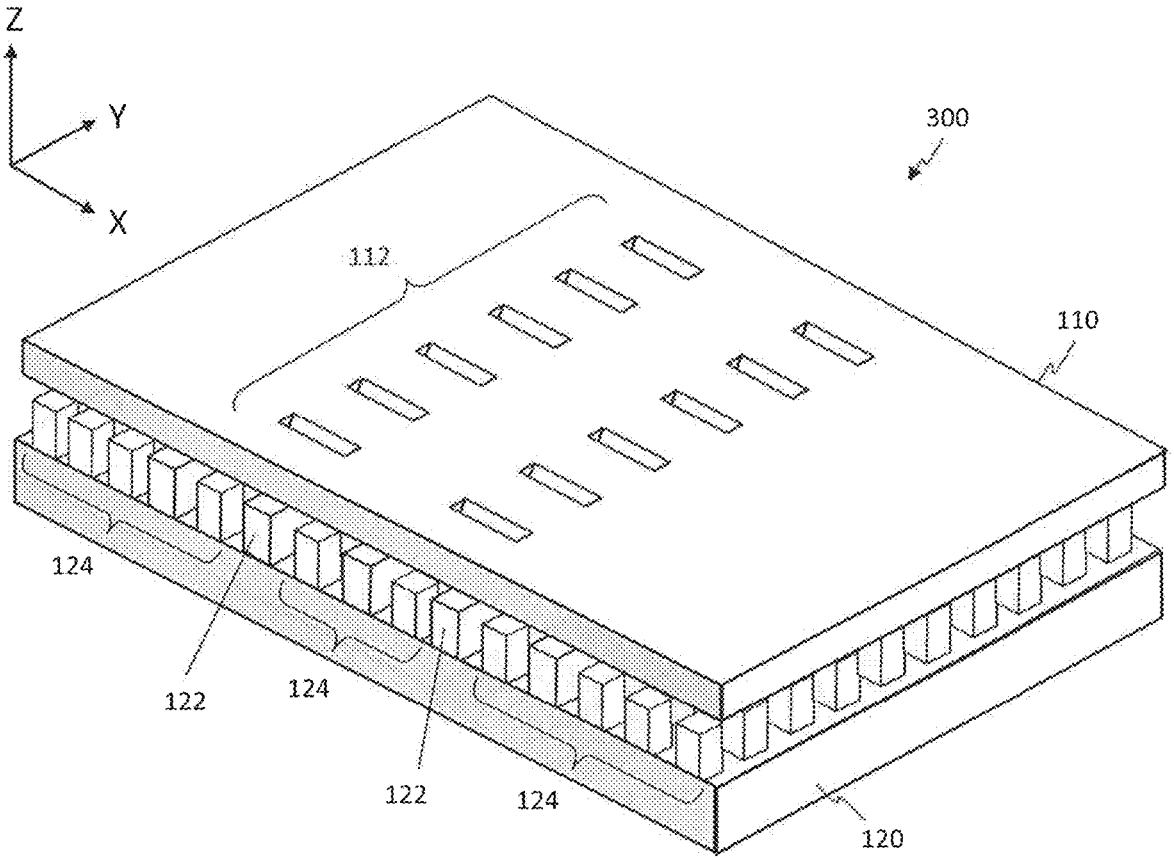
FIG. 6 is a perspective view schematically showing a partial construction of a slot array antenna device 300.
Figure 7:
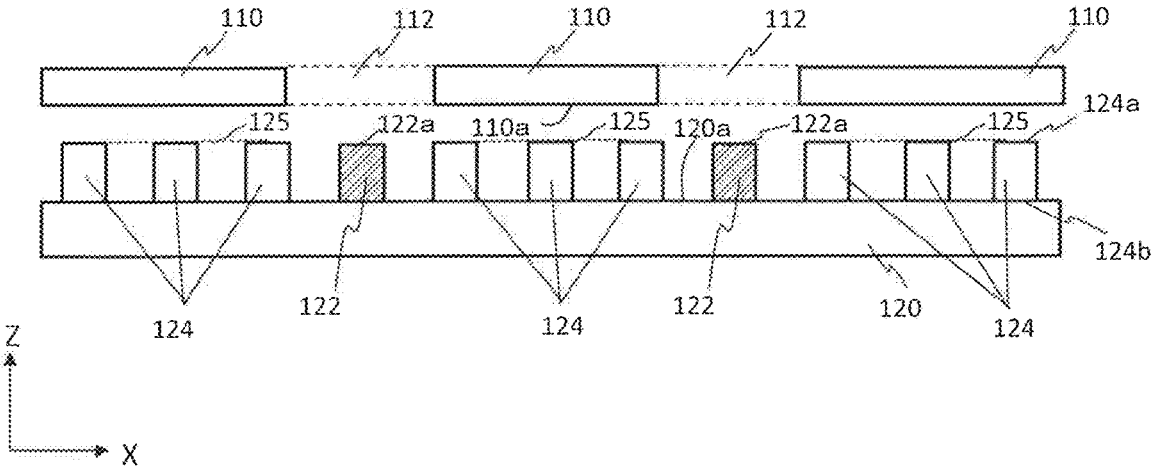
FIG. 7 is a diagram schematically showing a partial cross section which is parallel to the XZ plane and passes through centers of two adjacent slots 112 along the X direction of the slot array antenna device 300 shown in FIG. 6.

FIG. 6 is a perspective view schematically showing a partial exemplary construction of a slot array antenna device 300. FIG. 7 is a diagram schematically showing a partial cross section which is parallel to the XZ plane and passes through centers of two adjacent slots 112 along the X direction of the slot array antenna device 300. In the slot array antenna device 300, the first conductive member 110 includes a plurality of slots 112 which are arrayed along the X direction and the Y direction. In this example, the plurality of slots 112 include two rows of slots. Each slot row includes six slots 112 which are at equal intervals along the Y direction. The second conductive member 120 has two waveguide members 122 provided thereon. Each waveguide member 122 has an electrically-conductive waveguide face 122*a* that corresponds to one slot row. In the region between the two waveguide members 122, and in the regions lying outside the two waveguide members 122, a plurality of conductive rods 124 are provided. The conductive rods 124 create stretches of artificial magnetic conductor.

To the waveguide extending between each waveguide member 122 and the conductive surface 110*a*, an electromagnetic wave is supplied from a transmission circuit not shown. In this example, the interval between the centers of slots 112 along the Y direction is designed to be the same value as the wavelength of an electromagnetic wave propagating in the waveguide. As a result, electromagnetic waves with an phase are radiated from the six slots 112 placed side-by-side along the Y direction.

As has been described with reference to FIG. 5C, with the slot array antenna device 300 having such a structure, the interval between two waveguide members 122 can be narrowed as compared to a waveguide structure in which conventional hollow waveguides are used.

Figure 8:
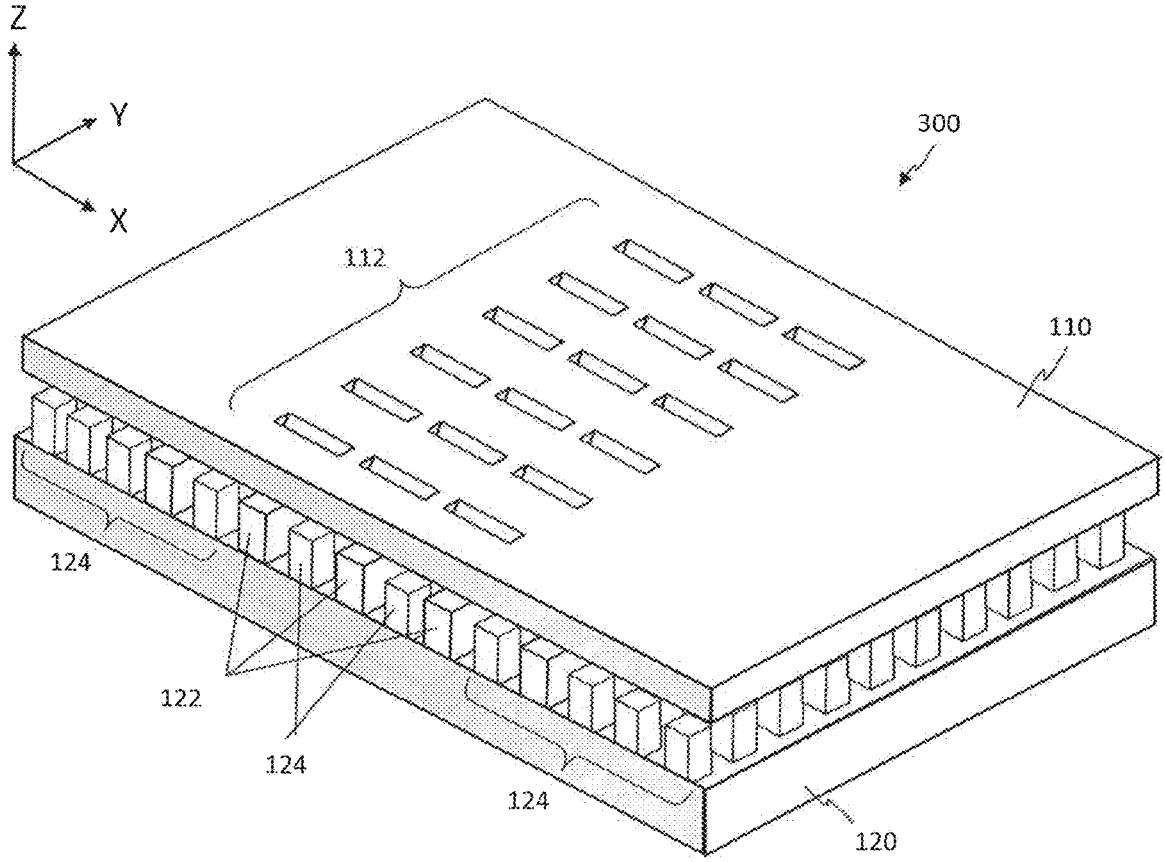
FIG. 8 is a perspective view schematically showing the construction of a slot array antenna device 300.
Figure 9:
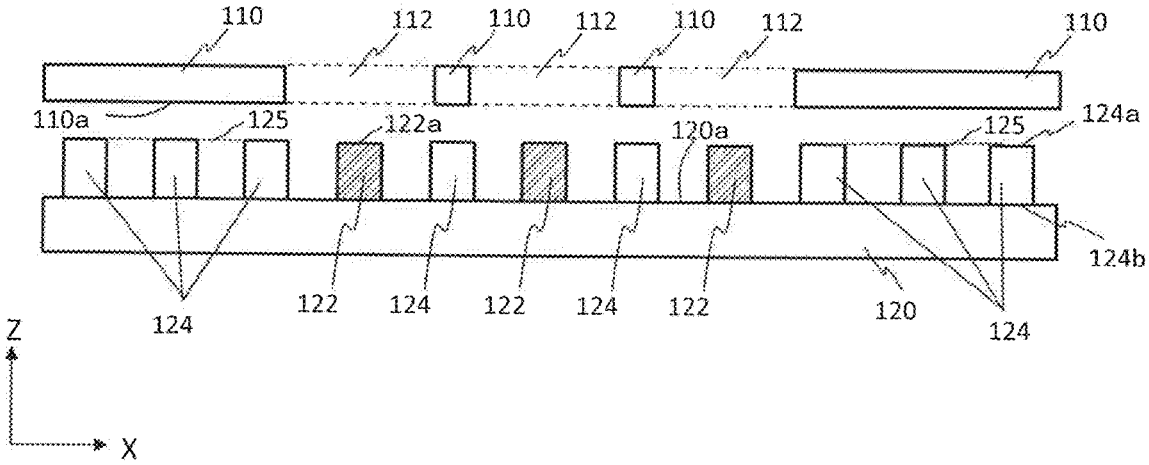
FIG. 9 is a diagram schematically showing a partial cross section which is parallel to the XZ plane and passes through centers of three adjacent slots 112 along the X direction of the slot array antenna device 300 shown in FIG. 8.

FIG. 8 is a perspective view schematically showing the construction of a slot array antenna device 300 one row of rods is provided between two adjacent waveguide members 122. FIG. 9 is a diagram schematically showing a partial cross section which is parallel to the XZ plane and passes through centers of three adjacent slots 112 along the X direction of the slot array antenna device 300 shown in FIG. 8.

In the construction of FIG. 8, the conductive rods 124 between two adjacent waveguide members 122 compose fewer rows (i.e., one row) than in the construction of FIG. 6. This reduces the interval between waveguide members 122 and the slot interval along the X direction, whereby, along the X direction, the direction in which grating lobes may occur in the slot array antenna device 300 can be kept away from the central direction. As is well known, when the arraying interval of antenna elements (i.e., the interval between the centers of two adjacent antenna elements) is greater than a half of the wavelength of the electromagnetic wave that is used, grating lobes will appear in the visible region of the antenna. As the arraying interval between antenna elements becomes greater, the directions in which grating lobes may occur will approach the direction of the main lobe. The gain of a grating lobe is higher than that of a secondary lobe, and is similar to the gain of a main lobe. Therefore, occurrence of any grating lobe may induce radar misdetections and deteriorations in the efficiency of the communication antenna. Accordingly, in the exemplary construction of FIG. 8, only one row of conductive rods 124 is provided between two adjacent waveguide members 122 to reduce the slot interval along the X direction. This allows the influence of grating lobes.

Hereinafter, the construction of the slot array antenna device 300 will be described in more detail.

The slot array antenna device 300 includes a plate-like first conductive member 110 and a plate-like second conductive member 120, which are in opposing and parallel positions to each other. The first conductive member 110 includes a plurality of slots 112 which are arrayed along a first direction (the Y direction) and a second direction (the X direction) that intersects (or, in this example, is orthogonal to) the first direction. A plurality of conductive rods 124 are arrayed on the second conductive member 120.

The conductive surface 110*a* of the first conductive member 110 has a two-dimensional expanse along a plane which is orthogonal to the axial direction (Z direction) of the conductive rods 124 (i.e., a plane which is parallel to the XY plane). Although the conductive surface 110*a* is shown to be a smooth plane in this example, the conductive surface 110*a* does not need to be a smooth plane, but may be curved or include minute rises and falls, as will be described later. The plurality of conductive rods 124 and the plurality of waveguide members 122 are connected to the second conductive surface 120*a*.

Figure 10:
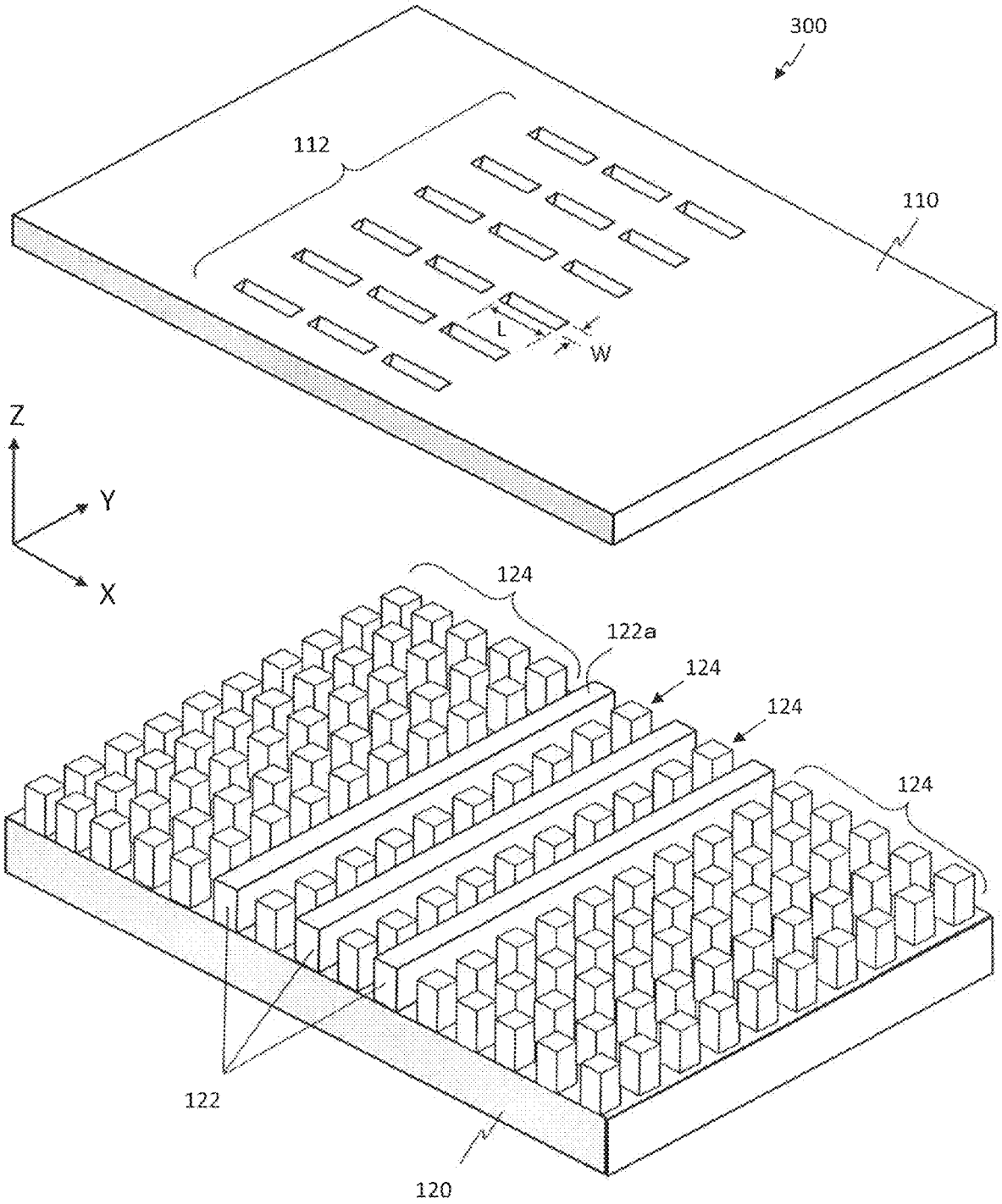
FIG. 10 is a perspective view schematically showing the slot array antenna device 300, illustrated so that the spacing between a first conductive member 110 and a second conductive member 120 is exaggerated for ease of understanding.
Figure 11:
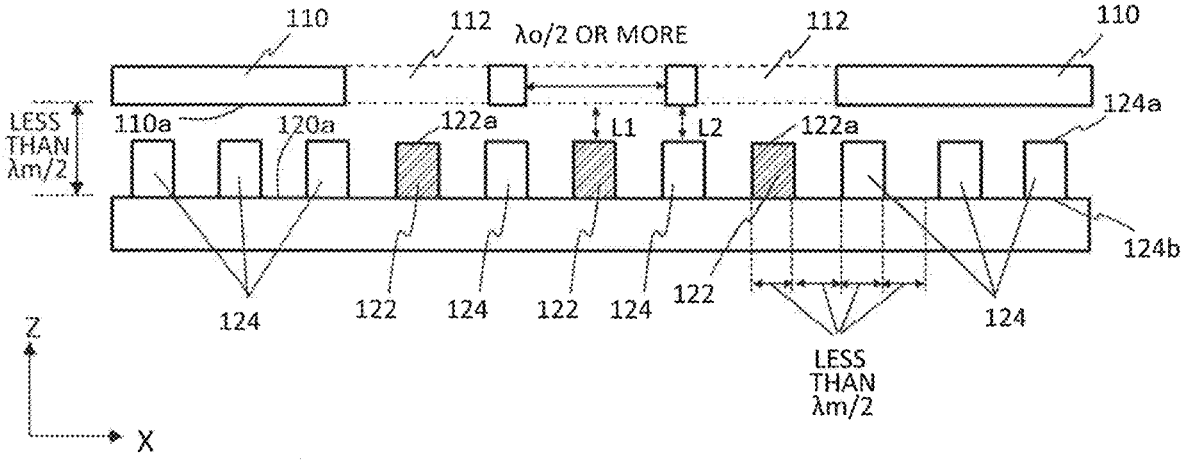
FIG. 11 is a diagram showing an exemplary range of dimension of each member in the structure shown in FIG. 9.

FIG. 10 is a perspective view schematically showing the slot array antenna device 300, illustrated so that the spacing between the first conductive member 110 and the second conductive member 120 is exaggerated for ease of understanding. In an actual slot array antenna device 200, as shown in FIG. 8 and FIG. 9, the spacing between the first conductive member 110 and the second conductive member 120 is narrow, with the first conductive member 110 covering over the conductive rods 124 on the second conductive member 120.

The waveguide face 122*a* of each waveguide member 122 shown in FIG. 10 has a stripe shape (which may also be referred to as a "strip shape") extending along the Y direction. Each waveguide face 122*a* is flat, and has a constant width (i.e., size along the X direction). However, the present disclosure is not limited to this example; the waveguide face 122*a* may partially include a portion(s) which differs in height or width from any other portion. By intentionally providing such a portion(s), the characteristic impedance of the waveguide can be altered, thus altering the propagation wavelength of an electromagnetic wave within the waveguide, and/or adjusting the state of excitation at the position of each slot 112. In the present specification, a "stripe shape" means a shape which is defined by a single stripe, rather than a shape constituted by stripes. Not only shapes that extend linearly in one direction, but also any shape that bends or branches along the way is also encompassed by a "stripe shape". In the case where any portion that undergoes a change in height or width is provided on the waveguide face 122*a*, it still falls under the meaning of "stripe shape" so long as the shape includes a portion that extends in one direction as viewed from the normal direction of the waveguide face 122*a*.

Each conductive rod 124 does not need to be entirely electrically conductive, so long as it at least includes an electrically conductive layer that extends along the upper face and the side face of the rod-like structure. Although this electrically conductive layer may be located at the surface layer of the rod-like structure, the surface layer may be composed of an insulation coating or a resin layer with no electrically conductive layer existing on the surface of the rod-like structure. Moreover, each second conductive member 120 does not need to be entirely electrically conductive, so long as it can support the plurality of conductive rods 124 to constitute an artificial magnetic conductor. Of the surfaces of the second conductive member 120, a face 120*a* carrying the plurality of conductive rods 124 may be electrically conductive, such that the surfaces of adjacent ones of the plurality of conductive rods 124 are electrically connected. Moreover, the electrically conductive layer of the second conductive member 120 may be covered with insulation coating or a resin layer. In other words, the entire combination of the second conductive member 120 and the plurality of conductive rods 124 may at least present an electrically conductive layer with rises and falls opposing the conductive surface 110*a* of the first conductive member 110.

In this example, the entire first conductive member 110 is composed of an electrically conductive material, and each slot 112 is an opening made in the first conductive member 110. However, slot the 112 is not limited to such a structure. For example, in a construction where the first conductive member 110 includes an internal dielectric layer and a superficial electrically conductive layer, the opening may only extend through the electrically conductive layer, and not through the dielectric layer, and this structure will still function as a slot.

The waveguide extending between the first conductive member 110 and each waveguide member 122 is open at both ends. Although not shown in FIG. 8 to FIG. 10, a choke structure may be provided near both ends of each waveguide member 122. A choke structure is typically composed of: an additional transmission line having a length of approximately λ0/8; and a plurality of grooves having a depth of approximately λ0/4, or a row of electrically conductive rods having a height of approximately λ0/4, that are disposed at an end of that additional transmission line. The choke structure confers a phase difference of about 180° (π) between the incident wave and a reflected wave. Thus, electromagnetic waves are restrained from leaking at both ends of the waveguide member 122. Instead of the second conductive member 120, such choke structures may be provided on the first conductive member 110.

The preferable length of an additional transmission line in a choke structure has been believed to be λr/4, where λr is the wavelength of a signal wave on the transmission line. However, the inventors have found that electromagnetic wave leakage can be suppressed and good functionality can be attained even when the length of an additional transmission line in a choke structure is shorter than λr/4. In actuality, it is more preferable that the length of the additional transmission line is equal to or less than λ0/4, which is even shorter than λr/4. In an embodiment according to the present disclosure, the length of the additional transmission line may be se to equal to or greater than λ0/16 and less than λ0/4. Examples of such construction will be later described as Embodiment 3.

Although not shown, the waveguiding structure in the slot array antenna device 300 has a port (opening) that is connected to a transmission circuit or reception circuit (i.e., an electronic circuit) not shown. The port may be provided at one end or an intermediate position (e.g., a central portion) of each waveguide member 122 shown in FIG. 10, for example. A signal wave which is sent from the transmission circuit via the port propagates through the waveguide extending upon the waveguide member 122, and is radiated through each slot 112. On the other hand, an electromagnetic wave which is led into the waveguide through each slot 112 propagates to the reception circuit via the port. At the rear side of the second conductive member 120, a structure including another waveguide that is connected to the transmission circuit or reception circuit (which in the present specification may also be referred to as a "distribution layer" or "feeding layer") may be provided. In that case, the port serves to couple between the waveguide in the distribution layer or feeding layer and the waveguide on the waveguide member 122.

In this example, two adjacent slots 112 along the X direction are excited with an equiphase. Therefore, the feeding path is arranged so that the transmission distances from the transmission circuit to two such slots 112 are equal. More preferably, two such slots 112 are excited with an equiphase and equiamplitude. Furthermore, the distance between the centers of two adjacent slots 112 along the Y direction is designed equal to the wavelength λg in the waveguide. As a result of this, electromagnetic waves with an equiphase are radiated from all slots 112, whereby a transmission antenna with a high gain can be realized.

Note that the interval between the centers of two adjacent slots along the Y direction may have a different value from that of the wavelength λg. This will allow a phase difference to occur at the positions of the plurality of slots 112, so that the azimuth at which the radiated electromagnetic waves will strengthen one another can be shifted from the frontal direction to another azimuth in the YZ plane. Thus, with the slot antenna 200 shown in FIG. 8, directivity within the YZ plane can be adjusted. Moreover, it is not necessary for two adjacent slots 112 along the X direction to be excited strictly with an equiphase. Depending on the purpose, a phase difference of less than π/4 will be tolerated.

An array antenna device including a two-dimensional array of such plural slots 112 on a plate-like conductive member 110 may also be called a flat panel array antenna device. Depending on the purpose, the plurality of slot rows placed side-by-side along the X direction may vary in length (i.e., in terms of distance between the slots at both ends of each slot row). A staggered array may be adopted such that, between two adjacent rows along the X direction, the positions of the slots are shifted along the Y direction. Depending on the purpose, the plurality of slot rows and the plurality of waveguide members may include portions which are not parallel but are angled. Without being limited to an implementation where the waveguide face 122*a* of each waveguide member 122 opposes all of the slots 112 being placed side-by-side along the Y direction, it suffices if each waveguide face 122*a* opposes at least one slot among the plural slots that are placed side-by-side along the Y direction.

In the examples shown in FIGS. 8 to 11, each slot has a planar shape which is nearly rectangular, measuring longer along the X direction and shorter along the Y direction. Assuming that each slot has a size (length) L along the X direction and a size (width) W along the Y direction, L and W are set to values at which higher-order mode oscillation does not occur and at which the slot impedance is not too small. For example, L may be set to a range of $\lambda 0/2<L<\lambda 0$. W may be less than λ0/2. In order to actively utilize higher-order modes, L may possibly be larger than λ0.

Figure 12:
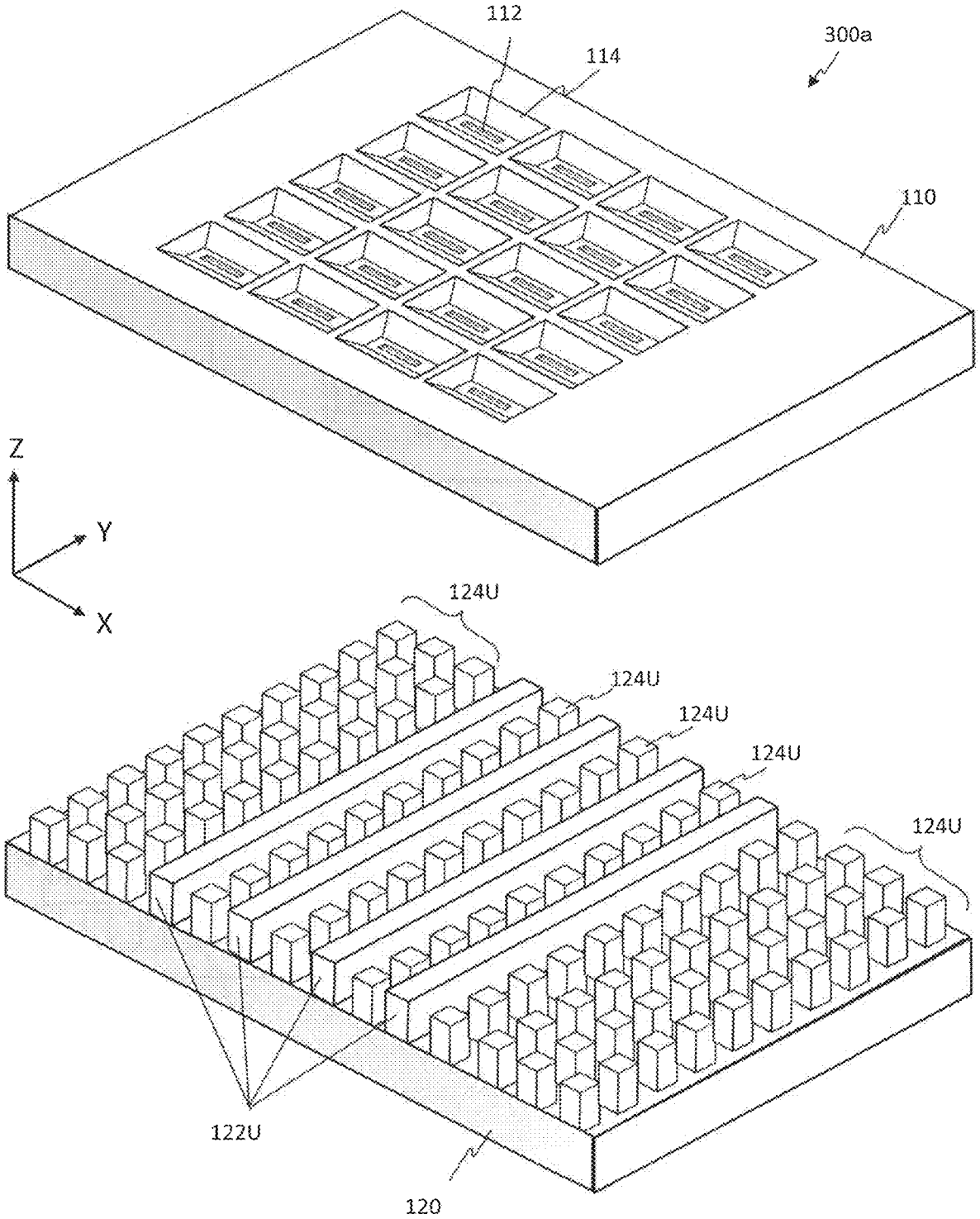
FIG. 12 is a perspective view schematically showing a partial structure of a slot array antenna device which includes a horn 114 for each slot 112.

FIG. 12 is a perspective view schematically showing a partial structure of a slot array antenna device 300*a* which includes a horn 114 for each slot 112. The slot array antenna device 300*a* includes: a first conductive member 110 having a two-dimensional array of a plurality of slots 112 and a plurality of horns 114 thereon; and a second conductive member 120 on which a plurality of waveguide members 122U and a plurality of conductive rods 124U are arrayed. The plurality of slots 112 of the first conductive member 110 are arrayed along a first direction (the Y direction), which extends along the conductive surface 110*a* of the first conductive member 110, and a second direction (the X direction) that intersects (or, in this example, is orthogonal to) the first direction. For simplicity, any port or choke structure to be provided at an end or center of each waveguide member 122U is omitted from illustration in FIG. 12.

Figure 13A:
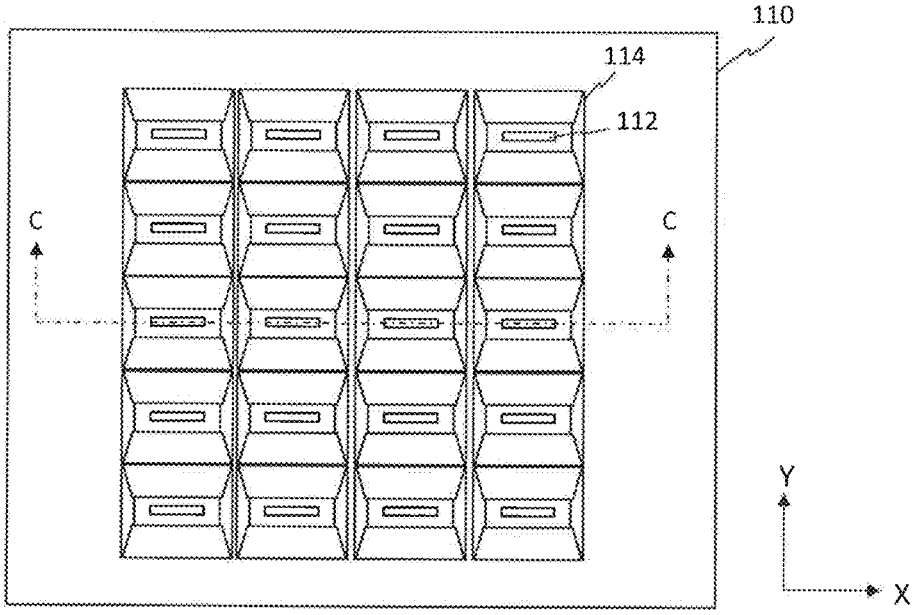
FIG. 13A is an upper plan view showing the array antenna device of FIG. 12 as viewed from the +Z direction.
Figure 13B:
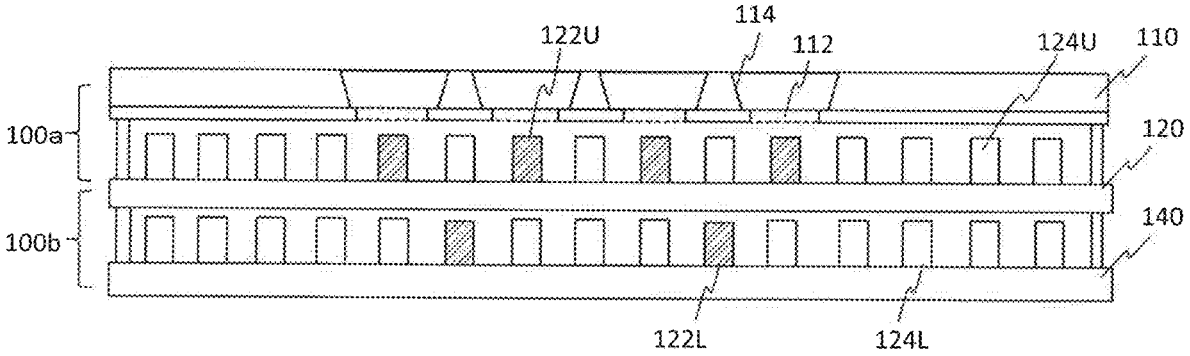
FIG. 13B is a cross-sectional view taken along line C-C in FIG. 13A.

FIG. 13A is an upper plan view of an array antenna device 300*a* shown in FIG. 12, which includes 20 slots 112 in an array of 5 rows and 4 columns, as viewed from the +Z direction. FIG. 13B is a cross-sectional view taken along line C-C in FIG. 13A. The first conductive member 110 in this array antenna device 300*a* includes a plurality of horns 114, which are placed so as to respectively correspond to the plurality of slots 112. Each of the plurality of horns 114 has four electrically conductive walls surrounding the slot 112. Such horns 114 allow directivity characteristics to be improved.

In the array antenna device shown 300*a* in the figures, a first waveguide device 100*a* and a second waveguide device 100*b* are layered. The first waveguide device 100*a* includes waveguide members 122U that directly couple to slots 112. The second waveguide device 100*b* includes a further waveguide member 122L that couples to the waveguide members 122U of the first waveguide device 100*a*. The waveguide member 122L and the conductive rods 124L of the second waveguide device 100*b* are arranged on a third conductive member 140. The second waveguide device 100*b* is basically similar in construction to the first waveguide device 100*a*.

As shown in FIG. 13A, the conductive member 110 has a plurality of slots 112 which are arrayed along the first direction (the Y direction) and a second direction (the X direction) orthogonal to the first direction. The waveguide face 122*a* of each waveguide member 122U extends along the Y direction, and opposes four slots that are disposed along the Y direction among the plurality of slots 112. Although the conductive member 110 has 20 slots 112 in an array of 5 rows and 4 columns in this example, the number of slots 112 is not limited to this example. Without being limited to the example where each waveguide member 122U opposes all slots that are disposed along the Y direction among the plurality of slots 112, each waveguide member 122U may oppose at least two adjacent slots along the Y direction. The interval between the centers of any two adjacent waveguide faces 122*a* is set to be shorter than the wavelength λ0, for example, and more preferably shorter than λ0/2.

Figure 13C:
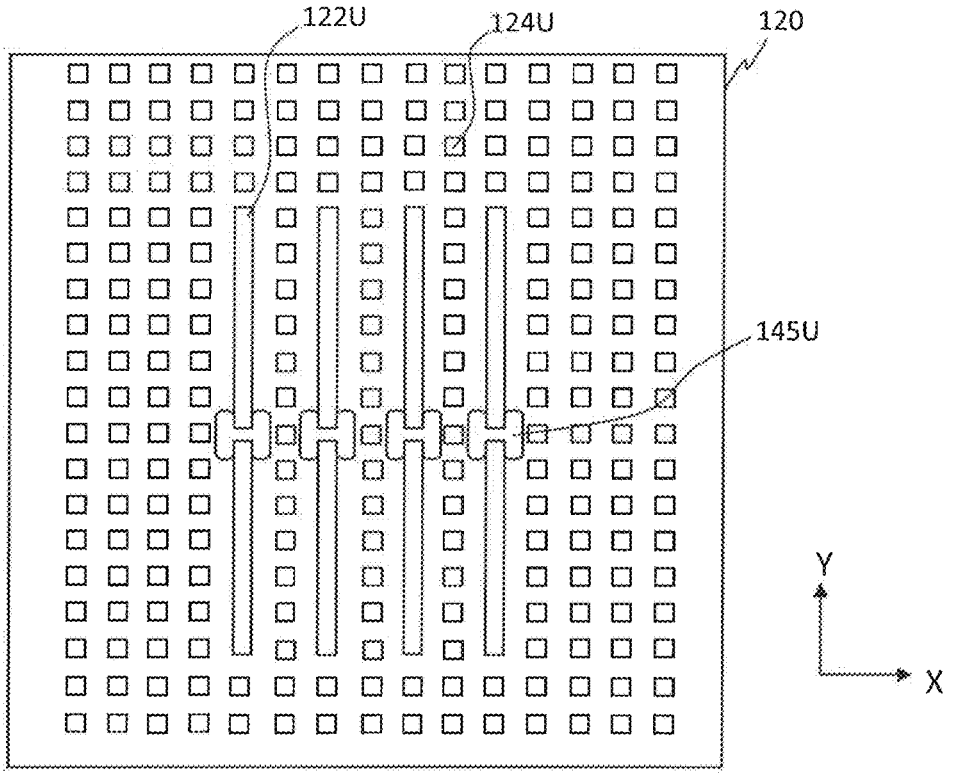
FIG. 13C is a diagram showing a planar layout of waveguide members 122U in a first waveguide device 100*a*.
Figure 13D:
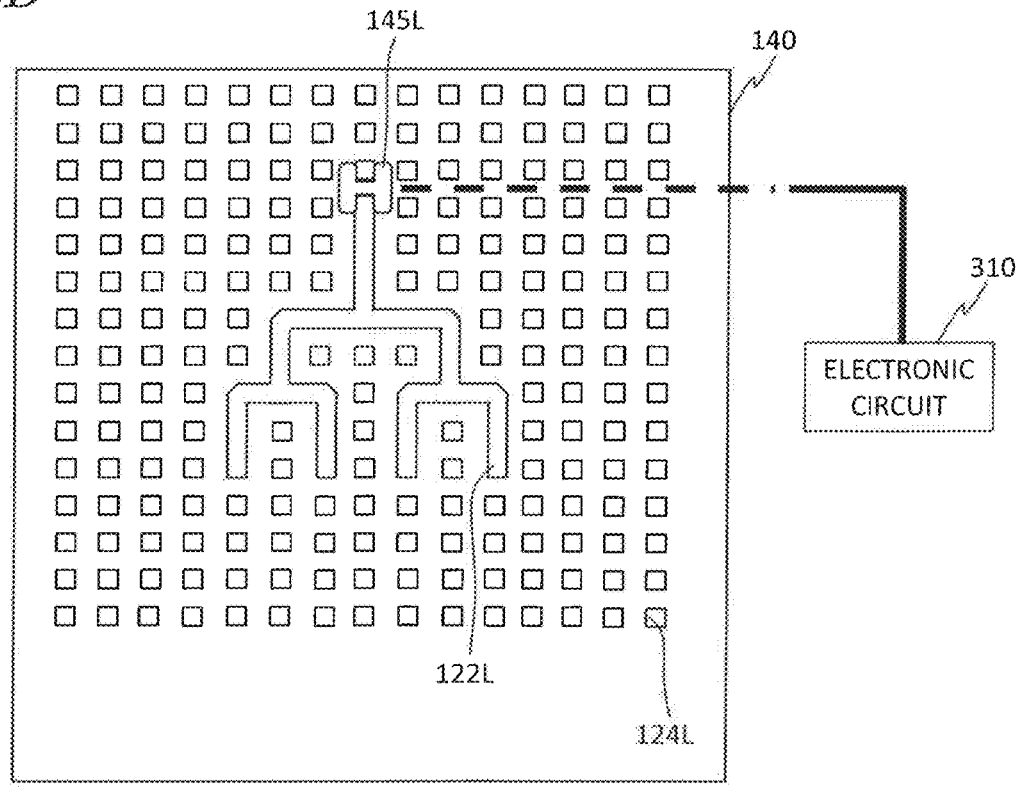
FIG. 13D is a diagram showing a planar layout of a waveguide member 122L in a second waveguide device 100*b*.

FIG. 13C is a diagram showing a planar layout of waveguide members 122U in the first waveguide device 100*a*. FIG. 13D is a diagram showing a planar layout of a waveguide member 122L in the second waveguide device 100*b*. As is clear from these figures, the waveguide members 122U of the first waveguide device 100*a* extend linearly, and include no branching portions or bends; on the other hand, the waveguide member 122L of the second waveguide device 100*b* includes both branching portions and bends. The combination of the "second conductive member 120" and the "third conductive member 140" in the second waveguide device 100*b* corresponds to the combination in the first waveguide device 100*a* of the "first conductive member 110" and the "second conductive member 120".

The waveguide members 122U of the first waveguide device 100*a* couple to the waveguide member 122L of the second waveguide device 100*b*, through ports (openings) 145U that are provided in the second conductive member 120. Stated otherwise, an electromagnetic wave which has propagated through the waveguide member 122L of the second waveguide device 100*b* passes through a port 145U to reach a waveguide member 122U of the first waveguide device 100*a*, and propagates through the waveguide member 122U of the first waveguide device 100*a*. In this case, each slot 112 functions as an antenna element (radiating element) to allow an electromagnetic wave which has propagated through the waveguide to be radiated into space. Conversely, when an electromagnetic wave which has propagated in space impinges on a slot 112, the electromagnetic wave couples to the waveguide member 122U of the first waveguide device 100*a* that lies directly under that slot 112, and propagates through the waveguide member 122U of the first waveguide device 100*a*. An electromagnetic wave which has propagated through a waveguide member 122U of the first waveguide device 100*a* may also pass through a port 145U to reach the waveguide member 122L of the second waveguide device 100*b*, and propagates through the waveguide member 122L of the second waveguide device 100*b*. Via a port 145L of the third conductive member 140, the waveguide member 122L of the second waveguide device 100*b* may couple to an external waveguide device or radio frequency circuit (electronic circuit). As one example, FIG. 13D illustrates an electronic circuit 310 which is connected to the port 145L. Without being limited to a specific position, the electronic circuit 310 may be provided at any arbitrary position. The electronic circuit 310 may be provided on a circuit board which is on the rear surface side (i.e., the lower side in FIG. 13B) of the third conductive member 140, for example. Such an electronic circuit is a microwave integrated circuit, and may be an MMIC (Monolithic Microwave Integrated Circuit) that generates or receives millimeter waves, for example.

The first conductive member 110 shown in FIG. 13A may be called a "radiation layer". Moreover, the entirety of the second conductive member 120, the waveguide members 122U, and the conductive rods 124U shown in FIG. 13D may be called an "excitation layer", whereas the entirety of the third conductive member 140, the waveguide member 122L, and the conductive rods 124L shown in FIG. 13D may be called a "distribution layer". Moreover, the "excitation layer" and the "distribution layer" may be collectively called a "feeding layer". Each of the "radiation layer", the "excitation layer", and the "distribution layer" can be mass-produced by processing a single metal plate. The radiation layer, the excitation layer, the distribution layer, and any electronic circuitry to be provided on the rear face side of the distribution layer may be produced as a single-module product.

In the array antenna of this example, as can be seen from FIG. 13B, a radiation layer, an excitation layer, and a distribution layer are layered, which are in plate form; therefore, a flat and low-profile flat panel antenna is realized as a whole. For example, the height (thickness) of a multilayer structure having a cross-sectional construction as shown in FIG. 13B can be 10 mm or less.

With the waveguide member 122L shown in FIG. 13D, the distances from the port 145L of the third conductive member 140 to the respective ports 145U (see FIG. 13C) of the second conductive member 120 measured along the waveguide member 122L are all set to an identical value. Therefore, a signal wave which is input to the waveguide member 122L reaches the four ports 145U of the second conductive member 120 all in the same phase, from the port 145L of the third conductive member 140. As a result, the four waveguide members 122U on the second conductive member 120 can be excited in the same phase.

Depending on the purpose, it is not necessary for all slots 112 functioning as antenna elements to radiate electromagnetic waves in the same phase. In the construction shown in FIG. 13D, the distances from the port 145L of the third conductive member 140 to the respective ports 145U (see FIG. 13C) of the second conductive member 120 as measured along the waveguide may differ from one another. The network patterns of the waveguide members 122 in the excitation layer and the distribution layer (or each layer included in the feeding layer) may be arbitrary, without being limited to what is shown.

The electronic circuit 310 is connected to a waveguide extending above each waveguide member 122U, via the ports 145U and 145L shown in FIG. 13C and FIG. 13D. A signal wave which is output from the electronic circuit 310 is subject to branching in the distribution layer, and then propagates on the plurality of waveguide members 122U, until reaching the plurality of slots 112. In order to ensure that the signal waves have an equal phase at the positions of two adjacent slots 112 along the X direction, the total waveguide lengths from the electronic circuit 310 to the two adjacent slots 112 along the X direction may be designed to be substantially equal, for example.

Next, variants of the horn 114 will be described. Without being limited to what is illustrated in FIG. 12, various structures may be utilized as the horns 114.

Figure 14A:
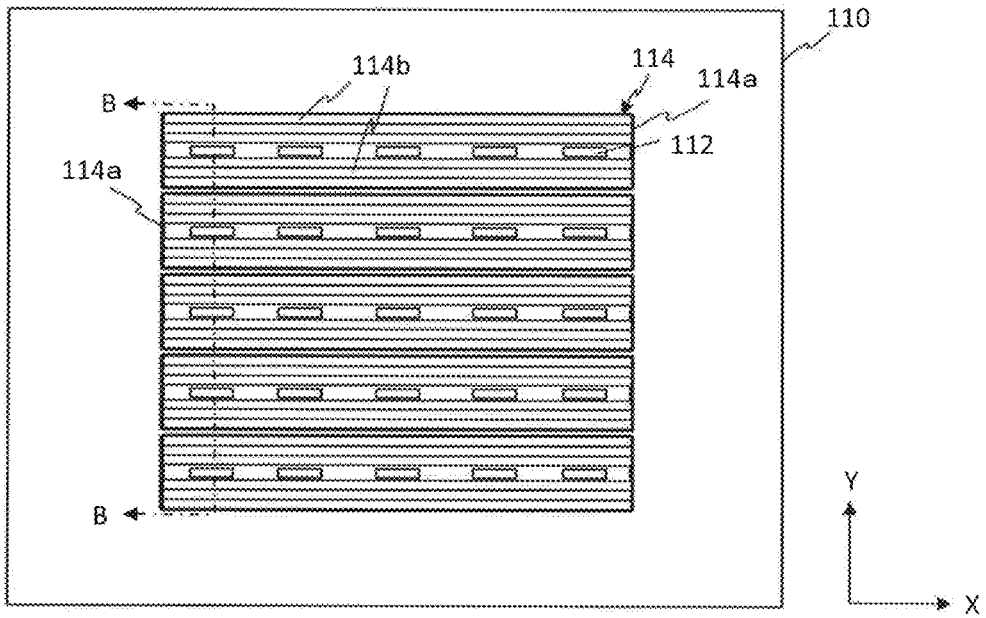
FIG. 14A is an upper plan view showing the structure of a plurality of horns 114 according to a variant.
Figure 14B:
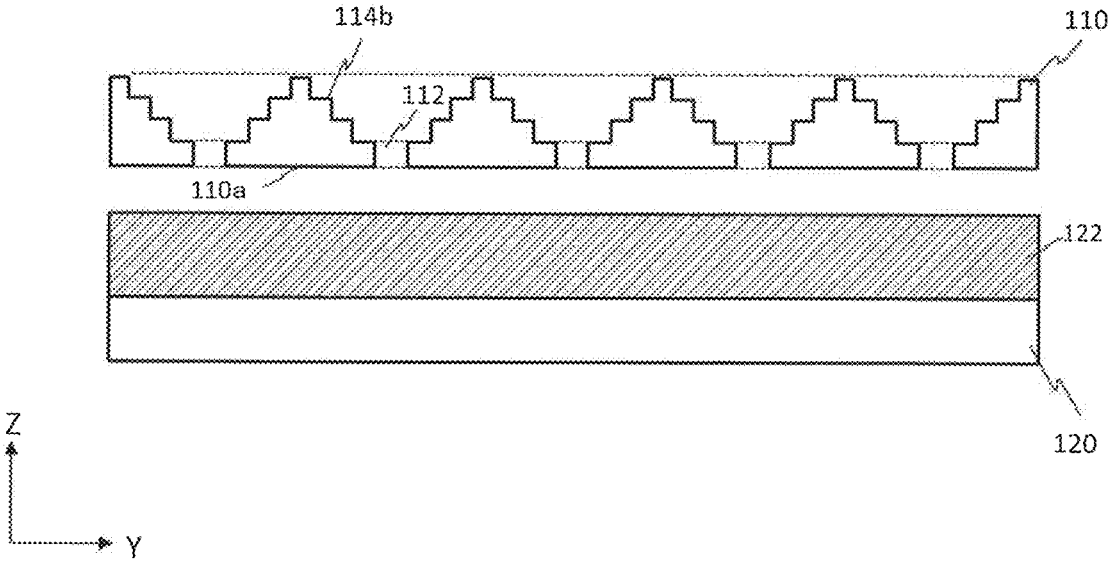
FIG. 14B is a cross-sectional view taken along line B-B in FIG. 14A.
Figure 15:
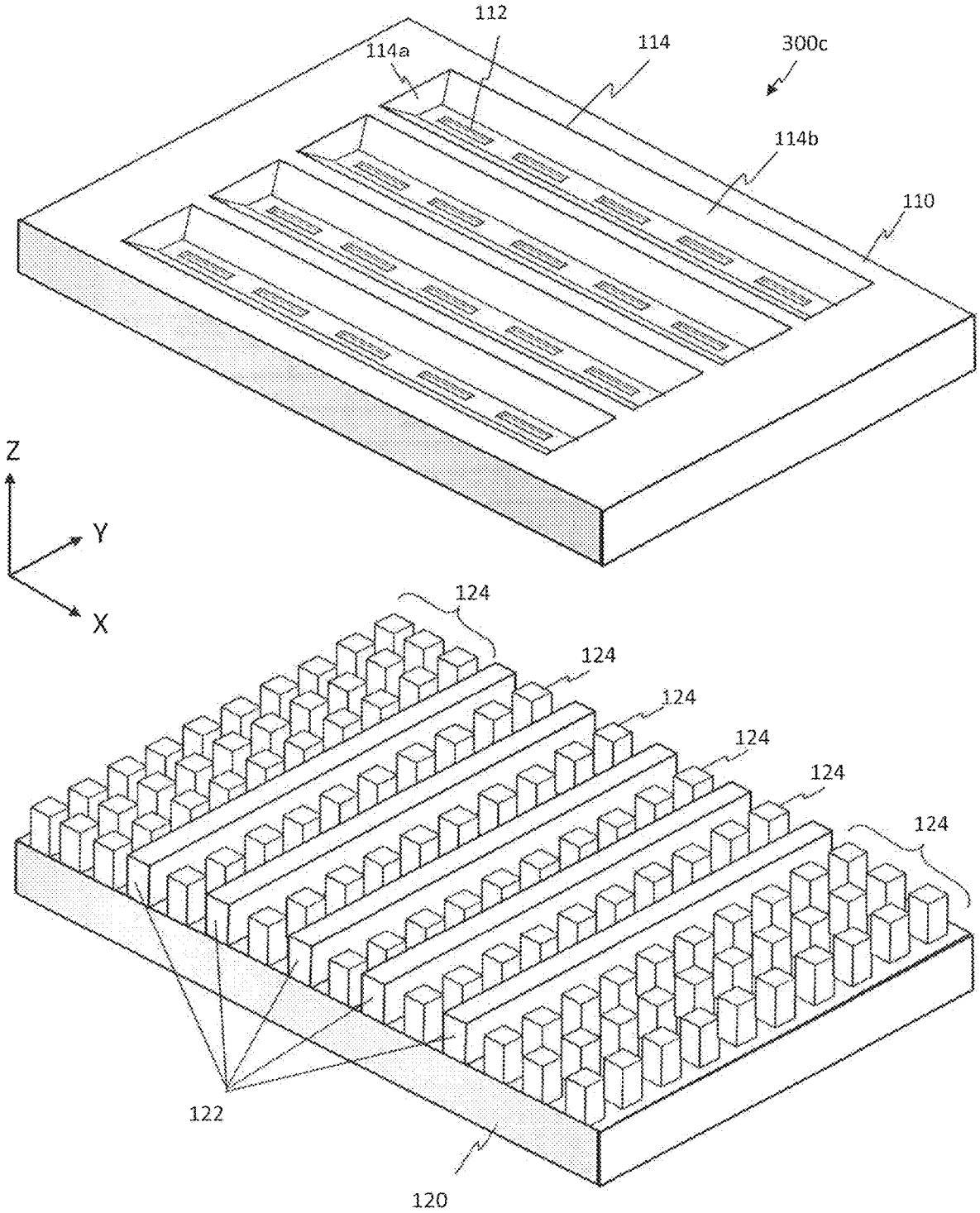
FIG. 15 is a perspective view showing an exemplary slot array antenna device including horns 114 each having slanted planar side walls.

FIG. 14A is an upper plan view showing the structure of a plurality of horns 114 according to a variant. FIG. 14B is a cross-sectional view taken along line B-B in FIG. 14A. The plurality of horns 114 in this variant are arrayed along the Y direction on the first conductive member 110, on its opposite surface from the conductive surface 110*a*. Each horn 114 includes a pair of first electrically conductive walls 114*a* extending along the Y direction and a pair of second electrically conductive walls 114*b* extending along the X direction. The pair of first electrically conductive walls 114*a* and the pair of second electrically conductive walls 114*b* surround plural (e.g., five in this example) slots 112 arrayed along the X direction, among the plurality of slots 112. The length of each second electrically conductive wall 114*b* along the X direction is longer than the length of each first electrically conductive wall 114*a* along the Y direction. The pair of second electrically conductive walls 114*b* present a staircase shape. As used herein, a "staircase shape" means a shape including steps, any may also be called a "stepped shape". In such a horn, the interval between the pair of second electrically conductive walls 114*b* along the Y direction increases away from the first conductive surface 110*a*. Adopting such a staircase shape provides an advantage of fabrication ease. Note that the pair of second electrically conductive walls 114*b* do not need to have a staircase shape. For example, as in a slot array antenna device 300*c* shown in FIG. 15, horns 114 each having slanted planar side walls may be used. In such horns, too, the interval between the pair of second electrically conductive walls 114*b* along the Y direction increases away from the first conductive surface 110*a*.

The inventors have found the following to be effective in enhancing the performance of the aforementioned array antenna device or waveguide device.

(1) Suppressing unwanted signal wave reflection at each port 145U that couples the waveguide in the excitation layer and the waveguide in the distribution layer.

(2) Ensuring that the distance between the centers of horns is different from the distance between the centers of slots, thus optimizing the directivity of the antenna array and/or providing an improved design freedom; this improvement is applicable not only to a horn antenna array in which the aforementioned WRG structure is used, but also to a horn antenna array in which the hollow waveguide structure is used.

(3) Using a different choke structure from conventionally, to suppress unwanted reflection when propagating an electromagnetic wave via each port.

(4) Adjusting the shape of a waveguide member having a plurality of branching portions to control an in-plane distribution of the excitation amplitude of the array antenna.

(5) Adjusting the shape of a waveguide member having a plurality of branching portions to reduce propagation losses.

(6) Improving the performance of the hollow waveguide that couples any electronic circuitry (e.g., MMIC) and the waveguide device.

(7) Providing a new array pattern for the rods, as adapted to the interval between the waveguide members 122U and 122L.

Hereinafter, more specific exemplary constructions for array antenna devices according to embodiments of the present disclosure will be described. Note however that unnecessarily detailed descriptions may be omitted. For example, detailed descriptions on what is well known in the art or redundant descriptions on what is substantially the same constitution may be omitted. This is to avoid lengthy description, and facilitate the understanding of those skilled in the art. The accompanying drawings and the following description, which are provided by the present inventors so that those skilled in the art can sufficiently understand the present disclosure, are not intended to limit the scope of claims. In the following description, any identical or similar constituent elements will be denoted by identical reference numerals.

Embodiment 1

<Array Antenna Device>

Figure 16:
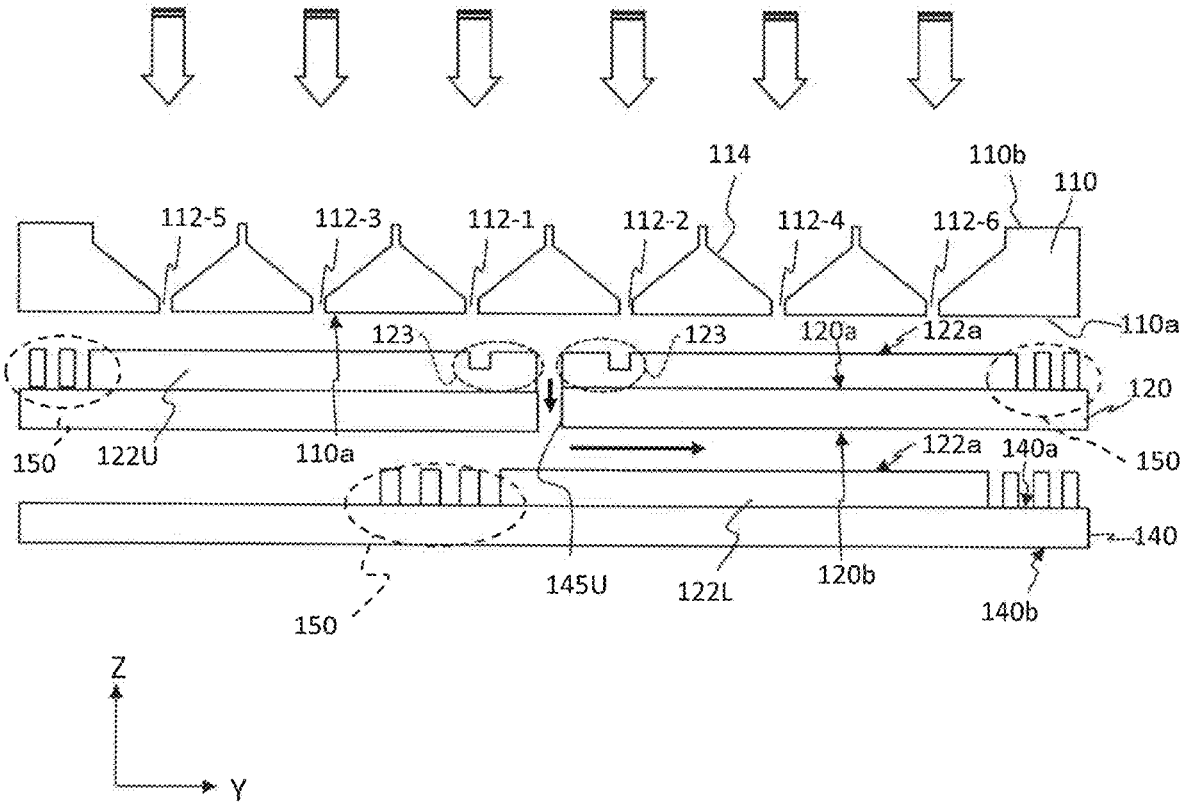
FIG. 16 is a diagram schematically showing a cross section of an array antenna device of the present embodiment, taken along waveguide members 122U and 122L.

First, with reference to FIG. 16, a first embodiment of an array antenna device according to the present disclosure will be described. FIG. 16 schematically shows a cross section of an array antenna device of the present embodiment, taken along waveguide members 122U and 122L. In the present disclosure, for convenience of illustration, the side on which free space exists for an electromagnetic wave (that is radiated from the array antenna device or impinges on the array antenna device) to propagate will be referred to as "the front side", and the opposite side thereof as "the rear side". In the present disclosure, the terms "first", "second", etc., are mere indicators for differentiating between portions, devices, parts, portions, layers, regions, and the like, without suggesting or imposing any restrictions.

As shown in FIG. 16, the array antenna device according to the present embodiment has a construction where a first conductive member 110, a second conductive member 120, and a third conductive member 140, each schematically having a thin-plate shape, are layered with appropriate air gaps therebetween. FIG. 16 shows a main portion of the array antenna device; it is to be understood that some electronic parts, e.g., those of an MMIC, are to be mounted on the rear side of the array antenna device shown in the figure. Between such electronic parts and the array antenna device shown, a conductive member of a thin-plate shape, which may serve as a further waveguide, may also be provided.

In the present embodiment, the first conductive member 110 has a first conductive surface 110*b* on the front side and a second conductive surface 110*a* on the rear side, and has a plurality of slots 112-1, 112-2, 112-3, 112-4, 112-5 and 112-6. These slots may be collectively referred to as the slots 112. Although FIG. 16 illustrates six slots 112, the number of slots 112 is not limited to this number in the present embodiment. The first conductive surface 110*b* of the first conductive member 110 is shaped so as to define a plurality of horns 114 each communicating with the respectively corresponding slot 112.

The second conductive member 120 is located on the rear side of the first conductive member 110. The second conductive member 120 has a third conductive surface 120*a* on the front side, which opposes the second conductive surface 110*a* of the first conductive member 110, and a fourth conductive surface 120*b* on the rear side. As such, the second conductive member 120 supports the first waveguide member 122U. The first waveguide member 122U has an electrically-conductive waveguide face 122*a* of a stripe shape that opposes the second conductive surface 110*a*, and extends linearly along the second conductive surface 110*a*. On both sides of the linearly-extending first waveguide member 122U (i.e., the frontward and rearward sides in FIG. 16) is located an artificial magnetic conductor provided on the third conductive surface 120*a* of the second conductive member 120. No rods composing the artificial magnetic conductor are located in the cross section shown in FIG. 16, which is the reason why no artificial magnetic conductor is shown to be present in FIG. 16. A choke structure 150 is provided at an end of the first waveguide member 122U. The choke structure 150 restrains leakage of an electromagnetic wave (signal wave) from the end of the first waveguide member 122U.

The second conductive surface 110*a* of the first conductive member 110, the waveguide face 122*a* of the first waveguide member 122U, and the artificial magnetic conductor (not shown in FIG. 16) together define a waveguide extending in the gap between the second conductive surface 110*a* and the waveguide face 122*a*. This waveguide communicates with and electromagnetically couples to the slots 112 in the first conductive member 110.

By allowing at least one of the distance from the second conductive surface 110*a* to the waveguide face 122*a* and the width of the waveguide face 122*a* to vary as appropriate along the direction that the first waveguide member 122U extends, the wavelength of a signal wave that propagates in this waveguide can be reduced. Assume that a signal wave has a central wavelength $\lambda r$ when both of the distance from the second conductive surface 110*a* to the waveguide face 122*a* and the width of the waveguide face 122*a* are constant along the direction that the first waveguide member 122U extends. When a signal wave of the same frequency propagates in a vacuum, the signal wave has a central wavelength $\lambda 0$ as described above. In this case, the relationship $\lambda r > \lambda 0$ holds. However, by forming rises and falls on the waveguide face 122*a* of the first waveguide member 122U to vary the distance from the second conductive surface 110*a* to the waveguide face 122*a* as appropriate, or vary the width of the waveguide face 122*a* as appropriate, for example, the central wavelength of a signal wave propagating in such a waveguide can be made shorter than $\lambda r$.

The second conductive member 120 has a port 145U that extends from the third conductive surface 120*a* through to the fourth conductive surface 120*b*. The port 145U communicates from the fourth conductive surface 120*b* to the waveguide extending between the second conductive surface 110*a* and the waveguide face 122*a*. In the present specification, when a port is said to "communicate from a conductive surface to a waveguide (i.e., that is associated with another conductive surface)" it is meant that, as viewed from the normal direction of the aperture plane of the port, the inner wall of the port and the side face (end face) at an end of the waveguide member that is associated with the waveguide in question are aligned in position (substantially flush).

Among the plurality of slots 112, a first slot 112-1 and a second slot 112-2, which are adjacent to each other, are at symmetric positions with respect to the center of the port 145U. In the example shown, the entirety of the six slots 112 are positioned symmetrically with respect to the center of the port 145U. The distance between the centers of any two adjacent slots 112 is set equal to the wavelength of a signal wave propagating in the waveguide (or, in the case where the wavelength varies with frequency modulation, its central wavelength). This is in order to supply equiphase signal waves to the respective slots 112. Depending on the intended characteristics of the array antenna, it may need to be designed so that the phase of the signal wave to be supplied to each slot is intentionally made different. In that case, the distance between the centers of two adjacent slots 112 may be chosen to be a length which somewhat differs from the wavelength of a signal wave propagating in the waveguide.

The third conductive member 140 is located on the rear side of the second conductive member 120. The third conductive member 140 has a fifth conductive surface 140*a* on the front side, which opposes the fourth conductive surface 120*b* of the second conductive member 120, and a sixth conductive surface 140*b* on the rear side. As such, the third conductive member 140 supports the second waveguide member 122L. The second waveguide member 122L has an electrically-conductive waveguide face 122*a* that opposes the fourth conductive surface 120*b*, and extends along the fourth conductive surface 120*b*.

On both sides of the second waveguide member 122L, too, is located an artificial magnetic conductor provided on the fifth conductive surface 140*a* of the third conductive member 140. The fourth conductive surface 120*b* of the second conductive member 120, the waveguide face 122*a* of the second waveguide member 120L, and the artificial magnetic conductor (not shown in FIG. 16) together define a waveguide extending in the gap between the fourth conductive surface 120*b* and the waveguide face 122*a* of the second waveguide member 122L. A choke structure 150 is provided near an end of the second waveguide member 122L. The second waveguide member 122L includes a bend which is not shown, such that the waveguide couples to an external electronic circuit via another port which is at a position not shown.

In the present embodiment, the first waveguide member 122U has a pair of impedance matching structures 123 adjoining the port 145U. The details of the impedance matching structure 123 will be described later.

In FIG. 16, examples of directions of propagation of signal waves such as millimeter waves are indicated by thick arrows. This example illustrates reception. Via the horns 114 and slots 112, electromagnetic waves (signal waves), e.g., millimeter waves, that have impinged on the array antenna device propagate through the waveguides extending between the conductive surface 110*a* of the first conductive member 110 and the waveguide face 122*a* of the waveguide member 122U, pass through the ports 145U, and propagate in the waveguide extending between the conductive surface 120*b* of the second conductive member 120 and the waveguide face 122*a* of the waveguide member 122L. Conversely, during transmission, an electromagnetic wave which has propagated along the waveguide member 122L passes through the ports 145U, to excite the plurality of slots 112 as it propagates along the waveguide member 122U.

<Impedance Matching Structures of the Port>

Figure 17:
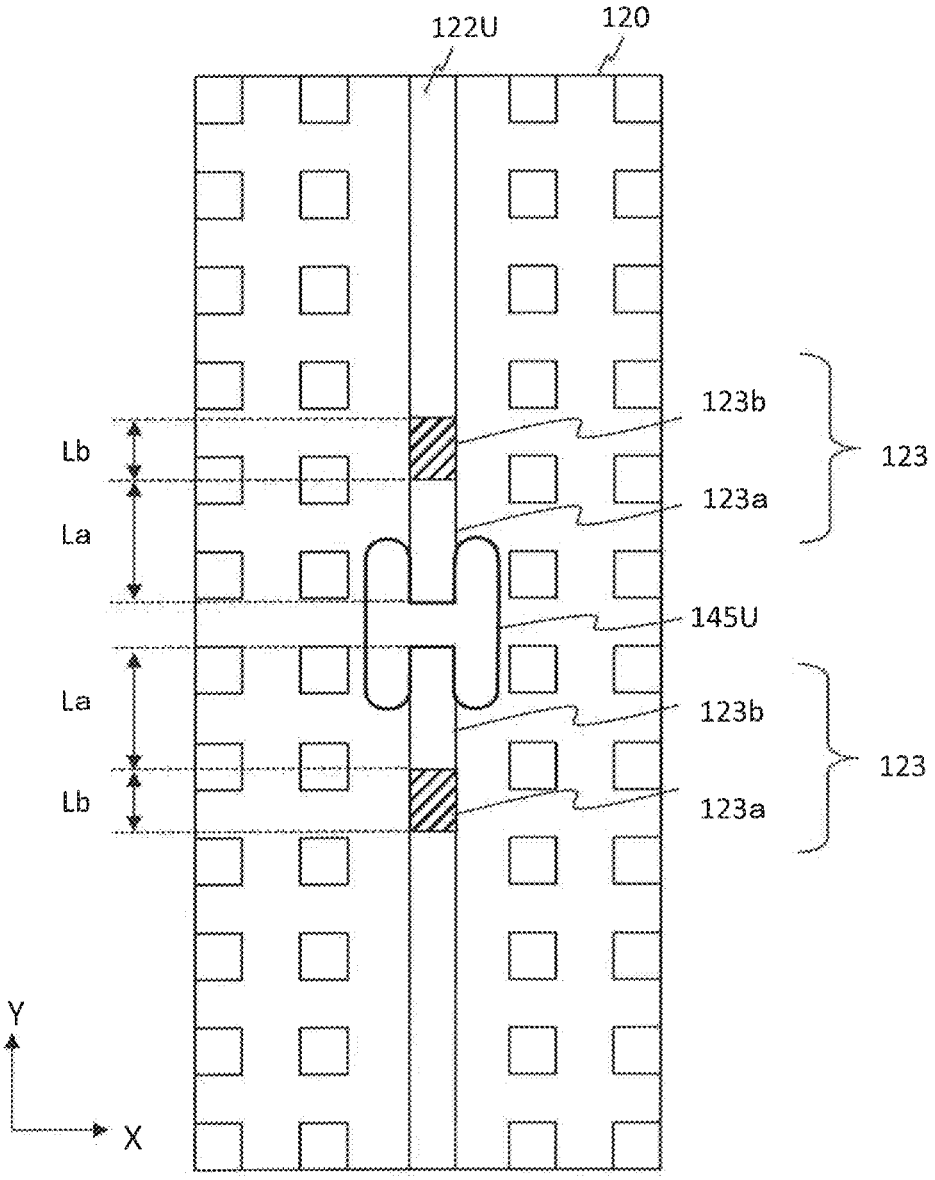
FIG. 17 is a plan view showing a portion of the second conductive member 120 according to the present embodiment.
Figure 18:
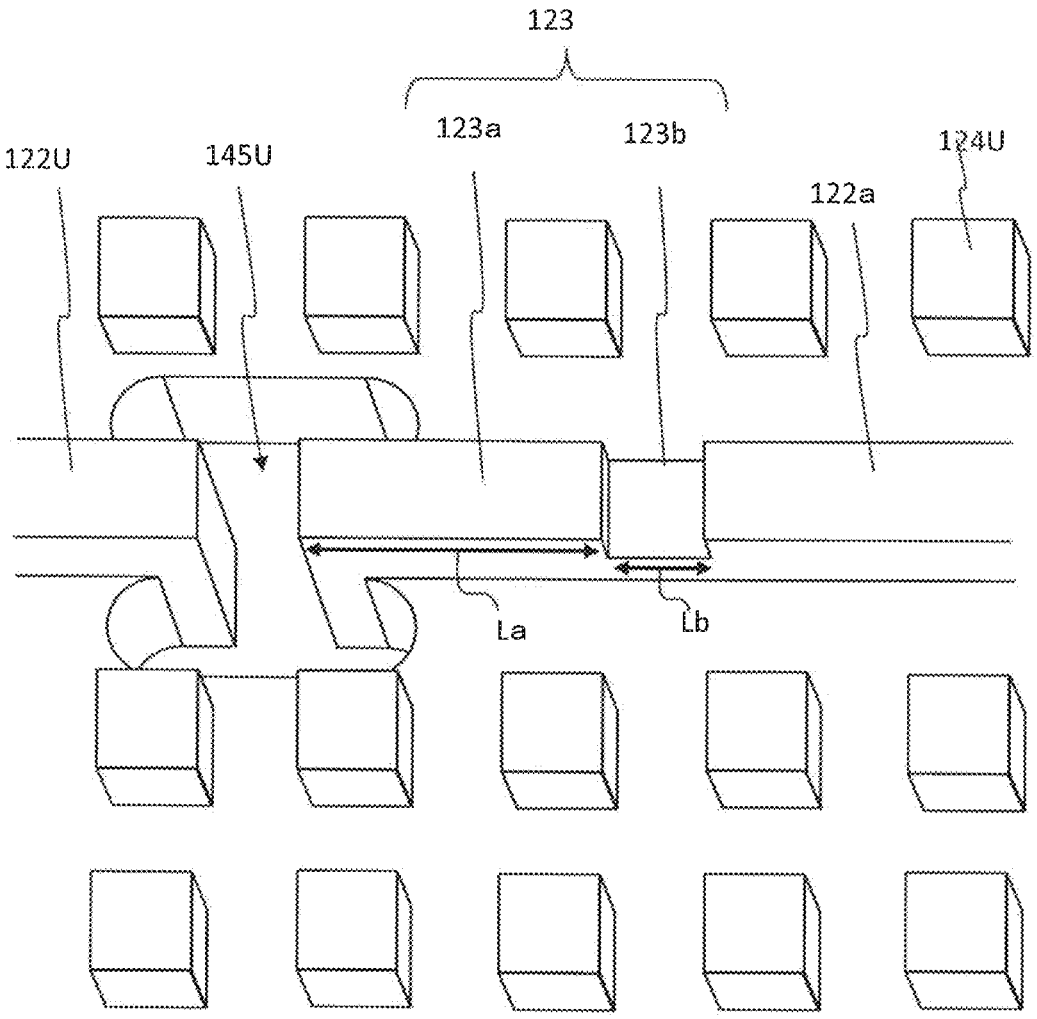
FIG. 18 is a perspective view showing a portion at which a waveguide member 122U and a port 145U are coupled.

A cross section taken perpendicular to the Z axis of each port 145U may have a variety of shapes. In the present embodiment, as shown in FIG. 17, a cross section of the port 145U taken perpendicular to the center axis (which is parallel to the Z axis in the present embodiment) has an H-shape. An "H-shape" includes two vertical portions which are substantially parallel to each other, and a lateral portion connecting the centers of the two vertical portions, in the fashion of the alphabetical letter "H". FIG. 17 is a plan view showing a portion of the second conductive member 120 according to the present embodiment. Although the second conductive member 120 includes a plurality of ports 145U and the first waveguide member 122U connecting the respective ports 145U, for simplicity FIG. 17 only shows one port 145U and a portion of the first waveguide member 122U that is connected to the port 145U. FIG. 18 is a perspective view showing a portion at which the waveguide member 122U and the port 145U are coupled.

With reference to FIG. 17 and FIG. 18, details of the impedance matching structures 123 will be described.

Each of the pair of impedance matching structures 123 according to the present embodiment includes a flat portion 123*a* adjoining the port 145U and a dent 123*b* adjoining the flat portion 123*a*.

The length (La+Lb) of the impedance matching structure 123 along the direction that the waveguide member 122U extends is about λr/2. The length La of the flat portion 123*a* along the direction that the waveguide member 122U extends is longer than λr/4. The length Lb of the dent 123*b* along the direction that the waveguide member 122U extends is shorter than the length La of the flat portion 123*a*. The length Lb is typically set to be shorter than λr/4.

FIG. 16 is referred to again. In the present embodiment, the distance between the centers of the first and second slots 112-1 and 112-2 that are the closest to the port 145U is equal to λr. As viewed from a direction perpendicular to the waveguide face 122*a*, the slots 112-1 and 112-2 that are the closest to the port 145U overlap at least portions of (or, in the example shown, portions of the dents 123*b*) of the impedance matching structure 123.

As described earlier, when at least one of the distance from the second conductive surface 110*a* to the waveguide face 122*a* and the width of the waveguide face 122*a* is allowed to vary along the waveguide, the central wavelength of a signal wave propagating in the waveguide can be made shorter than λ0. When the central wavelength of a signal wave propagating in the waveguide is thus shortened, the distance from the center of the first slot 112-1 to the center of the third slot 112-3 can be made shorter than the distance from the center of the first slot 112-1 to the center of the second slot 112-2. Note that the distance from the center of the first slot 112-1 to the center of the third slot 112-3, and the distance from the center of the third slot 112-3 to the center of the fifth slot 112-5, are both set equal to the wavelength (as taken within the waveguide) of a signal wave propagating in the waveguide. Similarly, the distance from the center of the second slot 112-2 to the center of the fourth slot 112-4, and the distance from the center of the fourth slot 112-4 to the center of the sixth slot 112-6, are both set equal to the wavelength (as taken within the waveguide) of a signal wave propagating in the waveguide.

Figure 19:
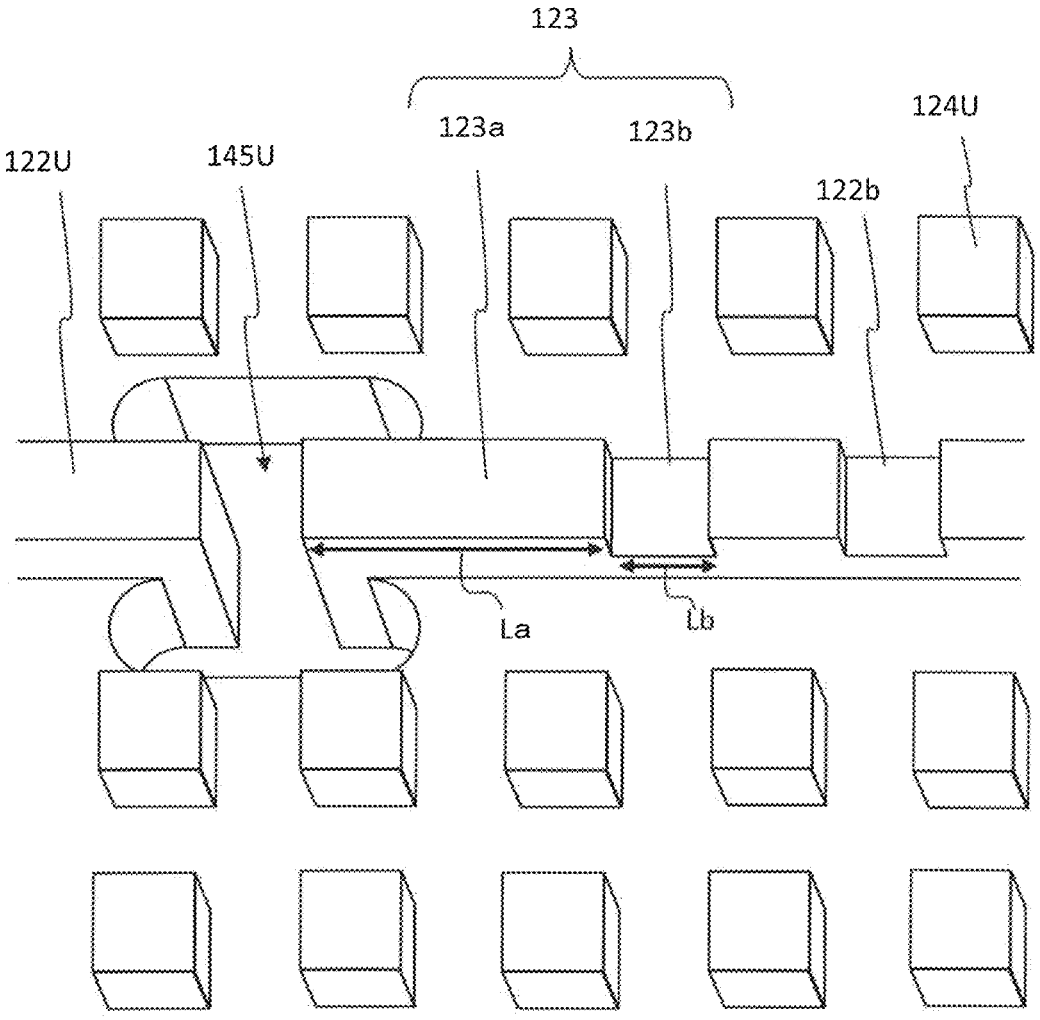
FIG. 19 is a perspective view showing an example of a first waveguide member 122U on which rises and falls for the purpose of wavelength reduction are provided.

FIG. 19 is a perspective view showing an example of a first waveguide member 122U on which rises and falls for the purpose of wavelength reduction are provided. FIG. 19 illustrates a dent 122*b* qualifying as such rises and falls. By providing the plurality of dents 122*b* at appropriate positions on the first waveguide member 122U, the wavelength of a signal wave propagating in the waveguide can be reduced. Specific examples constructions for such waveguide members are disclosed in Japanese Patent Application No. 2015-217657 and PCT/JP2016/083622. The entire disclosure of Japanese Patent Application No. 2015-217657 and PCT/JP2016/083622 is incorporated herein by reference.

Figure 20:
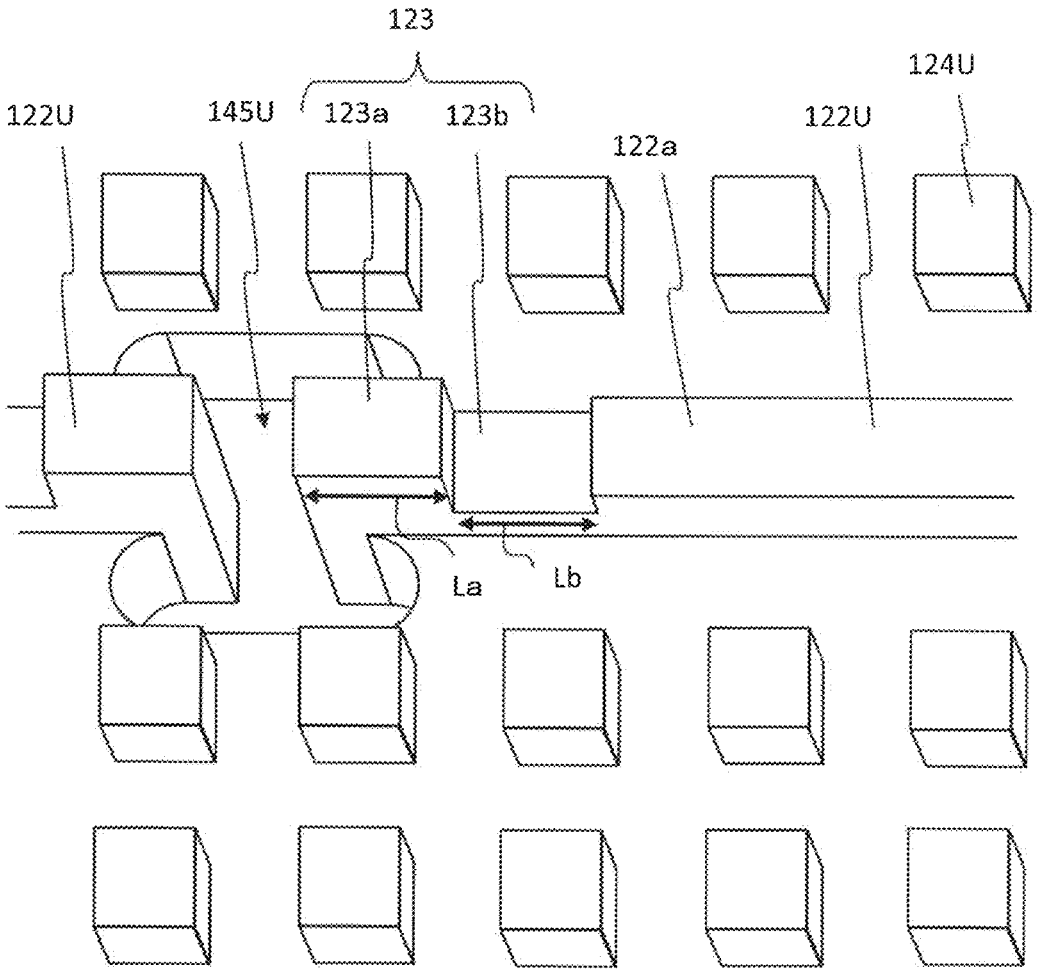
FIG. 20 is a perspective view showing a variant of an impedance matching structure 123.

FIG. 20 is a perspective view showing a variant of the impedance matching structure 123. In this example, the length La of the flat portion 123*a* of the impedance matching structure 123 is shorter than λr/4, and is substantially equal to the length Lb of the dent 123*b*. When such a construction is adopted, the height of the flat portion 123*a* needs to be made greater than the height of the waveguide member 122U, thus shortening the spacing between the flat portion 123*a* and the second conductive surface 110*a* of the first conductive member 110. As this spacing (design value) becomes shorter, the influences exerted on antenna performance fluctuations when the spacing deviates from the design value due to fluctuations in the fabrication process will increase. It has been confirmed that the impedance matching structure 123 as shown in FIG. 20 adequately shows an impedance matching function in an implementation where the distance between the centers of the two closest slots to the port 145U, i.e., the first slot 112-1 and the second slot 112-2, is set smaller than λ0.

In the present embodiment, the distance between the centers of the first slot 112-1 and the second slot 112-2 is equal to λr. Therefore, it is preferable to adopt the impedance matching structure 123 illustrated in FIG. 18, FIG. 19, etc., rather than adopting the impedance matching structure 123 shown in FIG. 20.

Variants of Embodiment 1

Next, with reference to FIGS. 21A through 21C, other examples of impedance matching structures around the port 145U will be described.

A port 145U shown in the figure is in a position at which the first waveguide member 122U is spatially separated into a first portion 122-1 and a second portion 122-2. Via the port 145U, one end of the first portion 122-1 and one end of the second portion 122-2 oppose each other. A portion of the inner wall of the port 145U is connected to the one end of the first portion 122-1 of the first waveguide member 122U. Another, opposing portion of the inner wall of the port 145U is connected to the one end of the second portion 122-2 of the first waveguide member 122U.

Figure 21A:
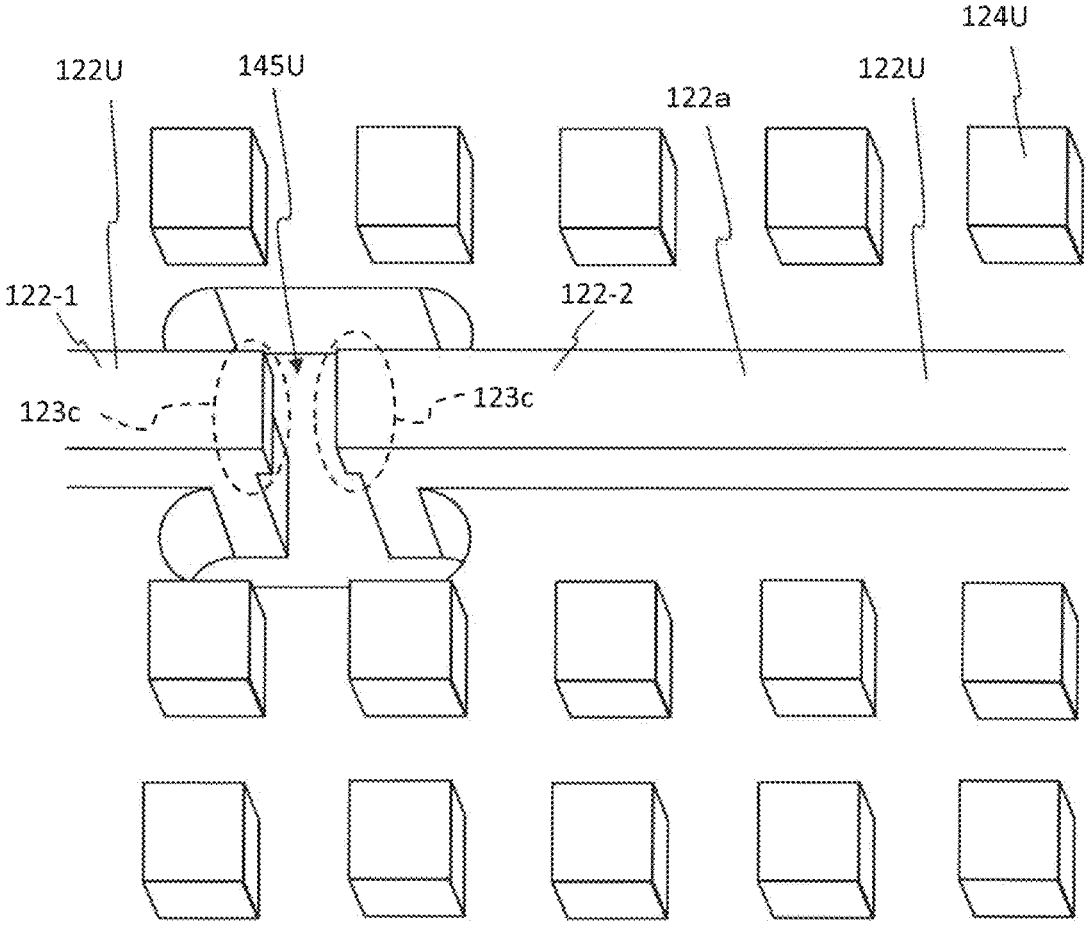
FIG. 21A is a diagram showing another example of an impedance matching structure at the port 145U.

In the example shown in FIG. 21A, the one end of the first portion 122-1 of the first waveguide member 122U and the one end of the second portion 122-2 each have a bump 123*c* for impedance matching purposes. The gap which is defined by the two opposing end faces at the one end of the first portion 122-1 of the first waveguide member 122U and the one end of the second portion 122-2 will be referred to as an "intra-waveguide member gap". In the example shown in FIG. 21A, in the region between the pair of opposing bumps 123*c*, the size of the gap is smaller than the size of the gap between the portion of the inner wall of the port 145U that connects to the first portion 122-1 of the waveguide member 122U and the other portion of the inner wall of the port 145U that connects to the second portion 122-2 of the waveguide member 122U. In the present disclosure, any such portion will be referred to as a "narrow portion". It has been confirmed through an analysis by the inventors that the degree of impedance matching improves when the intra-waveguide member gap has such a narrow portion.

In this example, a cross section of the port 145U which is orthogonal to the center axis of the port 145U has an H-shape; however, it may have other shapes as will be described later. The center axis of the port 145U is defined as a line which passes through the center of the opening of the port 145U and which is perpendicular to the plane of the opening.

In this example, the narrow portion between the pair of bumps 123*c* reaches the waveguide face 122*a* of the waveguide member 122U. Without being limited to the construction shown in FIG. 21A, the position and size of the narrow portion may be appropriately set in accordance with the required performance. For example, as shown in FIG. 21B, the narrow portion between the pair of bumps 123*c* may reach inside the port 145U.

Figure 21B:
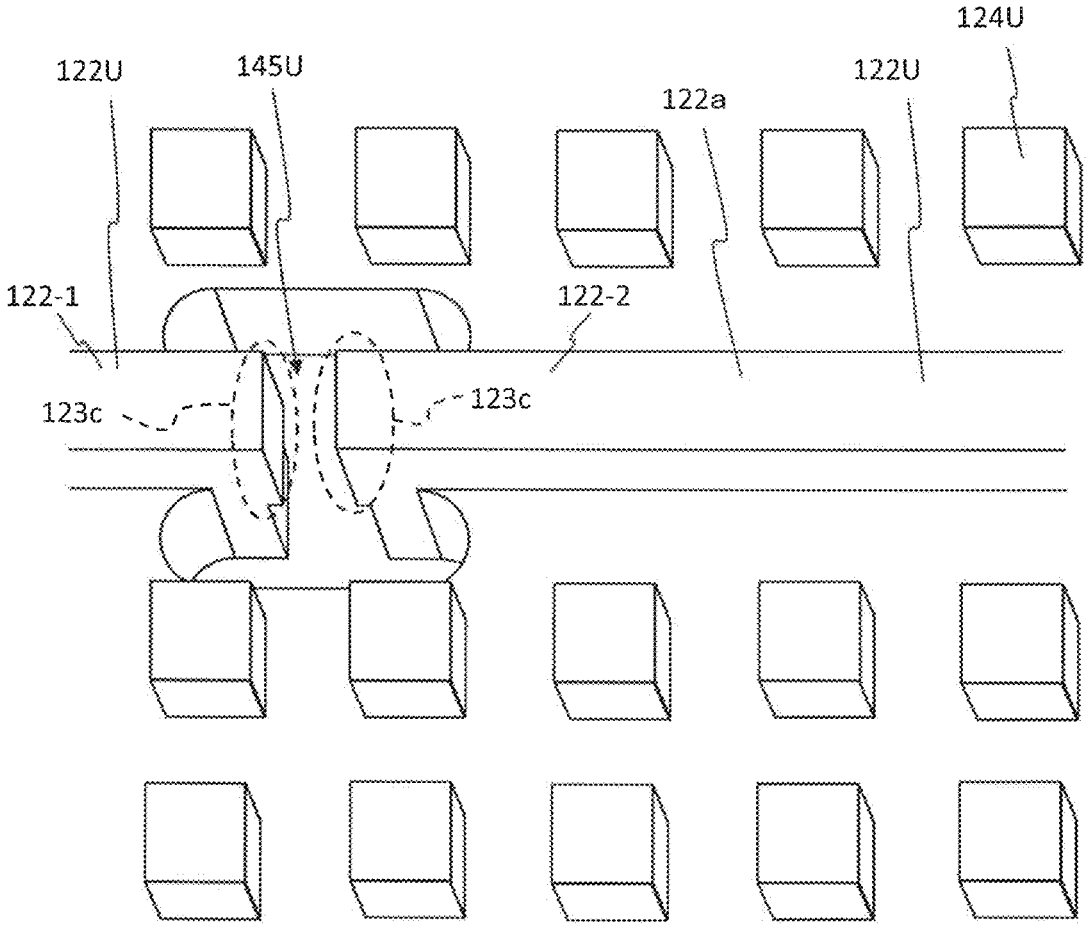
FIG. 21B is a diagram showing still another example of an impedance matching structure at the port 145U.
Figure 21C:
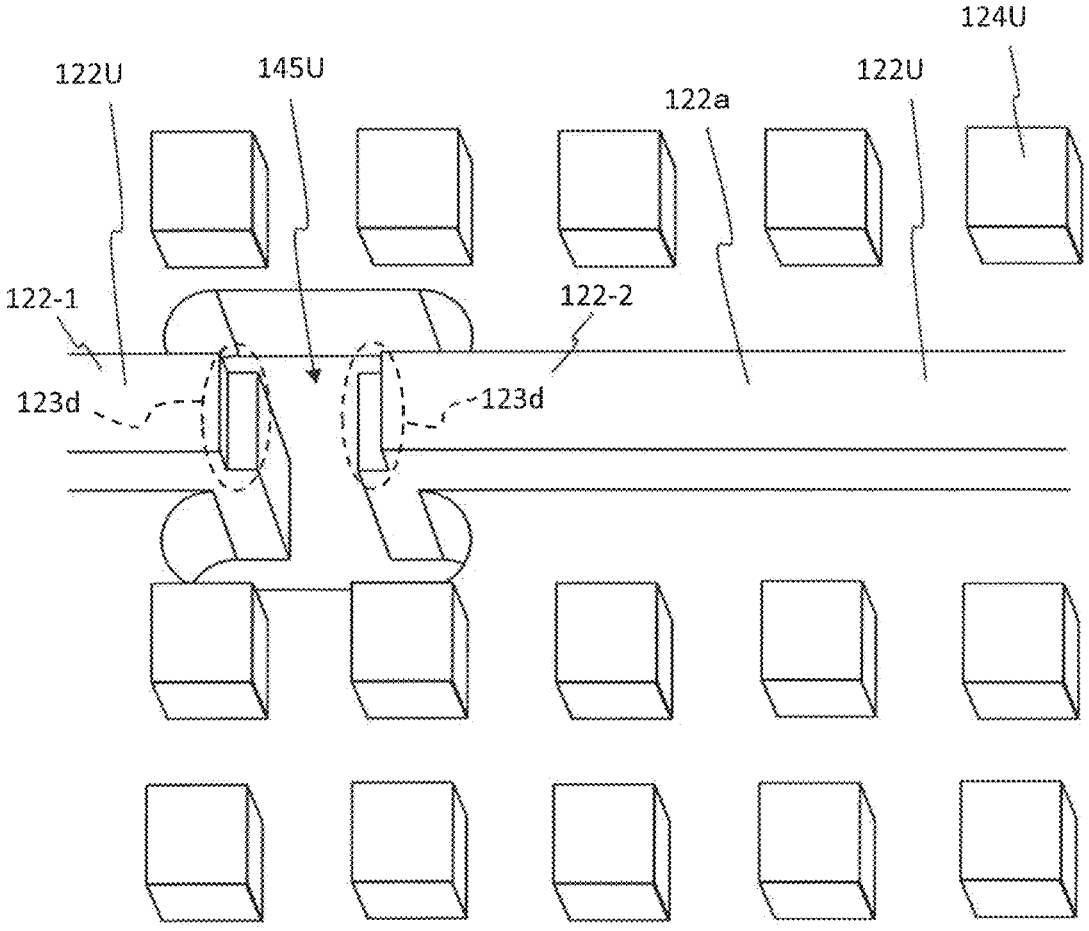
FIG. 21C is a diagram showing still another example of an impedance matching structure at the port 145U.

In the example shown in FIG. 21C, one end of the first portion 122-1 of the first waveguide member 122U and one end of the second portion 122-2 each have a dent 123*d* for suppressing reflection at the port. In this example, the intra-waveguide member gap which is defined by the two opposing end faces at the one end of the first portion 122-1 of the first waveguide member 122U and the one end of the second portion 122-2 includes a broad portion which is larger in size than the gap between the portion of the inner wall that connects to the first portion 122-1 of the waveguide member 122U and the other portion of the inner wall that connects to the second portion 122-2 of the waveguide member 122U.

A structuring include such a bump 123*c* or dent 123*d* may be provided in at least either one of the one end of the first portion 122-1 of the first waveguide member 122U and the one end of the second portion 122-2. Alternatively, either one of a bump 123*c* and a dent 123*d* may be provided at the one end of the first portion 122-1 of the first waveguide member 122U, while the other may be provided at the one end of the second portion 122-2. Alternatively, a bump 123*c* and a dent 123*d* may both be provided at the one end of the first portion 122-1 of the first waveguide member 122U, or a bump 123*c* and a dent 123*d* may both be provided at the one end of the second portion 122-2 of the first waveguide member 122U. Although the examples shown in FIGS. 21A through 21C illustrate only one bump 123*c* or dent 123*d* being provided at each of the one end of the first portion 122-1 of the first waveguide member 122U and the one end of the second portion 122-2, this is not a limitation. A plurality of bumps 123*c* or dents 123*d* may be provided in a staircase shape at each of the one end of the first portion 122-1 and the one end of the second portion 122-2. By appropriately providing a plurality of bumps 123*c* or dents 123*d*, reflection of signal waves can be suppressed more effectively.

The impedance matching structure 123 shown in FIG. 18 may be combined with any of the structures of FIGS. 21A through 21C.

Figure 22A:
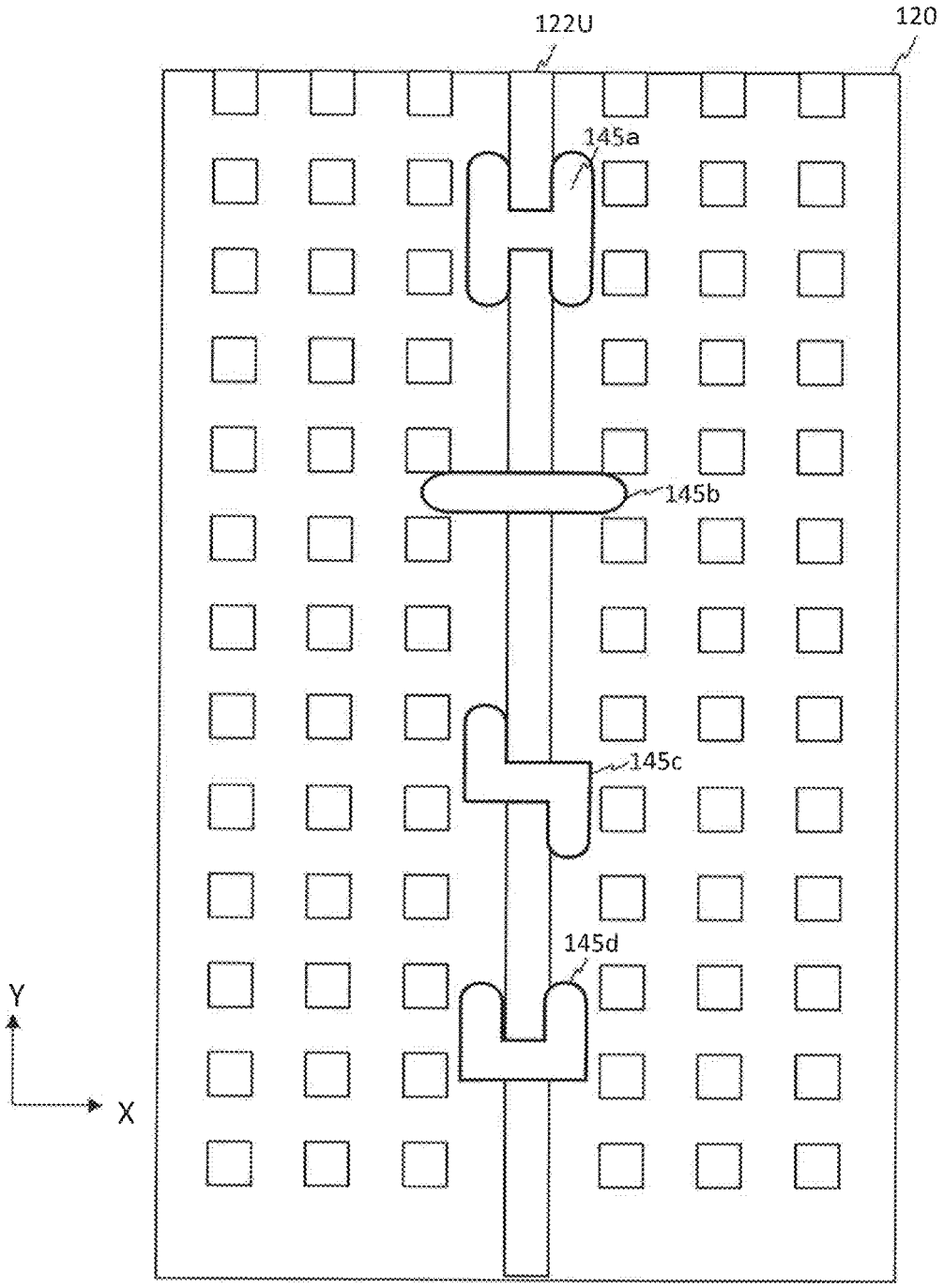
FIG. 22A is a plan view showing an exemplary shape of the port 145U.

FIG. 22A is a plan view showing an exemplary shape of the port 145U. An H-shaped port 145*a*, an I-shaped port 145*b*, a Z-shaped port 145*c*, and a C-shaped port 145*d* are shown in the figure. As is clear from the figure, the I-shaped port 145*b* has the largest size along the x axis direction. The H-shaped port 145*a* is symmetric with respect to the x axis, while the Z-shaped port 145*c* and the C-shaped port 145*d* are asymmetric with respect to the x axis. In the array antenna device according to the present embodiment, the H-shape port 145*a* is suitably used, although the other shapes are not excluded.

The various shapes of the port 145U shown in FIG. 22A may be adopted also for the slots 112. Each slot 112 may have a shape other than the rectangular shape (I-shape) shown in FIG. 13A, e.g., an H-shape.

Hereinafter, with reference to FIG. 22B, exemplary cross-sectional shapes of a port or a slot will be described in more detail. In the following description, ports and slots may be collectively referred to as "throughholes". The following variants are possible for any of the ports and slots according to embodiments of the present disclosure.

Figure 22B:
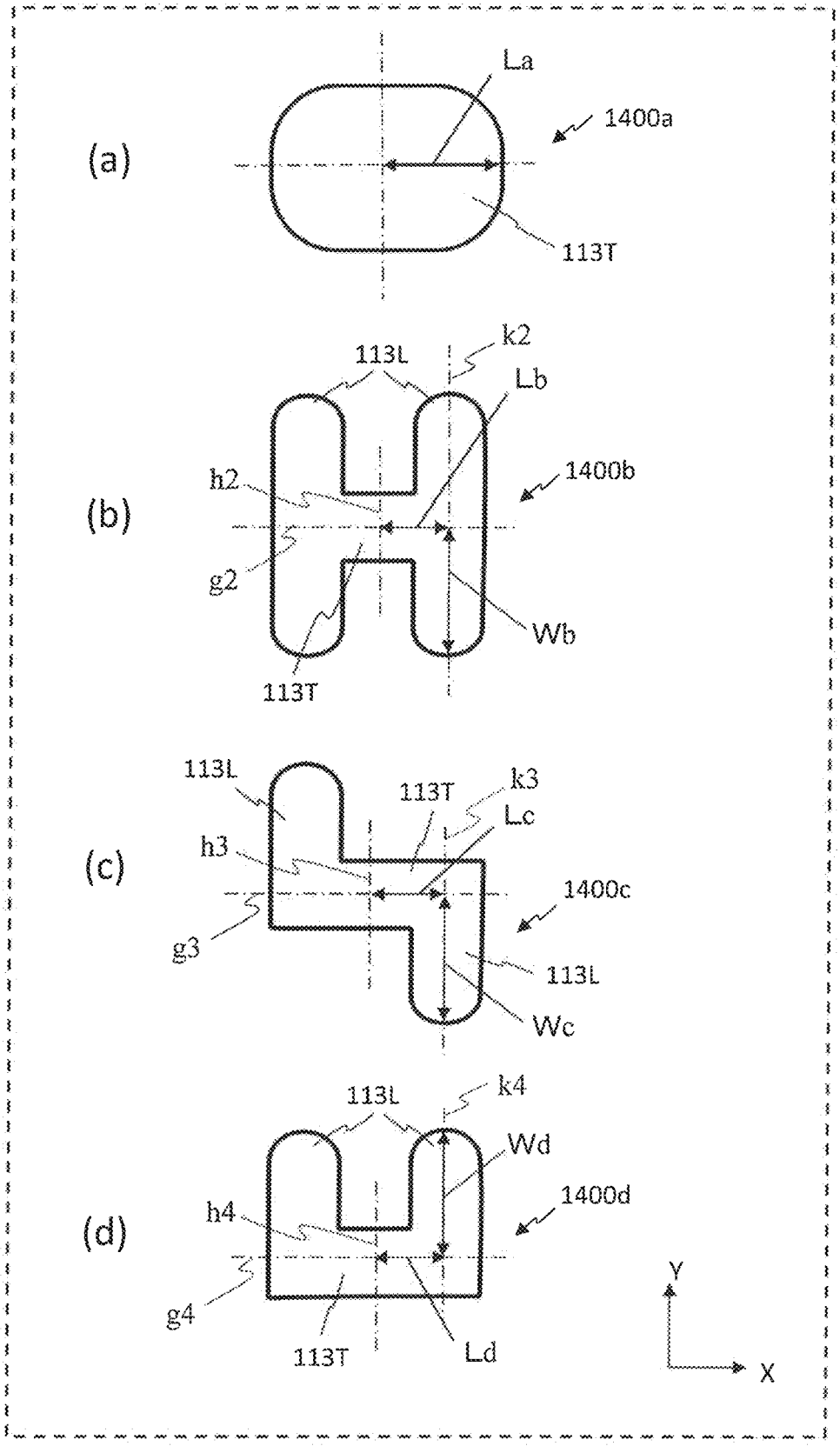
FIG. 22B is a diagram for describing exemplary cross-sectional shapes for ports or slots in more detail.

In FIG. 22B, (a) shows an example of a throughhole 1400*a* having an elliptic shape. The semimajor axis La of the throughhole 1400*a* indicated by arrowheads in the figure is set in order to ensure that higher-mode resonance will not occur and that the impedance will not be too small. More specifically, La may be set so that $\lambda 0/4<L<\lambda 0/2$ (where $\lambda 0$ denotes a free-space wavelength corresponding to the center frequency of the operating frequency band).

FIG. 22(*b*) shows an example of a throughhole 1400*b* having a shape including a pair of vertical portions 113L and a lateral portion 113T interconnecting the pair of vertical portions 113L (referred to as an "H-shape" in the present specification). The lateral portion 113T is substantially perpendicular to the pair of vertical portions 113L, and connects substantial centers of the pair of vertical portions 113L. In the case of such an H-shape throughhole 1400*b*, too, its shape and size are to be determined so that higher-mode resonance will not occur and that the impedance will not be too small. Now, assume a distance Lb from an intersection between a center line g2 of the lateral portion 113T and a center line h2 (which is perpendicular to the lateral portion 113T) of the entire H-shape to an intersection between the center line g2 and a center line k2 of the vertical portion 113L. Also assume a distance Wb from an intersection between the center line g2 and the center line k2 to an end of the vertical portion 113L. Then, the sum of Lb and Wb is set so that $\lambda 0/4<Lb+Wb<\lambda 0/2$. By making the distance Wb relatively long, the distance Lb can be made relatively short. As a result, the width of the H-shape along the X direction can be made e.g. less than $\lambda 0/2$, whereby the slot interval along the length direction of the lateral portion 113T can be reduced.

FIG. 22(*c*) shows an example of a throughhole 1400*c* including a lateral portion 113T and a pair of vertical portions 113L extending from both ends of the lateral portion 113T. The directions in which the pair of vertical portions 113L extend from the lateral portion 113T are substantially perpendicular to the lateral portion 113T, and are opposite to each other. Also in this example, assume a distance Lc from an intersection between a center line g3 of the lateral portion 113T and a center line h3 (which is perpendicular to the lateral portion 113T) of the entire shape to an intersection between the center line g3 and a center line k3 of the vertical portion 113L. Also assume a distance Wc from an intersection between the center line g3 and the center line k3 to an end of the vertical portion 113L. Then, the sum of Lb and Wb is set so that $\lambda 0/4<Lc+Wc<\lambda 0/2$. By making the distance Wc relatively long, the distance Lc can be made relatively short. As a result, the width of the entire shape in FIG. 22(*c*) along the X direction can be made e.g. less than $\lambda 0/2$, whereby the slot interval along the length direction of the lateral portion 113T can be reduced.

FIG. 22(*d*) shows an example of a throughhole 1400*d* including a lateral portion 113T and a pair of vertical portions 113L extending from both ends of the lateral portion 113T in the same perpendicular direction to the lateral portion 113T. Such a shape may be referred to as a "U-shape" in the present specification. Note that the shape shown in FIG. 22(*d*) may be regarded as an upper half shape of an H-shape. In this example, too, assume a distance Ld from an intersection between a center line g4 of the lateral portion 113T and a center line h4 (which is perpendicular to the lateral portion 113T) of the entire U-shape to an intersection between the center line g4 and a center line k4 of the vertical portion 113L. Also assume a distance Wd to an intersection between the center line g4 and the center line k4 to an end of the vertical portion 113L. Then, the sum of Lb and Wb is set so that $\lambda 0/4<Ld+Wd<\lambda 0/2$. By making the distance Wd relatively long, the distance Ld can be made relatively short. As a result, the width of the U-shape along the X direction can be made e.g. less than $\lambda 0/2$, whereby the slot interval along the length direction of the lateral portion 113T can be reduced.

Embodiment 2

In the present embodiment, by using horns with asymmetric shapes, the distance between the centers of the openings of the two adjacent horns (i.e., the distance between their phase centers) can be made shorter or longer than the distance between the centers of two adjacent slots. For example, in a direction along a waveguide member, the distance between the centers of slots is about $\lambda r$, but the distance between the centers of horn openings can be made shorter than $\lambda 0$. This permits freer positioning of constituent elements.

It has conventionally common practice that, in an antenna array including a plurality of horn antennas, all horns be oriented in the same direction, as is disclosed in e.g. Patent Document 1. It has also been common practice that the horns composing an array all have an identical shape. In such a construction, the interval between horn openings is equal to the interval between slots as taken at the bottoms of the horns. When a waveguide for supplying or receiving a signal wave is connected at the bottom of each horn, the interval between such connections is also equal to the interval between horn openings. Thus, the conventional construction has imposed constraints on the positioning of horn openings and waveguides.

In the present embodiment, at least one horn among a plurality of horns disposed side-by-side in one row has a shape which is asymmetric with respect to a plane that is perpendicular to both of the aperture plane of the horn and the E plane. This ensures that the distance between the centers of the openings of two adjacent horns is different from the distance between the centers of two slots communicating with these horns. This allows the positioning of horn openings and waveguides to be more freely designed.

Without being limited to a waffle iron ridge waveguide (WRG) as has been described above, each waveguide according to the present embodiment may alternatively be a hollow waveguide. Hereinafter, examples of using WRGs will be described first, followed by examples of using hollow waveguides.

Figure 23A:
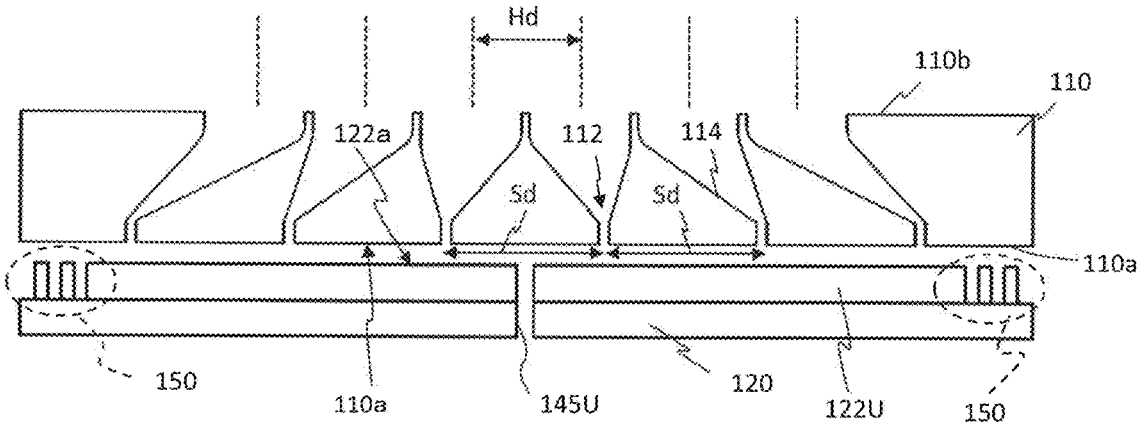
FIG. 23A is a cross-sectional view schematically showing a fundamental construction for an array antenna device according to the present embodiment.
Figure 23B:
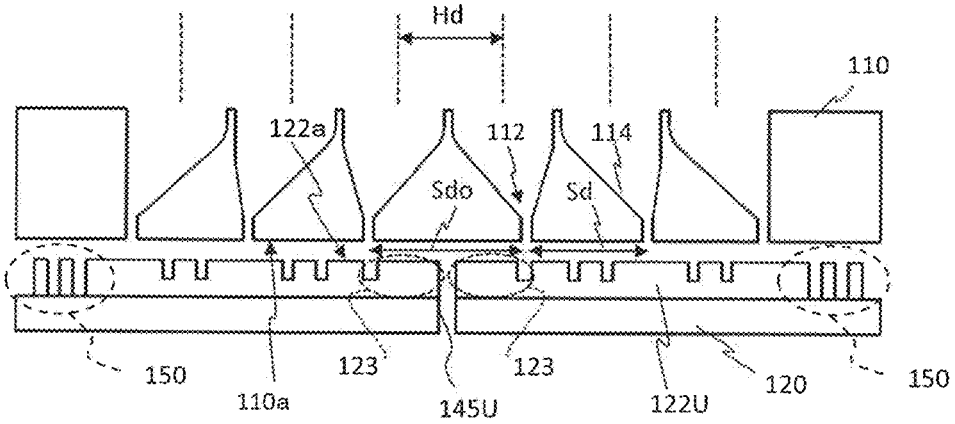
FIG. 23B is a cross-sectional view schematically showing another exemplary fundamental construction for an array antenna device according to the present embodiment.
Figure 23C:
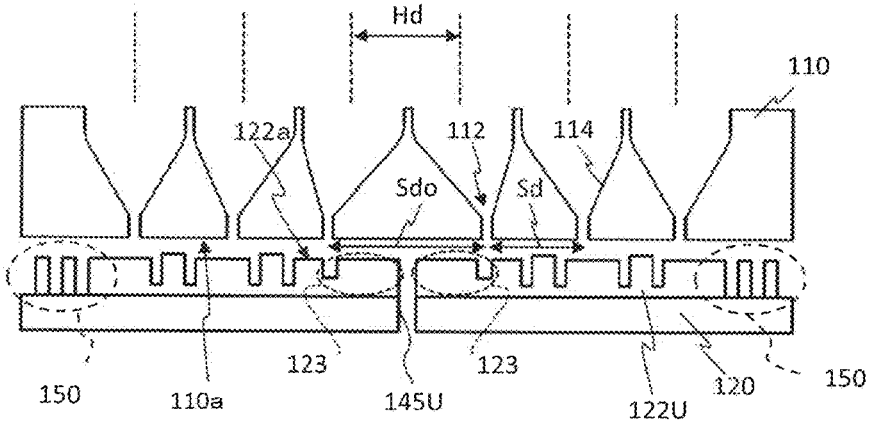
FIG. 23C is a cross-sectional view schematically showing still another exemplary fundamental construction for an array antenna device according to the present embodiment.

FIGS. 23A, 23B and 23C are cross-sectional views each schematically showing an exemplary construction for an array antenna device (which may also be referred to as an "antenna array" in the present specification) according to the present embodiment. Each array antenna device includes a plurality of horns 114 forming a row along one direction. A slot opens at the bottom of each horn.

The antenna array according to the present embodiment includes a conductive member 110 having a first conductive surface 110*b* on the front side and a second conductive surface 110*a* on the rear side. The conductive member 110 has a plurality of slots 112 forming a row along a first direction. The first conductive surface 110*b* of the conductive member 110 is shaped so as to define a plurality of horns 114 respectively communicating with the plurality of slots 112. The respective E planes of the plurality of slots 112 are on the same plane, or on a plurality of planes which are substantially parallel to one another. Herein, "a plurality of planes which are substantially parallel to one another" are not meant to be planes which are strictly parallel to one another. In the present disclosure, any number of planes which constitute angles within $\pm\pi/32$ with one another are regarded as substantially parallel. This condition may also be expressed as ±5.63 degrees. A plurality of planes which are substantially parallel to one another may also be expressed as "a plurality of planes in uniform orientation". In the examples from FIGS. 23A through 23C, the E planes of all of the slots 112 are on the same plane. The E plane of a slot 112, which is a plane containing electric-field vectors that are created in the central portion of the slot 112, passes through the center of the slot 112 and is substantially perpendicular to the second conductive surface 110*a*. FIGS. 23A through 23C each show a cross section where each antenna array is cut along the E plane (which may be referred to as an "E-plane cross section" in the present specification).

In the present embodiment, in an E-plane cross section of at least one horn among the plurality of horns 114, a length from one of two intersections between the E plane and the edge of the slot communicating with that horn to one of two intersections between the E plane and the edge of the aperture plane of that horn, this length extending along the inner wall surface of the horn, is longer than a length from the other intersection between the E plane and the edge of the slot to the other intersection between the E plane and the edge of the aperture plane of the horn, this length also extending also along the inner wall surface. In other words, the inner wall surface of the horn has a shape which is asymmetric with respect to a plane that passes through the center of the slot and is perpendicular to the aperture plane and to the E plane.

On the other hand, another horn that is adjacent to the aforementioned horn has an asymmetric or symmetric shape which is different from that of the aforementioned horn. In one example, the center of the opening of one of the two adjacent horns is shifted in the first direction from the slot center, whereas the center of the opening of the other horn is shifted in the opposite direction of the first direction from the slot center. Therefore, regarding these two adjacent horns, an axis that passes through the center of one slot and through the center of the aperture plane of one horn is different from, and not parallel to, an axis that passes through the center of the other slot and through the center of the aperture plane of the other horn. With this structure, it is ensured that the distance between the centers of two adjacent slots is different from the distance between the centers of the openings of the two horns respectively communicating with these slots.

The interval between slots is constrained by the wavelength of an electromagnetic wave propagating in the waveguide. Conventional horn structures have required that the interval between the center of the openings of horns be equal to the interval between the centers of slots. According to the present embodiment, this constraint can be eliminated, thereby permitting freer positioning of constituent elements.

In the example of FIG. 23A, no rises and falls are provided on the first waveguide member 122U, and the central wavelength of a signal wave propagating in the waveguide thereabove is $\lambda r$. The distance Sd between the centers of any two adjacent slots 112 is set to $\lambda r$. The distance Hd between the centers of the openings of any two adjacent horns 114 is smaller than the distance Sd between the centers of any two adjacent slots 112.

In the example of FIG. 23B, rises and falls are provided on the first waveguide member 122U for the purpose of wavelength reduction, and the aforementioned impedance matching structures 123 are provided at portions connecting to the port 145U. The rises and falls introduced for wavelength reduction purposes allow the central wavelength λg of a signal wave propagating in the waveguide with rises and falls to be reduced from λr. The distance Sd between the centers of two adjacent slots 112 is equal to the central wavelength λg of a signal wave propagating in the waveguide with rises and falls. While the distance Sdo between the centers of the pair of slots 112 that are the closest to the port 145U is maintained at about λr, the distance Sd between the centers of any other two adjacent slots 112 is made shorter than λr.

In the example of FIG. 23C, the effects of the rises and falls introduced for wavelength reduction purposes are enhanced in order to further reduce the central wavelength of a signal wave propagating in the waveguide from that in the example of FIG. 23B. In this example, too, the distance Sd between the centers of two adjacent slots 112 is equal to the central wavelength λg of a signal wave propagating in the waveguide with rises and falls. However, the distance Sdo between the centers of the pair of slots 112 that are the closest to the port 145U is maintained at about λr.

Hereinafter, with reference to FIGS. 24 through 28, an exemplary construction of an array antenna device according to the present embodiment will be described in more detail.

Figure 24:
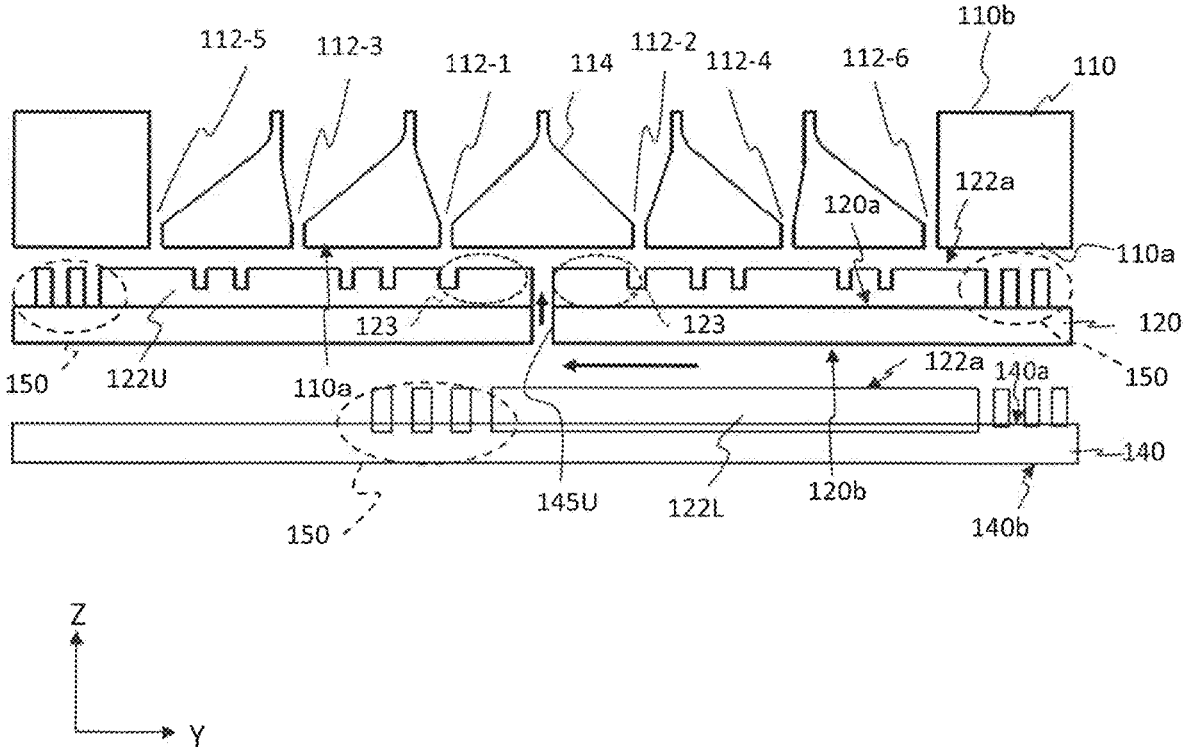
FIG. 24 is a diagram schematically showing a cross section of an array antenna device according to the present embodiment.

FIG. 24 is a diagram schematically showing a cross section of an array antenna device according to the present embodiment. One difference from the array antenna device according to the first embodiment having been described with reference to FIG. 16 is the different shape of the first conductive member 110, or specifically, the different shapes of the horns 114.

Figure 25:
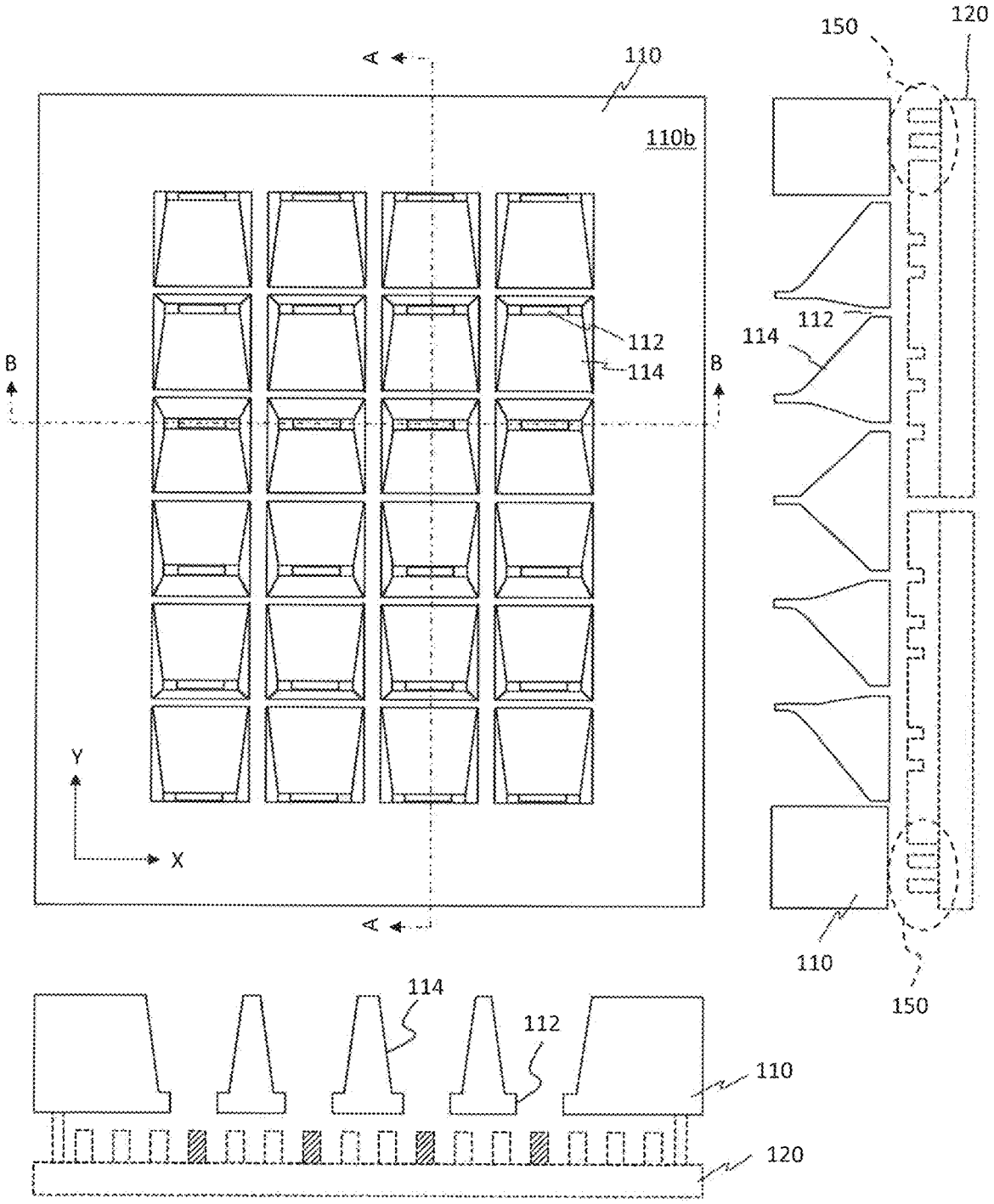
FIG. 25 is a diagram showing a planar shape of a first conductive surface 110*b* which is provided on the front side of a first conductive member 110 in the array antenna device of FIG. 24, as well as cross sections of the first conductive member 110 taken along line A-A and along line B-B.

FIG. 25 shows a planar shape of a first conductive surface 110*b* which is provided on the front side of the first conductive member 110 in the array antenna device of FIG. 24, as well as cross sections of the first conductive member 110 taken along line A-A and along line B-B. For reference sake, the shape of the second conductive member 120 is also indicated by broken lines.

Figure 26:
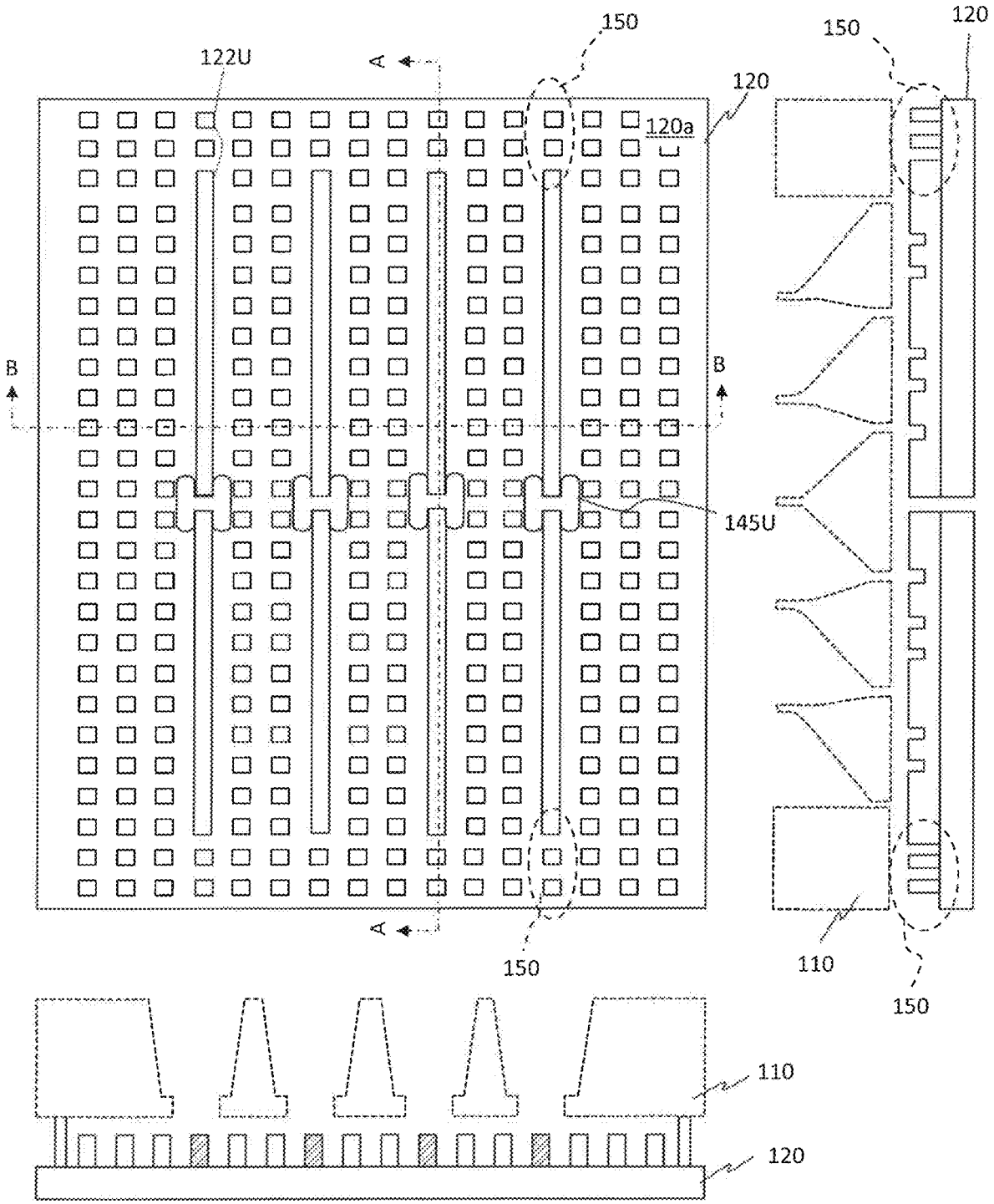
FIG. 26 is a diagram showing a planar shape of a third conductive surface 120*a* which is provided on the front side of the second conductive member 120 in the array antenna device of FIG. 24, as well as cross sections of the second conductive member 120 taken along line A-A and along line B-B.

FIG. 26 shows a planar shape of a third conductive surface 120*a* which is provided on the front side of the second conductive member 120 in the array antenna device of FIG. 24, as well as cross sections of the second conductive member 120 taken along line B-B and along line A-A. For reference sake, the shape of the first conductive member 110 is also indicated by broken lines.

As can be seen from these figures, in the array antenna device according to the present embodiment, all of the slots 112 are at symmetric positions with respect to the port 145U. Moreover, the first conductive surface 110*b* of the first conductive member 110 is shaped so as to define a plurality of horns 114 each communicating with the respectively corresponding slot 112. As shown in FIG. 24, among the plurality of horns 114, the distance between the centers of the openings of two adjacent horns 114 is shorter than the distance from the center of the first slot 112-1 to the center of the second slot 112-2 in the second conductive surface 110*a*.

Each of the plurality of horns 114 has a shape which is asymmetric with respect to a plane which passes through the center of the slot 112 and is orthogonal (e.g., parallel to the XZ plane in the example of FIG. 24) to both of the second conductive surface 110*a* and the waveguide. Being "orthogonal to a waveguide" means being orthogonal to the direction that the waveguide extends (i.e., the Y direction along which the waveguide member 122U extend). In each horn 114 of this asymmetric shape, a line which passes through the center of the slot 112 at the bottom and through the center of the opening of the horn is not orthogonal to the second conductive surface 110*a*. Rather, each such line is inclined so as to become closer to the port 145U away from the center of the slot 112 (i.e., toward the front surface), this line inclination being increasingly greater for horns 114 that are more distant from the port 145U.

In the present embodiment, in FIG. 24, in the region which is to the left of the first slot 112-1 and to the right of the second slot 112-2, the distance from the second conductive surface 110*a* to the waveguide face 112*a* varies along the waveguide, whereby the wavelength (as taken within the waveguide) of a signal wave propagating in the waveguide is reduced from λr into λg. On the second conductive surface 110*a*, the distance from the center of the first slot 112-1 to the center of the third slot 112-3 is set equal to the wavelength λg.

Figure 27:
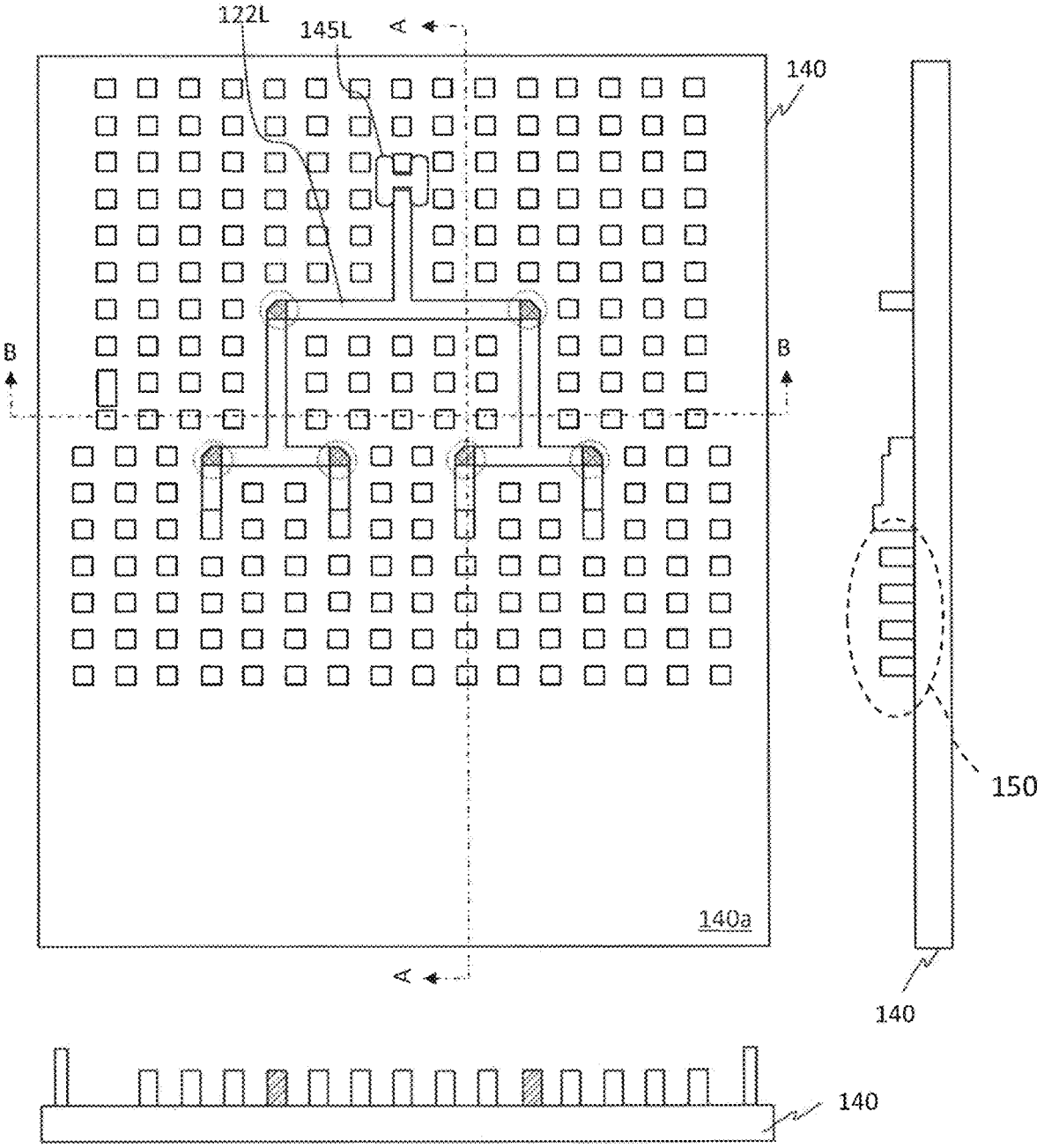
FIG. 27 is a diagram showing a planar shape of a fifth conductive surface 140*a* which is provided on the front side of the third conductive member 140 in the array antenna device of FIG. 24, as well as cross sections of the third conductive member 140 taken along line A-A and along line B-B.

FIG. 27 shows a planar shape of a fifth conductive surface 140*a* which is provided on the front side of the third conductive member 140 in the array antenna device of FIG. 24, as well as cross sections of the third conductive member 140 taken along line A-A and along line B-B. The array antenna of the present embodiment is a transmission antenna to transmit millimeter waves, and the second waveguide member 122L illustrated in FIG. 27 functions as a 4-port divider for exciting the four ports 145U shown in FIG. 26 with an equiphase.

Figure 28:
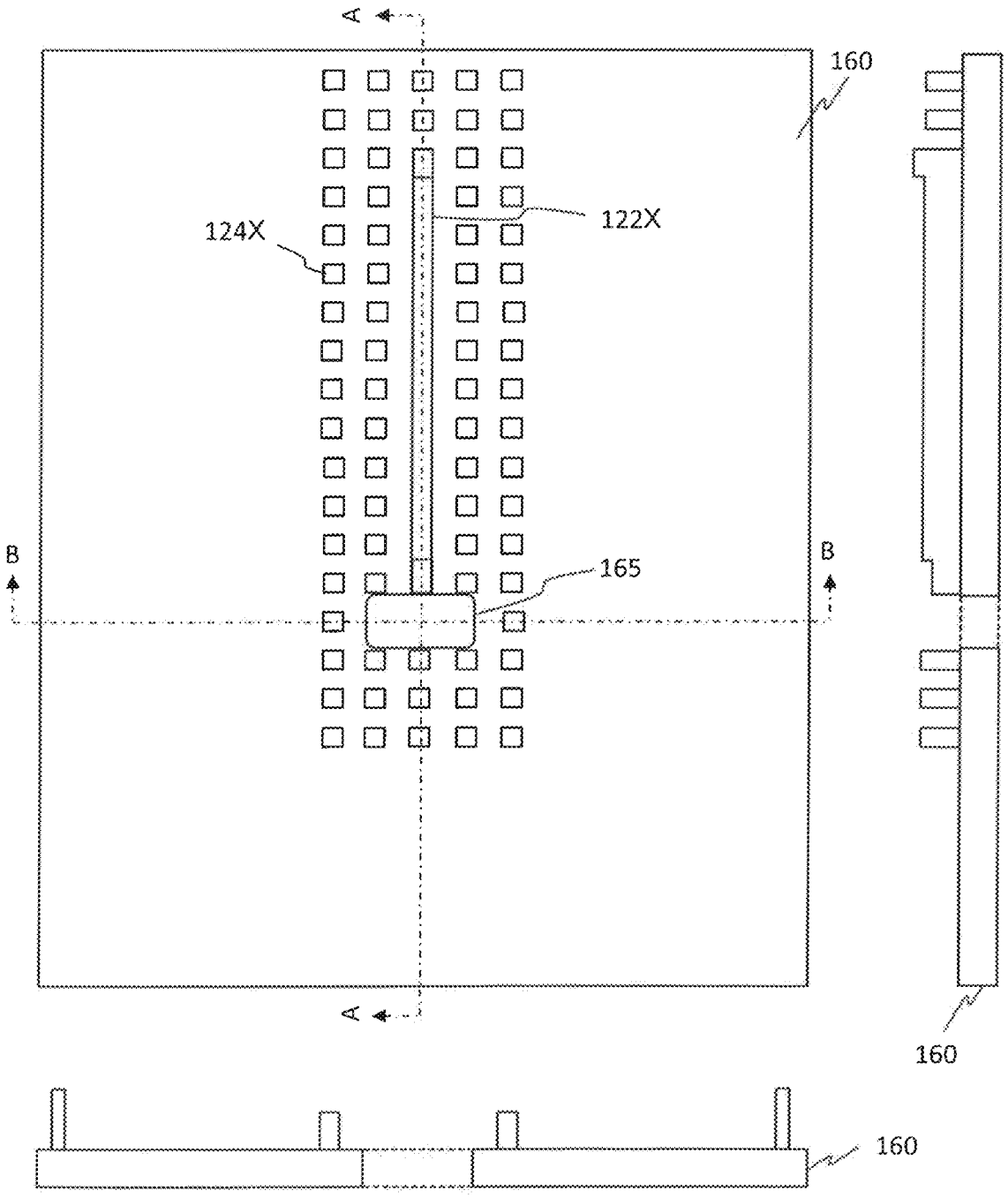
FIG. 28 is a diagram showing an exemplary construction for a fourth conductive member 160.

The waveguide extending between the fourth conductive surface 120*b* of the second conductive member 120 and the waveguide face 122*a* of the second waveguide member 122L couples to a waveguide on the fourth conductive member 160 shown in FIG. 28, via the port 145L in the third conductive member 140, for example. The fourth conductive member 160 illustrated in FIG. 28 supports a third waveguide member 122X and a plurality of electrically conductive rods 124X arrayed on both sides thereof. The plurality of rods 124X constitute an artificial magnetic conductor, and creates a waveguide in the air gap between the waveguide face of the third waveguide member 122X and the sixth conductive surface 140*b* of the third conductive member 140.

In the example of FIG. 27, a dent is formed in each bend (i.e., a portion surrounded by a dotted circle in FIG. 27) of the second waveguide member 122L. Such dents are provided in order to suppress unwanted reflection of a signal wave at each bend. Such a dent may or may not be provided in each bend as necessary.

The structural details of the second waveguide member 122L functioning as a 4-port divider, the port 145L, and a rectangular hollow-waveguide 165 will be described later.

Variant 1 of Embodiment 2

Figure 29:
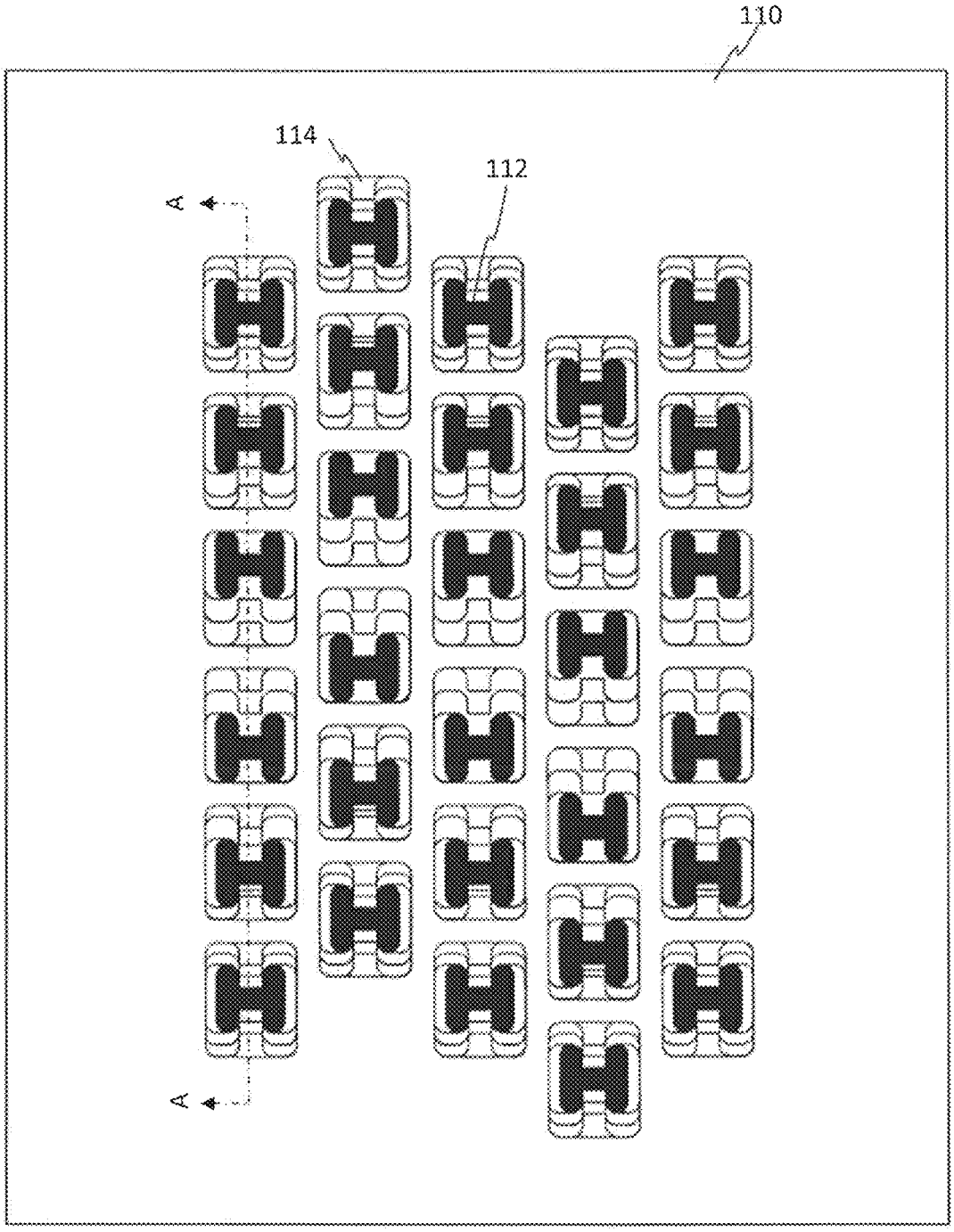
FIG. 29 is a plan view showing the shape of the front side of the first conductive member 110 according to a variant of the array antenna device of Embodiment 2.
Figure 30:
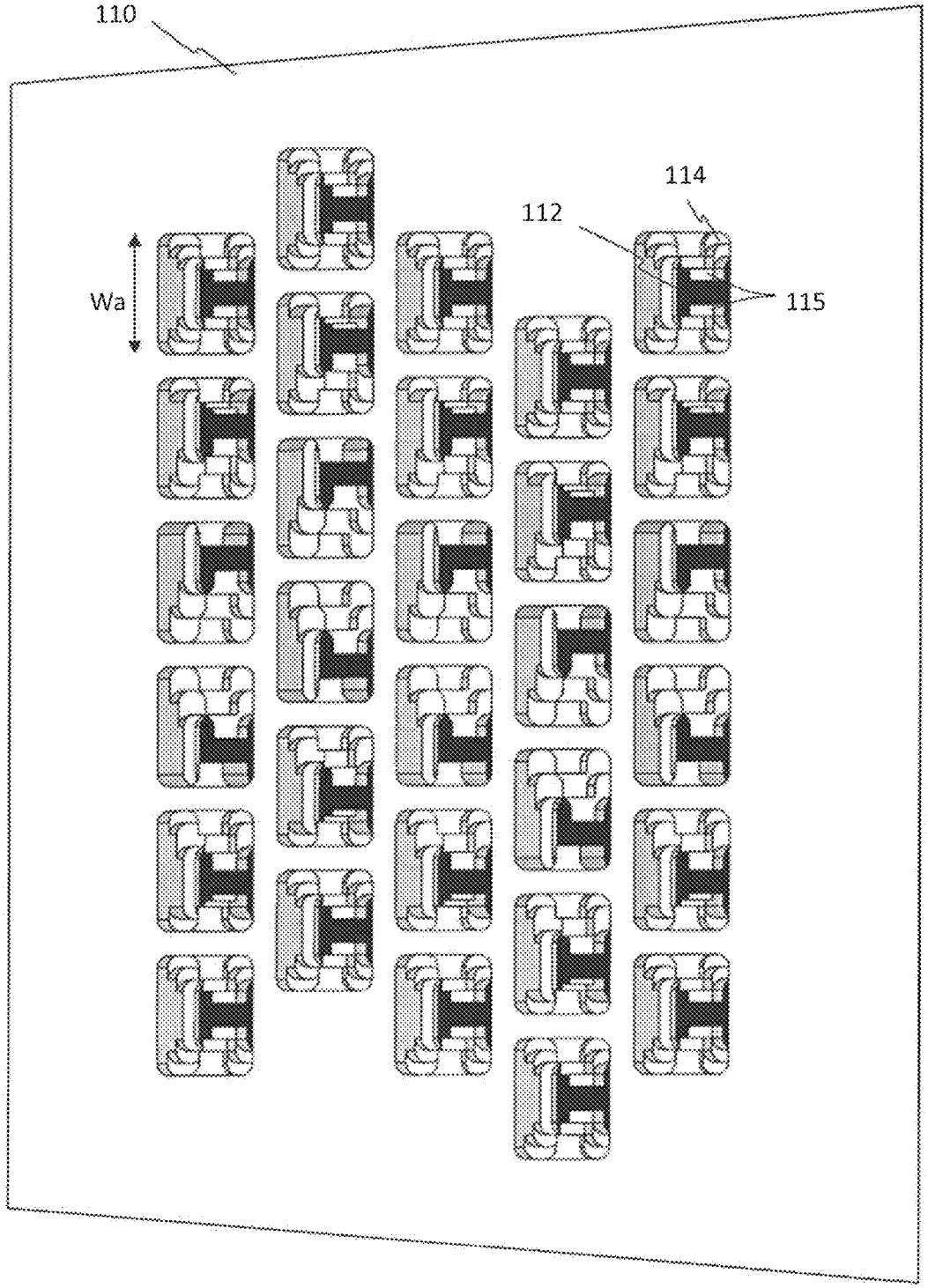
FIG. 30 is a perspective view showing the shape of the front side of the first conductive member 110.
Figure 31:
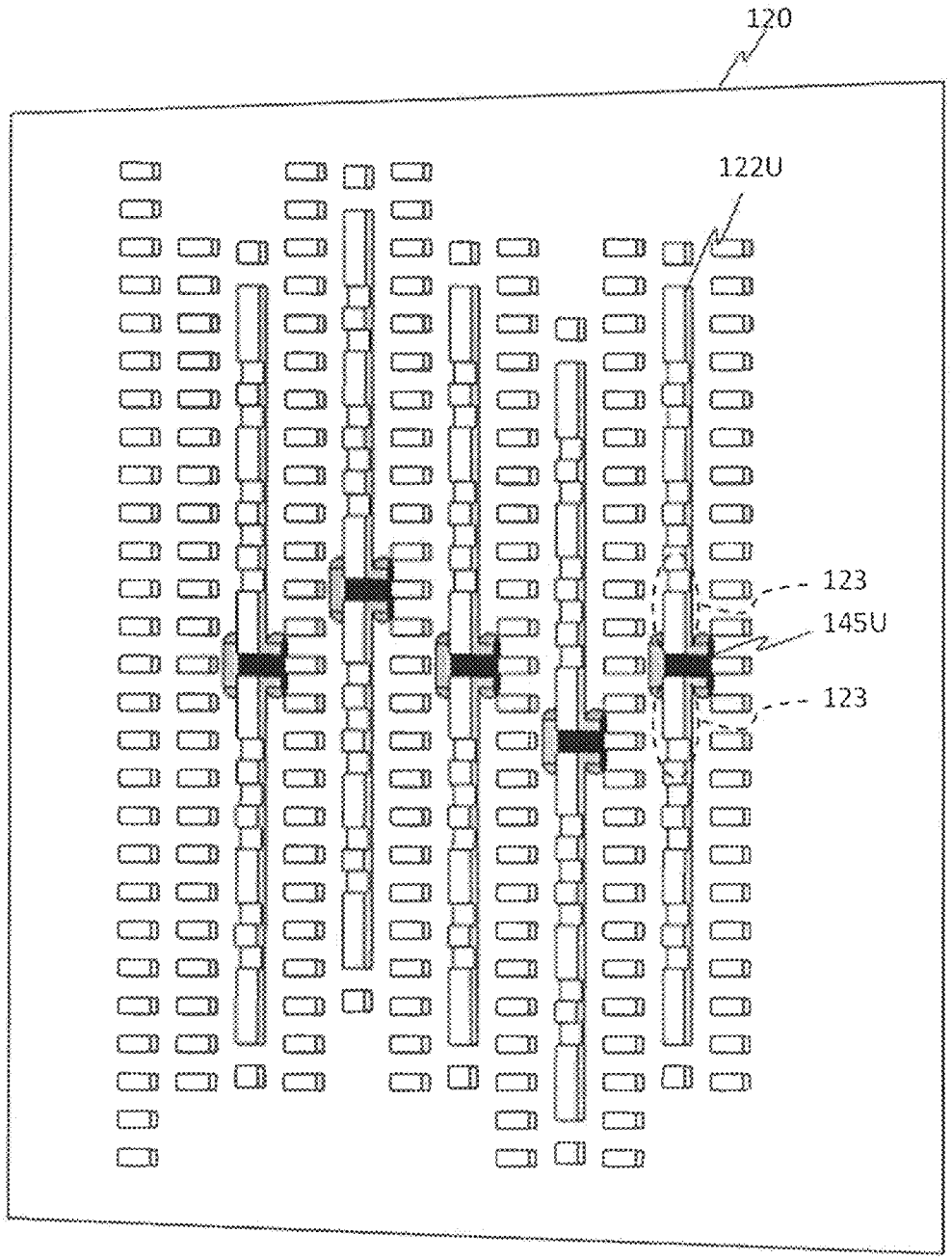
FIG. 31 is a perspective view showing the shape of the front side of the second conductive member 120 according to a variant.

FIG. 29 is a plan view showing the shape of the front side of the first conductive member 110 according to a variant of the array antenna device of Embodiment 2. FIG. 30 is a perspective view showing the shape of the front side of the first conductive member 110. FIG. 31 is a perspective view showing the shape of the front side of the second conductive member 120 according to this variant.

In this variant, as shown in FIG. 29 and FIG. 30, each horn 114 is composed of stepped wall surfaces. Each of the five rows of horn arrays includes six horns 114 disposed side-by-side in one row. A signal wave which has impinged on the six horns 114 in each row passes through the slot 112 communicating with each horn 114 to propagate on the waveguide member 122U shown in FIG. 31, and further passes through a port 145U so as to be input to a waveguide (not shown) on the rear side. Although the waveguide member 122U in FIG. 31 is shown to have the impedance matching structures 123 (described with reference to the first embodiment) provided thereon, such impedance matching structures 123 may not be provided.

In this variant, the even-numbered rows of horns 114 are shifted with respect to the odd-numbered rows of horns 114, along the direction that the waveguide members 122U extend. The amount of shift is about a half of the distance between the centers of the openings of two adjacent horns 114 along the direction that the waveguide members extend. Adopting such a staggered arrangement allows the direction of arrival of a reception wave to be detected not only with respect to the horizontal direction, but also with respect to the vertical direction.

In this variant, too, the plurality of slots 112 are at symmetric positions with respect to the port 145U. In each row, the distance between the centers of the openings of two adjacent horns is set shorter than the distance between the centers of the pair of slots that are the closest to the port 145U. Among the plurality of horns 114, any horn other than those which are at both ends of each row has a shape which is asymmetric with respect to a plane that passes through the center of the slot 112 and is orthogonal to the direction that the waveguide extends. In this variant, the two horns 114 at both ends of each horn row have shapes which are symmetric with respect to the aforementioned plane, and a line passing through the center of the respective slot 112 at the bottom and the center of the opening of the horn is substantially orthogonal to the second conductive surface 110*a*. Regarding the other four horns 114, the line passing through the center of the slot 112 at the bottom of the horn 114 and the center of the opening of the horn becomes closer to the port 145U away from the center of the slot 112 (i.e., toward the front surface). Among these four horns 114, the inclination of the aforementioned line is increasingly smaller for horns 114 that are more distant from the port 145U.

Figure 32A:
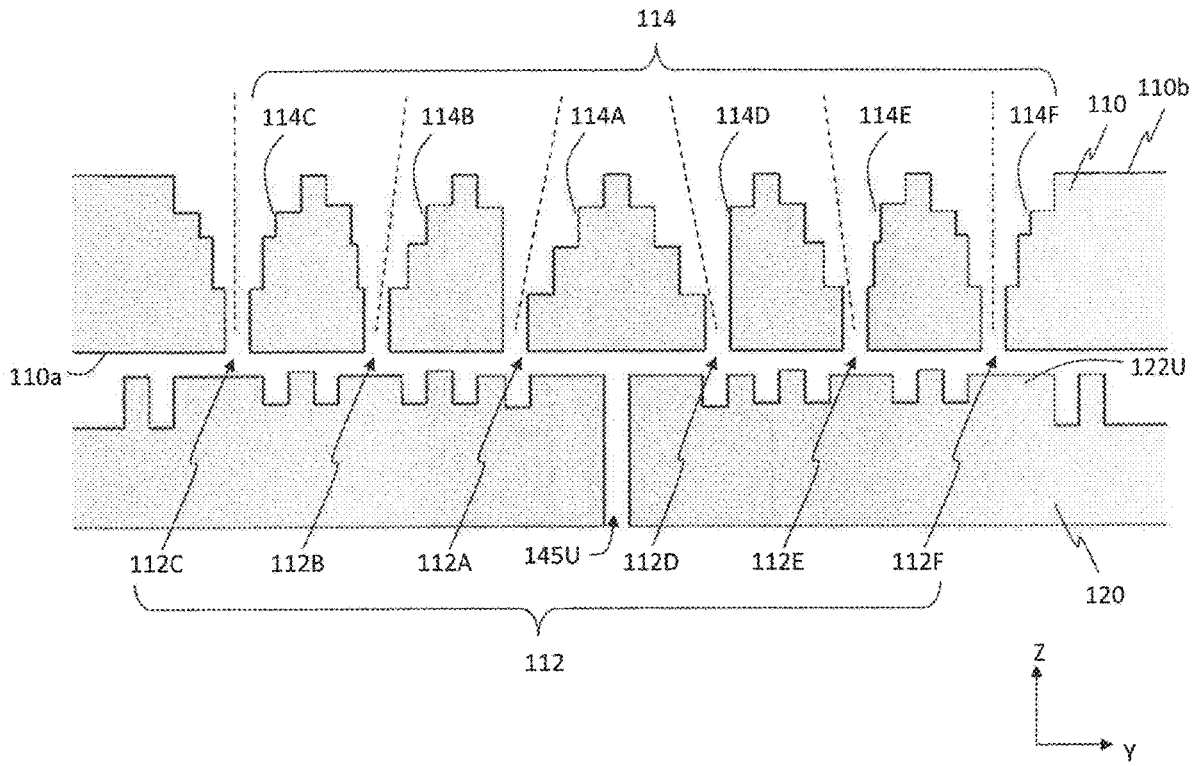
FIG. 32A is a diagram showing the structure of a cross section (an E-plane cross section) taken along line A-A in FIG. 29.

FIG. 32A is a diagram showing the structure of a cross section (an E-plane cross section) taken along line A-A in FIG. 29. In this example, among the six horns 114 in each row, the three horns which are on the −Y side of the port 145U will be denoted as the first horn 114A, the second horn 114B, and the third horn 114C, these being increasingly farther away from the port 145U in this order. Similarly, the three horns on the +Y side of the port 145U will be denoted as the fourth horn 114D, the fifth horn 114E, and the sixth horn 114F, these being increasingly farther away from the port 145U in this order. The first to sixth horns 114A, 114B, 114C, 114D, 114E and 114F communicate respectively with the first to sixth slots 112A, 112B, 112C, 112D, 112E and 112F. Each of the third horn 114C and the sixth horn 114F located at both ends of the horn row has a shape which is symmetric with respect to a plane that is perpendicular to both of the E plane and the aperture plane thereof. The other horns 114A, 114B, 114D and 114E each have a shape which is asymmetric with respect to a plane that is perpendicular to both of the E plane and the aperture plane thereof. Each horn has a symmetric shape with respect to its own E plane, which passes through the center of the horn. The stepped inner wall surface of each horn 114 may be regarded as a pyramidal shape by approximation. Therefore, such horns 114 may also be referred to as pyramid horns. Without being limited to a pyramid horn, each horn 114 may be a box horn having an internal cavity which is shaped as a rectangular solid (including a cube), as will be described later.

The fourth to sixth horns 114D, 114E and 114F have shapes obtained by inverting the first to third horns 114A, 114B and 114C, respectively, with respect to a plane which extends through a midpoint between the first horn 114A and the fourth horn 114D and is perpendicular to the E plane thereof. An axis (shown by a broken line in FIG. 32A) that passes through the center of the slot 112 and the center of the aperture plane of the horn 114 (referred to as the "center of the opening" in the present specification) is perpendicular to the second conductive surface 110*a* of the conductive member 110 for the two horns 114C and 114F at both ends, and is increasingly more inclined toward the inside for horns that are closer to the center in the horn row. In other words, the angle constituted by the axis passing through the slot center and the center of the opening of the horn and the normal of the second conductive surface 110*a* is increasingly greater for horns that are closer to the center in the horn row.

Figure 32B:
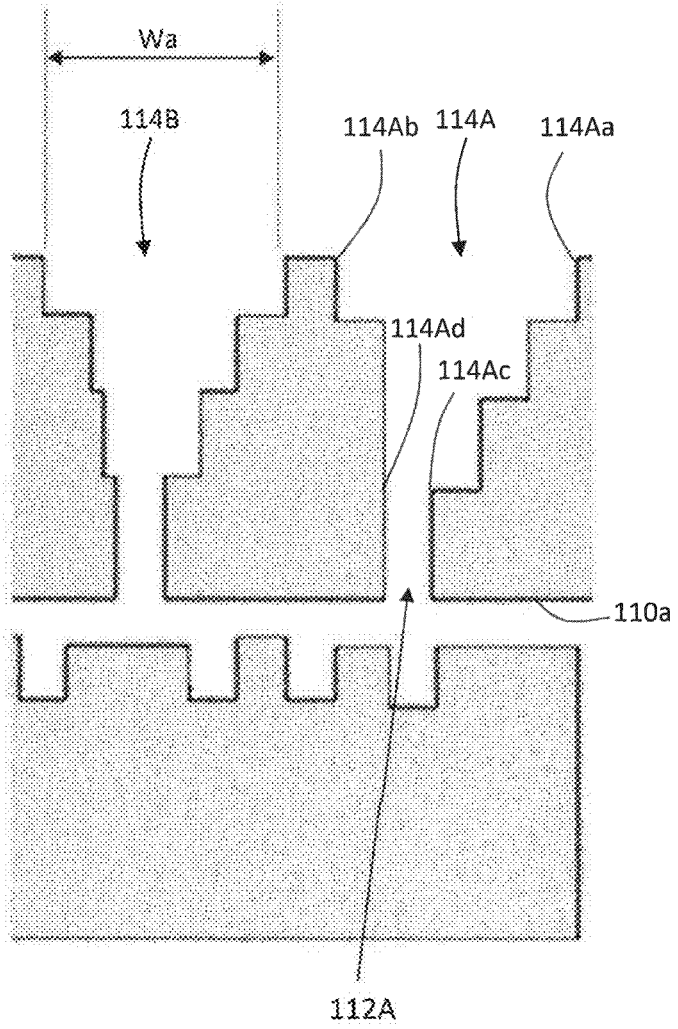
FIG. 32B is a partially enlarged view of the neighborhood of first and second horns 114A and 114B among the plurality of horns 114.

FIG. 32B is a partially enlarged view of the neighborhood of the first and second horns 114A and 114B among the plurality of horns 114. This antenna array is used for at least one of transmission and reception of an electromagnetic wave of the frequency band with a center frequency f0. Let the electromagnetic wave of the center frequency f0 have a free-space wavelength λ0. In an E-plane cross section of the first horn 114A, a difference of not less than λ0/32 and not more than λ0/4, for example, may be set between a length from one (114Ac) of two intersections between the E plane and the edge of the first slot 112A to one of two intersections between the E plane and the edge 114Aa of the aperture plane of the first horn 114A, as taken along the inner wall surface of the first horn 114A, and a length from the other intersection (114Ad) between the E plane and the first slot 112A to the other intersection (114Ab) between the E plane and the aperture plane of the first horn 114A, as taken along the aforementioned inner wall surface. Similar conditions may also be satisfied for the second horn 114B, the fourth horn 114D, and the fifth horn 114E. By stipulating such dimensional ranges, more suitable directivity adjustments can be made. In the example of FIG. 32B, the inner wall surface containing the other intersection (114Ad) between the E plane and the slot 112A is connected with the inner wall surface of the horn 114A, without there being any steps. In such a structure, too, so long as there is a step(s) between the inner wall surface containing the one intersection 114Ac between the E plane and the edge of the slot 112A and the inner wall surface of the horn 114A, the other intersection 114Ad is defined at the position which is equally distant from the second conductive surface 110*a* as the one intersection 114Ac between the E plane and the edge. The width Wa of the aperture plane of each of the plurality of horns 114 according to the present embodiment, as taken along its E plane, may be set to a value which is smaller than λ0, for example. By stipulating the aforementioned conditions concerning the difference between lengths along the inner wall surface of each horn 114 and the width of its aperture plane, it becomes possible to avoid deteriorations in the directivity characteristics of the antenna array, while ensuring freedom in the arrangement of the aperture plane and the bottom of each horn 114. For example, an array has successfully been obtained such that the side lobe intensity is reduced to −20 dBi or less relative to the main lobe intensity, as will be described later.

As can be seen from FIG. 30, as viewed from a direction which is perpendicular to its aperture plane, the inner wall surface of each horn 114 has a pair of projections 115 that protrude toward the central portion of the slot 112 communicating with that horn 114. A plurality of such pairs of projections 115 are provided in a staircase shape. By providing such projections 115, the operable frequency band of the horn 114 can be broadened. Note that the inner wall surface of each horn does not need to be a staircase shape, but may present a continuous slope(s). Similarly, the projections do not need to present a staircase shape, but may be a bump(s) with a continuous surface. Such projections may be provided only in some among the plurality of horns 114. Each horn 114 may have one projection, rather than a pair of projections. So long as a projection is provided on at least one part of the inner wall surface of at least one horn 114, the aforementioned effects can be obtained for that horn 114.

As shown in FIG. 32A, the first conductive surface 110*b* of the first conductive member 110 has a flat face(s) continuing from the edge of the aperture plane of a horn(s) 114 at one end or both ends of the row constituted by the plurality of horns 114. To the inner wall surface of the horn 114C and/or 114F at both ends in the construction of FIG. 32A, the aforementioned flat face of the first conductive surface 110*b* is connected. Because of the flat face existing on one side near the aperture plane, an electromagnetic wave (beam) which is radiated from the horn 114C, 114F will incline toward the flat face. This produces an effect similar to inclining the horn 114C, 114F. By adjusting the position, area, etc., of each such flat face, the directivity of the antenna array can be adjusted.

Figure 32C:
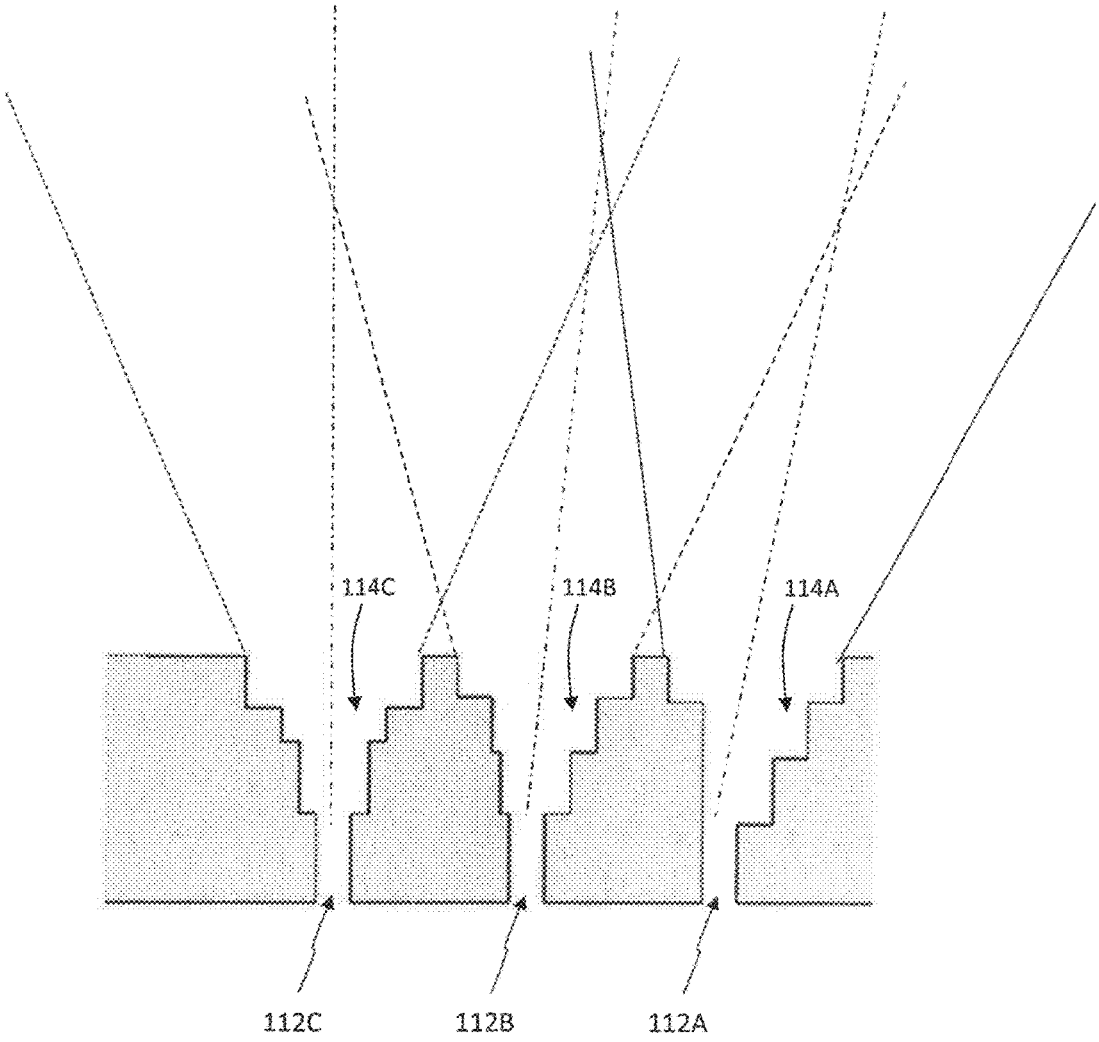
FIG. 32C is a diagram schematically showing the directions of electromagnetic waves which are radiated from three horns 114A, 114B and 114C disposed side-by-side in the present embodiment.

FIG. 32C is a diagram schematically showing the directions of electromagnetic waves which are radiated from three horns 114A, 114B and 114C disposed side-by-side in the present embodiment. In FIG. 32C, two solid lines indicate the expanse of a main lobe of an electromagnetic wave which is radiated from the first horn 114A. Two broken lines indicate the expanse of a main lobe of an electromagnetic wave which is radiated from the second horn 114B. Two dotted lines indicate the expanse of a main lobe of an electromagnetic wave which is radiated from the third horn 114C. Three dot-dash lines indicate the center axes of the respective main lobes.

As shown in FIG. 32C, in the present embodiment, when electromagnetic waves are supplied to the slots 112A, 112B and 112C, the three main lobes that are respectively radiated from the horns 114A, 114B and 114C overlap one another. The center axes of the three main lobes are oriented in respectively different directions. The differences among the directions of the center axes of the three main lobes are smaller than the width of each main lobe. As used herein, the differences among the directions of the center axes of the three main lobes refer to the largest of the angles each taken between any two center axes among the three center axes, in particular. The width of a main lobe means the angle of divergence of the main lobe. The other horns 114D, 114E and 114F not shown in FIG. 32C also have similar radiation characteristics. In the present embodiment, by adjusting the shape of each horn 114, the direction of the main lobe can be adjusted within the bounds of the aforementioned conditions.

The inventors have found that an horn antenna array of such a structure can reduce the influence of side lobes at the time of electromagnetic wave radiation, thus enabling satisfactory radiation. Hereinafter, this effect will be described by taking as an example a construction including a single-row antenna array.

Figure 33A:
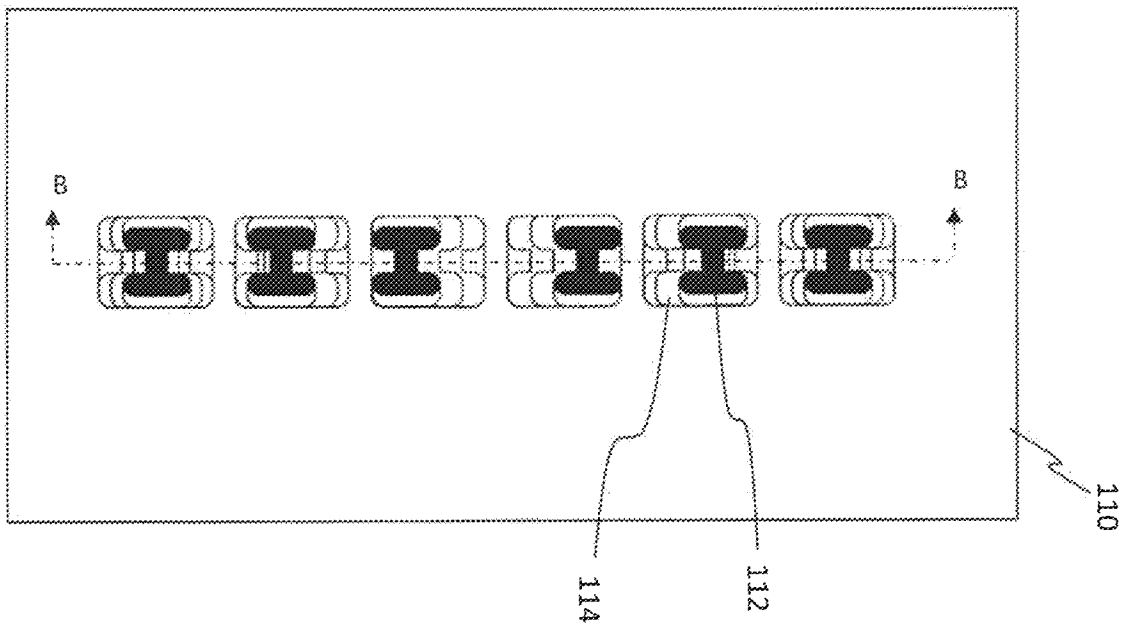
FIG. 33A is a plan view showing an exemplary construction of a single-row antenna array.

FIG. 33A is a plan view showing an exemplary construction of a single-row antenna array. This antenna array construction is identical to the construction of one row in the antenna array shown in FIG. 29. Through simulations, the inventors have calculated an intensity distribution of electromagnetic waves to be radiated from the antenna array shown in FIG. 33A, thus confirming the effects of the present embodiment.

Figure 33B:
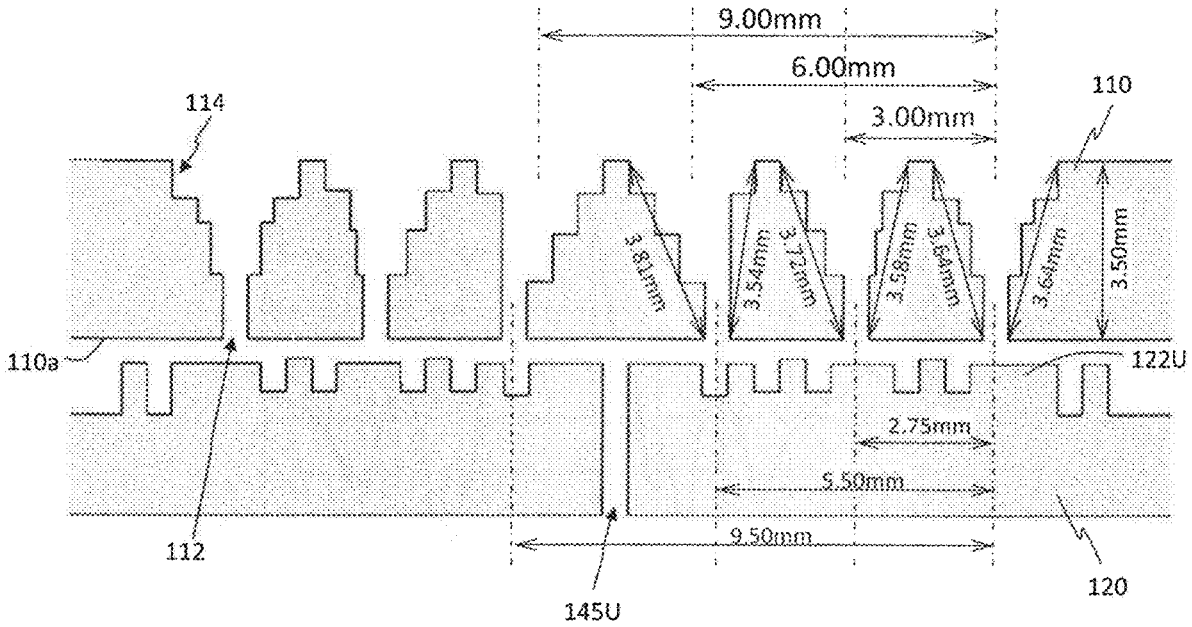
FIG. 33B is a cross-sectional view showing the structure and dimensions of conductive members 110 and 120 used in a simulation.

FIG. 33B is a cross-sectional view showing the structure and dimensions of conductive members 110 and 120 used in this simulation. The frequency of the electromagnetic wave to be transmitted or received is 76.5 GHz. Feeding is performed from the lower direction in the figure, via the port 145U shown in the center, such that three antenna elements on each of the right and left sides are fed in each instance. The interval between the centers of the slots 112 at the bottoms of two middle horns 114 is 4 mm. The interval between the centers of slots 112 at the bottoms of any other, outer horns is 2.75 mm, i.e., narrower. The distance between the centers of the openings of horns 114 is universally 3 mm. If the height of each radiating element is to be defined as the distance from the lower opening of the slot 112 to the aperture plane of the horn 114, this height is 3.50 mm. An electromagnetic wave having a frequency of 76.5 GHz has a free-space wavelength $\lambda 0$ of 3.92 mm, and thus the height of each radiating element is smaller than the free-space wavelength. Moreover, the distance between the centers of the openings of horns 114 is also smaller than the free-space wavelength. In this example, an interval of 4 mm is ensured between the bottoms of the two middle horns 114, thus elongating the waveguide member 122U in this portion as compared to the other regions. As a result of this, matching in a branching portion where the waveguide splits into the right and the left from the port 145U onwards is improved, such that reflection is reduced.

Figure 33C:
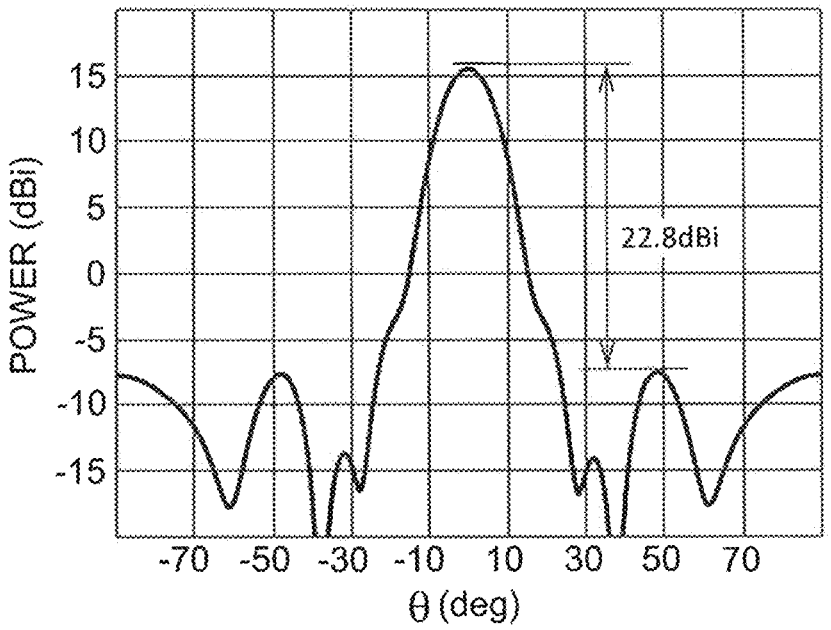
FIG. 33C is a graph showing results of the simulation.

FIG. 33C is a graph showing results of the simulation for this example. The graph of FIG. 33C shows an angular distribution of electric field intensity of the radiated electromagnetic waves. The horizontal axis represents the angle $\theta$ from the frontal direction within the E plane, and the vertical axis represents the electric field intensity (unit: dBi). As shown in the figure, the level of side lobes was lowered by about 22.8 dBi than the level of the main lobe.

Figure 33D:
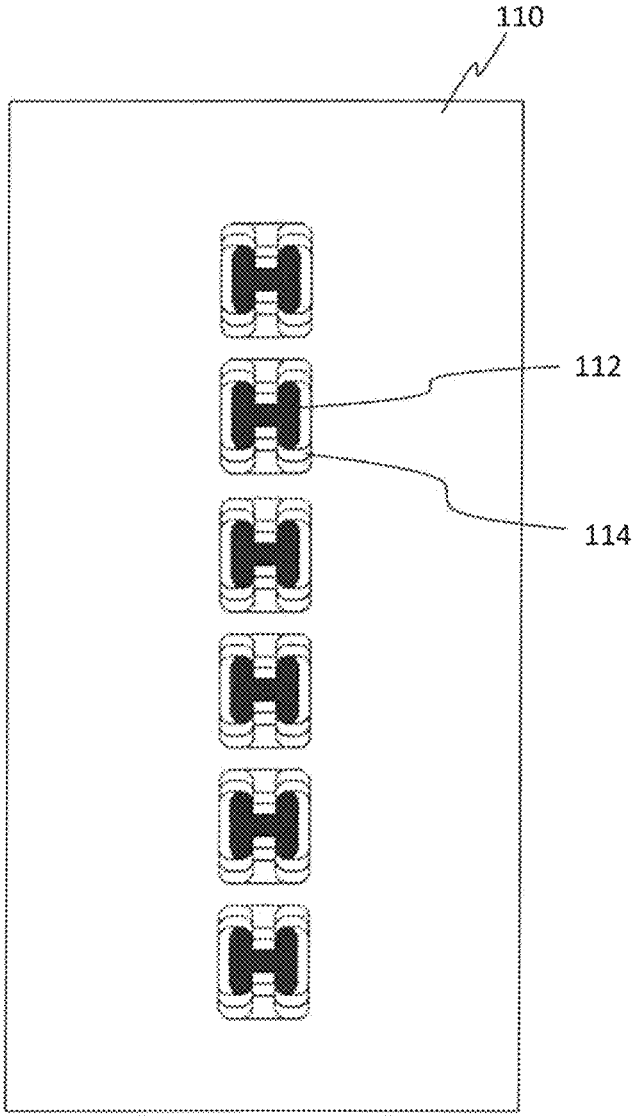
FIG. 33D is a diagram showing an exemplary construction in which six horns 114 all have symmetric shapes.

For comparison, the inventors have also performed a simulation for a construction in which the six horns 114 all have symmetric shapes as shown in FIG. 33D, under the same conditions. The shape of each horn 114 in this construction is identical to the shape of each of the two horns 114 at both ends shown in FIG. 33A.

Figure 33E:
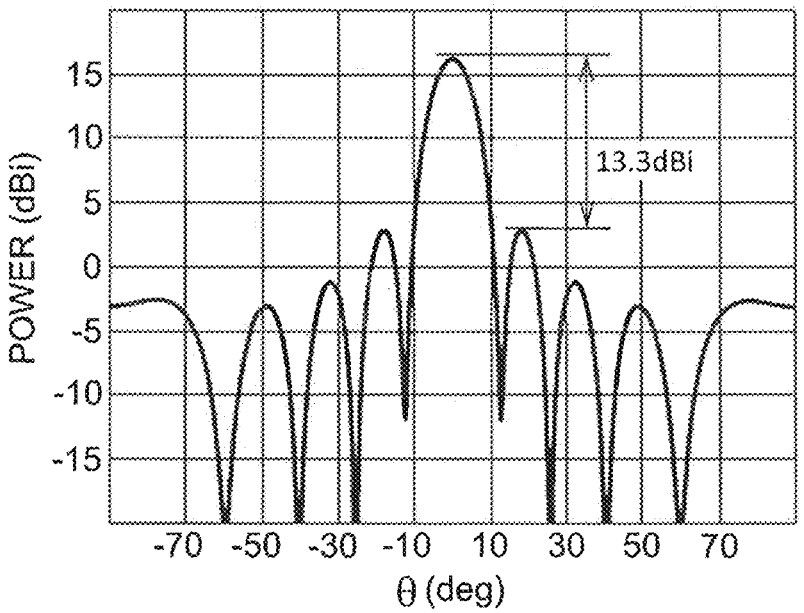
FIG. 33E is a graph showing results of the simulation for the example shown in FIG. 33D.

FIG. 33E is a graph showing results of the simulation for the example shown in FIG. 33D. In this example, the reduction in the level of side lobes relative to the level of the main lobe is only about 13.3 dBi. Thus, this result indicates superiority of the present embodiment.

Although the antenna array according to the present embodiment is illustrated as having six slots 112 and horns 114 in each row, the number of slots 112 and horns 114 in each row may be any number which is two or greater. As for the number of rows, without being limited to five rows, any number which is one or more greater may be adopted.

Figure 34A:
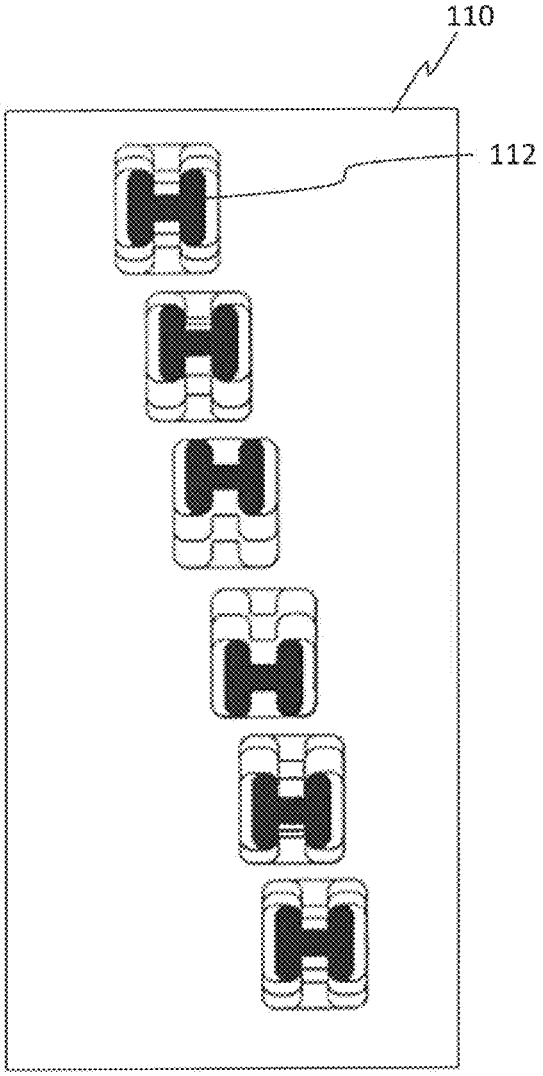
FIG. 34A is a plan view showing an example where the direction that the plurality of slots 112 in one row are arrayed is a direction which intersects the E plane.
Figure 34B:
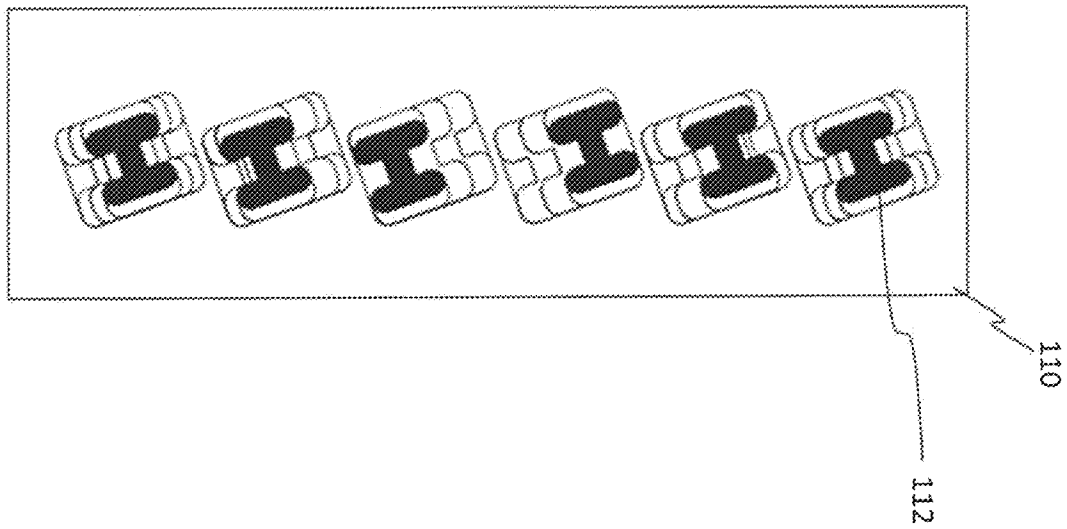
FIG. 34B is a plan view showing another example where the direction that the plurality of slots 112 in one row are arrayed is a direction which intersects the E plane.

The first direction, i.e., the direction that the plurality of slots 112 in one row are arrayed, does not need to be a direction which is parallel to the E plane of each slot 112. FIG. 34A and FIG. 34B are plan views each showing an example where the direction that the plurality of slots 112 in one row are arrayed is a direction which intersects the E plane. Such constructions will also function as slot antenna arrays.

Figure 34C:
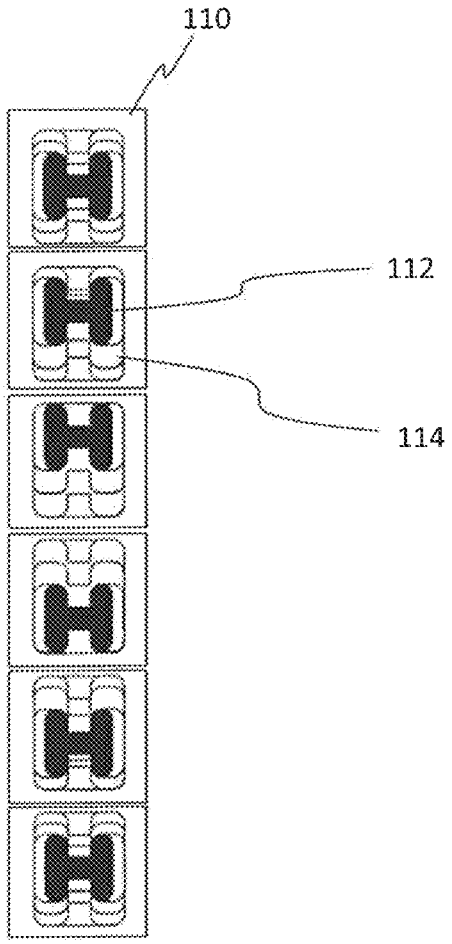
FIG. 34C is a diagram showing an example where the conductive member 110 is composed of a plurality of split portions.

FIG. 34C is a diagram showing another example of an antenna array. In this example, the conductive member 110 is separated from horn to horn. As in this example, the conductive member 110 may be composed of a plurality of separate portions. In this case, each horn may be adjusted in position or orientation to obtain desired antenna characteristics.

Variant 2 of Embodiment 2

The aforementioned antenna array having asymmetric horns is applicable not only to an antenna device in which ridge waveguides are used, but also to an antenna device in which hollow waveguides are used. Hereinafter, examples of such constructions will be described.

Figure 35A:
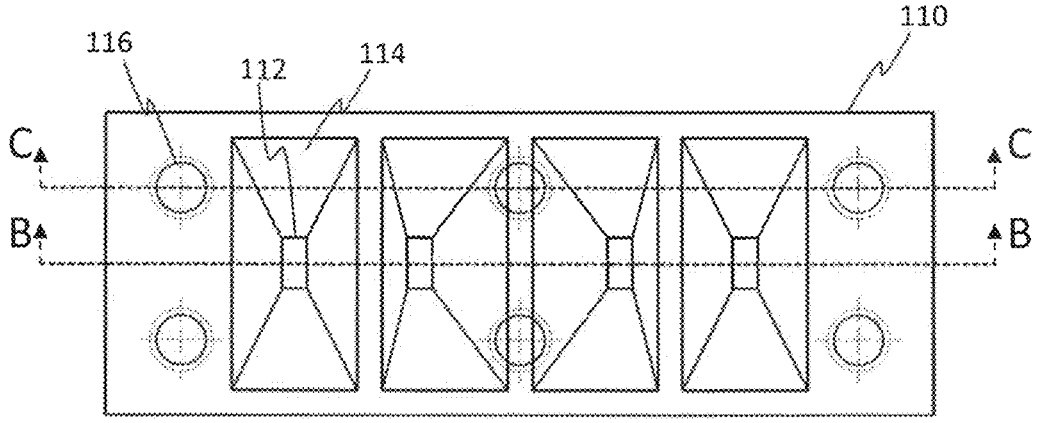
FIG. 35A is a plan view showing an exemplary construction for an antenna array in which a hollow waveguide is used.
Figure 35B:
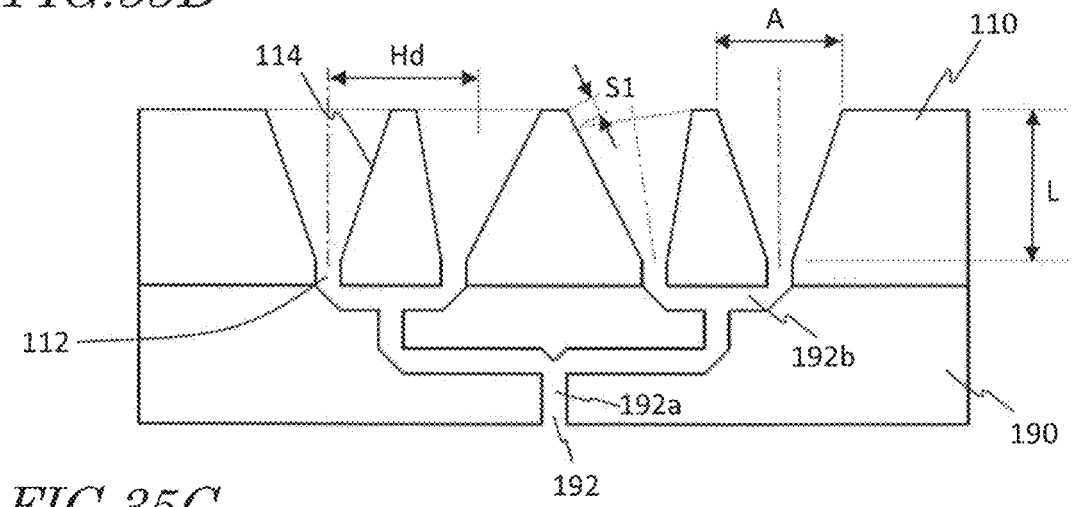
FIG. 35B is a diagram showing a cross section taken along line B-B in FIG. 35A.
Figure 35C:
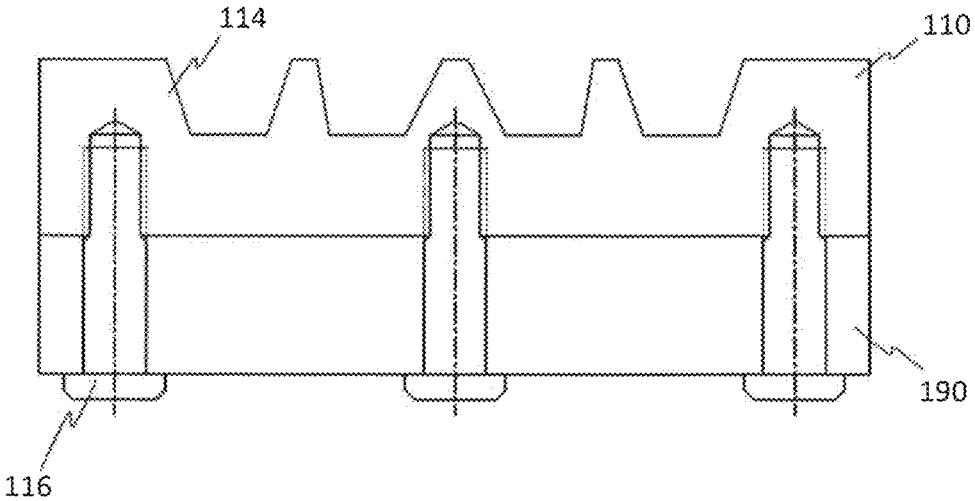
FIG. 35C is a diagram showing a cross section taken along line C-C in FIG. 35A.

FIG. 35A is a plan view showing an exemplary construction for an antenna array in which a hollow waveguide is used. FIG. 35B is a diagram showing a cross section taken along line B-B in FIG. 35A. FIG. 35C is a diagram showing a cross section taken along line C-C in FIG. 35A.

The conductive member 110 of the antenna array in this example has four slots 112 and four horns 114. Among the four horns 114, the two horns 114 at both ends have symmetric shapes, whereas the inner two horns 114 have asymmetric shapes. Each horn 114 has a pyramidal shape.

As shown in FIG. 35B, the antenna array further includes a conductive member 190 having a hollow waveguide 192. The plurality of slots 112 are connected to the hollow waveguide 192. The hollow waveguide 192 includes a stem 192*a* and a plurality of branches 192*b* that branch out from the stem via at least one branching portion. In the example of FIG. 35B, the hollow waveguide 192 includes four branches 192*b* that branch out from the single stem 192*a* via two branching portions. Terminal ends of the plurality of branches 192*b* are respectively connected to the plurality of slots 112. The stem 192*a* of the hollow waveguide 192 is connected to an electronic circuit such as an MMIC. During transmission, a signal wave is supplied to the stem 192*a* from the electronic circuit. This signal wave propagates separately into the plurality of branches 192*b*, thus exciting the plurality of slots 112.

Example dimensions for FIG. 35B may be as follows. The electromagnetic wave to be transmitted or received may have a frequency of 76.5 GHz, and a free-space wavelength λ0 of 3.92 mm. The distance Hd between the centers of the openings of two adjacent horns 114 may be 3.0 mm (approximately 0.77λ0), for example. In an E-plane cross section of each of the two inner asymmetric horns 114, a difference S1 of e.g. 0.39 mm (approximately 0.10λ0) may exist between a length from one of two intersections between the E plane and the edge of the slot 112 to one of two intersections between the E plane and the edge of the aperture plane of the horn 114, as taken along the inner wall surface, and a length from the other intersection between the E plane and the edge of the slot 112 to the other intersection between the E plane and the edge of the aperture plane of the horn 114, as taken along the inner wall surface. The width A of the aperture plane of each horn 114 along the first direction may be 2.5 mm (approximately 0.64λ0), for example. The distance L from the bottom of each horn 114 to the aperture plane may be 3.0 mm (approximately 0.77λ0), for example. Different dimensions from these dimensions may also be adopted.

The conductive members 110 and 190 are fixed to each other by a plurality of bolts 116. By adopting asymmetric shapes for at least some of the plurality of horns 114, it becomes easy to achieve desired radiation characteristics or reception characteristics even in the case where the bolts 116 constrain the structure of the hollow waveguide 192, for example.

Figure 35D:
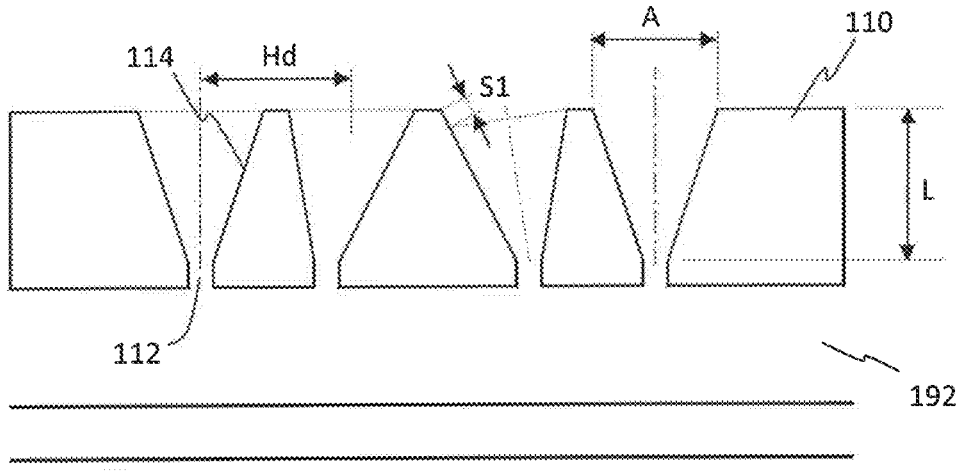
FIG. 35D is a cross-sectional view showing another variant.

FIG. 35D is a cross-sectional view showing another variant. In this example, at least a portion of the conductive member 110 functions as a longitudinal wall of the hollow waveguide 192. The plurality of horns 114 are provided on the longitudinal wall of the hollow waveguide 192. The hollow waveguide 192 in this example extends along the direction in which the slots 112 are arrayed. A signal wave which is supplied to one end of the hollow waveguide 192 propagates in the hollow waveguide 192 to excite the plurality of slots 112. In this case, because of the non-uniform intervals among the plurality of slots 112, the plurality of slots 112 are excited under non-equiphase conditions. The effects of the present embodiment can also be obtained with such an antenna array.

Figure 36A:
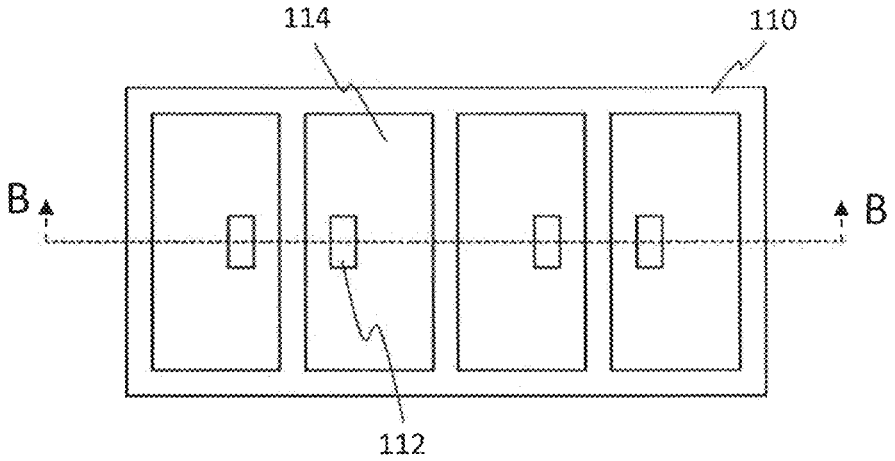
FIG. 36A is a plan view showing still another variant.
Figure 36B:
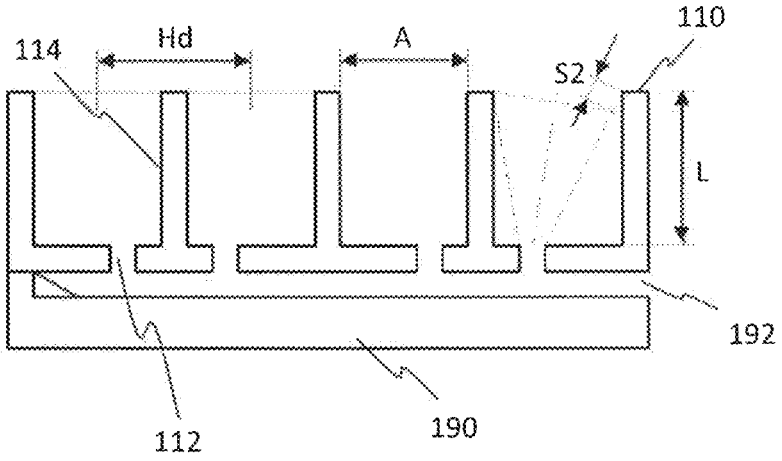
FIG. 36B is a diagram showing a cross section taken along line B-B in FIG. 36A.

FIG. 36A is a plan view showing still another variant. FIG. 36B is a diagram showing a cross section taken along line B-B in FIG. 36A. Each horn 114 in this example is a box horn having an internal cavity which is shaped as a rectangular solid or a cube. The inner wall surface of each horn 114 has a bottom face communicating with the slot 112, and side faces which are perpendicular to the bottom face. In an E-plane cross section of each horn 114, the center of the slot 112 is shifted inward or outward of the center of the aperture plane of the horn 114.

The plurality of slots 112 are connected to a hollow waveguide 192 which is composed of conductive members 110 and 190. The bottom face of the conductive member 110 functions also as a part of the longitudinal wall of the hollow waveguide 192.

Example dimensions in this example may be as follows. The distance Hd between the centers of the openings of two adjacent horns 114 may be 3.0 mm (approximately 0.77λ0), for example. In an E-plane cross section of each horn 114, a difference S2 of e.g. 0.39 mm (approximately 0.10λ0) may exist between the shortest distance from one of two intersections between the E plane and the edge of the slot 112 to one of two intersections between the E plane and the edge of the aperture plane of the horn 114 and the shortest distance from the other intersection between the E plane and the edge of the slot 112 to the other intersection between the E plane and the edge of the aperture plane of the horn 114. The width A of the aperture plane of each horn 114 along the first direction may be 2.5 mm (approximately 0.64λ0), for example. The distance L from the bottom of each horn 114 to the aperture plane may be 3.0 mm (approximately 0.77λ0), for example. Different dimensions from these dimensions may also be adopted.

In the above example of using a hollow waveguide, it is not necessary for all slots to be connected to one hollow waveguide. Some of the plurality of slots may be connected to one hollow waveguide, while others may be connected to another hollow waveguide.

Embodiment 3

Embodiment 3 relates to a technique of suppressing signal wave reflection at the port by adapting the choke structure near the port.

A conventional choke structure, as is disclosed in e.g. Patent Document 1, would include an additional ridge having a length of approximately λr/4 (which hereinafter may be referred to as a "choke ridge"). It has been believed that the length of the choke ridge should not be deviated from λr/4, or the function of the choke structure would be undermined.

However, the inventors have found that even if the choke ridge length is shorter than λr/4, the choke structure may still adequately function, and it may even be preferable for the choke ridge length to be shorter than λr/4 in many cases. More preferably, the choke ridge length is not more than λ0/4. Since λ0 is often smaller by about 10% than λr, λ0/4 is also smaller by about 10% than λr/4. Based on this knowledge, the choke ridge length is chosen to be not more than λ0/4 in the waveguide device according to the present embodiment.

The choke structure according to the present embodiment includes: an electrically-conductive ridge (choke ridge) provided at a position adjacent to a port; and one or more electrically conductive rods provided on the conductive surface with a gap from a farther end of the ridge from the port. The choke ridge may also be considered as a part of the waveguide member as split by the port. The choke ridge length may be set to not less than λ0/16 and not more than λ0/4, for example.

In the present embodiment, a portion of the ridge or the port near the choke structure may be recessed or tapered, thereby being able to suppress signal wave reflection. Hereinafter, with respect to the construction of FIG. 27 for instance, an example of a waveguide device including the aforementioned choke structure will be described.

Figure 37A:
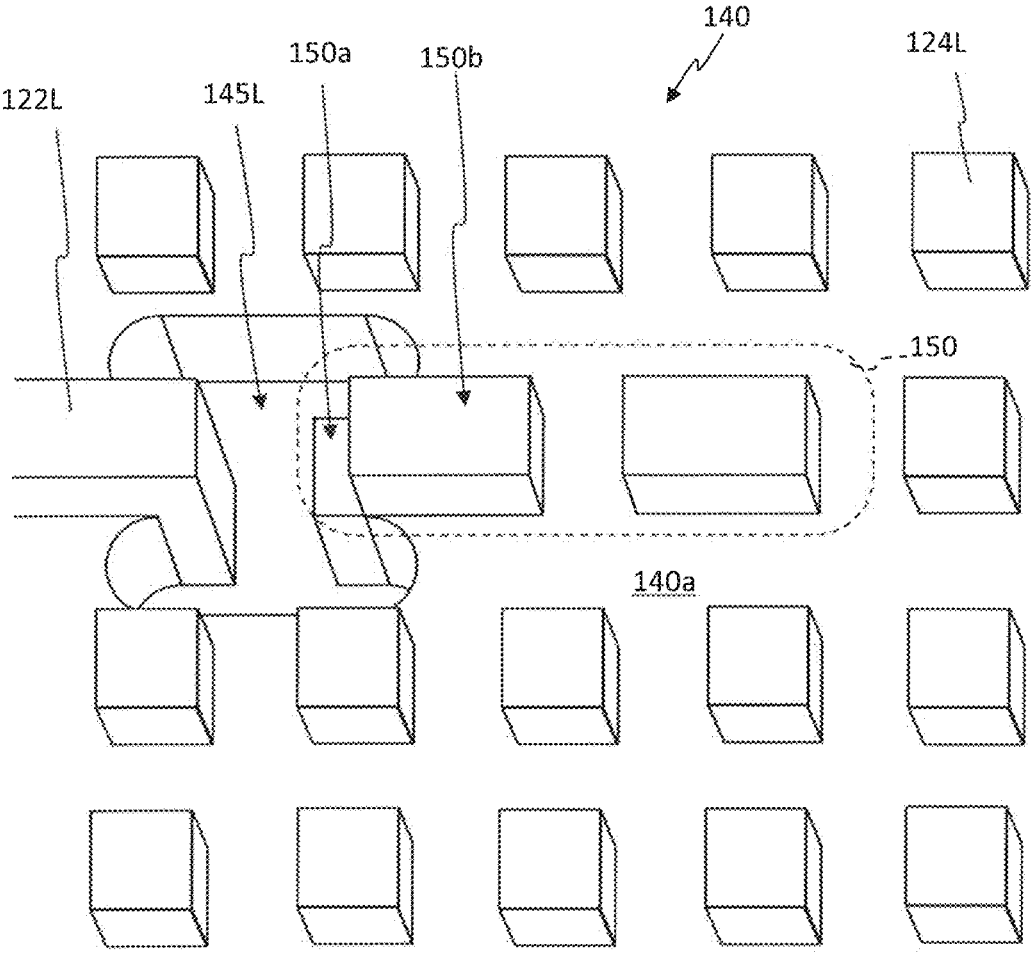
FIG. 37A is a perspective view showing an example of an impedance matching structure at a port 145L of the third conductive member 140 as shown in FIG. 27.

FIG. 37A is a perspective view showing an example of an impedance matching structure at a port 145L of the third conductive member 140 as shown in FIG. 27.

The third conductive member 140 according to the present embodiment has a port 145L at a position adjacent to one end of the second waveguide member 122L. A choke structure 150 is provided at a position opposing the one end of the second waveguide member 122L via the port 145L.

Figure 37B:
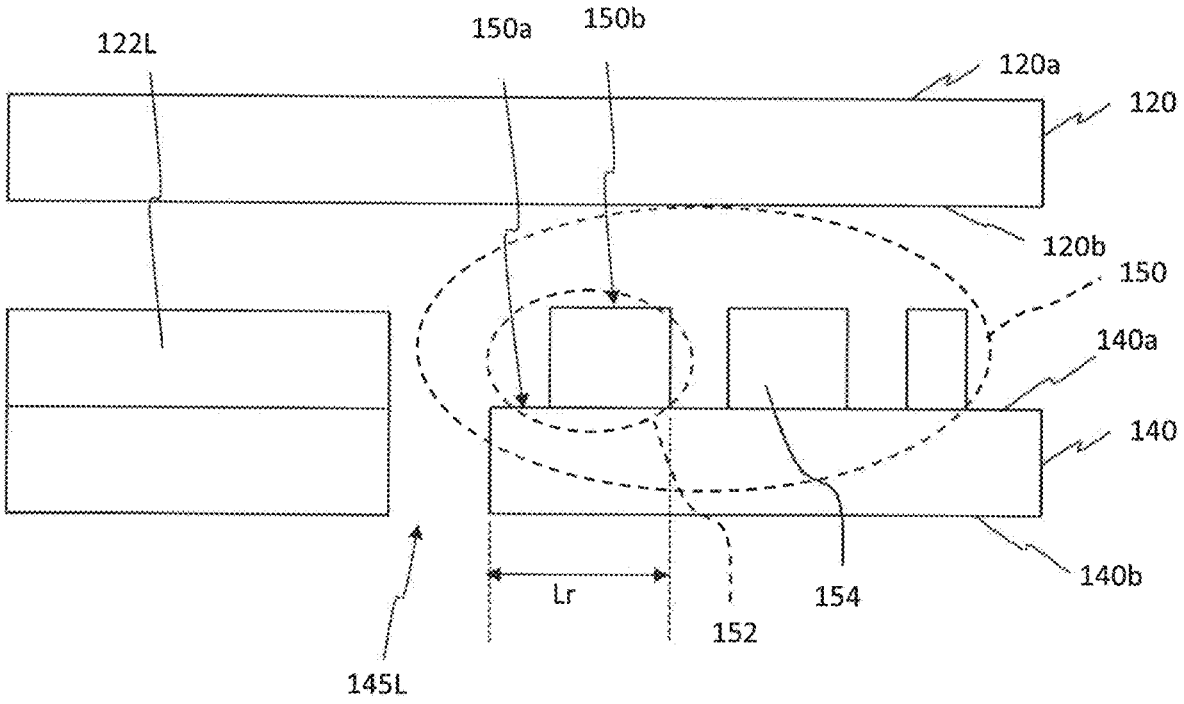
FIG. 37B is a diagram schematically showing a cross section of the port 145L and the choke structure 150 shown in FIG. 37A.

FIG. 37B is a diagram schematically showing a cross section of the port 145L and the choke structure 150 shown in FIG. 37A. As shown in FIG. 37B, the port 145L extends from the fifth conductive surface 140*a* of the third conductive member 140 on the front side through to the sixth conductive surface 140*b* on the rear side.

The choke structure 150 in the present embodiment includes a first portion 150*a* adjacent to the port 145L and a second portion 150*b* adjacent to the first portion 150*a*. The first portion 150*a* is composed of a recess in one end of the choke structure 150. This recess makes the interval (distance) from the first portion 150*a* to the fourth conductive surface 120*b* of the second conductive member 120 longer, by about λ/4, than the interval (distance) from the second portion 150*b* to the fourth conductive surface 120*b* of the second conductive member 120, thus realizing an impedance matching structure. In this example, the interval (distance) from the first portion 150*a* to the fourth conductive surface 120*b* of the second conductive member 120 is equal to the interval (distance) from the fifth conductive surface 140*a* of the third conductive member 140 to the fourth conductive surface 120*b* of the second conductive member 120.

Since such an impedance matching structure is provided on the choke structure 150 side, when a signal wave passes through the port 145L, unwanted reflection at the port 145L is suppressed. As a result, the signal wave is able to efficiently couple to the waveguide extending between the waveguide face 122*a* of the waveguide member 122L and the fourth conductive surface 120*b*.

In the example shown in FIG. 37B, the choke structure 150 includes a choke ridge 152 provided at a position adjacent to the port 145L, and one or more electrically conductive rods 154 provided on the conductive surface 140*a* with a gap from a farther end of the choke ridge 152 from the port 145L. The choke ridge 152 includes the first portion 150*a* and the second portion 150*b*. In the example of FIG. 37B, the upper face of the first portion 150*a*, which is at the same height as the conductive surface 140*a*, is also part of the choke ridge 152. The length Lr of the choke ridge 152 may be set to not more than λ0/4, for example. The rod(s) 154 may have the same dimensions as, or different dimensions from, those of the conductive rods 124 composing the artificial magnetic conductor stretching on both sides of the waveguide member 122L.

Variants of Embodiment 3

Figure 38A:
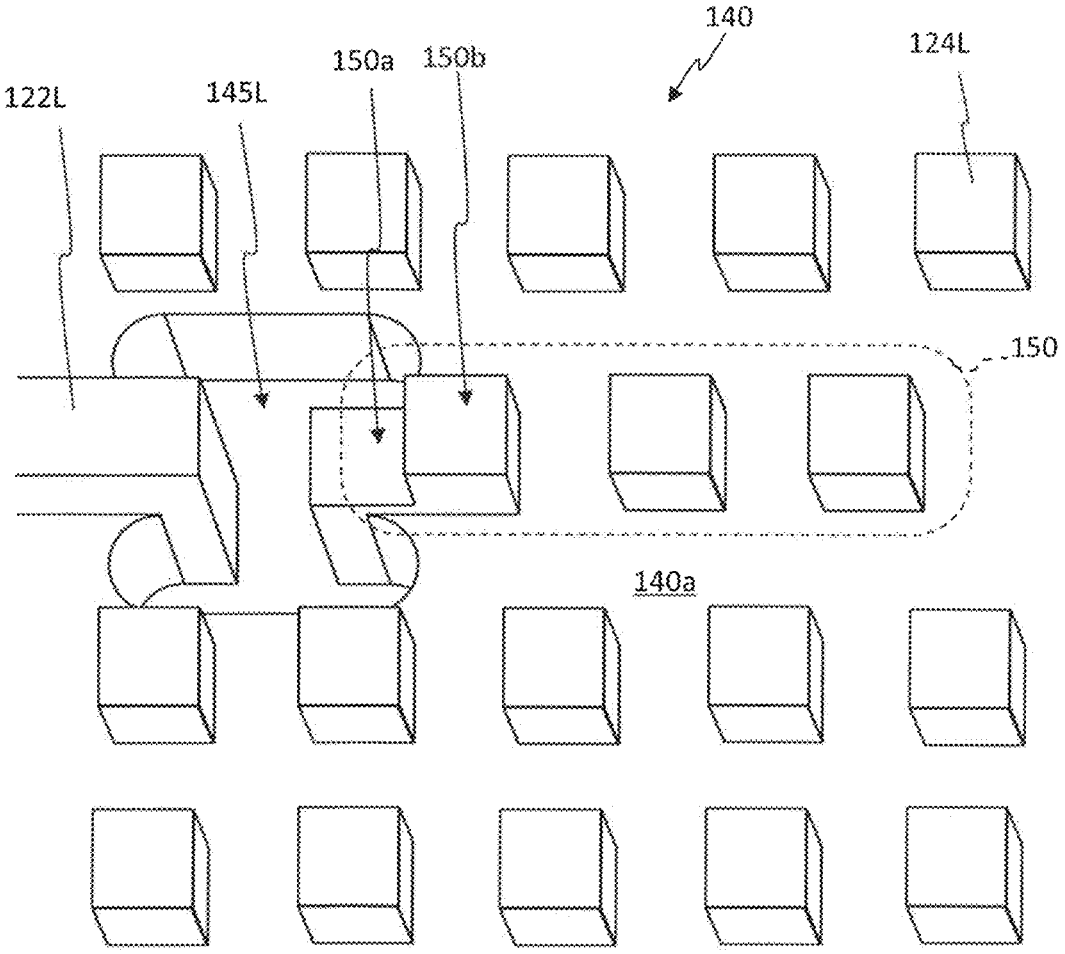
FIG. 38A is a perspective view showing an impedance matching structure according to a variant of Embodiment 3.
Figure 38B:
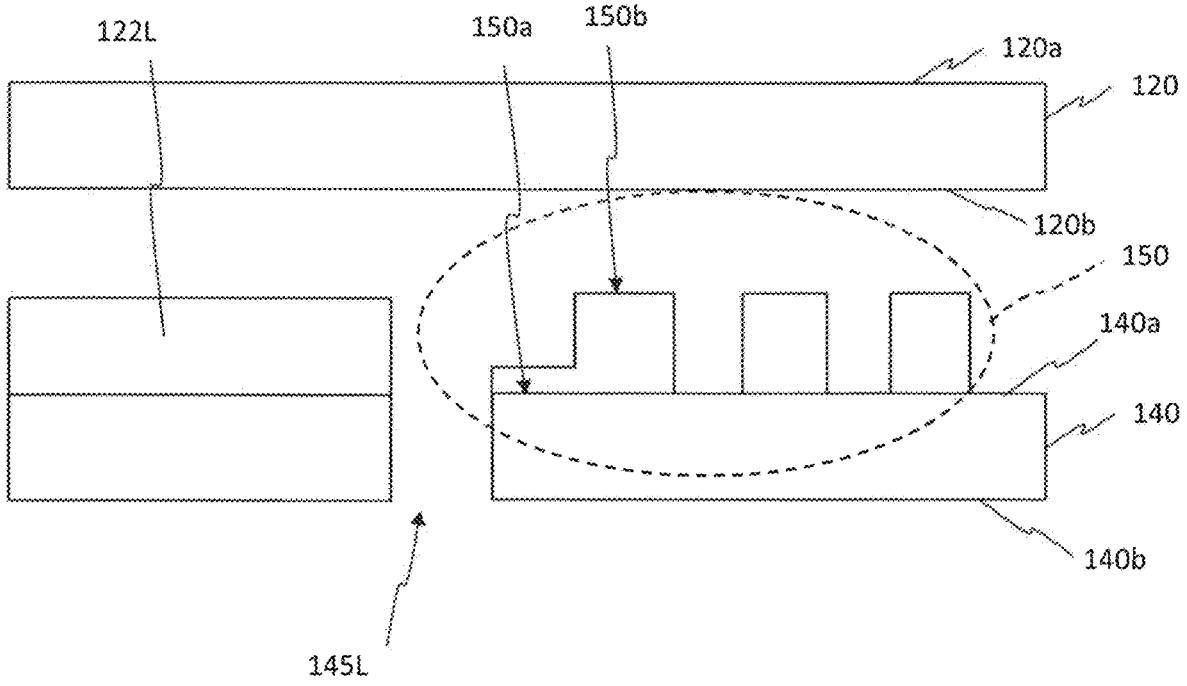
FIG. 38B is a diagram schematically showing a cross section of the port 145L and the choke structure 150 shown in FIG. 38A.

FIGS. 38A and 38B are a perspective view and a cross-sectional view, respectively, showing an impedance matching structure according to a variant of Embodiment 3. In this variant, the shape of the structure defining the choke structure 150 is different from the shape in the implementation of FIG. 37A and FIG. 37B. Moreover, the interval (distance) from the first portion 150*a* to the fourth conductive surface 120*b* of the second conductive member 120 is shorter than the interval (distance) from the fifth conductive surface 140*a* of the third conductive member 140 to the fourth conductive surface 120*b* of the second conductive member 120. Furthermore, when the first portion 150*a* is viewed from the waveguide member 122L, the first portion 150*a* has an increased depth, and the second portion 150*b* is accordingly shorter.

Figure 39A:
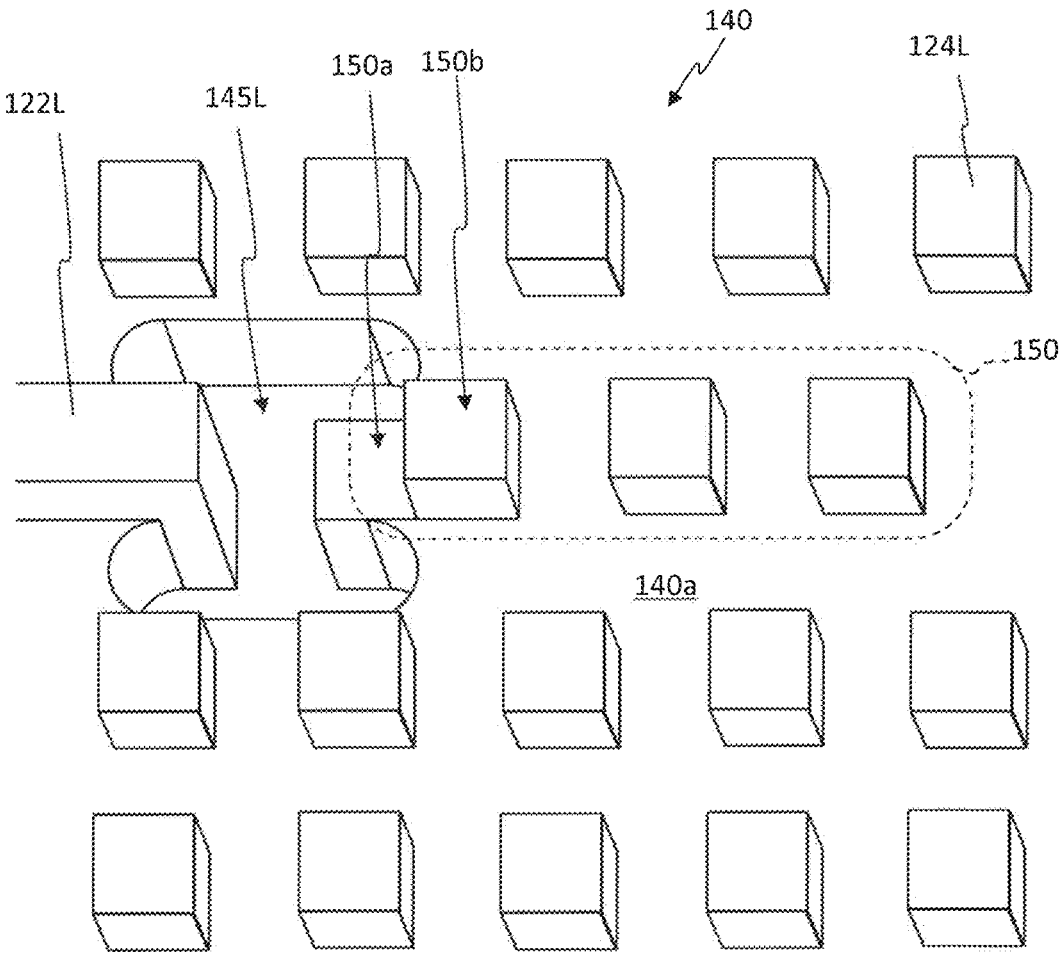
FIG. 39A is a perspective view showing an impedance matching structure according to another variant of Embodiment 3.
Figure 39B:
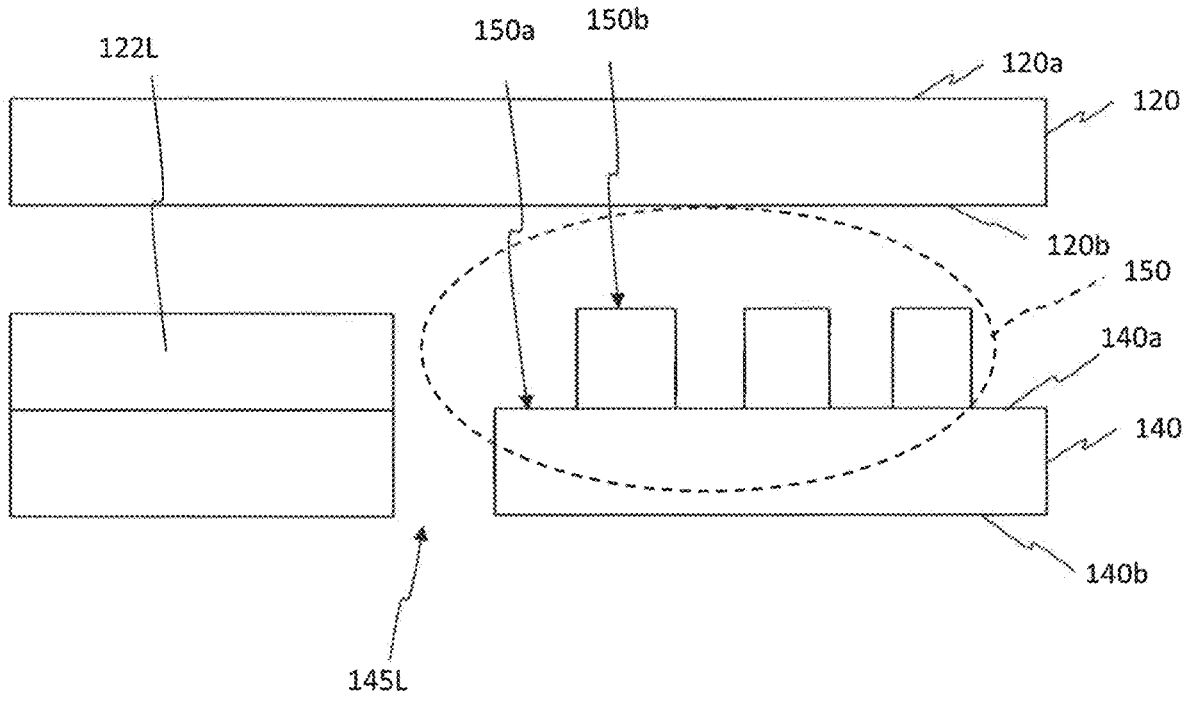
FIG. 39B is a diagram schematically showing a cross section of the port 145L and the choke structure 150 shown in FIG. 39A.

FIGS. 39A and 39B are a perspective view and a cross-sectional view, respectively, showing an impedance matching structure according to another variant of Embodiment 3. This variant differs from the exemplary construction in FIGS. 38A and 38B in that, in this variant, the interval (distance) from the first portion 150*a* to the fourth conductive surface 120*b* of the second conductive member 120 is equal to the interval (distance) from the fifth conductive surface 140*a* of the third conductive member 140 to the fourth conductive surface 120*b* of the second conductive member 120.

Figure 40A:
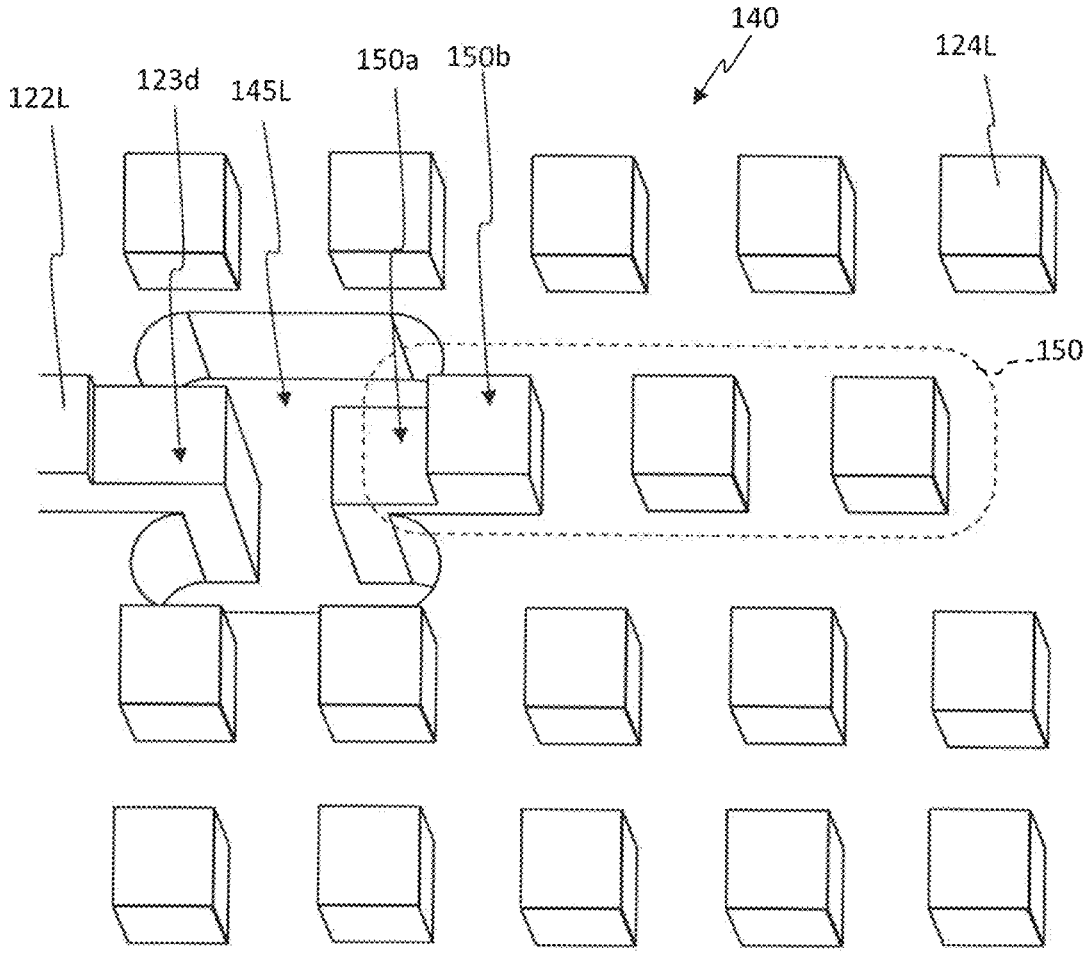
FIG. 40A is a perspective view showing an impedance matching structure according to still another variant of Embodiment 3.
Figure 40B:
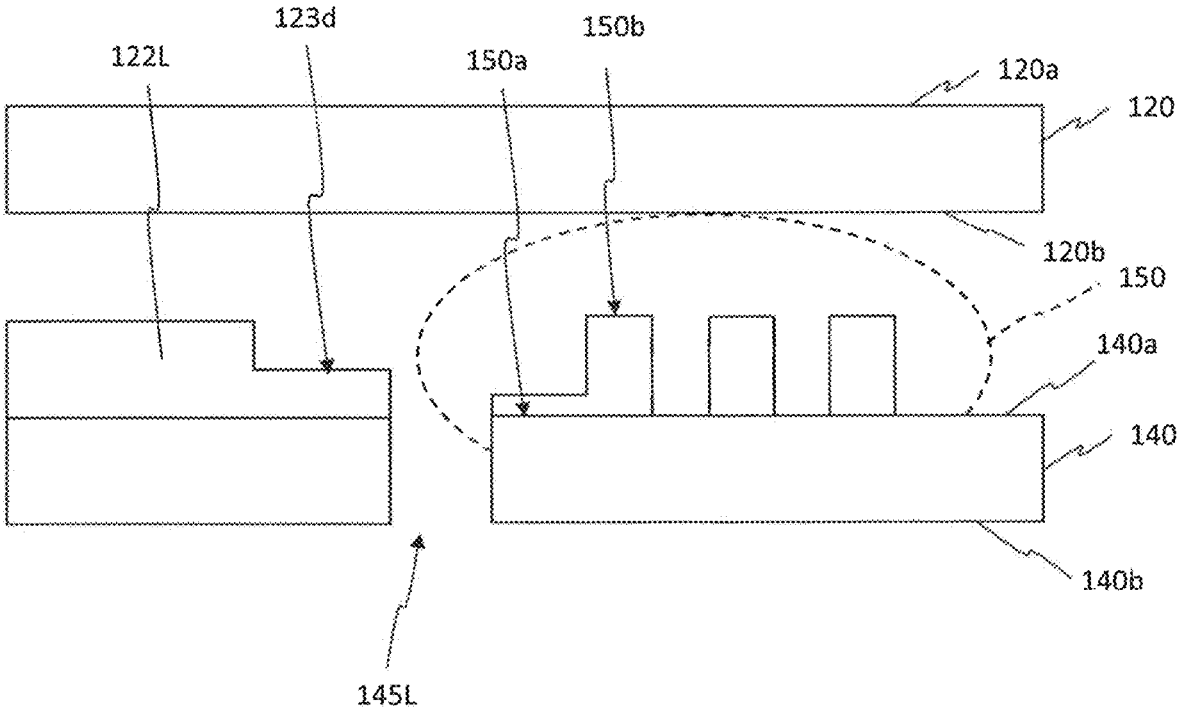
FIG. 40B is a diagram schematically showing a cross section of the port 145L and the choke structure 150 shown in FIG. 40A.

FIGS. 40A and 40B are a perspective view and a cross-sectional view, respectively, showing an impedance matching structure according to still another variant of Embodiment 3. In this variant, in addition to an impedance matching structure provided on the choke structure 150 side, a dent 123*d* for impedance matching purposes is also provided in the waveguide member 122L.

Figure 41:
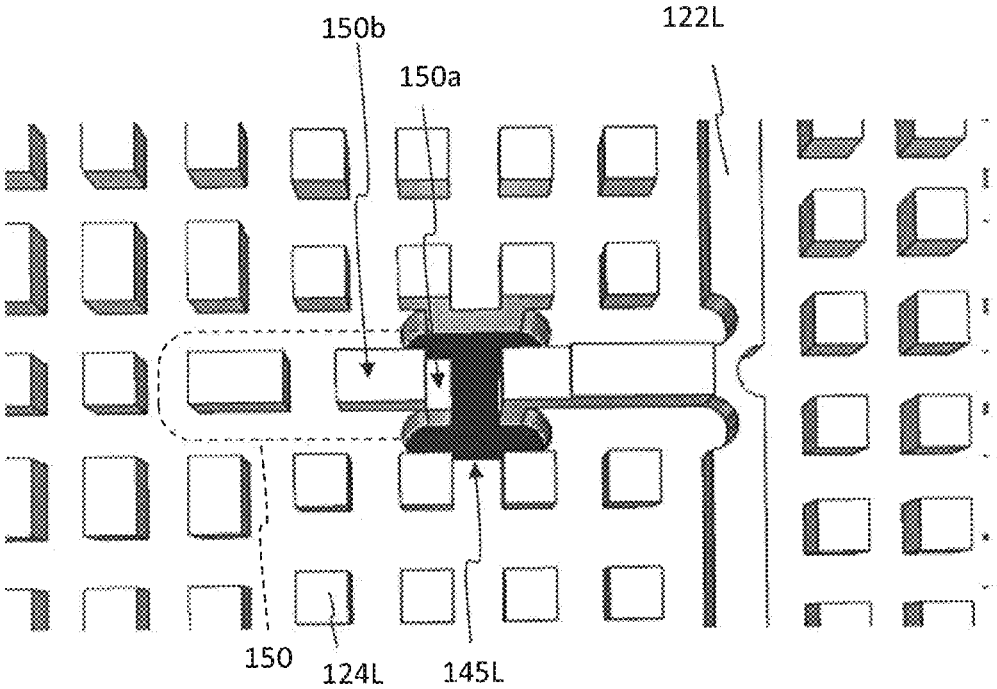
FIG. 41 is a perspective view showing a specific exemplary construction having an impedance matching structure according to Embodiment 3.
Figure 42:
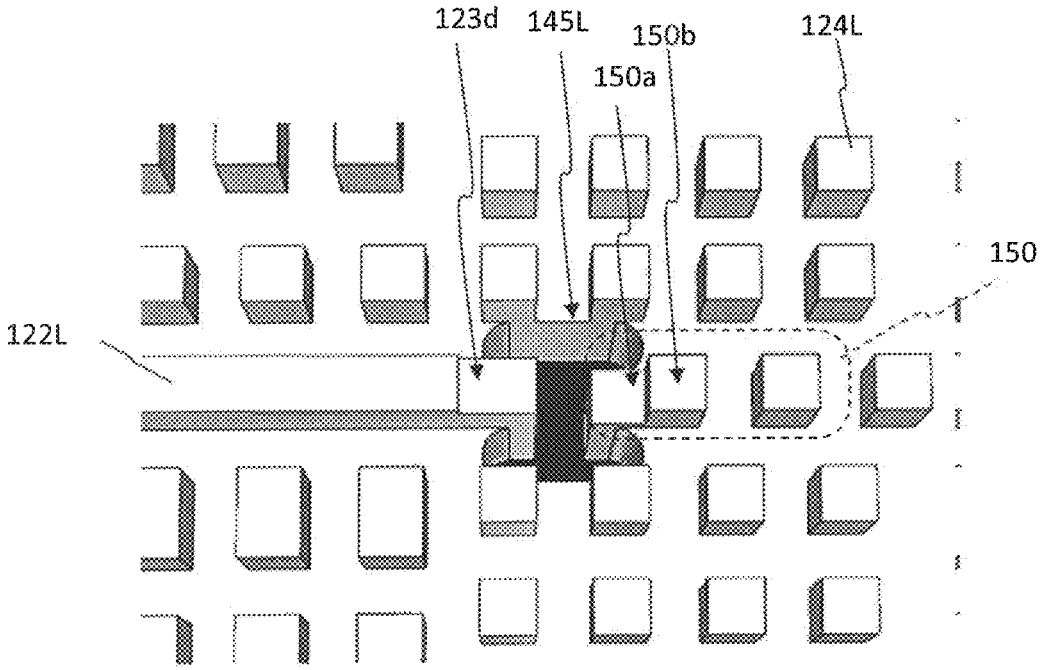
FIG. 42 is a perspective view showing another specific exemplary construction having an impedance matching structure according to Embodiment 3.

FIG. 41 and FIG. 42 are perspective views each showing a specific exemplary construction having the aforementioned impedance matching structure. Unwanted reflection when a signal wave passes through the port 145L can also be suppressed by using the impedance matching structures shown in FIGS. 38A through 42.

The above examples each illustrate an impedance matching structure provided at a port 145L that extends from the fifth conductive surface 140*a* of the third conductive member 140 on the front side through to the sixth conductive surface 140*b* on the rear side. Similar structures are also applicable to a port or a slot other than the port 145L. The choke structure 150 according to the present embodiment may be provided near any kind of throughhole, such as a port or a slot. For example, the port 145L shown in FIG. 42 or the like may be allowed to function as a slot (antenna element).

FIGS. 43A through 43I are schematic cross-sectional views for describing variations of the present disclosure. In these examples, the choke structure 150 exists between the first conductive member 110 and the second conductive member 120. The port 145 extends through the second conductive member 120.

Figure 43A:
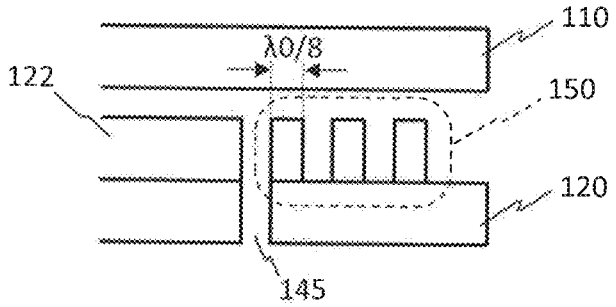
FIG. 43A is a diagram showing an exemplary structure in the neighborhood of the choke structure and the port 145 according to Embodiment 3.
Figure 43B:
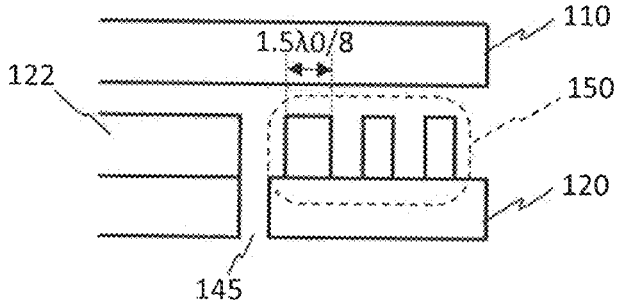
FIG. 43B is a diagram showing an exemplary structure in the neighborhood of the choke structure and the port 145 according to Embodiment 3.

FIG. 43A shows an example where the choke ridge length is shortened to approximately λ0/8. Conventionally, such a construction has been believed unable to sufficiently suppress electromagnetic wave leakage; however, it has been found through analyses by the inventors that leakage can actually be suppressed to a practically satisfactory level. When the choke ridge length is λ0/8 as shown in FIG. 43B, it is often the case that the length and width of each conductive rod that is provided around the ridge are also λ0/8, so that the choke ridge and each conductive rod may be identical in terms of their dimensions and shapes. Such a structure is also an embodiment of the present disclosure.

Figure 43C:
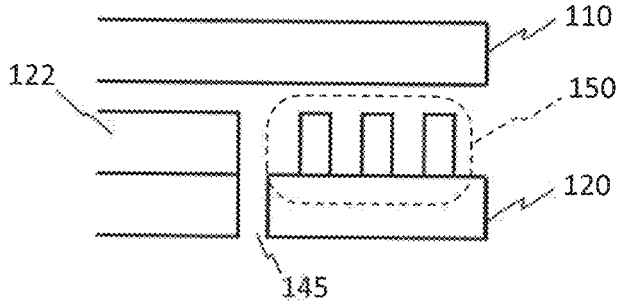
FIG. 43C is a diagram showing an exemplary structure in the neighborhood of the choke structure and the port 145 according to Embodiment 3.
Figure 43D:
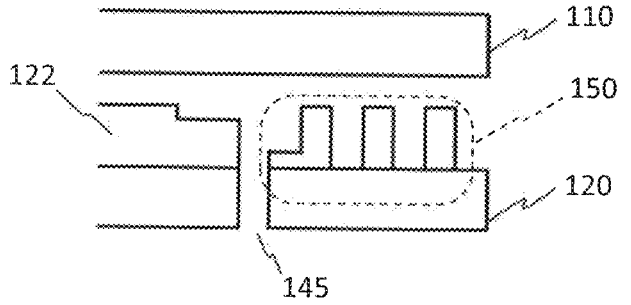
FIG. 43D is a diagram showing an exemplary structure in the neighborhood of the choke structure and the port 145 according to Embodiment 3.
Figure 43E:
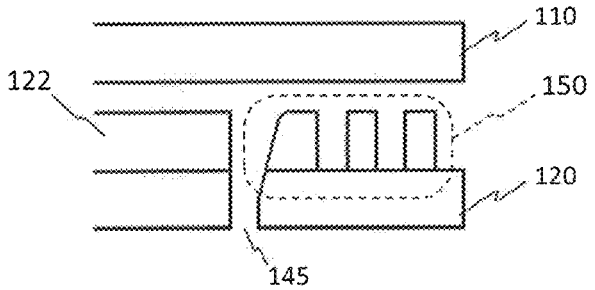
FIG. 43E is a diagram showing an exemplary structure in the neighborhood of the choke structure and the port 145 according to Embodiment 3.
Figure 43F:
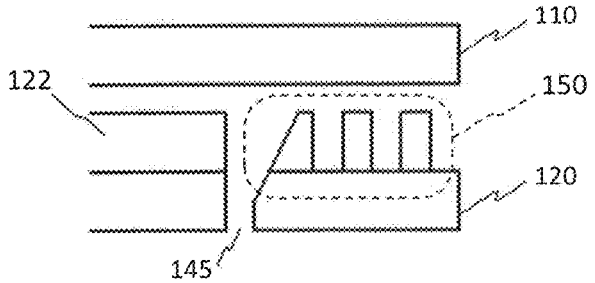
FIG. 43F is a diagram showing an exemplary structure in the neighborhood of the choke structure and the port 145 according to Embodiment 3.
Figure 43G:
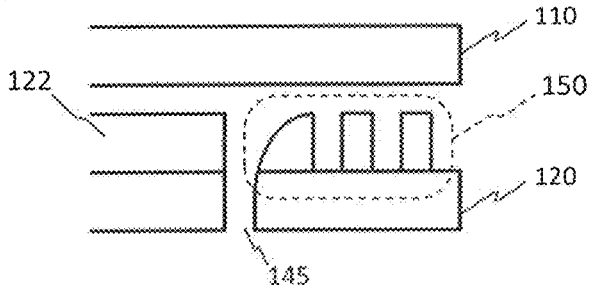
FIG. 43G is a diagram showing an exemplary structure in the neighborhood of the choke structure and the port 145 according to Embodiment 3.
Figure 43H:
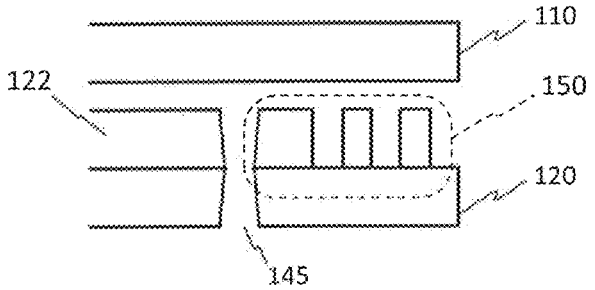
FIG. 43H is a diagram showing an exemplary structure in the neighborhood of the choke structure and the port 145 according to Embodiment 3.

FIGS. 43B through 43D show examples where the choke ridge has a recess. The depth and extent of the recess may be various, as are illustrated in these figures. In the example of FIG. 43B, the length of the non-recessed portion of the choke ridge (i.e., the second portion) is 1.5 times as large as λ0/8. In the example of FIG. 43D, a recess is provided also at a site of the waveguide member 122 that is adjacent to the port 145. The site of the recess is a gap enlargement; that is, at this site, the distance between the conductive surface 110*a* of the conductive member 110 and the waveguide face 122*a* of the waveguide member 122 is longer than at a site which is adjacent to the recess on the opposite side from the port 145.

Figure 43I:
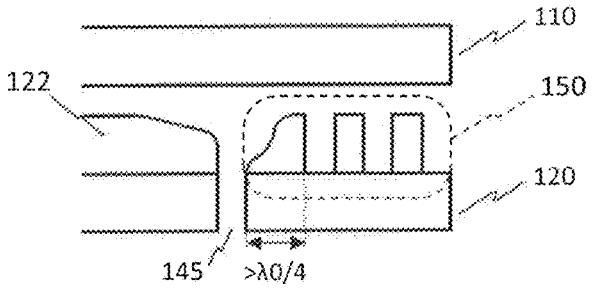
FIG. 43I is a diagram showing an exemplary structure in the neighborhood of the choke structure and the port 145 according to Embodiment 3.

FIGS. 43E through 43I show examples where one end of the choke ridge or the waveguide member 122 is tapered, rather than being recessed. In these examples, at least one of the choke ridge and the waveguide member 122 has a slope at the gap enlargement. Such structures also provide similar effects of reflection suppression. As shown in FIG. 43B and FIG. 43I, when the recess or taper is large, the length of the entire choke ridge as measured at the bottom may exceed λ0/4 in some cases.

As in these examples, a gap enlargement may be provided for the choke structure by introducing a recess or a taper at the choke ridge, whereby a signal wave passing through the port 145 can be restrained from being reflected near the port 145.

Although the above examples illustrate that the port 145 is provided in the second conductive member 120, the port 145 may instead be provided in the first conductive member 110. The port 145 may be allowed to function as a slot (antenna element).

Figure 44A:
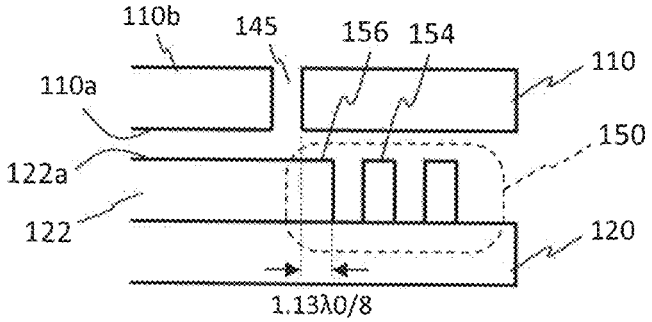
FIG. 44A is a diagram showing an exemplary structure in the neighborhood of the choke structure and the port 145 according to Embodiment 3.

FIGS. 44A through 44G illustrate examples where the port 145 is provided in the first conductive member 110. The first conductive member 110 in each of these examples includes a port 145 provided at a position opposing a portion of the waveguide face 122*a* near one end of the waveguide member 122. The port 145 communicates from the first conductive surface 110*b* to the second conductive surface 110*a*. The second conductive member 120 includes a choke structure 150 in a region containing one end of the waveguide member 122. The choke structure 150 includes: a waveguide member end portion 156 spanning from the edge of the opening of the port 145 to the edge of one end of the waveguide member 122 as projected onto the waveguide face 122*a*; and one or more conductive rods 154 provided on the third conductive surface 120*a* with a gap from the one end of the waveguide member 122. In the example of FIG. 44A, the length of the waveguide member end portion 156 is 1.13 as large as λ0/8.

Given that an electromagnetic wave propagating in the waveguide has a central wavelength of λ0 in free space, the length of the waveguide member end portion 156 along the direction of the waveguide may be set equal to or greater than λ0/16 and less than λ0/4, for example.

Figure 44B:
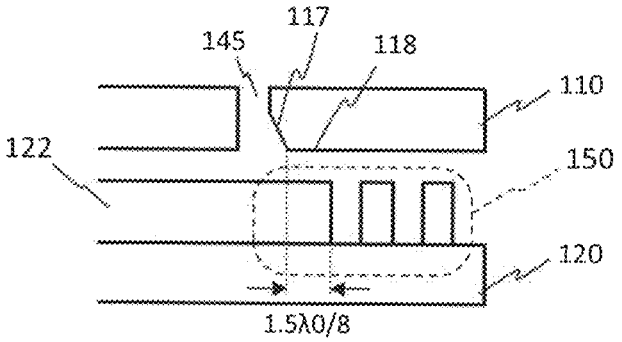
FIG. 44B is a diagram showing an exemplary structure in the neighborhood of the choke structure and the port 145 according to Embodiment 3.
Figure 44C:
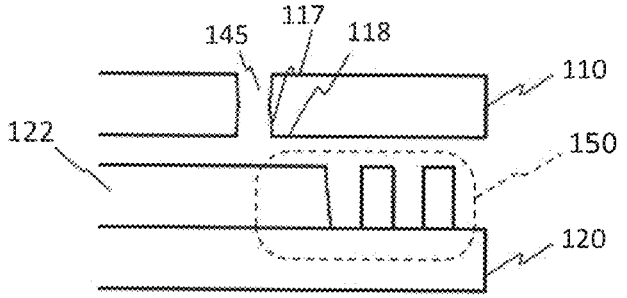
FIG. 44C is a diagram showing an exemplary structure in the neighborhood of the choke structure and the port 145 according to Embodiment 3.
Figure 44D:
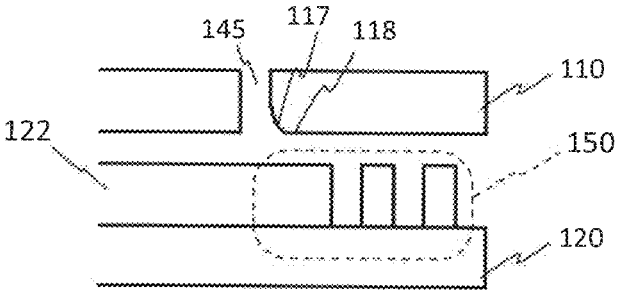
FIG. 44D is a diagram showing an exemplary structure in the neighborhood of the choke structure and the port 145 according to Embodiment 3.
Figure 44E:
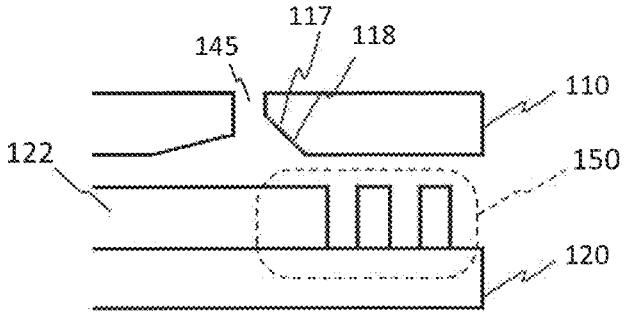
FIG. 44E is a diagram showing an exemplary structure in the neighborhood of the choke structure and the port 145 according to Embodiment 3.
Figure 44F:
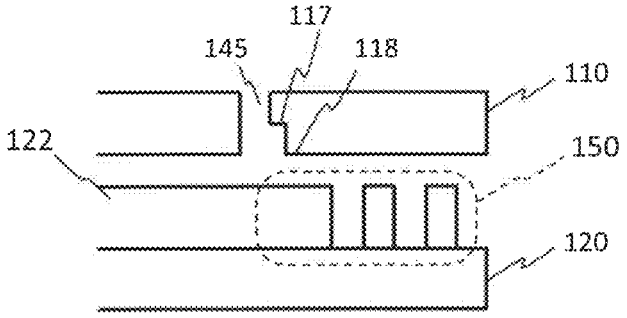
FIG. 44F is a diagram showing an exemplary structure in the neighborhood of the choke structure and the port 145 according to Embodiment 3.
Figure 44G:
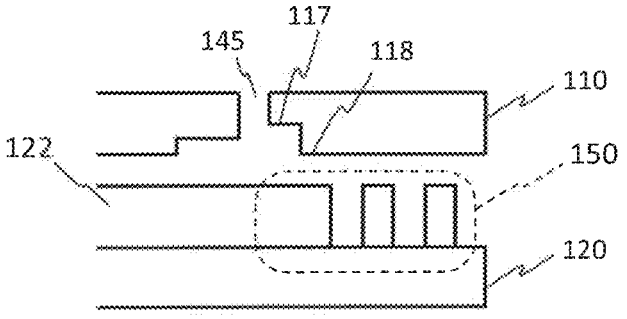
FIG. 44G is a diagram showing an exemplary structure in the neighborhood of the choke structure and the port 145 according to Embodiment 3.
Figure 45A:
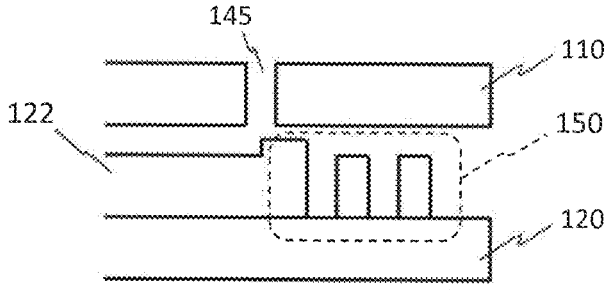
FIG. 45A is a diagram showing an exemplary structure in the neighborhood of the choke structure and the port 145 according to Embodiment 3.
Figure 45B:
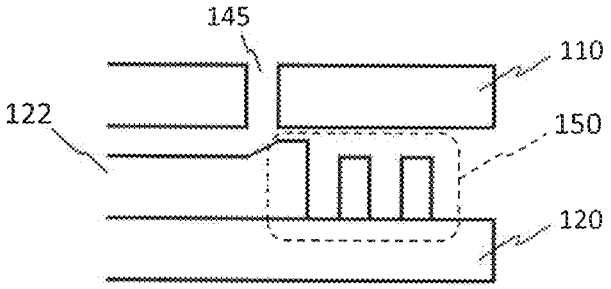
FIG. 45B is a diagram showing an exemplary structure in the neighborhood of the choke structure and the port 145 according to Embodiment 3.
Figure 45C:
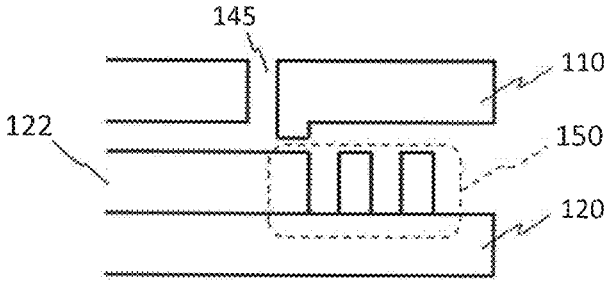
FIG. 45C is a diagram showing an exemplary structure in the neighborhood of the choke structure and the port 145 according to Embodiment 3.
Figure 45D:
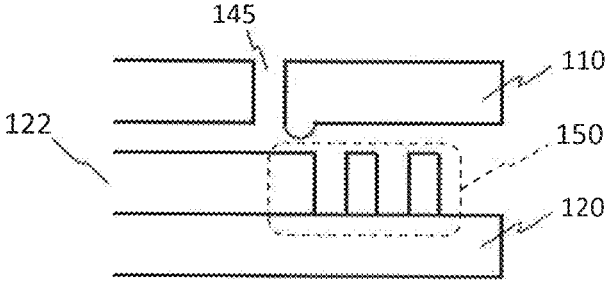
FIG. 45D is a diagram showing an exemplary structure in the neighborhood of the choke structure and the port 145 according to Embodiment 3.

In the examples shown in FIGS. 44B through 44G, at a site opposing the waveguide member end portion 156, the second conductive surface 110*a* of the first conductive member 110 includes a first portion 117 adjoining the port 145, and a second portion 118 adjoining the first portion 117. The distance between the first portion 117 and the waveguide face 122*a* is longer than the distance between the second portion 118 and the waveguide face 122*a*. The first portion 117 has a slope in the examples in FIGS. 44B through 44E. In the example of FIG. 44B, the length of the second portion is 1.5 times as large as λ0/8. In the examples of FIG. 44F and FIG. 44G, the first portion 117 is a recessed site. The recess or slope is a gap enlargement, where the distance from the waveguide face 122*a* is longer than in any adjoining site. The gap enlargement may be provided on both sides that are adjacent to the port 145 along the direction that the waveguide member 122 extends. FIG. 44C, FIG. 44E, and FIG. 44G show such examples.

By providing a gap enlargement as shown in FIGS. 44B through 44G, a signal wave passing through the port 145 is restrained from being reflected near the port 145.

FIGS. 45A through 45D are diagrams further variants. In these examples, the first conductive member 110 or the waveguide member 122 has a gap reducement near the port 145, instead of a gap enlargement. At the gap reducement, the distance between the conductive surface 110*a* and the waveguide face 122*a* is reduced relative to any adjoining site. Such a structure may be adopted depending on the purpose. These structures are also able to restrain a signal wave passing through the port 145 from being reflected near the port 145.

Embodiment 4

Figure 46A:
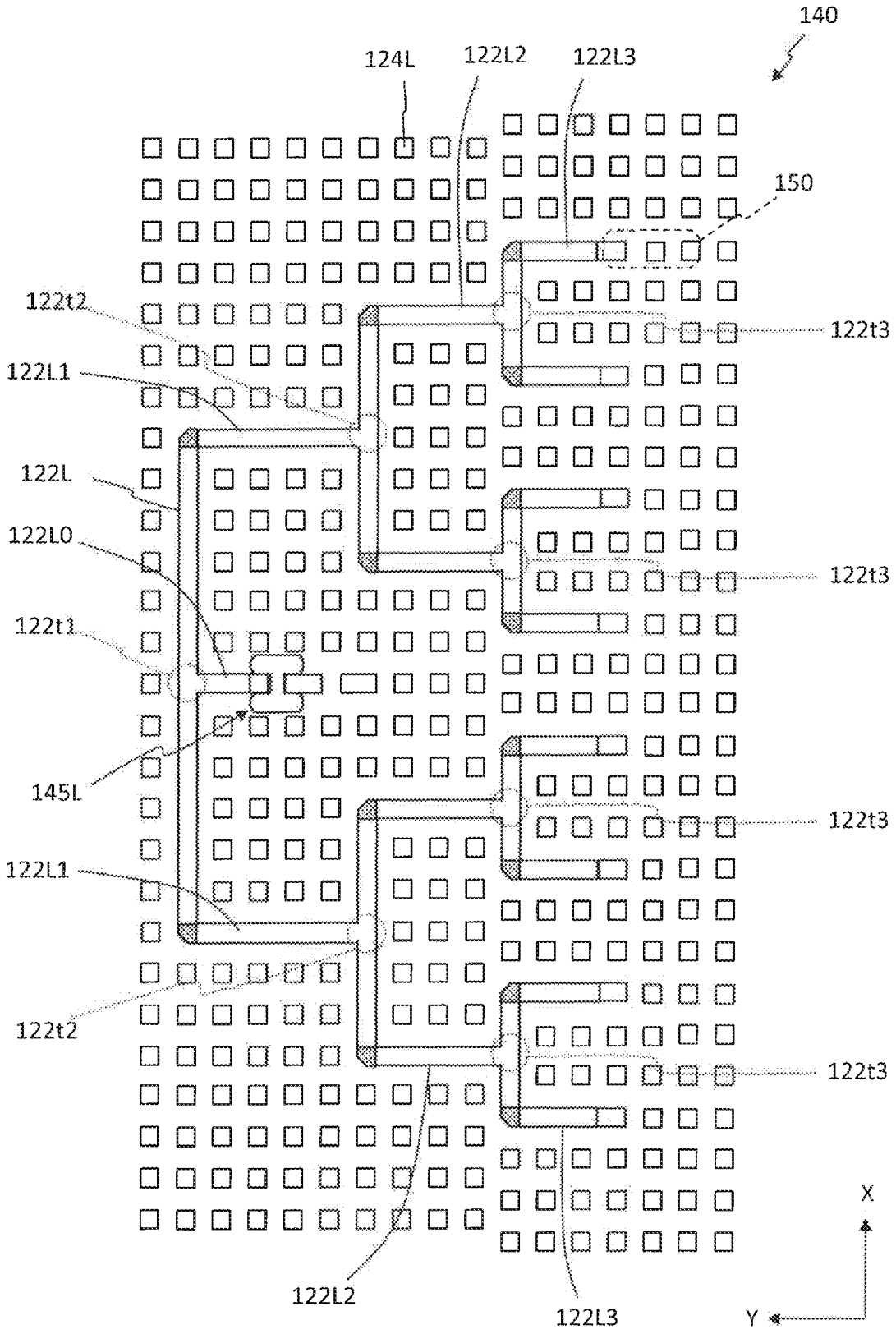
FIG. 46A is a plan view schematically showing the structure of a third conductive member 140 (distribution layer) according to Embodiment 4.

FIG. 46A is a plan view schematically showing the structure of a third conductive member 140 (distribution layer) according to Embodiment 4. The present embodiment differs from the above-described embodiments in that the waveguide member 122L on the third conductive member 140 has an 8-port divider structure.

As shown in FIG. 46A, the waveguide member 122L according to the present embodiment includes a plurality of T-branching portions 122*t*1, 122*t*2 and 122*t*3 (which may hereinafter after be collectively referred to as the "T-branching portions 122*t*"). Via combinations among the plurality of T-branching portions 122*t*, a single waveguide section 122L0 (hereinafter also referred to as the "stem 122L0") extending from the port 145L branches out into eight waveguide terminal sections 122L3. The waveguide member 122L is designed so that the propagation distances from the port 145L to the respective tip ends of the eight waveguide terminal sections 122L3 all equal, regardless of the path.

The plurality of T-branching portions 122*t* include: a first branching portion 122*t*1 at which the stem 122L0 of the waveguide member 122L branches out into two first branches 122L1; two second branching portions 122*t*2 at each of which a respective first branch 122L1 branches out into two second branches 122L2; and four third branching portions 122*t*3 at each of which a respective second branch 122L2 branches out into two third branches 122L3. The eight third branches 122L3 functions as the waveguide terminal sections.

Figure 46B:
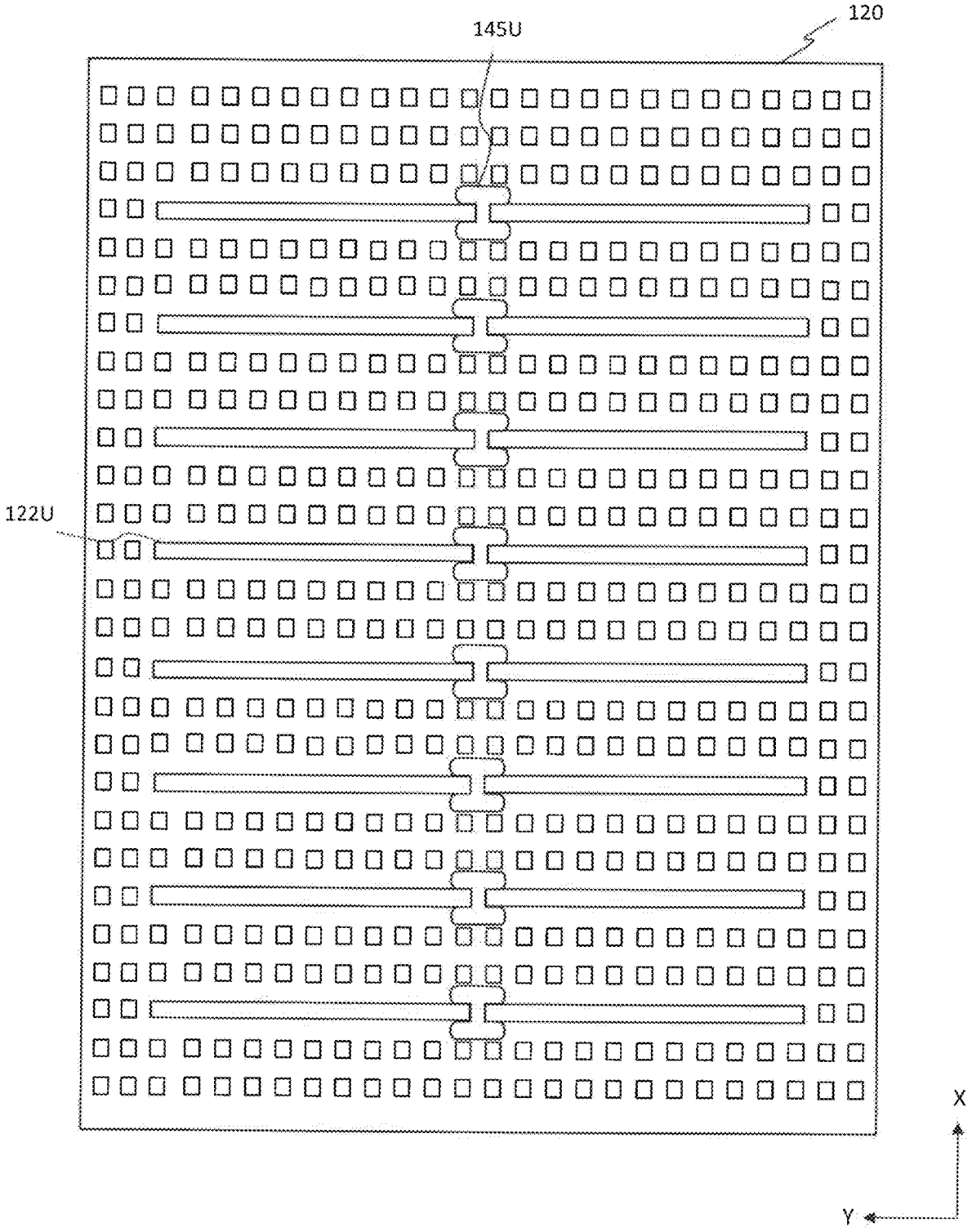
FIG. 46B is a plan view showing the structure of a second conductive member 120 (excitation layer) according to Embodiment 4.

FIG. 46B is a plan view showing the structure of the second conductive member 120 (excitation layer) according to the present embodiment. The tip ends of the eight waveguide terminal sections 122L3 correspond to eight ports 145U on the second conductive member 120. Signal waves from the eight waveguide terminal sections 122L3, having passed through the eight ports 145U, propagate on the eight waveguide members 122U on the second conductive member 120, to excite the plurality of slots 112 of the first conductive member 110 thereabove.

Figure 46C:
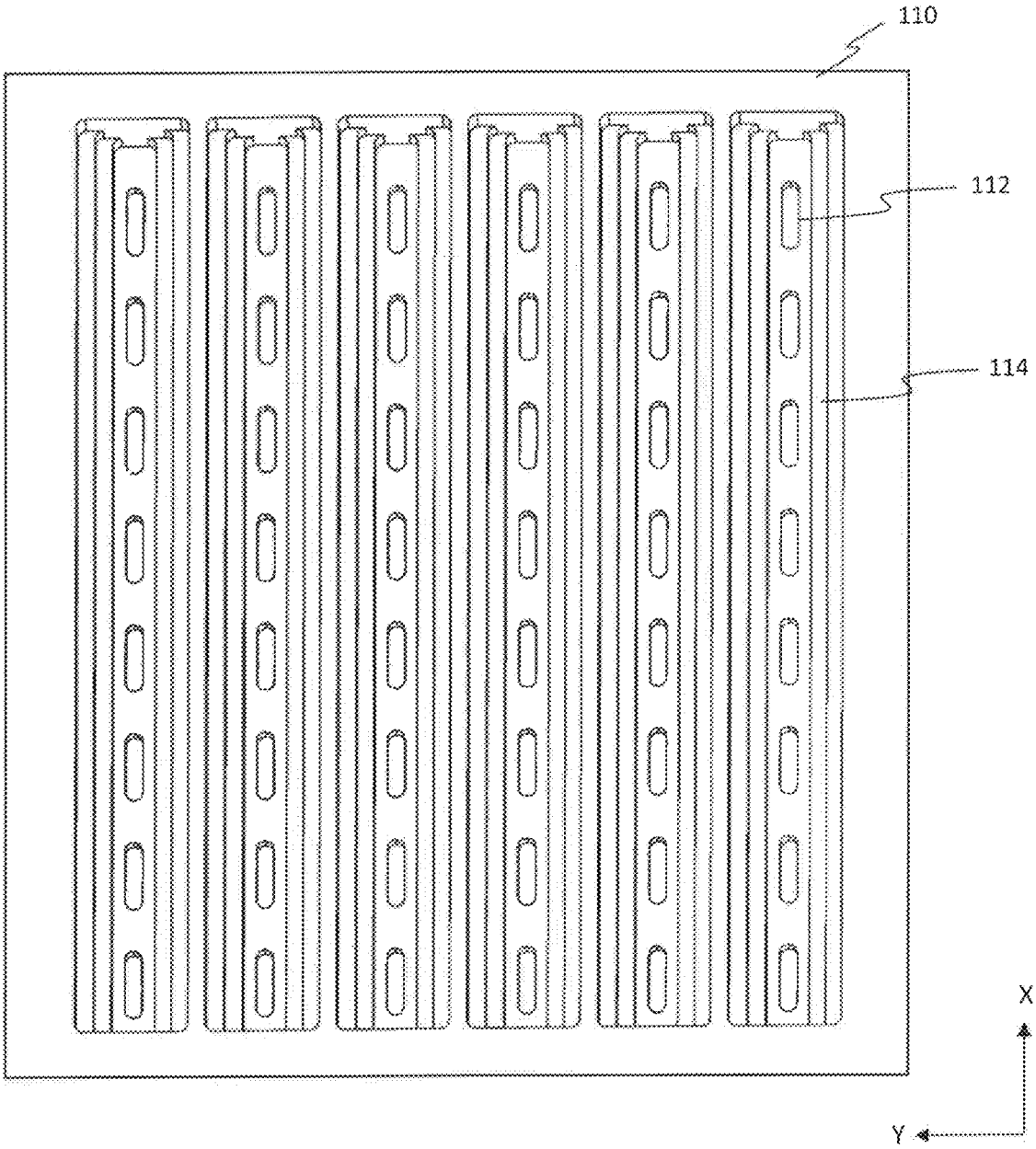
FIG. 46C is a plan view showing the structure of a first conductive member 110 according to Embodiment 4.

FIG. 46C is a plan view showing the structure of the first conductive member 110 according to the present embodiment. The first conductive member 110 according to the present embodiment has 48 slots 112. There are eight rows disposed side-by-side along the X direction, each slot row consisting of eight slots 112 flanking one another along the Y direction. The eight slot rows respectively oppose the eight waveguide members 122U on the second conductive member 120. A signal wave propagating along each of the eight waveguide members 122U on the second conductive member 120 excites the slots 112 in the opposing slot row on the first conductive member 110. As a result of this, an electromagnetic wave is radiated.

FIG. 46A is referred to again. The third conductive member 140 has a port 145L at a position adjacent to the tip end of the stem 122L0 of the waveguide member 122L. The side face (end face) of the tip end of the stem 122L0 is connected to the inner wall of the port 145L. The port 145L opposes the tip end of the waveguide member 122X which is on the fourth conductive member 160 as illustrated in FIG. 28.

A signal wave which has passed through the port (rectangular hollow-waveguide) 165 shown in FIG. 28 and propagated on the waveguide member 122X passes through the port 145L and reaches the stem 122L0 of the waveguide member 122L. Beginning from the stem 122L0, this signal wave is subject to branching at the plurality of branching portions 122*t*, and the resultant signal waves reach the tip ends of the eight waveguide terminal sections 122L3. Then, they pass through the eight ports 145U in the second conductive member 120 shown in FIG. 46B, and propagate through waveguides respectively extending above the eight waveguide members 122U on the second conductive member 120. As a result, the slots 112 shown in FIG. 46C are excited, whereby electromagnetic waves are radiated into external space.

The waveguide member 122L shown in FIG. 46A has 14 bends (which are shown hatched in FIG. 46A). At each of these bends, a dent or a bump is formed. The present embodiment is arranged so that, among the eight waveguide terminal sections 122L3, four waveguide terminal sections 122L3 that are located central (inner) are different in shape from the outer four waveguide terminal sections 122L3. More specifically, the bends of the four waveguide terminal sections 122L3 connecting to the central (inner) four ports 145U (FIG. 46B) have dents. On the other hand, the bends of the four waveguide terminal sections 122L3 connecting to the outer four ports have bumps. Thus, the bend structure differs depending on the waveguide terminal section 122L3. Based on this structure, the antenna elements connecting to the outer four ports 145U have smaller excitation amplitudes than do the antenna elements connecting to the inner four ports 145U. As a result of this, side lobes can be suppressed when this structure is used as an array antenna.

The aforementioned effect is based on the inventors' finding that, when a dent is provided in a bend, signal wave reflection at the bend is suppressed, but that when a bump is provided on a bend, signal wave reflection at the bend conversely increases. In order to enhance the radiation efficiency of an array antenna, it is preferable to suppress reflection at the bends. However, when suppression of side lobes is a priority, it is effective to purposely cause reflection at the outer bends of the waveguide member 122L in the distribution layer, thus suppressing the amplitude of electromagnetic waves to be radiated from the outer slots, as in the present embodiment, for example.

Figure 47:
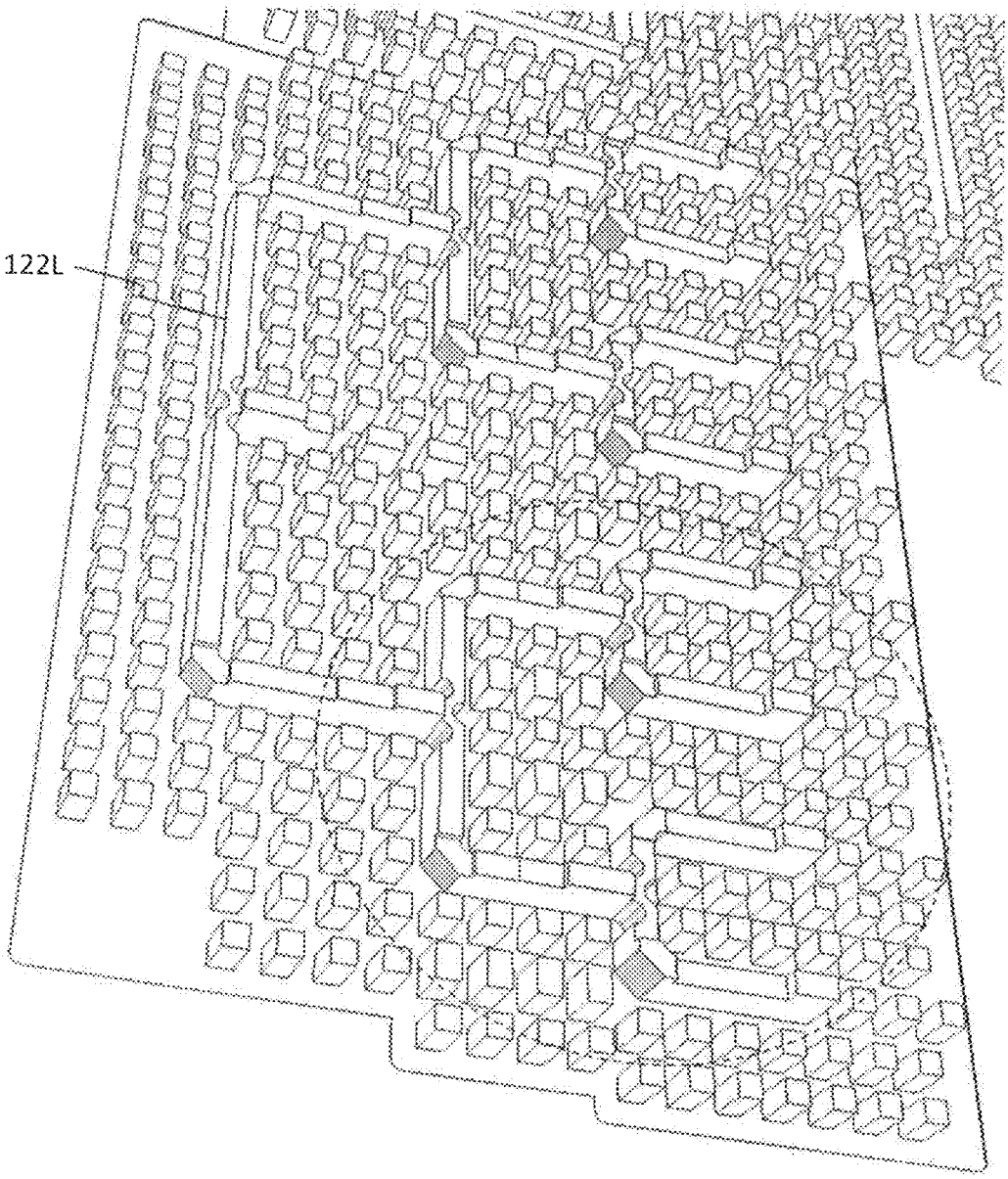
FIG. 47 a perspective view showing a variant of Embodiment 4.

FIG. 47 is a perspective view showing a variant of the present embodiment. In the waveguide member 122L shown in FIG. 47, the outer corner of each bend is beveled, and there are three semicylindrical concavities (dents) in the side faces of each branching portion, these semicylindrical concavities (dents) reaching the waveguide face. Furthermore, the waveguide member 122L includes structures such that the waveguide face of the stem side of each T-branching portion increases in height toward the branching portion (impedance transforming sections). With these structures, unwanted reflection at the bends or branching portions can be suppressed.

Figure 48A:
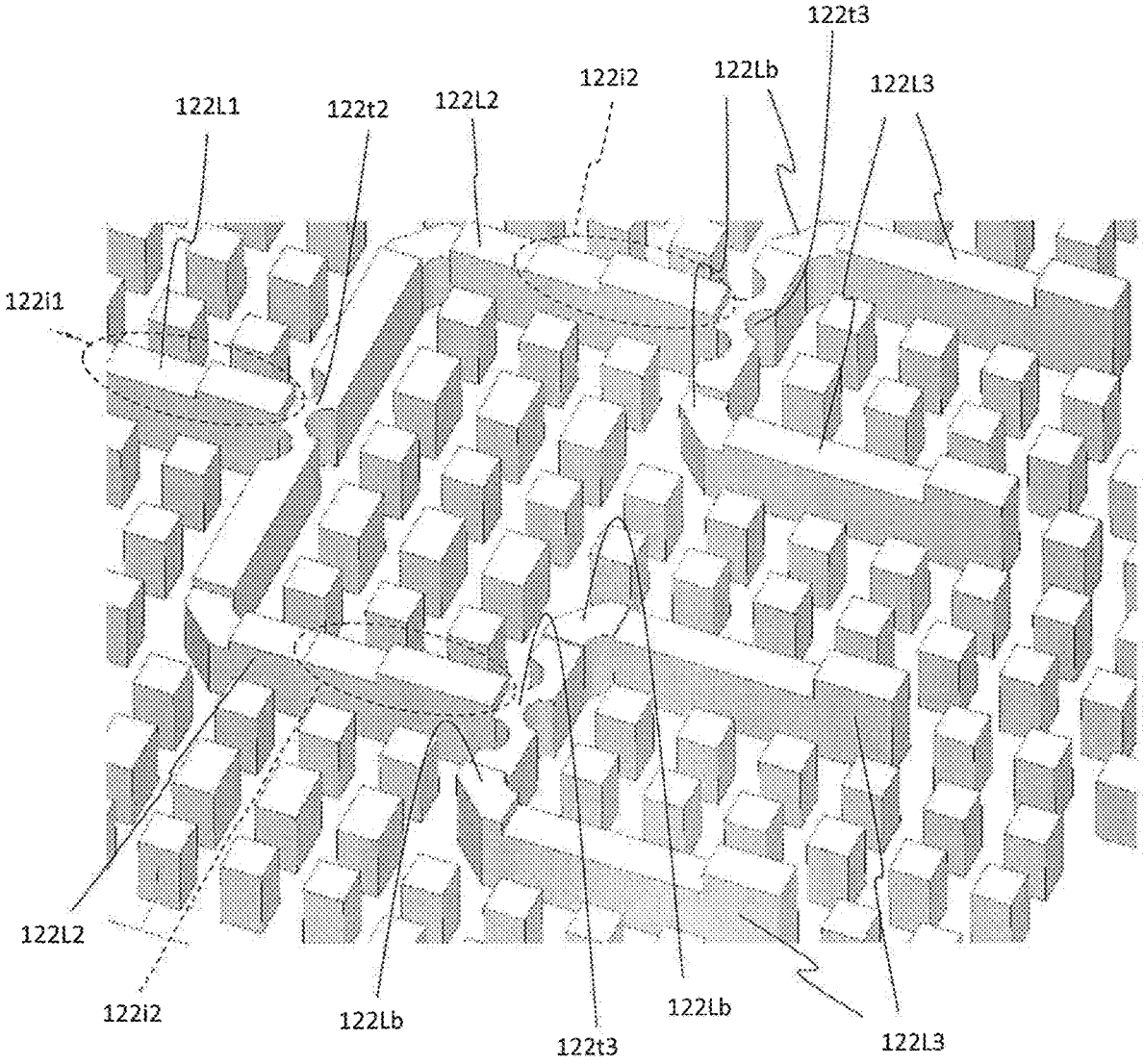
FIG. 48A is a diagram showing enlarged a portion of the waveguide member 122L shown in FIG. 47.

FIG. 48A is a diagram showing enlarged a portion (surrounded by a broken line) of the waveguide member 122L shown in FIG. 47. FIG. 48A shows only a half (4-port divider) of the waveguide member 122L having eight waveguide terminal sections 122L3. Among the four waveguide terminal sections 122L3 shown in the figure, the bends 122Lb of the outer (i.e., shown lower in FIG. 48A) two waveguide terminal sections 122L3 have bumps. On the other hand, the bends 122Lb of the inner (i.e., shown upper in the figure) two waveguide terminal sections 122L3 have dents. As for the bends 122Lb of the other four waveguide terminal sections 122L3 not shown in FIG. 48A, similarly, the outer bends 122Lb have bumps, while the inner bends 122Lb have dents. With this structure, signal wave reflection can be intentionally increased at the outer bends 122Lb, thus reducing the amplitude of signal waves traveling from the outer waveguide terminal sections 122L3 to the excitation layer. Thus, side lobes can be reduced.

Without being limited to the above structures, various structures for side lobe reduction may be adopted. For example, without altering the height of the bends 122Lb of at least two outer waveguide terminal sections 122L3 from the reference height (i.e., the height of any site without a dent or a bump), dents may be provided at the bends 122Lb of at least two inner waveguide terminal sections 122L3. Alternatively, without altering the height of the bends 122Lb of at least two inner waveguide terminal sections 122L3 from the reference height, bumps may be provided at the bends 122Lb of at least two outer waveguide terminal sections 122L3. The dent depth or the bump height may be different in all of the bends 122Lb, or may be equal among some of the bends 122Lb.

In the present embodiment, the amplitudes of signal waves that are coupled to the outer ports 145U (see FIG. 36B) are suppressed by making the height of the outer bends 122Lb higher than the height of the inner bends 122Lb; however, this structure is not a limitation. For example, a construction may be possible where corner beveling for the bends 122Lb illustrated in FIG. 48A is applied only to the inner bends 122Lb, and not to the outer bends 122Lb. Since corner beveling suppresses signal wave reflection, it is possible to selectively increase the amplitudes of the signal waves to be radiated from the inner slots 112 by beveling only the inner bends 122Lb. Alternatively, by making shape adjustments at sites other than the bends 122Lb, reflection may be suppressed at the inner side, while being enhanced at the outer side. For example, one possible structure may be where the three concavities in the side faces of each branching portion 122*t*3 shown in FIG. 48A are provided only in some of the inner branching portions 122*t*3. Similar effects can also be attained by a structure in which the path of signal wave propagation is varied in length or impedance between the inner and the outer.

For purposes other than reducing side lobes, at least one of the plurality of waveguide terminal sections 122L3 may have a shape which is different from the shape of another. The shape of each waveguide terminal section may be designed as appropriate, in accordance with the require performance of the array antenna.

In the present embodiment, the waveguide member 122L in the distribution layer may have an 8-port divider construction, or any other construction such as a 4-port divider, a 16-port divider, or a 32-port divider. In other words, in order to obtain the effects of the present embodiment, the waveguide member 122L may have a construction such that one stem branches into $2^N$ (where N is an integer of 2 or greater) waveguide terminal sections via combinations among a plurality of T-branching portions. In such a construction, the waveguide member having a conductive surface opposing the waveguide member 122L at least has $2^N$ ports opposing $2^N$ waveguide terminal sections. By ensuring that at least one of the $2^N$ waveguide terminal sections has a shape which is different from the shape of another, desired radiation characteristics can be realized in accordance with the purpose. While N=3 in the present embodiment, it may alternatively that N=2 or N≥4.

When N≥3, four waveguide terminal sections that are located central (inner) among the $2^N$ waveguide terminal sections may have a different shape from the shape of at least four waveguide terminal sections that are located outward of the four waveguide terminal sections. For example, the bend shapes of the four waveguide terminal sections that are located central may be dented, while the bend shapes of at least four waveguide terminal sections that are located outward of the four waveguide terminal sections may be bumps, whereby a side lobe reduction effect similar to that of the present embodiment can be obtained.

On the other hand, when N=2, two central waveguide terminal sections among the four waveguide terminal sections may have a different shape from the shape of the two waveguide terminal sections that are located outward of the two waveguide terminal sections. For example, the bend shapes of the two central waveguide terminal sections may be dented, while the bend shapes of the two waveguide terminal sections that are located outward of the two waveguide terminal sections may be bumps, whereby a side lobe reduction effect can be obtained for an array antenna having four rows of slots.

Next, the structure and effects of the impedance transforming sections according to the present embodiment will be described. In the following description, the impedance transforming sections 122*i*1 and 122*i*2 may be collectively referred to as the "impedance transforming sections 122*i*".

As shown in FIG. 48A, the waveguide member 122L in the distribution layer includes a plurality of impedance transforming sections 122*i* for increasing the capacitance of the waveguide, each at the stem 122L0 side of a respective one of the plurality of T-branching portions 122*t*. In the present embodiment, each impedance transforming section 122*i* is structured so as to decrease the distance between a waveguide face and the conductive surface of an opposing conductive member. In other words, each impedance transforming section 122*i* has a bump with a greater height than that of an adjacent portion. Each impedance transforming section 122*i* may include a broad portion in which the width (i.e., the dimension along a direction perpendicular to the direction that the waveguide face extends) of the waveguide face is broader than that of an adjacent portion. Broadening the width, instead of decreasing the distance between the waveguide face and the conductive surface of the conductive member, also provides a similar effect of capacitance increase. By appropriately setting the height (or the distance between the waveguide face and the conductive surface) or the width of each impedance transforming section 122*i*, the degree of impedance matching in the branching portion 122*t* can be enhanced.

In the example shown in FIG. 48A, each impedance transforming section 122*i* includes a first transforming subsection being adjacent to a branching portion 122*t* and having a constant height, and a second transforming subsection which adjoins the first transforming subsection on the opposite side from the branching portion 122*t* and having a constant height. The height of the first transforming subsection is greater than the height of the second transforming subsection. In the case of altering the width rather than the height, the width of the first transforming subsection is broader than the width of the second transforming subsection. Without being limited to a construction where the height or width is altered in two steps, each impedance transforming section 122*i* may be arranged so that the height or width is altered in one step, or three or more steps.

In the waveguide member 122L, the length of a portion of the same height along the waveguide would typically be set to about ¼ of the wavelength of a signal wave within the waveguide; unlike this, however, the present embodiment adopts a value which is distant from such values.

In the present embodiment, among the plurality of impedance transforming sections 122*i*, the length of a first impedance transforming section 122*i*1 which is relatively far from the waveguide terminal section 122L3, as taken along the waveguide, is shorter than the length of a second impedance transforming section 122*i*2 which is relatively close to the waveguide terminal section 122L3, as taken along the waveguide. In the example of FIG. 48A, a first impedance transforming section 122*i*1 is at the first branch 122L1, while a second impedance transforming section 122*i*2 is at each second branch 122L2.

Figure 48B:
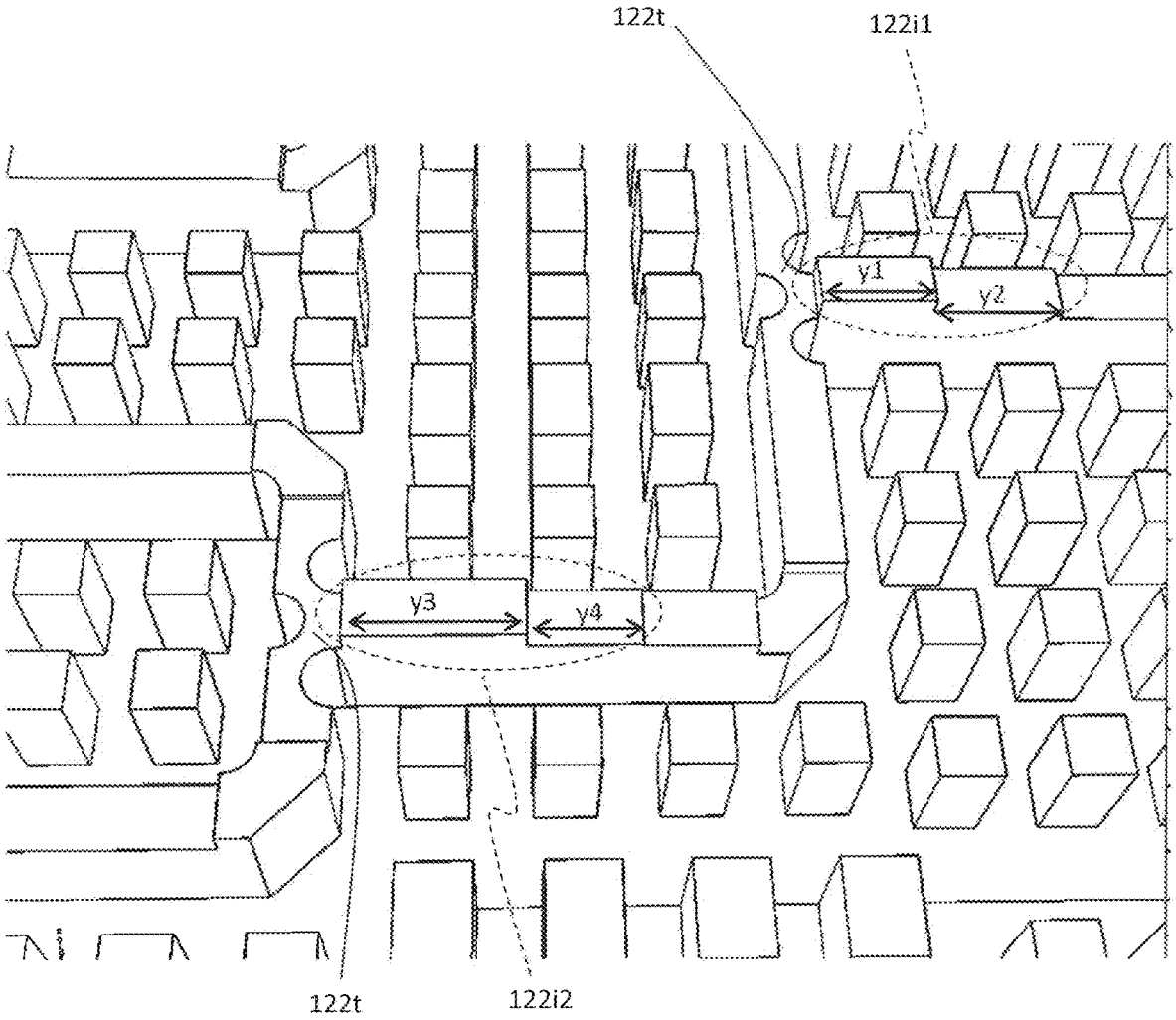
FIG. 48B is a diagram for describing dimensions of impedance transforming sections 122*i*1 and 122*i*2.

FIG. 48B is a diagram for describing dimensions of the impedance transforming sections 122*i*1 and 122*i*2. In the first impedance transforming section 122*i*1, assume that the first transforming subsection closer to the branching portion has a length y1 along the waveguide, and that the second transforming subsection farther from the branching portion has a length y2 along the waveguide. Similarly, in the second impedance transforming section 122*i*2, assume that the first transforming subsection closer to the branching portion has a length y3 along the waveguide and that the second transforming subsection farther from the branching portion has a length y4 along the waveguide. In the present embodiment, $y1<y2$, $y3>y4$, and $y3>y1$ are satisfied. Example values of y1, y2, y3 and y4 may be: y1=1.0 mm; y2=1.15 mm; y3=1.4 mm; and y4=0.9 mm.

Thus, in the present embodiment, in a direction along the waveguide, the first transforming subsection of the first impedance transforming section 122*i*1 is shorter than the first transforming subsection of each second impedance transforming section 122*i*2. Moreover, in a direction along the waveguide, the first transforming subsection (length y1) of the first impedance transforming section **122*i*1 is shorter than the second transforming subsection (length y2) of the first impedance transforming section 122*i*1, and the first transforming subsection (length y3) of each second impedance transforming section 122*i*2 is longer than the second transforming subsection (length y4) of the second impedance transforming section 122*i*2. Moreover, of the first transforming subsection of the first impedance transforming section 122*i*1, the end that is closer to the waveguide terminal section 122L3 reaches the branching portion 122*t* which is the farther from the waveguide terminal sections 122L3; on the other hand, of the first transforming subsection of each second impedance transforming section 122*i*2, the end that is closer to the waveguide terminal sections 122L3 does not reach the branching portion 122*t* which is the closer to the waveguide terminal section 122L3. This construction successfully enhances the degree of impedance matching in the branching portion 122*t***, as compared to a generic impedance transformer in which the lengths of all transforming subsections are set to ¼ of the propagation wavelength.

Although the present embodiment illustrates that the third conductive member 140 (distribution layer) has an 8-port divider construction, the second conductive member 120 (excitation layer) may also have a similar construction. In other words, the plurality of waveguide terminal sections 122L3 may oppose the plurality of slots 112 in the first conductive member 110. Such a construction will control an in-plane distribution of the excitation amplitude of the array antenna, thus reducing propagation losses at the branching portions **122*t***.

Embodiment 5

Figure 49:
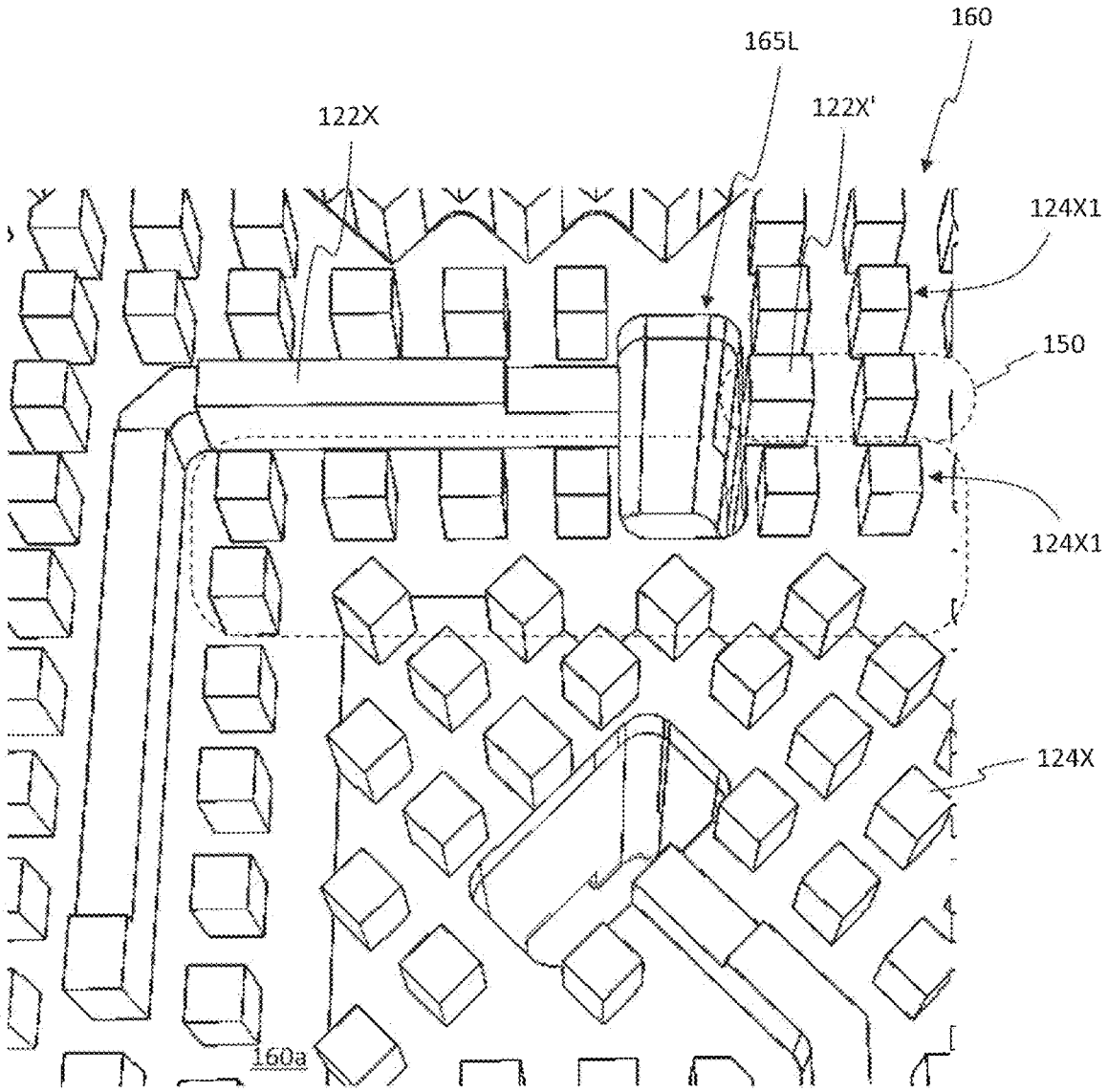
FIG. 49 is a perspective view showing a partial structure of a fourth conductive member 160 according to Embodiment 5.

FIG. 49 is a perspective view showing a partial structure of a fourth conductive member 160 according to Embodiment 5. The fourth conductive member 160 according to the present embodiment includes: a rectangular hollow-waveguide 165L at a position adjacent to one end of a waveguide member 122X; and a choke structure 150 at a position opposing the one end of the waveguide member 122X via the rectangular hollow-waveguide 165L. The rectangular hollow-waveguide 165L communicates from the conductive surface of the fourth conductive member 160 on the rear side to the waveguide extending above the waveguide member 122X. The rectangular hollow-waveguide 165L couples an electronic circuit (e.g., an MMIC), which generates or receives a signal wave (radio frequency signal), to the fourth conductive member 160. That is, a signal wave which is generated by the electronic circuit passes through the rectangular hollow-waveguide 165L to propagate in the waveguide member 122X from one end to the other end, and is sent from this other end, via a port, to an upper layer (i.e., the distribution layer or the excitation layer). On the other hand, a signal wave which is sent to the other end of the waveguide member 122X from an antenna element propagates through the waveguide member 122X to the one end, and passes through the rectangular hollow-waveguide 165L to be sent to the electronic circuit.

As viewed from the normal direction of the conductive surface **160*a* of the fourth conductive member 160, the rectangular hollow-waveguide 165**L has a rectangular shape that is defined by a pair of longer sides and a pair of shorter sides orthogonal to the longer sides. Herein, a "rectangular shape" is not limited to a strict rectangle. For example, shapes with round corners, and shapes in which at least one of the longer side pair and the shorter side pair is deviated from being parallel by a small angle, are also encompassed within "rectangular shapes".

One of the pair of longer sides of the rectangular hollow-waveguide 165L is in contact with one end of the waveguide member 122X. The other of the pair of longer sides is in contact with a side face of a choke ridge 122X', which is a constituent element of the choke structure 150. The choke ridge 122X' might also be regarded as a portion of the waveguide member 122X as split by the rectangular hollow-waveguide 165L. The dimension of the choke ridge 122X' along the direction that the waveguide member 122X extends is slightly larger than that of each rod 124X. The choke structure 150 is constituted by the choke ridge 122X' and several rods 124X along its extension. Note that rods 124X may alternatively serve as the choke ridge 122X'.

The plurality of rods 124X on the fourth conductive member 160 include two or more rows of rods 124X which are arrayed on both sides of the waveguide member 122X in a direction along the waveguide member 122X. Also on both sides of the choke ridge 122X', two or more rows of rods 124X are provided. In FIG. 49, for reference sake, two rows of rods that are adjacent to the waveguide member 122X and the choke ridge 122X' are indicated by broken lines. Among the rows of rods extending along the waveguide member 122X so as to be adjacent to the waveguide member 122X on both sides, the rectangular hollow-waveguide 165L splits the first rod rows 124X1, but does not reach the second rod rows. More specifically, the length of each longer side of the rectangular hollow-waveguide 165L is at least longer than twice the shortest distance between the centers of two rows of rods, and shorter than 3.5 times the shortest distance between the centers thereof. The length of each shorter side of the rectangular hollow-waveguide 165L is shorter than 1.5 times the aforementioned shortest distance between the centers.

With such a rectangular hollow-waveguide 165L, when an electronic circuit such as an MMIC and a waveguide are connected, the signal wave energy is restrained from leaking, whereby the performance of the array antenna device can be improved.

Embodiment 6

This Embodiment 6 and the next Embodiment 7 relate to the size of conductive rods and the period with which they are arranged.

Embodiments 6 and 7 are similar in that each conductive rod has a prismatic shape, and that the period with which the conductive rods are arranged is altered by changing the size of its "polygonal sides". As used herein, a "polygonal side" is a polygonal side along the X direction or the Y direction in FIG. 3, as observed when a conductive rod of a prismatic shape is viewed from the normal direction of the conductive surface. Hereinafter, the ratio between the length of an X-direction polygonal side and the length of a Y-direction polygonal side of a conductive rod is referred to as an "aspect ratio" of the conductive rod.

In the preceding embodiments, the leading end **124*a* of each conductive rod illustrated in the figures is shown to have a substantially square planar shape. In other words, their aspect ratio is substantially 1 (see, for example, FIG. 17**).

In the present embodiment and the next Embodiment 7, an artificial magnetic conductor is composed of conductive rods each having a non-square planar shape with an aspect ratio that is not 1. A difference between the present embodiment and the next Embodiment 7 is that: in the present embodiment, the polygonal side of each conductive rod along a direction which is parallel to the direction that an adjacent waveguide member extends (the Y direction) is reduced in size; in the next Embodiment 7, the polygonal side of each conductive rod along a direction which is perpendicular to the direction that an adjacent waveguide member extends (the X direction) is reduced in size. Although the X-direction polygonal side of each conductive rod is increased in size in the present embodiment, this is due to their positional relationship with the adjacent waveguide member.

As described above, by forming rises and falls on the waveguide face of the waveguide member, and varying the distance between the waveguide face and the conductive surface of the opposing conductive member along the waveguide, it is possible to reduce the wavelength of a signal wave which propagates on the waveguide. In addition or in the alternative, the wavelength of a signal wave which propagates on the waveguide can be reduced also by varying the width of the waveguide face along the waveguide. The inventors have examined this with respect to a certain example, which showed that, given a central wavelength $\lambda r$ of a signal wave propagating on a waveguide face without rises and falls, for example, the wavelength $\lambda g$ of a signal wave propagating on a waveguide face with rises and falls was $\lambda g=0.61\lambda r$. For example, if $\lambda r=4.5$ mm, it was reduced to $\lambda g=2.75$ mm.

Thus, the inventors have decided to, rather than determining the interval between conductive rods on the basis of the wavelength $\lambda r$, change the size of conductive rods in a manner of accounting for the reduced wavelength $\lambda g$. This makes allows the artificial magnetic conductor to have an improved effect of suppressing leakage of electromagnetic waves (signal waves).

Hereinafter, the construction of the conductive rods according to the present embodiment will be described.

While the present embodiment again relates to the construction of an array antenna device, what will mainly be described below is, with respect to the second conductive member 120 (on which conductive rods and waveguide members are provided) of an array antenna device, the structure and arrangement of the conductive rods. Note that the following description is applicable not only to the second conductive member 120, but also to the third conductive member 140 and/or the fourth conductive member 160. As for those constituent elements of the array antenna device which will not be described here, the foregoing description concerning the array antenna device is to be relied on, because their description is not being repeated. Note that, instead of on the second conductive member 120, the plurality of conductive rods may be provided on the conductive surface of the first conductive member opposing each waveguide member.

Figure 50A:
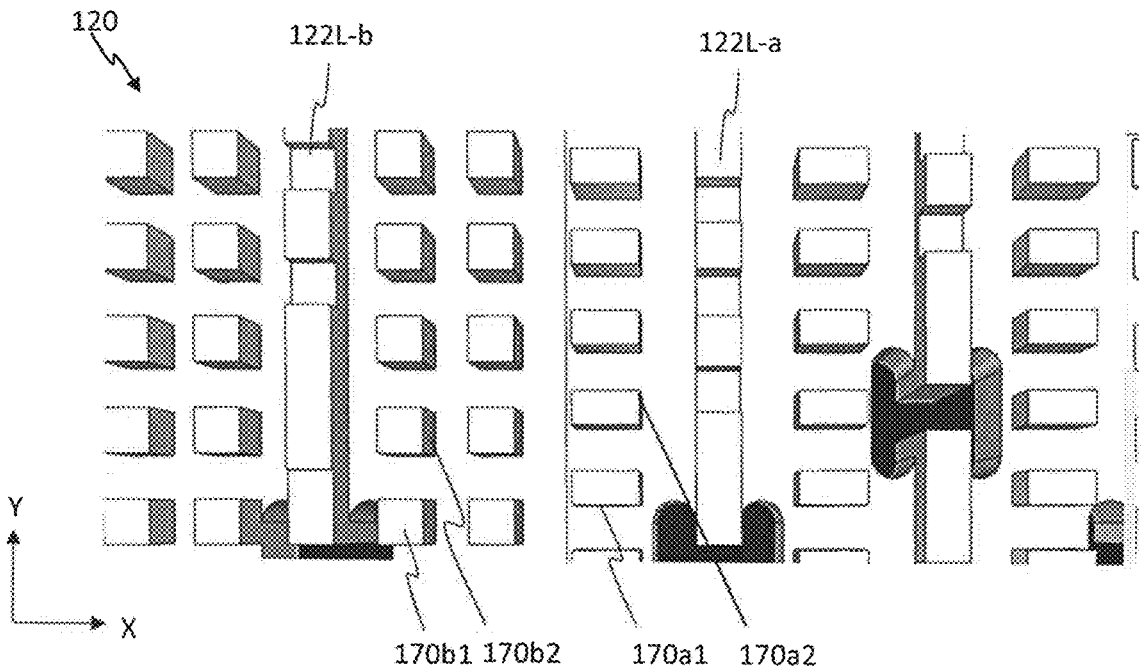
FIG. 50A shows a second conductive member 120 including conductive rods 170*a*1 and 170*a*2 whose aspect ratio is not 1, according to Embodiment 6.

FIG. 50A shows a second conductive member 120 including conductive rods 170*a*1 and 170*a*2 whose aspect ratio is not 1, according to the present embodiment. The second conductive member 120 also includes conductive rods 170*b*1 and 170*b*2 having an aspect ratio of 1. As will be understood from FIG. 50A, regarding the Y direction, conductive rods of identical shapes are arrayed at equal intervals. This will be expressed in the present embodiment as "conductive rods being in a periodic array". In the following, a plurality of conductive rods that are disposed in a periodic array along the Y direction, each conductive rod having an aspect ratio of 1, will be referred to as a "standard conductive rod group" or "standard conductive rods". On the other hand, a plurality of conductive rods that are disposed in a periodic array along the Y direction, each conductive rod having an aspect ratio which is not 1, will be described a "high-density conductive rod group" or "high-density conductive rods". The "high-density conductive rod group" may also be referred to as the "first rod group", and the "standard conductive rod group" as the "second rod group". As viewed from the normal direction of the conductive surface of the conductive member supporting these rod groups, each of the plurality of conductive rods (first rods) in the first rod group has a non-square shape such that its polygonal sides extending in a direction along the waveguide are longer than the other polygonal sides. On the other hand, as viewed from the normal direction of the aforementioned conductive surface, each of the plurality of conductive rods (second rods) in the second rod group has a square shape.

Figure 50B:
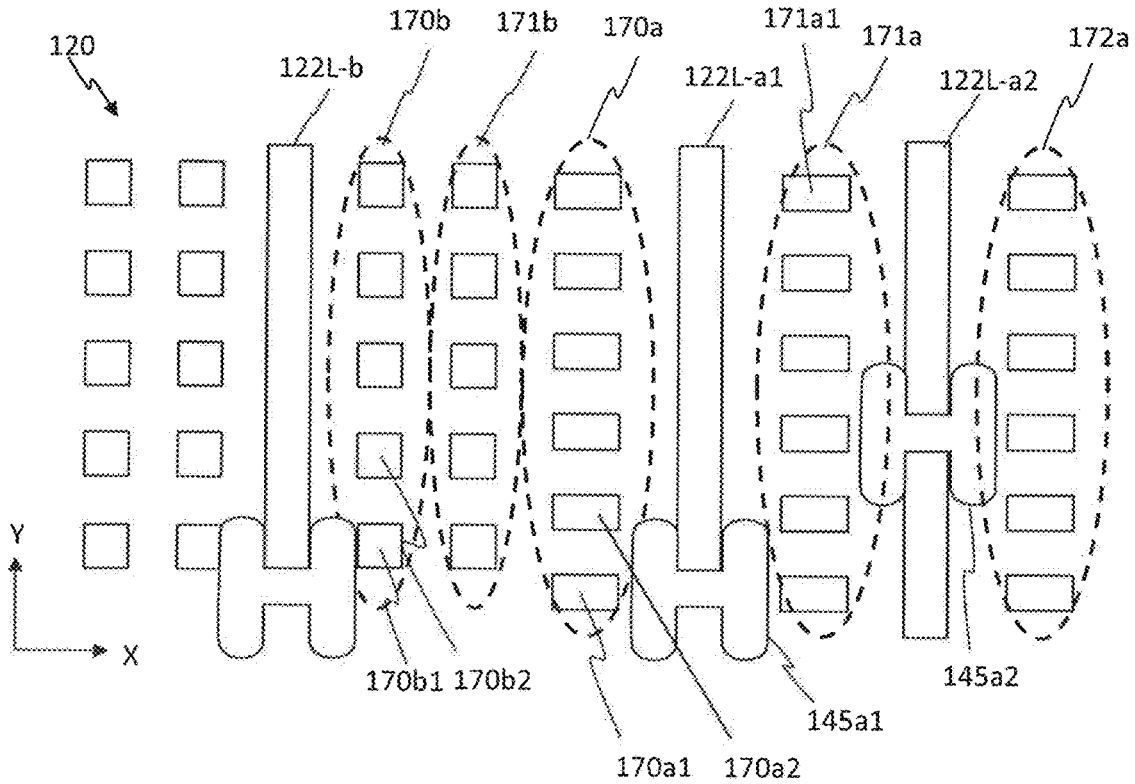
FIG. 50B is an upper plan view schematically showing high-density conductive rod groups 170*a*, 171*a* and 172*a* and standard conductive rod groups 170*b* and 171*b*

FIG. 50B is an upper plan view schematically showing the high-density conductive rod groups 170*a*, 171*a* and 172*a* and the standard conductive rod groups 170*b* and 171*b*.

As described above, it is in answer to adopting a waveguide face which provides a wavelength reduction effect that the high-density conductive rods are provided in the present embodiment. Therefore, the high-density conductive rods are to be provided adjacent to a waveguide member which provides a wavelength reduction effect of at least a predetermined level or greater. On the other hand, at any position that is not adjacent to such a waveguide member, standard conductive rods are provided rather than high-density conductive rods.

FIG. 50B shows waveguide members 122L-a1 and 122L-a2 that provide a wavelength reduction effect. At positions adjacent to these waveguide members, the high-density conductive rod groups 170*a*, 171*a* and 172*a* are provided. On the other hand, at a position not adjacent to these waveguide members, the standard conductive rod group 171*b* is provided. The standard conductive rod group 170*b* is being provided adjacent to a waveguide member 122L-b that does not provide a wavelength reduction effect of a predetermined level or greater.

First, the standard conductive rod groups 170*b* and 171*b* will be described. For instance, the conductive rods 170*b*1 and 170*b*2 included in the standard conductive rod group 170*b* will be described. The leading ends of the conductive rods 170*b*1 and 170*b*2 have square planar shapes, with an aspect ratio of 1. The interval between the conductive rods 170*b*1 and 170*b*2 (i.e., the distance of their gap along the Y direction) is designed to be substantially equal to the length of one side of this square.

To give a specific example, each polygonal side of the conductive rods 170*b*1 and 170*b*2 may be 0.5 mm, and the interval between the conductive rods may also be 0.5 mm. In other words, regarding the Y direction, the conductive rod group 170*b* is arranged so that conductive rods having 0.5 mm polygonal sides are disposed in a periodic array at intervals of 0.5 mm.

Next, the high-density conductive rod groups 170*a*, 171*a* and 172*a* will be described. For instance, conductive rods 170*a*1 and 170*a*2 included in the high-density conductive rod group 170*a* will be described. The leading ends 124*a* of the conductive rods 170*a*1 and 170*a*2 have rectangle planar shapes, with an aspect ratio which is not 1. The length of their Y-direction polygonal sides is shorter than the length of the polygonal sides of the conductive rods 170*b*1 and 170*b*2. On the other hand, the interval between the conductive rods 170*a*1 and 170*a*2 (i.e., the distance of their gap along the Y direction) is equal to the interval between the conductive rods 170$b$1 and 170$b$2 in the present embodiment.

To give a specific example, each polygonal side of the conductive rods 170$a$1 and 170$a$2 along the Y direction may be 0.325 mm, and the interval between the conductive rods may be 0.5 mm. In other words, regarding the Y direction, the high-density conductive rod group 170$a$ is arranged so that conductive rods having 0.325 mm polygonal sides are disposed in a periodic array at intervals of 0.5 mm.

In a comparison between the period with which the conductive rods in the high-density conductive rod groups 170$a$, 171$a$ and 172$a$ are arrayed and the period with which the conductive rods in the standard conductive rod groups 170$b$ and 171$b$ are arrayed, it is the latter that is longer. In the above specific example, the latter is 0.175 mm longer per period. Therefore, given a range of the same length, a greater number of conductive rods can be provided in each high-density conductive rod group. Thus, leakage of a signal wave propagate in the waveguide member can be suppressed more effectively.

Hereinafter, the dimension and arrangement of the conductive rods, along the X direction, that compose each high-density conductive rod group will also be described. Attention will be paid to a conductive rod 171$a$1 in the high-density conductive rod group 171$a$ in FIG. 50B.

As has been described in "(1) width of the conductive rod" above, the width (i.e., the size along the X direction and along the Y direction) of a conductive rod may be set to be less than $\lambda m/2$, and more preferably less than $\lambda 0/4$.

Thus, the inventors have set the size of the conductive rod 171$a$1 along the X direction to be less than $\lambda 0/4$. In addition, it is ensured that the distance (i.e., the size of the gap; the same definition will also apply below) between the conductive rod 171$a$1 and the waveguide member 122L-a1, and the distance between the conductive rod 171$a$1 and the waveguide member 122L-a2, are greater than those in the standard conductive rod groups.

To give a specific example, the width of the conductive rod 171$a$1 along the X direction is 0.75 mm ($=0.19\lambda 0$), which is 0.25 mm longer than that of the conductive rod 170$b$1. The distance between the conductive rod 171$a$1 and the waveguide member 122L-a1, and the distance between the conductive rod 171$a$1 and the waveguide member 122L-a2, are both 0.625 mm ($=0.16\cdot\lambda 0$)), which is 0.125 mm longer than the distance between the conductive rod 170$b$1 and the waveguide member 122L-b.

In FIG. 50A, not only the waveguide member 122L-a but also the waveguide member 122L-b has rises and falls formed on its waveguide face. Therefore, high-density conductive rod groups may be provided on both sides of the waveguide member 122L-b, too. In the present embodiment, more rises and falls are formed on the waveguide member 122L-a than on the waveguide member 122L-b, thus resulting in a greater wavelength reduction effect. Accordingly, high-density conductive rod groups 170$a$, 171$a$ and 172$a$ are formed as conductive rod groups on both sides of the waveguide members 122L-a1 and 122L-a2. The criterion as to which one of a high-density conductive rod group or a standard conductive rod group is to be provided may be appropriately determined. For example, given a central wavelength $\lambda r$ of a signal wave propagating on a waveguide face that does not provide a wavelength reduction effect, and a wavelength $\lambda g$ of a signal wave propagating on a waveguide face that provides a wavelength reduction effect, a high-density conductive rod group may be provided when $\lambda g<0.80\lambda r$, while a standard conductive rod group may be provided when $\lambda g\geq 0.80\lambda r$.

In the present embodiment, the period with which the conductive rod groups 170$a$, 171$a$ and 172$a$ are disposed are arranged along the Y direction (i.e., the distance between the centers of adjacent rods) is equal to ½ of the distance between a port 145$a$1 in the waveguide member 122L-a1 and a port 145$a$2 in the waveguide member 122L-a2, as taken along the Y direction. By choosing such a period, even though the ports 145$a$1 and 145$a$2 are at different positions along the Y direction, the horizontal portions (lateral portions) of the H-shaped ports 145$a$1 and 145$a$2 along the Y direction are aligned with the positions of the respectively adjacent conductive rods 171$a$ along the Y direction. By choosing such relative positioning, the states of electric fields near the ports 145$a$1 and 145$a$2 can be made identical. The period with which the conductive rods 170$a$, 171$a$ and 172$a$ may be arranged along the Y direction in order for this effect to be attained is not limited to ½ of the period with which the port 145$a$1 and the port 145$a$2 are disposed along the Y direction. Stated more generally, a dimension which is an integer fraction of 1 (where the integer includes 1) can be selected. In the case where maintaining identical states of electric fields is the purpose, it is not necessary to adopt any waveguide face that provides a wavelength reduction effect.

Embodiment 7

The preceding embodiments have illustrated, as shown in e.g. FIG. 26 or FIG. 31, structures where one conductive member has a plurality of waveguide members thereon, such that a signal wave for transmission and/or a signal wave for reception propagates in a plurality of waveguides that are created by the conductive member opposing the plurality of waveguide members, the waveguide members themselves, and an artificial magnetic conductor.

When a plurality of waveguide members are provided, their interval affects the reception performance and/or the transmission performance of the antenna array. For example, the interval between the plurality of waveguide members provided in the excitation layer determines the arraying interval of antenna elements (i.e., the interval between the centers of two adjacent antenna elements). As has already been described, if the interval between the centers of two adjacent antenna elements becomes greater than the wavelength of an electromagnetic wave used, grating lobes will appear in the visible region of the antenna. When the arraying interval between antenna element further increases, the directions of grating lobes will become closer to the direction of the main lobe. This makes it necessary to reduce the arraying interval of the antenna elements, i.e., the interval between waveguide members. Moreover, in order to expand the angular range in which the antenna array is capable of reception, the waveguide members in the excitation layer need to be provided at smaller intervals.

When the interval between waveguide members is reduced, the number of conductive rod rows to be provided therebetween may become restricted. For example, depending on the interval between two adjacent waveguide members, it may only be possible for one row of conductive rods to be provided, which may not achieve adequate electromagnetic isolation between the waveguide faces. This results in a possibility that an electromagnetic wave propagating within a given waveguide may leak out to an adjacent waveguide face.

Accordingly, regarding any conductive rod that is disposed adjacent to a waveguide member, the inventors have decided to reduce the size of its polygonal side extending in a direction perpendicular to the waveguide member (i.e., the X direction), within a plane which is parallel to the waveguide member. This ensures that each waveguide member is surrounded by at least two rows of conductive rods, whereby sufficient electromagnetic isolation between the waveguide faces can be achieved.

Hereinafter, the construction according to the present embodiment will be described.

While the present embodiment again relates to the construction of an array antenna device, what will mainly be described below is, with respect to the second conductive member 120 (on which conductive rods and waveguide members are provided) of an array antenna device, the structure and arrangement of the conductive rods. Note that the following description is applicable not only to the second conductive member 120, but also to the third conductive member 140 and/or the fourth conductive member 160. As for those constituent elements of the array antenna device which will not be described here, the foregoing description concerning the array antenna device is to be relied on, because their description is not being repeated. Note that, instead of on the second conductive member 120, the plurality of conductive rods may be provided on the conductive surface of the first conductive member opposing each waveguide member.

Figure 51A:
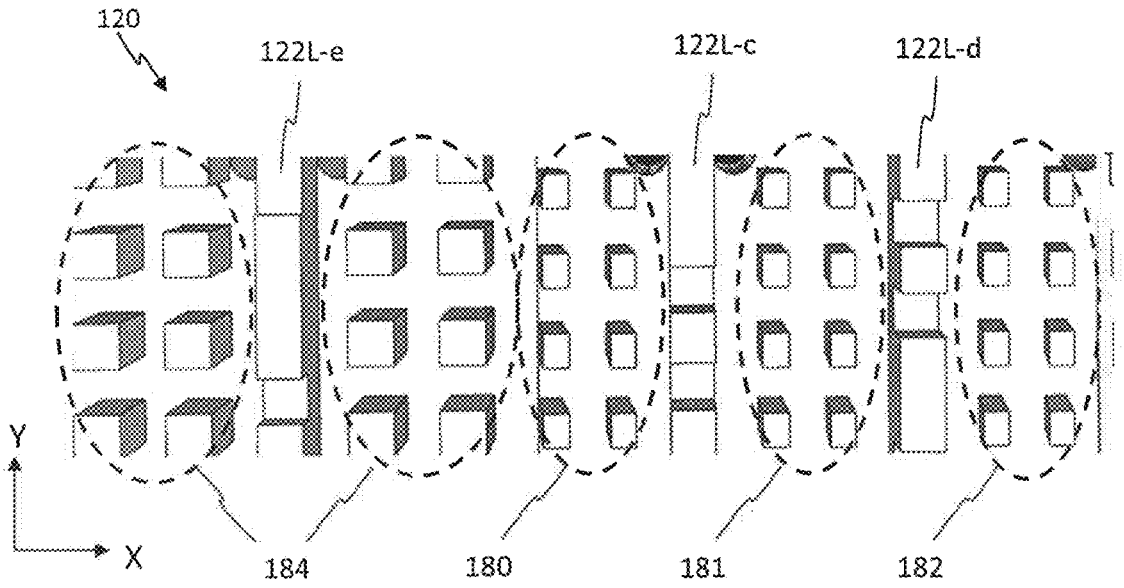
FIG. 51A is a diagram showing two waveguide members 122L-c and 122L-d each surrounded by two rows of conductive rods on both sides.

FIG. 51A shows two waveguide members 122L-c and 122L-d each surrounded by two rows of conductive rods on both sides. The waveguide member 122L-c is surrounded by a two-row conductive rod group 180 and a two-row conductive rod group 181. The waveguide member 122L-d is surrounded by a two-row conductive rod group 181 and a two-row conductive rod group 182. The Y-direction dimension of each conductive rod in the two-row conductive rod groups 180 to 182 is longer than its X-direction dimension. For reference sake, FIG. 51A also shows a waveguide member 122L-e and two standard conductive rod groups 184 arrayed on both sides thereof.

Hereinafter, each conductive rod in the conductive rod groups 180 to 182 will be referred to as a "conductive rod according to the present embodiment", whereas each conductive rod in each standard conductive rod group 184 will be referred to as a "standard conductive rod". It will be understood that the conductive rod according to the present embodiment is smaller than the standard conductive rod.

Figure 51B:
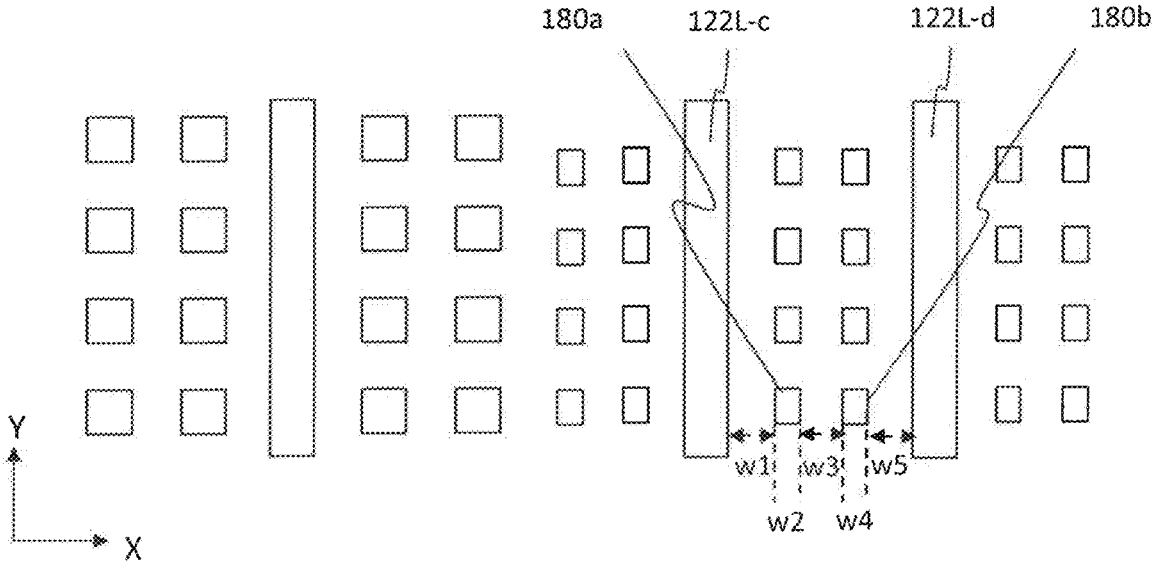
FIG. 51B is an upper plan view schematically showing dimensions and arrangement of conductive rods according to the present embodiment.

FIG. 51B is an upper plan view schematically showing dimensions and arrangement of conductive rods according to the present embodiment. As conductive rods according to the present embodiment, two adjacent conductive rods 180*a* and 180*b* along the Y direction will be discussed.

The span from the waveguide member 122L-c to the waveguide member 122L-d may be divided up as follows.

w1: distance from the waveguide member 122L-c to the conductive rod 180*a* w2: width of the conductive rod 180*a* along the X direction w3: distance from the conductive rod 180*a* to the conductive rod 180*b* w4: width of the conductive rod 180*b* along the X direction w5: distance from the conductive rod 180*b* to the waveguide member 122L-d The present embodiment conveniently assumes that w2=w4, w1=w5. However, this is not an essential requirement.

As described above, w2 and w4 are shorter than the width of a standard conductive rod along the X direction in the present embodiment. For example, if the width of a standard conductive rod along the X direction is λ0/8, then w2 and w4 may be λ0/16. This allows w3 to be about λ0/8. If w1 and w5 are allowed to be λ0/8, then the interval from the waveguide member 122L-c to the waveguide member 122L-d will be about λ0/2.

On the other hand, on the XY plane, if a standard conductive rod is a square having polygonal sides that are λ0/8 long and the interval between two rows of rods is also λ0/8, then the interval between the two waveguide members is λ0·5/8. Therefore, the interval between the two waveguide members is shorter in the construction of the present embodiment.

The dimension of a conductive rod according to the present embodiment along the Y direction is set to be longer than its dimension along the X direction. Thus, strength of each conductive rod is ensured. However, along the Y direction as well, the dimension of a conductive rod according to the present embodiment can be made shorter than the dimension of a standard conductive rod. This allows the high-density conductive as described in Embodiment 6 to be provided.

Embodiments 6 and 7 above illustrate that conductive rods have prismatic shapes. Alternatively, the conductive rods may have cylindrical shapes. In that case, the radius of each cylinder may be decreased, for example, thus to improve the density with which the conductive rods are disposed in a direction along the waveguide member, or to increase the number of rows of conductive rods to be disposed between mutually adjacent waveguide members. Alternatively, the conductive rods may be composed of elliptic cylinders rather than cylinders, where the longer side and the shorter side as referred to in the above description for a rectangle should read as the major axis and the minor axis of an ellipse, respectively.

(Specific Example of Array Antenna Device)

Thus, illustrative embodiments of the present invention have been described above. Hereinafter, with reference to FIG. 52, FIG. 53 and FIGS. 54A through 54D, a specific exemplary construction for an array antenna device including the construction according to each embodiment above will be described.

Figure 52:
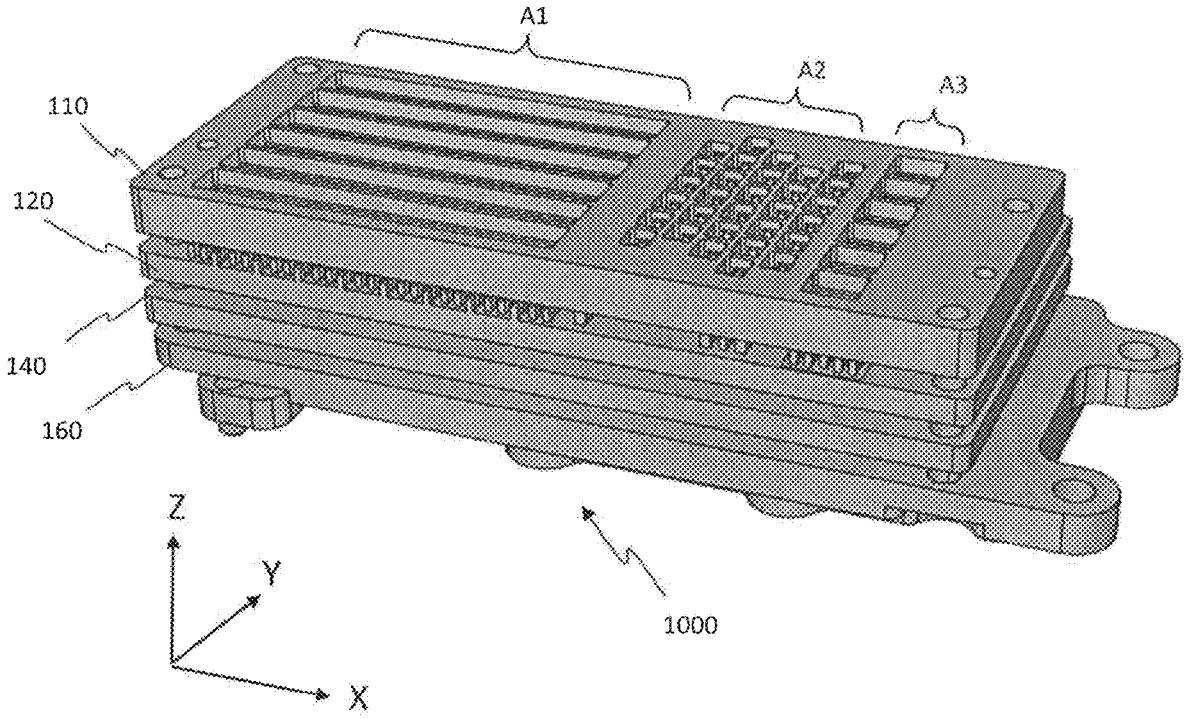
FIG. 52 is a three-dimensional perspective view of an exemplary array antenna device 1000.
Figure 53:
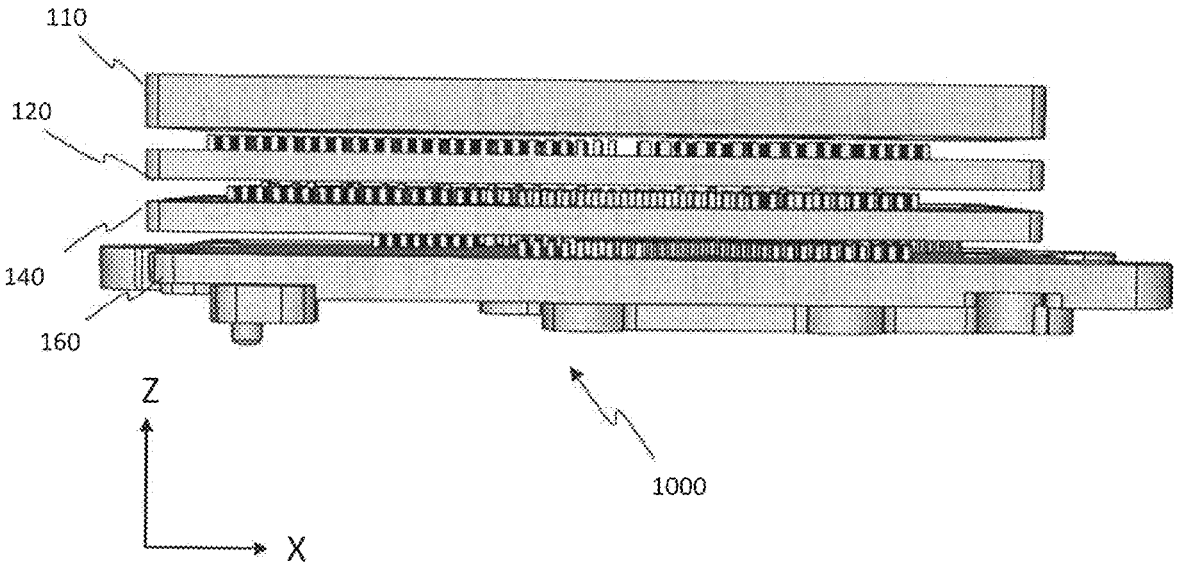
FIG. 53 is a side view of the array antenna device 1000.

FIG. 52 is a three-dimensional perspective view of an exemplary array antenna device 1000. FIG. 53 is a side view of the array antenna device 1000.

The array antenna device 1000 is composed of four conductive members which are layered upon one another. Specifically, in the +Z direction, a fourth conductive member 160, a third conductive member 140, a second conductive member 120, and a first conductive member 110 are layered in this order. The spacing between two opposing conductive members is as described above.

The respective port provided in each conductive member and the respective waveguide in the layer on its rear side (i.e., the −Z direction side) are disposed opposite to each other. For example, the conductive member 140 will be discussed. Between the waveguide face of a waveguide member which is provided on the conductive member 140 and the conductive surface of the conductive member 120 opposing the conductive member 140, a waveguide is created. The waveguide is connected to a port which is provided in the conductive member 140. On the conductive member 160 immediately below the port, a waveguide pertaining to that layer is created at a position opposing the port. This allows a signal wave to propagate through the port to the lower layer. Conversely, a signal wave which is generated by an electronic circuit 310, e.g., MMIC, (FIG. 13D) is able to propagate to the upper layer.

As shown in FIG. 52, the array antenna device 1000 includes three kinds of antennas A1 to A3. For example, the antennas A1 and A3 may be transmission antennas for use in transmitting a signal wave, and the antenna A2 may be a reception antenna for use in receiving a signal wave. In the array antenna device 1000, independent waveguides are created respectively corresponding to the antennas A1 to A3.

Figure 54A:
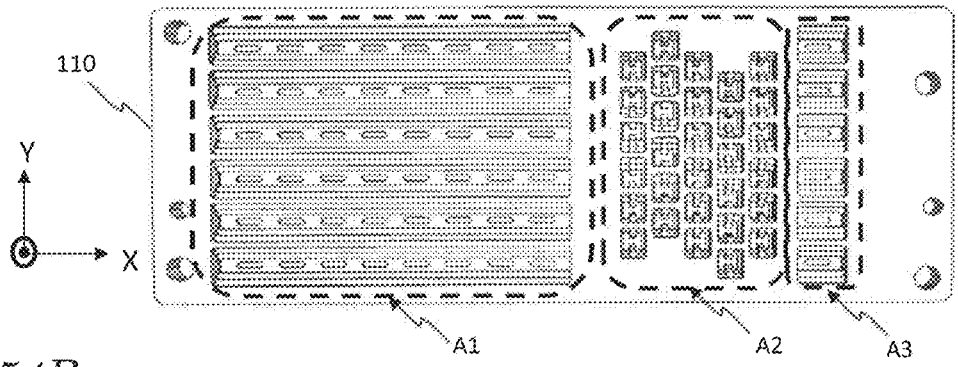
FIG. 54A is a diagram showing a first conductive member 110, which is a radiation layer.
Figure 54B:
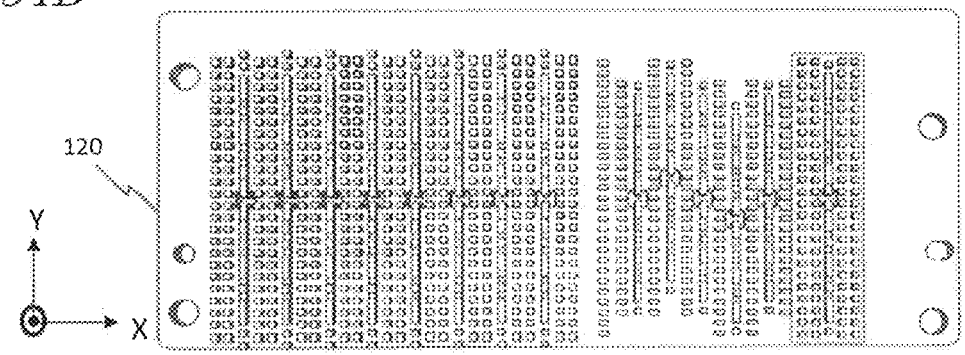
FIG. 54B is a diagram showing a second conductive member 120, which is an excitation layer.
Figure 54C:
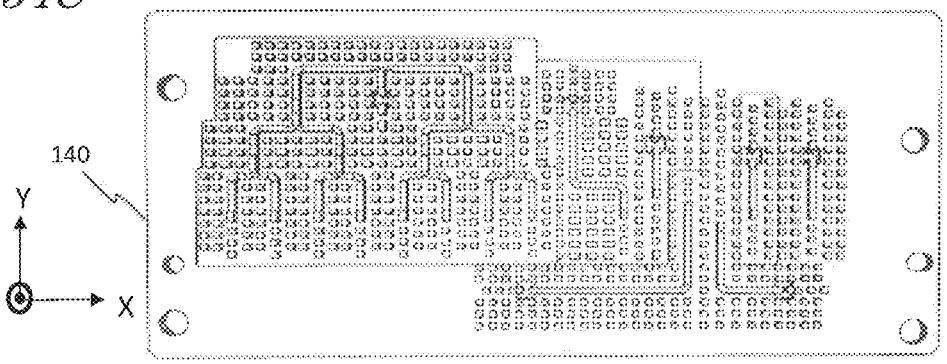
FIG. 54C is a diagram showing a third conductive member 140, which is a distribution layer.
Figure 54D:
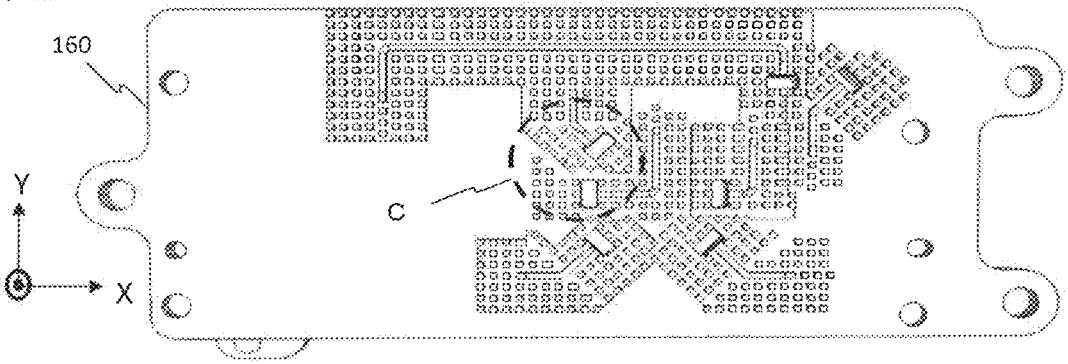
FIG. 54D is a diagram showing a fourth conductive member 160, which is a connection layer.

FIGS. 54A through 54D are front views showing specific constructions for, respectively, the first conductive member 110, the second conductive member 120, the third conductive member 140, and the fourth conductive member 160, when looking in the −Z (the rear side) direction from the +Z (the front side) direction. FIG. 54A shows the first conductive member 110, which is a radiation layer. FIG. 54B shows the second conductive member 120, which is an excitation layer. FIG. 54C shows the third conductive member 140, which is a distribution layer. FIG. 54D shows the fourth conductive member 160, which is a connection layer.

FIG. 54A is referred to. In the array antenna device 1000, for example, the array antenna shown in FIG. 14A is adopted as the antenna A1. The antenna A1 is adjusted so that radiated electromagnetic waves will have a uniform distribution, whereby a high gain is realized.

As the antenna A2, the array antenna shown in FIG. 29 is adopted. As a result, an effect of reducing the array pitch of the antenna elements to a half is obtained, along the Y axis direction in the figure.

As the antenna A3, an array antenna including a plurality of horns 114 disposed side-by-side in each row, as in the construction shown in FIG. 12, is adopted. In the antenna A3, too, the array pitch of the antenna elements can be reduced along the Y axis direction in the figure.

Note that portion C surrounded by a broken circle in FIG. 54D indicates a connection structure as has been described with reference to FIG. 49. Each rectangular hollow-waveguide and each waveguide member provided in any other position are also connected by the same structure. In other words, preferably all of the connection structures in the fourth conductive member 160 are identical to the connection structure shown in FIG. 49; however, this is an example. It is not necessary for all connection structures to be universally the connection structure shown in FIG. 49.

<Variants>

Next, other variants of the waveguide member 122, the conductive members 110 and 120, and the conductive rod 124 will be described.

Figure 55A:
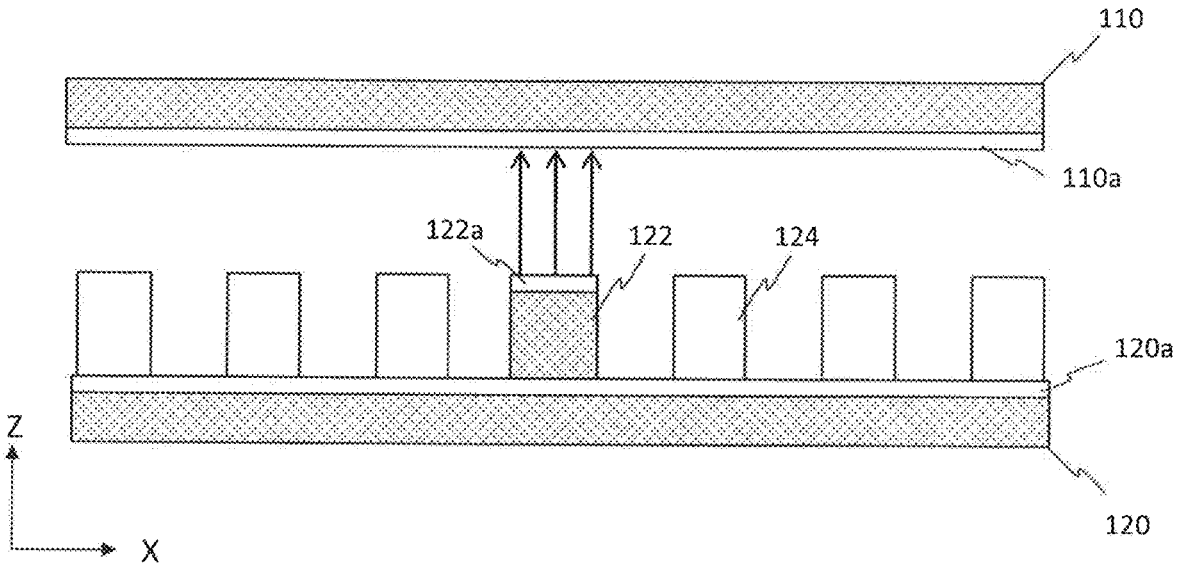
FIG. 55A is a cross-sectional view showing an exemplary structure where only a waveguide face 122*a*, defining an upper face of the waveguide member 122, is electrically conductive, while any portion of the waveguide member 122 other than the waveguide face 122*a* is not electrically conductive.

FIG. 55A is a cross-sectional view showing an exemplary structure in which only the waveguide face 122*a*, defining an upper face of the waveguide member 122, is electrically conductive, while any portion of the waveguide member 122 other than the waveguide face 122*a* is not electrically conductive. Both of the first conductive member 110 and the second conductive member 120 alike are only electrically conductive at their surface that has the waveguide member 122 provided thereon (i.e., the conductive surface 110*a*, 120*a*), while not being electrically conductive in any other portions. Thus, each of the waveguide member 122, the first conductive member 110, and the second conductive member 120 does not need to be electrically conductive.

Figure 55B:
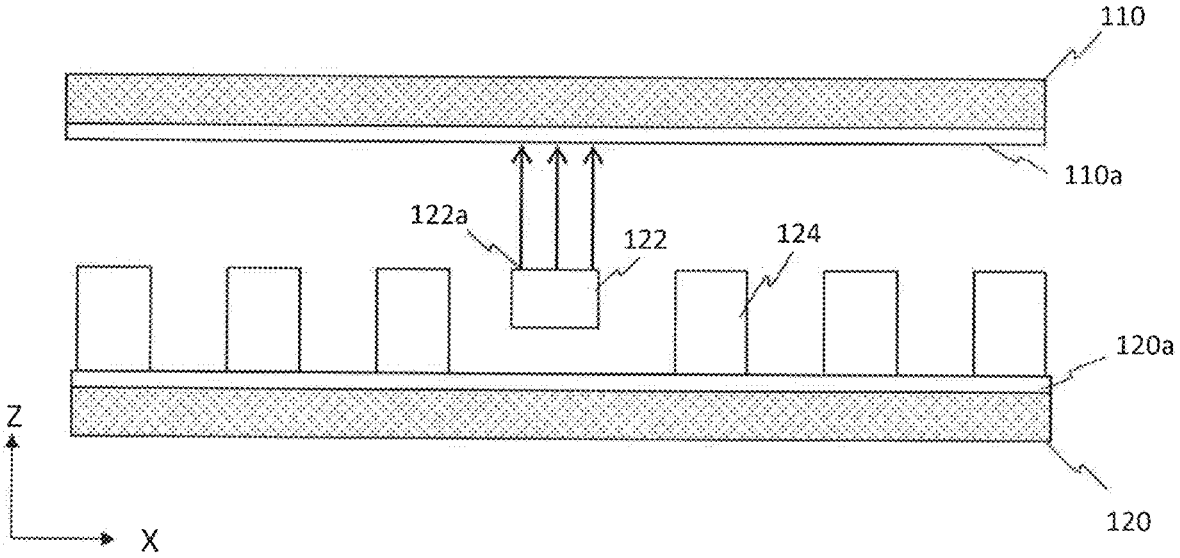
FIG. 55B is a diagram showing a variant in which the waveguide member 122 is not formed on the second conductive member 120.

FIG. 55B is a diagram showing a variant in which the waveguide member 122 is not formed on the second conductive member 120. In this example, the waveguide member 122 is fixed to a supporting member (e.g., the wall of the housing outer periphery) that supports the first conductive member 110 and the second conductive member 120. A gap exists between the waveguide member 122 and the second conductive member 120. Thus, the waveguide member 122 does not need to be connected to the conductive member 120.

Figure 55C:
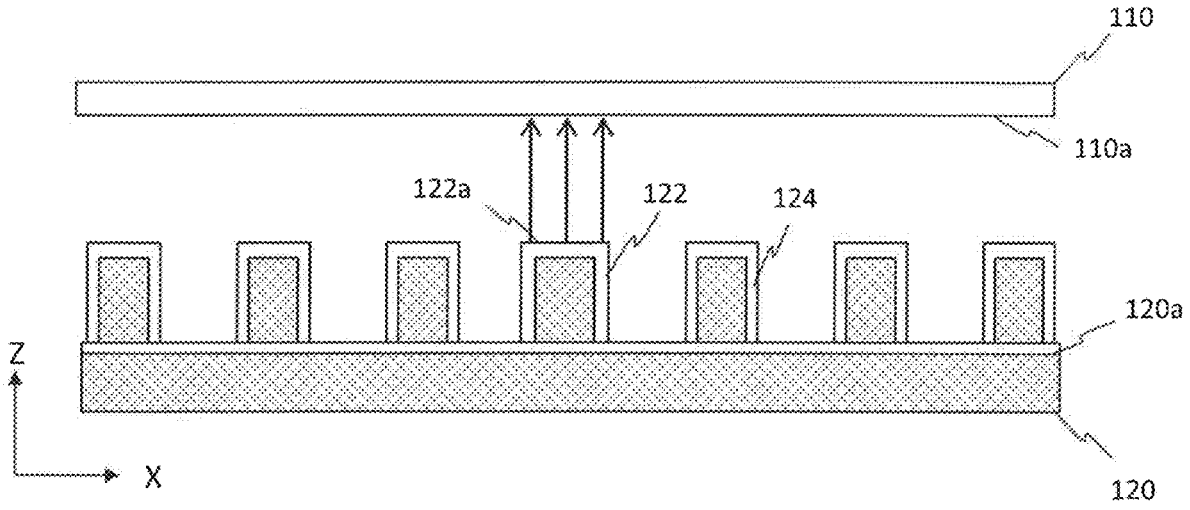
FIG. 55C is a diagram showing an exemplary structure where the second conductive member 120, the waveguide member 122, and each of the plurality of conductive rods 124 are composed of a dielectric surface that is coated with an electrically conductive material such as a metal.

FIG. 55C is a diagram showing an exemplary structure where the second conductive member 120, the waveguide member 122, and each of the plurality of conductive rods 124 are composed of a dielectric surface that is coated with an electrically conductive material such as a metal. The second conductive member 120, the waveguide member 122, and the plurality of conductive rods 124 are connected to one another via the electrical conductor. On the other hand, the first conductive member 110 is made of an electrically conductive material such as a metal.

Figure 55D:
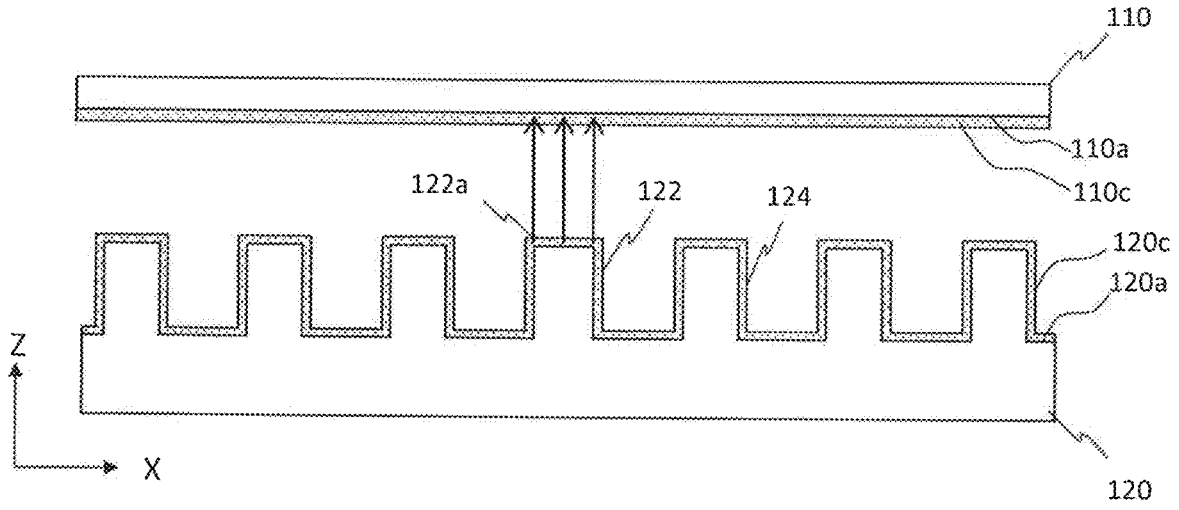
FIG. 55D is a diagram showing an exemplary structure in which dielectric layers 110*c* and 120*c* are respectively provided on the outermost surfaces of conductive members 110 and 120, a waveguide member 122, and conductive rods 124.
Figure 55E:
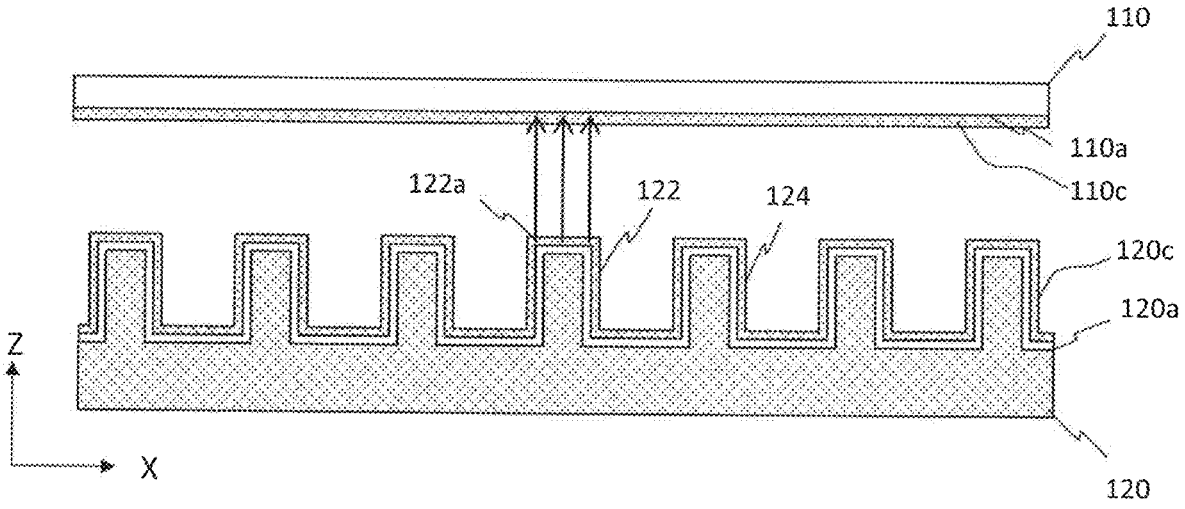
FIG. 55E is a diagram showing another exemplary structure in which dielectric layers 110*c* and 120*c* are respectively provided on the outermost surfaces of conductive members 110 and 120, a waveguide member 122, and conductive rods 124.

FIG. 23D and FIG. 23E are diagrams each showing an exemplary structure in which dielectric layers 110*c* and 120*c* are respectively provided on the outermost surfaces of conductive members 110 and 120, a waveguide member 122, and conductive rods 124. FIG. 55D shows an exemplary structure in which the surface of metal conductive members, which are conductors, are covered with a dielectric layer. FIG. 55E shows an example where the conductive member 120 is structured so that the surface of members which are composed of a dielectric, e.g., resin, is covered with a conductor such as a metal, this metal layer being further coated with a dielectric layer. The dielectric layer that covers the metal surface may be a coating of resin or the like, or an oxide film of passivation coating or the like which is generated as the metal becomes oxidized.

The dielectric layer on the outermost surface will allow losses to be increased in the electromagnetic wave propagating through the WRG waveguide, but is able to protect the conductive surfaces 110*a* and 120*a* (which are electrically conductive) from corrosion. It also prevents influences of a DC voltage, or an AC voltage of such a low frequency that it is not capable of propagation on certain WRG waveguides.

Figure 55F:
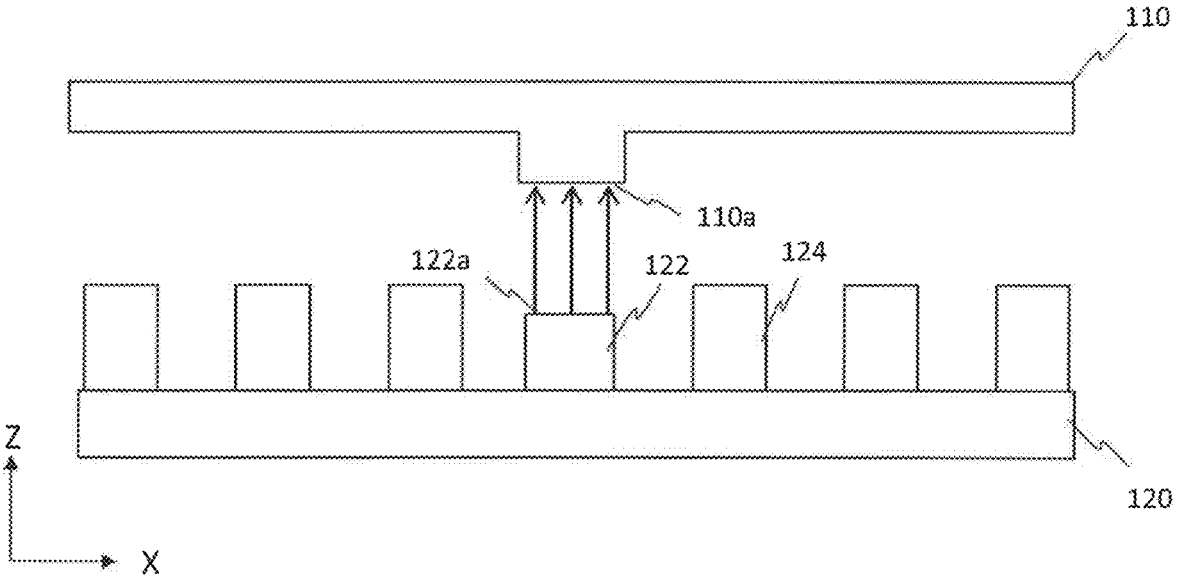
FIG. 55F is a diagram showing an example where the height of the waveguide member 122 is lower than the height of the conductive rods 124 and a conductive surface 110*a* of the first conductive member 110 protrudes toward the waveguide member 122.

FIG. 55F is a diagram showing an example where the height of the waveguide member 122 is lower than the height of the conductive rods 124, and the conductive surface 110*a* of the first conductive member 110 protrudes toward the waveguide member 122. Even such a structure will operate in a similar manner to the above-described embodiment, so long as the ranges of dimensions depicted in FIG. 4 are satisfied.

Figure 55G:
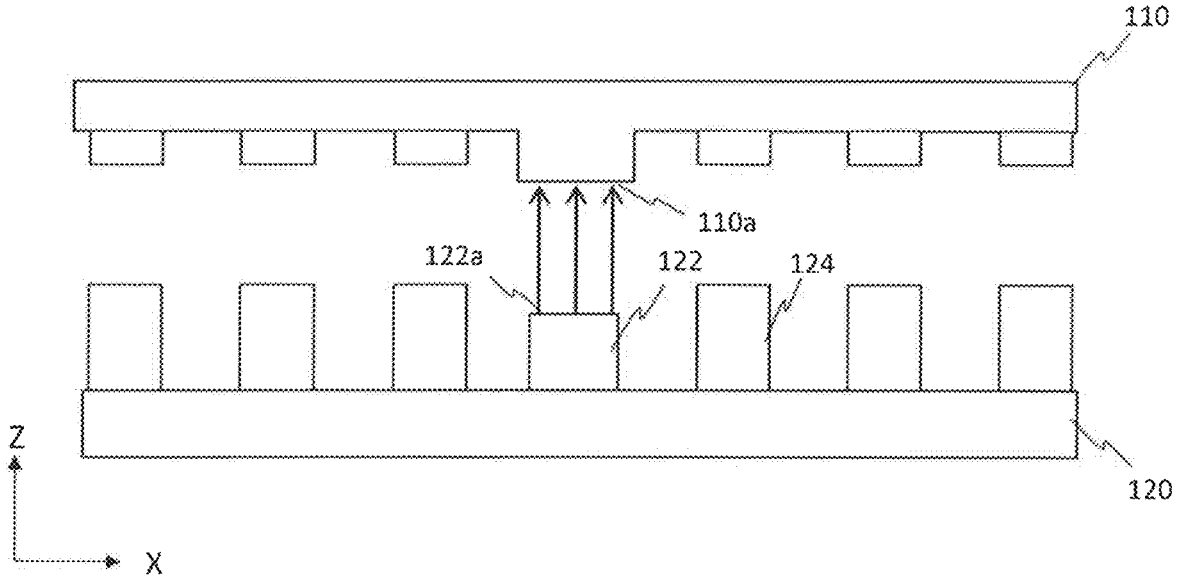
FIG. 55G is a diagram showing an example where, further in the structure of FIG. 55F, portions of the conductive surface 110*a* that oppose the conductive rods 124 protrude toward the conductive rods 124.

FIG. 55G is a diagram showing an example where, further in the structure of FIG. 55F, portions of the conductive surface 110*a* that oppose the conductive rods 124 protrude toward the conductive rods 124. Even such a structure will operate in a similar manner to the above-described embodiment, so long as the ranges of dimensions depicted in FIG. 4 are satisfied. Instead of a structure in which the conductive surface 110*a* partially protrudes, a structure in which the conductive surface 110*a* is partially dented may be adopted.

Figure 56A:
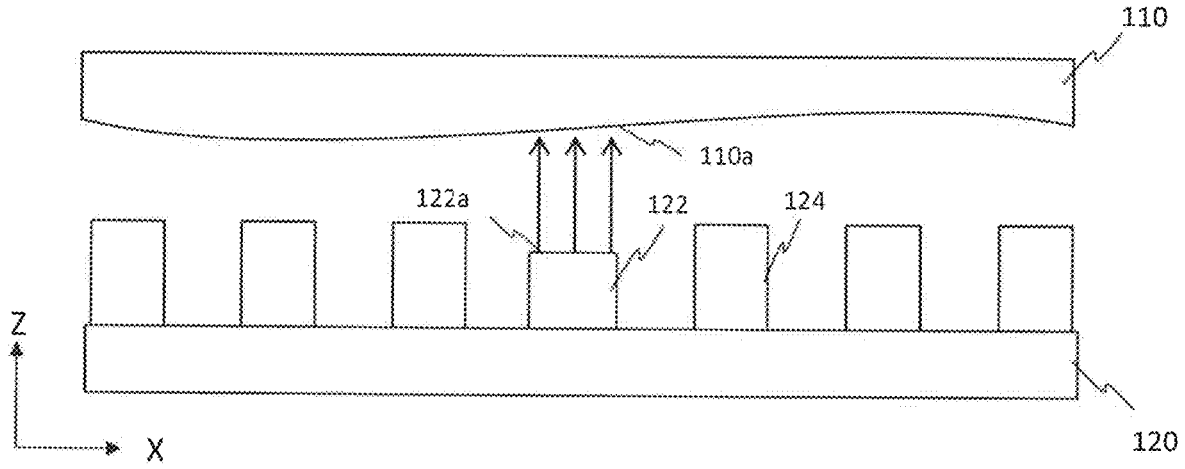
FIG. 56A is a diagram showing an example where a conductive surface 110*a* of the first conductive member 110 is shaped as a curved surface.
Figure 56B:
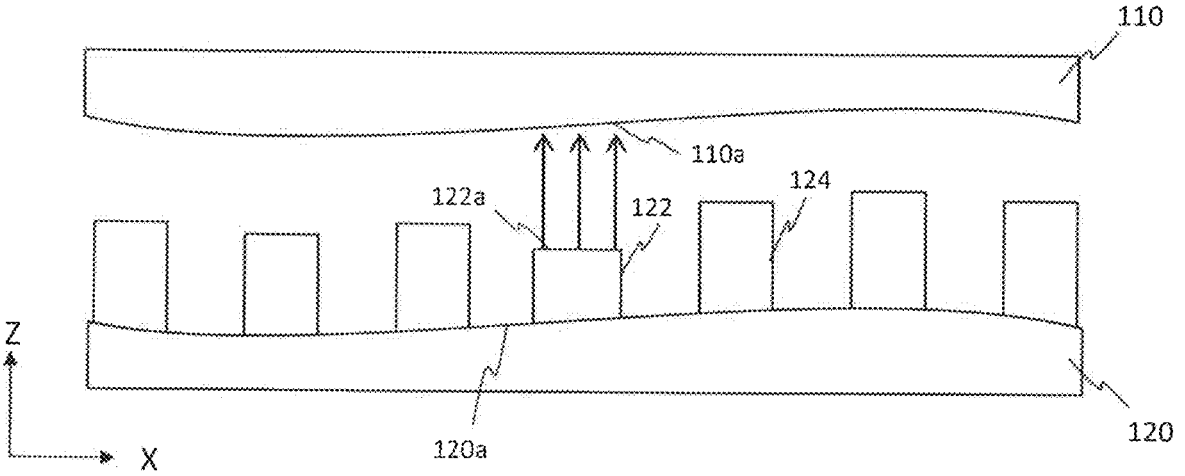
FIG. 56B is a diagram showing an example where also a conductive surface 120*a* of the second conductive member 120 is shaped as a curved surface.

FIG. 56A is a diagram showing an example where a conductive surface 110*a* of the first conductive member 110 is shaped as a curved surface. FIG. 56B is a diagram showing an example where also a conductive surface 120*a* of the second conductive member 120 is shaped as a curved surface. As demonstrated by these examples, at least one of the conductive surfaces 110*a* and 120*a* may not be shaped as planes, but may be shaped as curved surfaces. In particular, the second conductive member 120 may have a conductive surface 120*a* that macroscopically includes no planar portions, as has been described with reference to FIG. 2B.

The waveguide device and antenna device according to the present embodiment can be suitably used in a radar device to be incorporated in moving entities such as vehicles, marine vessels, aircraft, robots, or the like (hereinafter simply referred to as a "radar"), or a radar system, for example. A radar would include an antenna device according to an embodiment of the present disclosure and a microwave integrated circuit that is connected to the antenna device. A radar system would include the radar device and a signal processing circuit that is connected to the microwave integrated circuit of the radar device. An antenna device according to the present embodiment includes a WRG structure which permits downsizing, and thus allows the area of the face on which antenna elements are arrayed to be reduced, as compared to a construction in which a conventional hollow waveguide is used. Therefore, a radar system incorporating the antenna device can be easily mounted in a narrow place such as a face of a rearview mirror in a vehicle that is opposite to its specular surface, or a small-sized moving entity such as a UAV (an Unmanned Aerial Vehicle, a so-called drone). Note that, without being limited to the implementation where it is mounted in a vehicle, a radar system may be used while being fixed on the road or a building, for example.

A slot array antenna according to an embodiment of the present disclosure can also be used in a wireless communication system. Such a wireless communication system would include a slot array antenna according to any of the above embodiments and a communication circuit (a transmission circuit or a reception circuit). Details of exemplary applications to wireless communication systems will be described later.

A slot array antenna according to an embodiment of the present disclosure can further be used as an antenna in an indoor positioning system (IPS). An indoor positioning system is able to identify the position of a moving entity, such as a person or an automated guided vehicle (AGV), that is in a building. An array antenna can also be used as a radio wave transmitter (beacon) for use in a system which provides information to an information terminal device (e.g., a smartphone) that is carried by a person who has visited a store or any other facility. In such a system, once every several seconds, a beacon may radiate an electromagnetic wave carrying an ID or other information superposed thereon, for example. When the information terminal device receives this electromagnetic wave, the information terminal device transmits the received information to a remote server computer via telecommunication lines. Based on the information that has been received from the information terminal device, the server computer identifies the position of that information terminal device, and provides information which is associated with that position (e.g., product information or a coupon) to the information terminal device.

The present specification employs the term "artificial magnetic conductor" in describing the technique according to the present disclosure, this being in line with what is set forth in a paper by one of the inventors Kirino (Non-Patent Document 1) as well as a paper by Kildal et al., who published a study directed to related subject matter around the same time. However, it has been found through a study by the inventors that the invention according to the present disclosure does not necessarily require an "artificial magnetic conductor" under its conventional definition. That is, while a periodic structure has been believed to be a requirement for an artificial magnetic conductor, the invention according to the present disclosure does not necessary require a periodic structure in order to be practiced.

The artificial magnetic conductor that is described in the embodiments of the present disclosure consists of rows of conductive rods, for example. In order to prevent electromagnetic waves from leaking away from the waveguide face, it has been believed essential that there exist at least two rows of conductive rods on one side of the waveguide member(s), such rows of conductive rods extending along the waveguide member(s) (ridge(s)). The reason is that it takes at least two rows of conductive rods for them to have a "period". However, according to a study by the inventors, even when only one row of conductive rods, or only one conductive rod, exists between two waveguide members that extend in parallel to each other, the intensity of a signal that leaks from one waveguide member to the other waveguide member can be suppressed to −10 dB or less, which is a practically sufficient value in many applications. The reason why such a sufficient level of separation is achieved with only an imperfect periodic structure is so far unclear. However, in view of this fact, in the present disclosure, the conventional notion of "artificial magnetic conductor" is extended so that the term also encompasses a structure including only one row of conductive rods, or only one conductive rod.

<Application Example 1: Onboard Radar System>

Next, as an Application Example of utilizing the above-described array antenna device, an instance of an onboard radar system including an array antenna device will be described. A transmission wave used in an onboard radar system may have a frequency of e.g. 76 gigahertz (GHz) band, which will have a wavelength λ0 of about 4 mm in free space.

In safety technology of automobiles, e.g., collision avoidance systems or automated driving, it is particularly essential to identify one or more vehicles (targets) that are traveling ahead of the driver's vehicle. As a method of identifying vehicles, techniques of estimating the directions of arriving waves by using a radar system have been under development.

Figure 57:
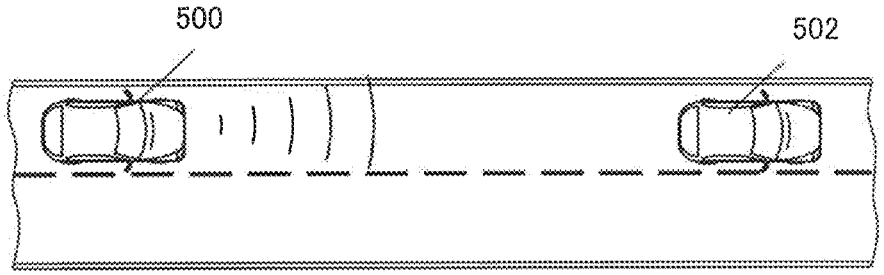
FIG. 57 is a diagram showing a driver's vehicle 500, and a preceding vehicle 502 that is traveling in the same lane as the driver's vehicle 500.

FIG. 57 shows a driver's vehicle 500, and a preceding vehicle 502 that is traveling in the same lane as the driver's vehicle 500. The driver's vehicle 500 includes an onboard radar system which incorporates an array antenna device according to the above-described embodiment. When the onboard radar system of the driver's vehicle 500 radiates a radio frequency transmission signal, the transmission signal reaches the preceding vehicle 502 and is reflected therefrom, so that a part of the signal returns to the driver's vehicle 500. The onboard radar system receives this signal to calculate a position of the preceding vehicle 502, a distance ("range") to the preceding vehicle 502, velocity, etc.

Figure 58:
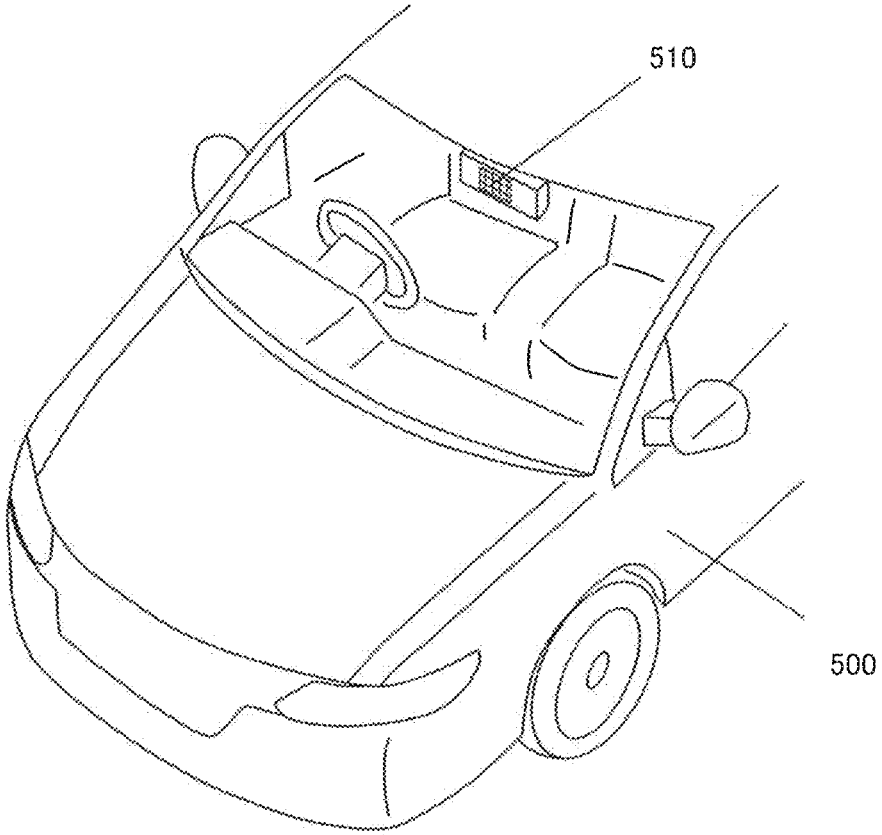
FIG. 58 is a diagram showing an onboard radar system 510 of the driver's vehicle 500.

FIG. 58 shows the onboard radar system 510 of the driver's vehicle 500. The onboard radar system 510 is provided within the vehicle. More specifically, the onboard radar system 510 is disposed on a face of the rearview mirror that is opposite to its specular surface. From within the vehicle, the onboard radar system 510 radiates a radio frequency transmission signal in the direction of travel of the vehicle 500, and receives a signal(s) which arrives from the direction of travel.

The onboard radar system 510 of this Application Example includes a slot array antenna device according to the any of the above embodiments. This Application Example is arranged so that the direction that each of the plurality of waveguide members extends coincides with the vertical direction, and that the direction in which the plurality of waveguide members are arrayed (with respect to one another) coincides with the horizontal direction. As a result, the lateral dimension of the plurality of slots as viewed from the front can be reduced. Exemplary dimensions of an antenna device including the above array antenna device may be 60 mm (wide)×30 mm (long)×10 mm (deep). It will be appreciated that this is a very small size for a millimeter wave radar system of the 76 GHz band.

Note that many a conventional onboard radar system is provided outside the vehicle, e.g., at the tip of the front nose. The reason is that the onboard radar system is relatively large in size, and thus is difficult to be provided within the vehicle as in the present disclosure. The onboard radar system 510 of this Application Example may be installed within the vehicle as described above, but may instead be mounted at the tip of the front nose. Since the footprint of the onboard radar system on the front nose is reduced, other parts can be more easily placed.

The Application Example allows the interval between a plurality of waveguide members (ridges) that are used in the transmission antenna to be narrow, which also narrows the interval between a plurality of slots to be provided opposite from a number of adjacent waveguide members. This reduces the influences of grating lobes. For example, when the interval between the centers of two laterally adjacent slots is shorter than the free-space wavelength λ0 of the transmission wave (i.e., less than about 4 mm), no grating lobes will occur frontward. As a result, influences of grating lobes are reduced. Note that grating lobes will occur when the interval at which the antenna elements are arrayed is greater than a half of the wavelength of an electromagnetic wave. If the interval at which the antenna elements are arrayed is less than the wavelength, no grating lobes will occur frontward. Therefore, in the case where no beam steering is performed to impart phase differences among the radio waves radiated from the respective antenna elements composing an array antenna, grating lobes will exert substantially no influences so long as the interval at which the antenna elements are arrayed is smaller than the wavelength. By adjusting the array factor of the transmission antenna, the directivity of the transmission antenna can be adjusted. A phase shifter may be provided so as to be able to individually adjust the phases of electromagnetic waves that are transmitted on plural waveguide members. In this case, in order to avoid the influences of grating lobes, it is preferable that the interval between antenna elements is less than a half of the free-space wavelength λo of the transmission wave. By providing a phase shifter, the directivity of the transmission antenna can be changed in any desired direction. Since the construction of a phase shifter is well-known, description thereof will be omitted.

A reception antenna according to the Application Example is able to reduce reception of reflected waves associated with grating lobes, thereby being able to improve the precision of the below-described processing.

Hereinafter, an example of a reception process will be described.

Figure 59A:
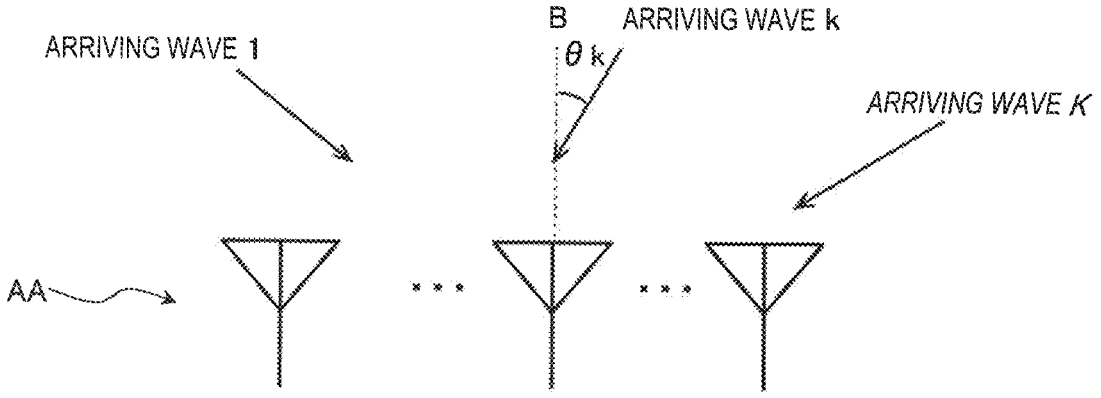

FIG. 59A shows a relationship between an array antenna device AA of the onboard radar system 510 and plural arriving waves k (k: an integer from 1 to K; the same will always apply below. K is the number of targets that are present in different azimuths). The array antenna device AA includes M antenna elements in a linear array. Principlewise, an antenna can be used for both transmission and reception, and therefore the array antenna device AA can be used for both a transmission antenna and a reception antenna. Hereinafter, an example method of processing an arriving wave which is received by the reception antenna will be described.

The array antenna device AA receives plural arriving waves that simultaneously impinge at various angles. Some of the plural arriving waves may be arriving waves which have been radiated from the transmission antenna of the same onboard radar system 510 and reflected by a target(s). Furthermore, some of the plural arriving waves may be direct or indirect arriving waves that have been radiated from other vehicles.

The incident angle of each arriving wave (i.e., an angle representing its direction of arrival) is an angle with respect to the broadside B of the array antenna device AA. The incident angle of an arriving wave represents an angle with respect to a direction which is perpendicular to the direction of the line along which antenna elements are arrayed.

Now, consider a $k^{th}$ arriving wave. Where K arriving waves are impinging on the array antenna device from K targets existing at different azimuths, a "$k^{th}$ arriving wave" means an arriving wave which is identified by an incident angle $\theta_k$.

Figure 59B:
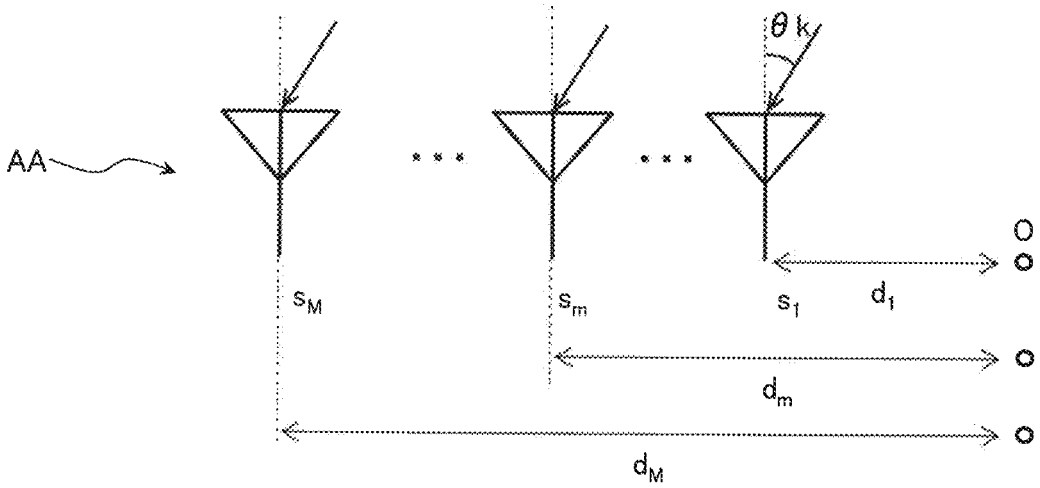

FIG. 59B shows the array antenna device AA receiving the $k^{th}$ arriving wave. The signals received by the array antenna device AA can be expressed as a "vector" having M elements, by Math. 1.

$$S=[s_1,s_2,\ldots,s_M]^T \quad \text{(Math. 1)}$$

In the above, $s_m$ (where m is an integer from 1 to M; the same will also be true hereinbelow) is the value of a signal which is received by an $M^{th}$ antenna element. The superscript $^T$ means transposition. S is a column vector. The column vector S is defined by a product of multiplication between a direction vector (referred to as a steering vector or a mode vector) as determined by the construction of the array antenna device and a complex vector representing a signal from each target (also referred to as a wave source or a signal source). When the number of wave sources is K, the waves of signals arriving at each individual antenna element from the respective K wave sources are linearly superposed. In this state, $s_m$ can be expressed by Math. 2.

$$s_m = \sum_{k=1}^{K} a_k \exp\left\{ j\left( \frac{2\pi}{\lambda} d_m \sin\theta_k + \varphi_k \right) \right\} \quad \text{[Math. 2]}$$

In Math. 2, $a_k$, $\theta_k$ and $\phi_k$ respectively denote the amplitude, incident angle, and initial phase of the $k^{th}$ arriving wave. Moreover, λ denotes the wavelength of an arriving wave, and j is an imaginary unit.

As will be understood from Math. 2, $s_m$ is expressed as a complex number consisting of a real part (Re) and an imaginary part (Im).

When this is further generalized by taking noise (internal noise or thermal noise) into consideration, the array reception signal X can be expressed as Math. 3.

$$X=S+N \quad \text{(Math. 3)}$$

N is a vector expression of noise.

The signal processing circuit generates a spatial covariance matrix Rxx (Math. 4) of arriving waves by using the array reception signal X expressed by Math. 3, and further determines eigenvalues of the spatial covariance matrix Rxx.

$$R_{xx} = XX^H \quad \text{[Math. 4]}$$

$$= \begin{bmatrix} Rxx_{11} & \ldots & Rxx_{1M} \\ \vdots & \ddots & \vdots \\ RXX_{M1} & \ldots & Rxx_{MM} \end{bmatrix}$$

In the above, the superscript $^H$ means complex conjugate transposition (Hermitian conjugate).

Among the eigenvalues, the number of eigenvalues which have values equal to or greater than a predetermined value that is defined based on thermal noise (signal space eigenvalues) corresponds to the number of arriving waves. Then, angles that produce the highest likelihood as to the directions of arrival of reflected waves (i.e. maximum likelihood) are calculated, whereby the number of targets and the angles at which the respective targets are present can be identified. This process is known as a maximum likelihood estimation technique.

Figure 60:
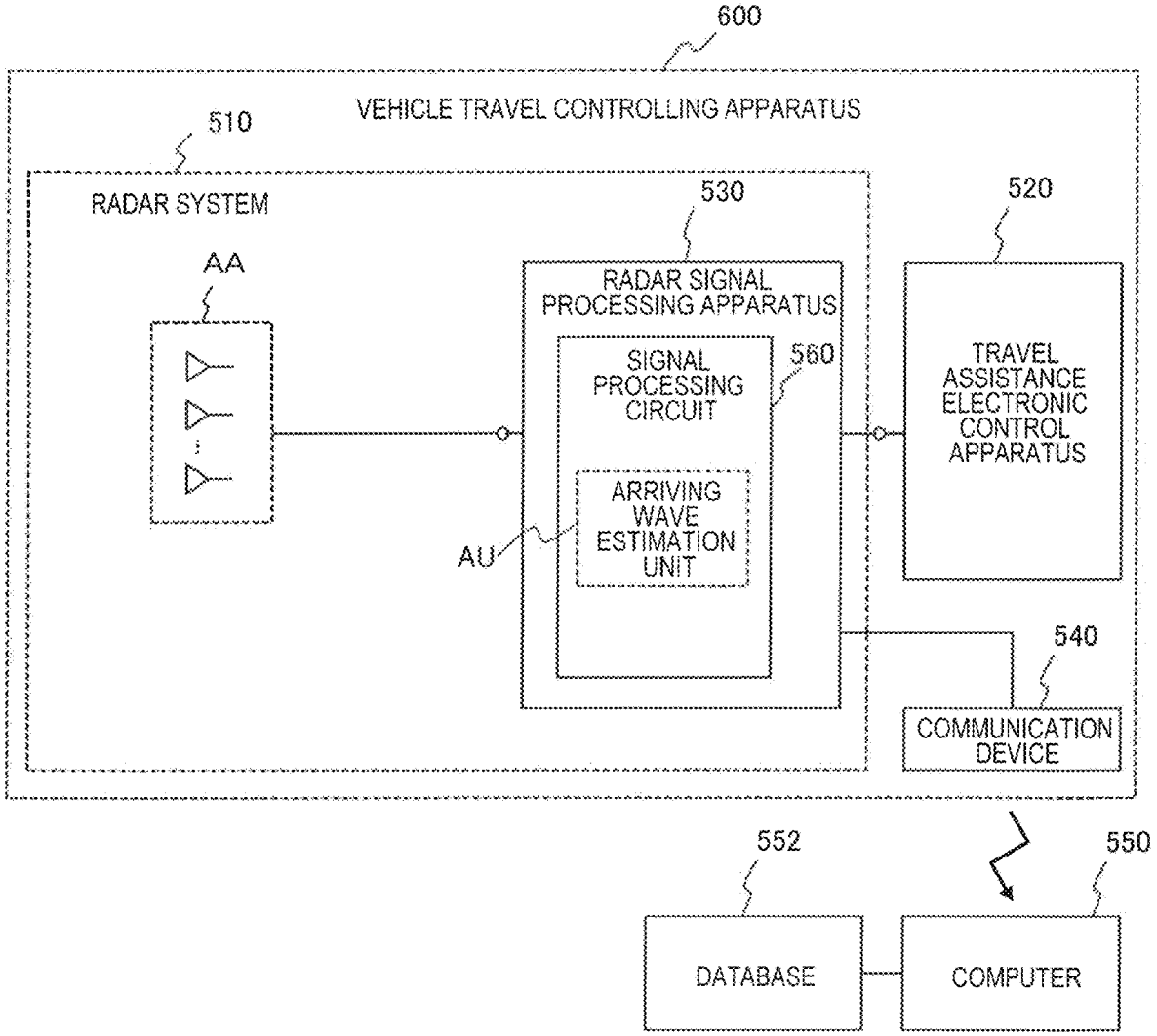

Next, see FIG. 60. FIG. 60 is a block diagram showing an exemplary fundamental construction of a vehicle travel controlling apparatus 600 according to the present disclosure. The vehicle travel controlling apparatus 600 shown in FIG. 60 includes a radar system 510 which is mounted in a vehicle, and a travel assistance electronic control apparatus 520 which is connected to the radar system 510. The radar system 510 includes an array antenna device AA and a radar signal processing apparatus 530.

The array antenna device AA includes a plurality of antenna elements, each of which outputs a reception signal in response to one or plural arriving waves. As mentioned earlier, the array antenna device AA is capable of radiating a millimeter wave of a high frequency. Note that, without being limited to the array antenna device according to any of the above embodiments, the array antenna device AA may be any other array antenna device that suitably performs reception.

In the radar system 510, the array antenna device AA needs to be attached to the vehicle, while at least some of the functions of the radar signal processing apparatus 530 may be implemented by a computer 550 and a database 552 which are provided externally to the vehicle travel controlling apparatus 600 (e.g., outside of the driver's vehicle). In that case, the portions of the radar signal processing apparatus 530 that are located within the vehicle may be perpetually or occasionally connected to the computer 550 and database 552 external to the vehicle so that bidirectional communications of signal or data are possible. The communications are to be performed via a communication device 540 of the vehicle and a commonly-available communications network.

The database 552 may store a program which defines various signal processing algorithms. The content of the data and program needed for the operation of the radar system 510 may be externally updated via the communication device 540. Thus, at least some of the functions of the radar system 510 can be realized externally to the driver's vehicle (which is inclusive of the interior of another vehicle), by a cloud computing technique. Therefore, an "onboard" radar system in the meaning of the present disclosure does not require that all of its constituent elements be mounted within the (driver's) vehicle. However, for simplicity, the present application will describe an implementation in which all constituent elements according to the present disclosure are mounted in a single vehicle (i.e., the driver's vehicle), unless otherwise specified.

The radar signal processing apparatus 530 includes a signal processing circuit 560. The signal processing circuit 560 directly or indirectly receives reception signals from the array antenna device AA, and inputs the reception signals, or a secondary signal(s) which has been generated from the reception signals, to an arriving wave estimation unit AU. A part or a whole of the circuit (not shown) which generates a secondary signal(s) from the reception signals does not need to be provided inside of the signal processing circuit 560. A part or a whole of such a circuit (preprocessing circuit) may be provided between the array antenna device AA and the radar signal processing apparatus 530.

The signal processing circuit 560 is configured to perform computation by using the reception signals or secondary signal(s), and output a signal indicating the number of arriving waves. As used herein, a "signal indicating the number of arriving waves" can be said to be a signal indicating the number of preceding vehicles (which may be one preceding vehicle or plural preceding vehicles) ahead of the driver's vehicle.

The signal processing circuit 560 may be configured to execute various signal processing which is executable by known radar signal processing apparatuses. For example, the signal processing circuit 560 may be configured to execute "super-resolution algorithms" such as the MUSIC method, the ESPRIT method, or the SAGE method, or other algorithms for direction-of-arrival estimation of relatively low resolution.

The arriving wave estimation unit AU shown in FIG. estimates an angle representing the azimuth of each arriving wave by an arbitrary algorithm for direction-of-arrival estimation, and outputs a signal indicating the estimation result. The signal processing circuit 560 estimates the distance to each target as a wave source of an arriving wave, the relative velocity of the target, and the azimuth of the target by using a known algorithm which is executed by the arriving wave estimation unit AU, and output a signal indicating the estimation result.

In the present disclosure, the term "signal processing circuit" is not limited to a single circuit, but encompasses any implementation in which a combination of plural circuits is conceptually regarded as a single functional part. The signal processing circuit 560 may be realized by one or more System-on-Chips (SoCs). For example, a part or a whole of the signal processing circuit 560 may be an FPGA (Field-Programmable Gate Array), which is a programmable logic device (PLD). In that case, the signal processing circuit 560 includes a plurality of computation elements (e.g., general-purpose logics and multipliers) and a plurality of memory elements (e.g., look-up tables or memory blocks). Alternatively, the signal processing circuit 560 may be a set of a general-purpose processor(s) and a main memory device(s). The signal processing circuit 560 may be a circuit which includes a processor core(s) and a memory device(s). These may function as the signal processing circuit 560.

The travel assistance electronic control apparatus 520 is configured to provide travel assistance for the vehicle based on various signals which are output from the radar signal processing apparatus 530. The travel assistance electronic control apparatus 520 instructs various electronic control units to fulfill predetermined functions, e.g., a function of issuing an alarm to prompt the driver to make a braking operation when the distance to a preceding vehicle (vehicular gap) has become shorter than a predefined value; a function of controlling the brakes; and a function of controlling the accelerator. For example, in the case of an operation mode which performs adaptive cruise control of the driver's vehicle, the travel assistance electronic control apparatus 520 sends predetermined signals to various electronic control units (not shown) and actuators, to maintain the distance of the driver's vehicle to a preceding vehicle at a predefined value, or maintain the traveling velocity of the driver's vehicle at a predefined value.

In the case of the MUSIC method, the signal processing circuit 560 determines eigenvalues of the spatial covariance matrix, and, as a signal indicating the number of arriving waves, outputs a signal indicating the number of those eigenvalues ("signal space eigenvalues") which are greater than a predetermined value (thermal noise power) that is defined based on thermal noise.

Figure 61:
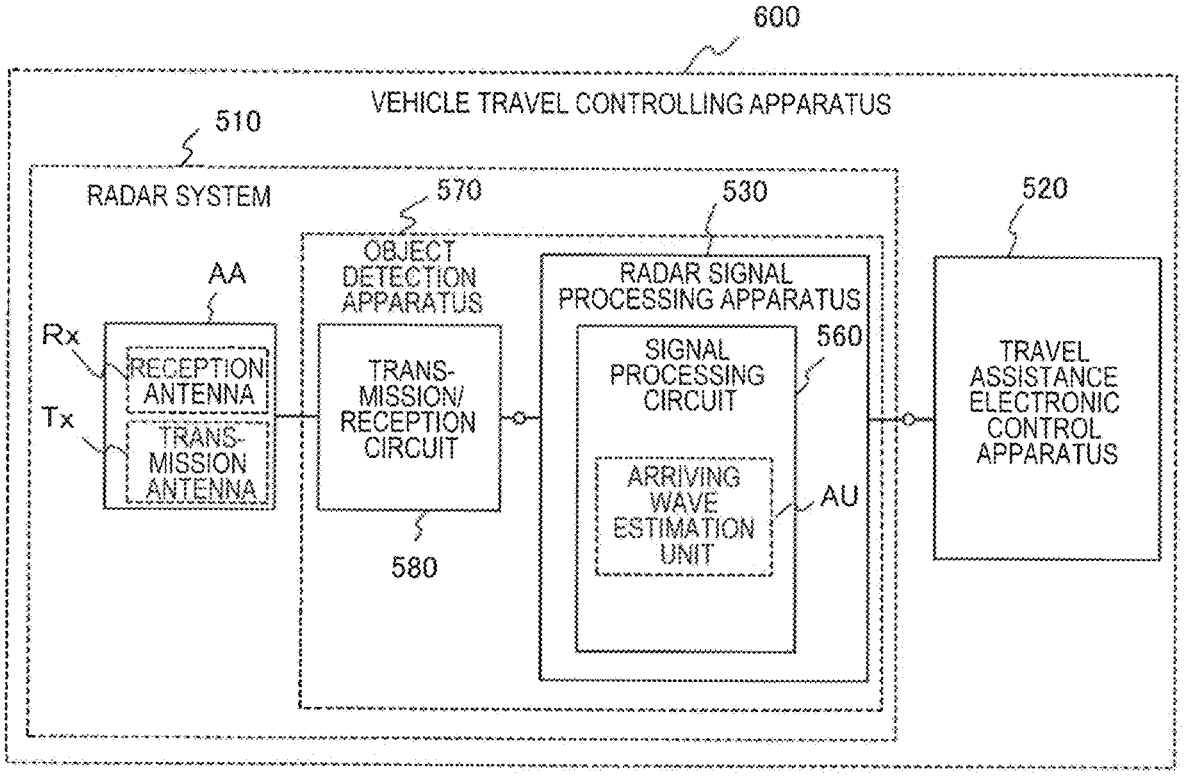

Next, see FIG. 61. FIG. 61 is a block diagram showing another exemplary construction for the vehicle travel controlling apparatus 600. The radar system 510 in the vehicle travel controlling apparatus 600 of FIG. 61 includes an array antenna device AA, which includes an array antenna device that is dedicated to reception only (also referred to as a reception antenna) Rx and an array antenna device that is dedicated to transmission only (also referred to as a transmission antenna) Tx; and an object detection apparatus 570.

At least one of the transmission antenna Tx and the reception antenna Rx has the aforementioned waveguide structure. The transmission antenna Tx radiates a transmission wave, which may be a millimeter wave, for example. The reception antenna Rx that is dedicated to reception only outputs a reception signal in response to one or plural arriving waves (e.g., a millimeter wave(s)).

A transmission/reception circuit 580 sends a transmission signal for a transmission wave to the transmission antenna Tx, and performs "preprocessing" for reception signals of reception waves received at the reception antenna Rx. A part or a whole of the preprocessing may be performed by the signal processing circuit 560 in the radar signal processing apparatus 530. A typical example of preprocessing to be performed by the transmission/reception circuit 580 may be generating a beat signal from a reception signal, and converting a reception signal of analog format into a reception signal of digital format.

Note that the radar system according to the present disclosure may, without being limited to the implementation where it is mounted in the driver's vehicle, be used while being fixed on the road or a building.

Next, an example of a more specific construction of the vehicle travel controlling apparatus 600 will be described.

Figure 62:
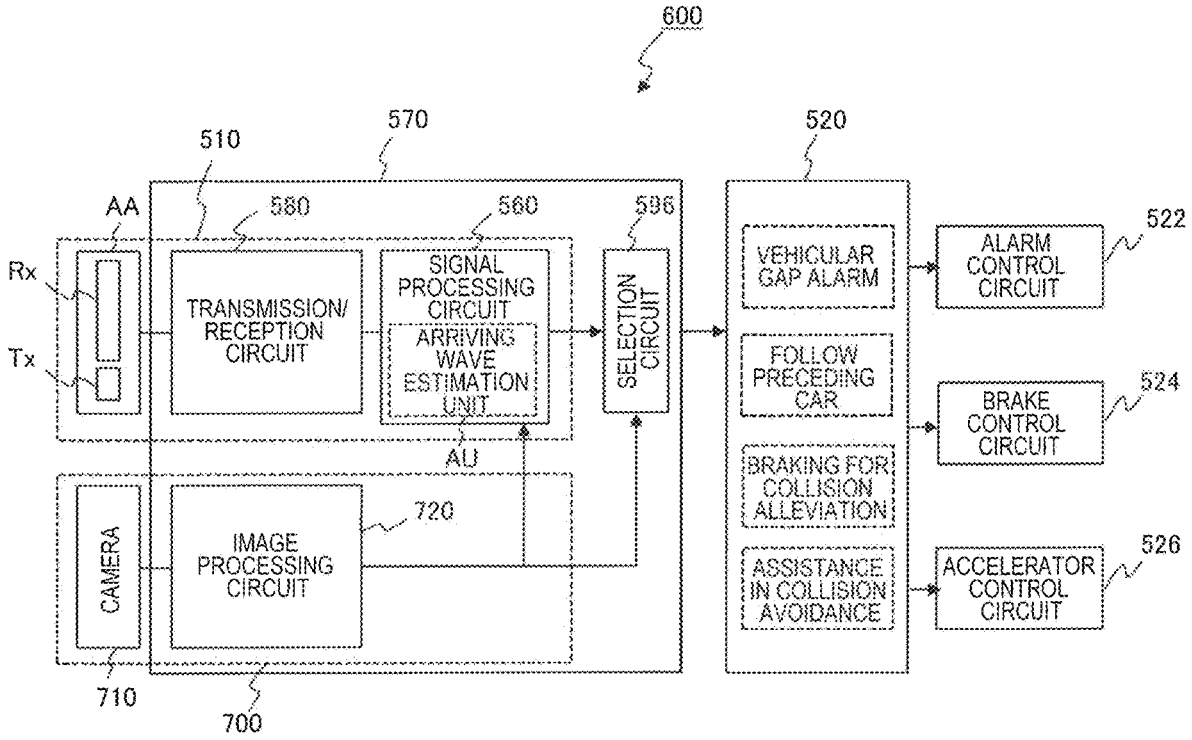

FIG. 62 is a block diagram showing an example of a more specific construction of the vehicle travel controlling apparatus 600. The vehicle travel controlling apparatus 600 shown in FIG. 62 includes a radar system 510 and an onboard camera system 700. The radar system 510 includes an array antenna device AA, a transmission/reception circuit 580 which is connected to the array antenna device AA, and a signal processing circuit 560.

The onboard camera system 700 includes an onboard camera 710 which is mounted in a vehicle, and an image processing circuit 720 which processes an image or video that is acquired by the onboard camera 710.

The vehicle travel controlling apparatus 600 of this Application Example includes an object detection apparatus 570 which is connected to the array antenna device AA and the onboard camera 710, and a travel assistance electronic control apparatus 520 which is connected to the object detection apparatus 570. The object detection apparatus 570 includes a transmission/reception circuit 580 and an image processing circuit 720, in addition to the above-described radar signal processing apparatus 530 (including the signal processing circuit 560). The object detection apparatus 570 detects a target on the road or near the road, by using not only the information which is obtained by the radar system 510 but also the information which is obtained by the image processing circuit 720. For example, while the driver's vehicle is traveling in one of two or more lanes of the same direction, the image processing circuit 720 can distinguish which lane the driver's vehicle is traveling in, and supply that result of distinction to the signal processing circuit 560. When the number and azimuth(s) of preceding vehicles are to be recognized by using a predetermined algorithm for direction-of-arrival estimation (e.g., the MUSIC method), the signal processing circuit 560 is able to provide more reliable information concerning a spatial distribution of preceding vehicles by referring to the information from the image processing circuit 720.

Note that the onboard camera system 700 is an example of a means for identifying which lane the driver's vehicle is traveling in. The lane position of the driver's vehicle may be identified by any other means. For example, by utilizing an ultra-wide band (UWB) technique, it is possible to identify which one of a plurality of lanes the driver's vehicle is traveling in. It is widely known that the ultra-wide band technique is applicable to position measurement and/or radar. Using the ultra-wide band technique enhances the range resolution of the radar, so that, even when a large number of vehicles exist ahead, each individual target can be detected with distinction, based on differences in distance. This makes it possible to identify distance from a guardrail on the road shoulder, or from the median strip. The width of each lane is predefined based on each country's law or the like. By using such information, it becomes possible to identify where the lane in which the driver's vehicle is currently traveling is. Note that the ultra-wide band technique is an example. A radio wave based on any other wireless technique may be used. Moreover, LIDAR (Light Detection and Ranging) may be used together with a radar. LIDAR is sometimes called "laser radar".

The array antenna device AA may be a generic millimeter wave array antenna device for onboard use. The transmission antenna Tx in this Application Example radiates a millimeter wave as a transmission wave ahead of the vehicle. A portion of the transmission wave is reflected off a target which is typically a preceding vehicle, whereby a reflected wave occurs from the target being a wave source. A portion of the reflected wave reaches the array antenna device (reception antenna) AA as an arriving wave. Each of the plurality of antenna elements of the array antenna device AA outputs a reception signal in response to one or plural arriving waves. In the case where the number of targets functioning as wave sources of reflected waves is K (where K is an integer of one or more), the number of arriving waves is K, but this number K of arriving waves is not known beforehand.

The example of FIG. 60 assumes that the radar system 510 is provided as an integral piece, including the array antenna device AA, on the rearview mirror. However, the number and positions of array antenna devices AA are not limited to any specific number or specific positions. An array antenna device AA may be disposed on the rear surface of the vehicle so as to be able to detect targets that are behind the vehicle. Moreover, a plurality of array antenna devices AA may be disposed on the front surface and the rear surface of the vehicle. The array antenna device(s) AA may be disposed inside the vehicle. Even in the case where a horn antenna whose respective antenna elements include horns as mentioned above is to be adopted as the array antenna device(s) AA, the array antenna device(s) with such antenna elements may be situated inside the vehicle.

The signal processing circuit 560 receives and processes the reception signals which have been received by the reception antenna Rx and subjected to preprocessing by the transmission/reception circuit 580. This process encompasses inputting the reception signals to the arriving wave estimation unit AU, or alternatively, generating a secondary signal(s) from the reception signals and inputting the secondary signal(s) to the arriving wave estimation unit AU.

In the example of FIG. 62, a selection circuit 596 which receives the signal being output from the signal processing circuit 560 and the signal being output from the image processing circuit 720 is provided in the object detection apparatus 570. The selection circuit 596 allows one or both of the signal being output from the signal processing circuit 560 and the signal being output from the image processing circuit 720 to be fed to the travel assistance electronic control apparatus 520.

Figure 63:
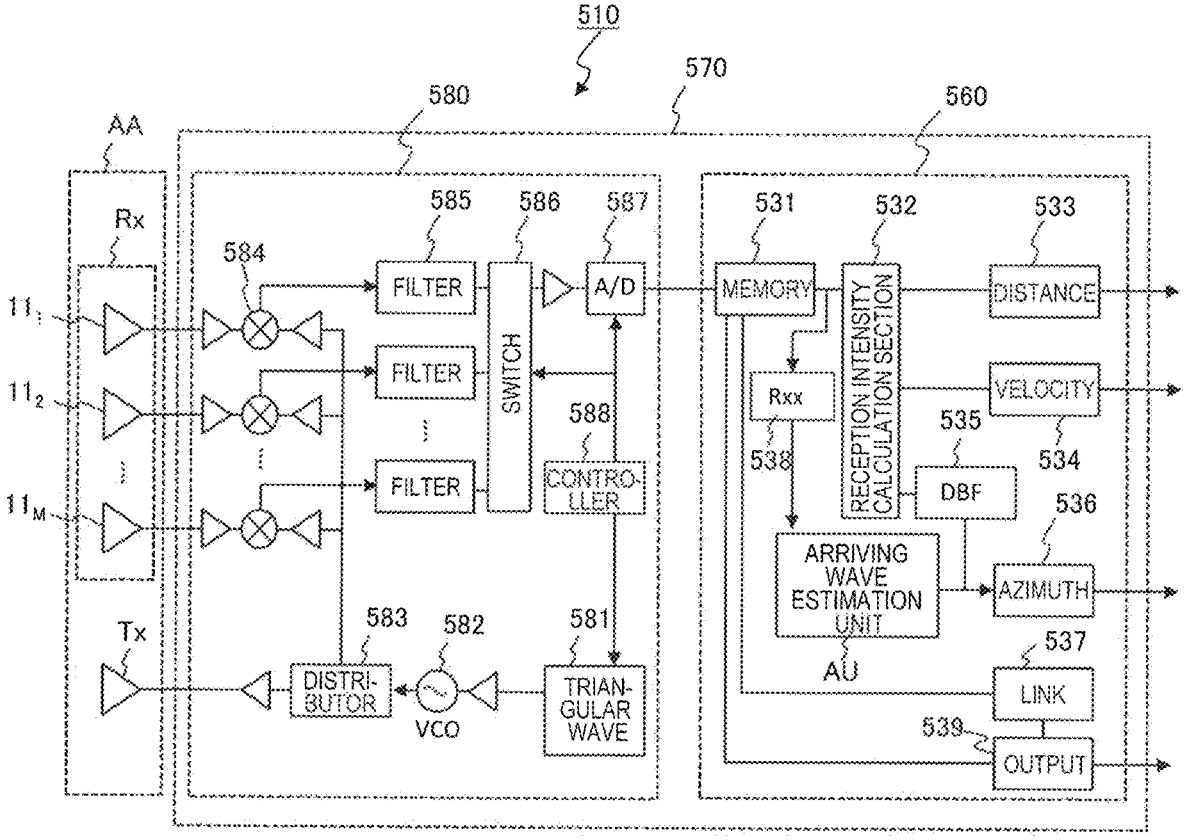

FIG. 63 is a block diagram showing a more detailed exemplary construction of the radar system 510 according to this Application Example.

As shown in FIG. 63, the array antenna device AA includes a transmission antenna Tx which transmits a millimeter wave and reception antennas Rx which receive arriving waves reflected from targets. Although only one transmission antenna Tx is illustrated in the figure, two or more kinds of transmission antennas with different characteristics may be provided. The array antenna device AA includes M antenna elements $\mathbf{11}_1$, $\mathbf{11}_2$, . . . , $\mathbf{11}_M$ (where M is an integer of 3 or more). In response to the arriving waves, the plurality of antenna elements $\mathbf{11}_1$, $\mathbf{11}_2$, . . . , $\mathbf{11}_M$ respectively output reception signals $s_1$, $s_2$, . . . , $s_M$ (FIG. 27B).

In the array antenna device AA, the antenna elements $\mathbf{11}_1$ to $\mathbf{11}_M$ are arranged in a linear array or a two-dimensional array at fixed intervals, for example. Each arriving wave will impinge on the array antenna device AA from a direction at an angle θ with respect to the normal of the plane in which the antenna elements $\mathbf{11}_1$ to $\mathbf{11}_M$ are arrayed. Thus, the direction of arrival of an arriving wave is defined by this angle θ.

When an arriving wave from one target impinges on the array antenna device AA, this approximates to a plane wave impinging on the antenna elements $\mathbf{11}_1$ to $\mathbf{11}_M$ from azimuths of the same angle θ. When K arriving waves impinge on the array antenna device AA from K targets with different azimuths, the individual arriving waves can be identified in terms of respectively different angles $\theta_1$ to $\theta_K$.

As shown in FIG. 63, the object detection apparatus 570 includes the transmission/reception circuit 580 and the signal processing circuit 560.

The transmission/reception circuit 580 includes a triangular wave generation circuit 581, a VCO (voltage controlled oscillator) 582, a distributor 583, mixers 584, filters 585, a switch 586, an A/D converter 587, and a controller 588. Although the radar system in this Application Example is configured to perform transmission and reception of millimeter waves by the FMCW method, the radar system of the present disclosure is not limited to this method. The transmission/reception circuit 580 is configured to generate a beat signal based on a reception signal from the array antenna device AA and a transmission signal from the transmission antenna Tx.

The signal processing circuit 560 includes a distance detection section 533, a velocity detection section 534, and an azimuth detection section 536. The signal processing circuit 560 is configured to process a signal from the A/D converter 587 in the transmission/reception circuit 580, and output signals respectively indicating the detected distance to the target, the relative velocity of the target, and the azimuth of the target.

First, the construction and operation of the transmission/reception circuit 580 will be described in detail.

Figure 64:
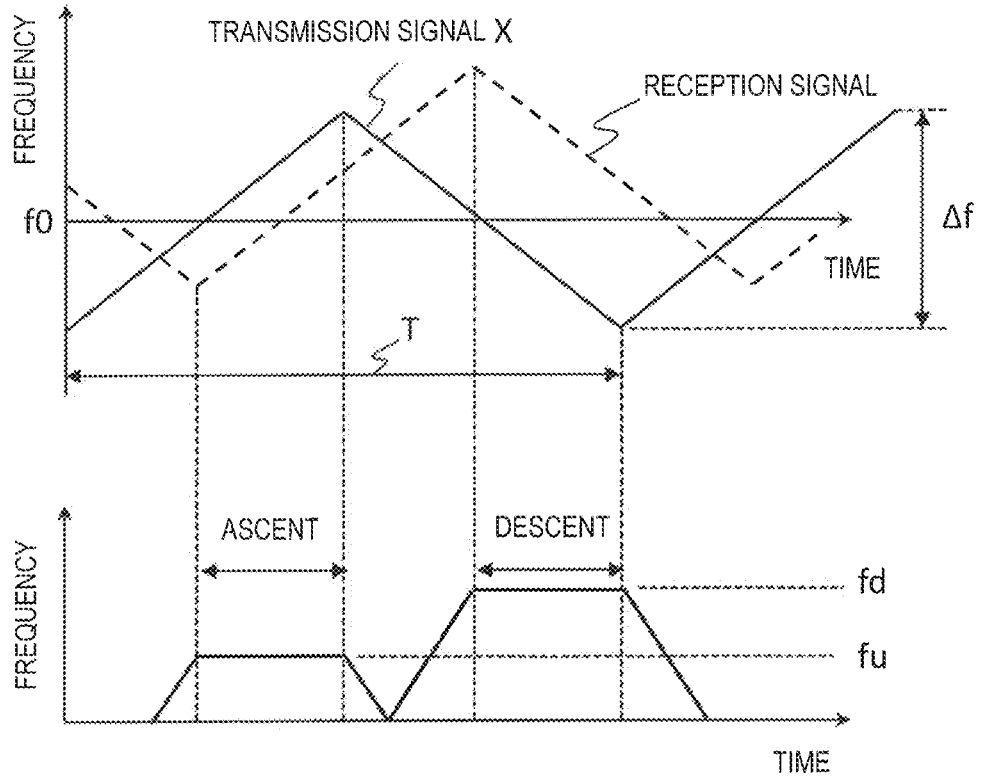

The triangular wave generation circuit 581 generates a triangular wave signal, and supplies it to the VCO 582. The VCO 582 outputs a transmission signal having a frequency as modulated based on the triangular wave signal. FIG. 64 is a diagram showing change in frequency of a transmission signal which is modulated based on the signal that is generated by the triangular wave generation circuit 581. This waveform has a modulation width Δf and a center frequency of f0. The transmission signal having a thus modulated frequency is supplied to the distributor 583. The distributor 583 allows the transmission signal obtained from the VCO 582 to be distributed among the mixers 584 and the transmission antenna Tx. Thus, the transmission antenna radiates a millimeter wave having a frequency which is modulated in triangular waves, as shown in FIG. 64.

In addition to the transmission signal, FIG. 64 also shows an example of a reception signal from an arriving wave which is reflected from a single preceding vehicle. The reception signal is delayed from the transmission signal. This delay is in proportion to the distance between the driver's vehicle and the preceding vehicle. Moreover, the frequency of the reception signal increases or decreases in accordance with the relative velocity of the preceding vehicle, due to the Doppler effect.

When the reception signal and the transmission signal are mixed, a beat signal is generated based on their frequency difference. The frequency of this beat signal (beat frequency) differs between a period in which the transmission signal increases in frequency (ascent) and a period in which the transmission signal decreases in frequency (descent). Once a beat frequency for each period is determined, based on such beat frequencies, the distance to the target and the relative velocity of the target are calculated.

Figure 65:
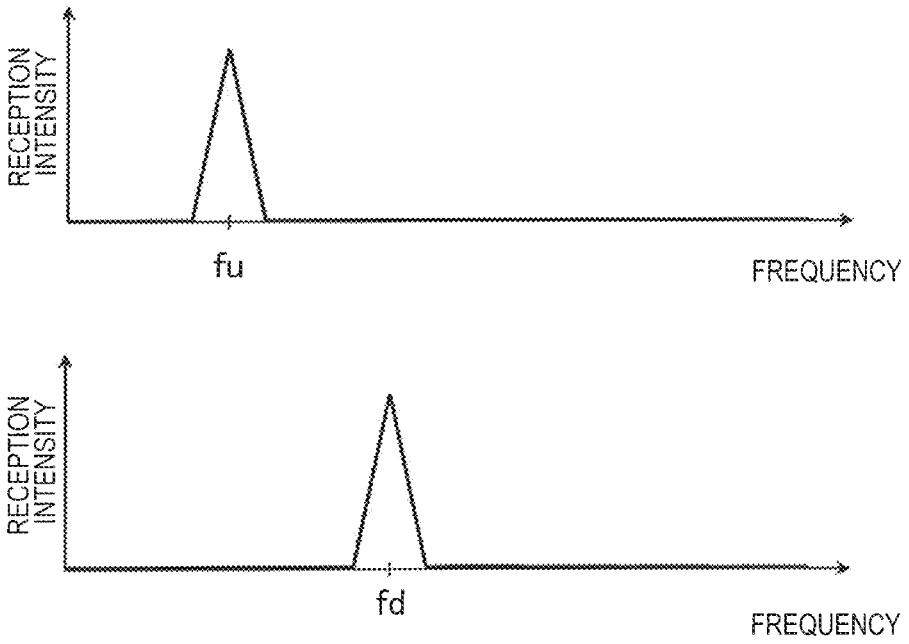

FIG. 65 shows a beat frequency fu in an "ascent" period and a beat frequency fd in a "descent" period. In the graph of FIG. 65, the horizontal axis represents frequency, and the vertical axis represents signal intensity. This graph is obtained by subjecting the beat signal to time-frequency conversion. Once the beat frequencies fu and fd are obtained, based on a known equation, the distance to the target and the relative velocity of the target are calculated. In this Application Example, with the construction and operation described below, beat frequencies corresponding to each antenna element of the array antenna device AA are obtained, thus enabling estimation of the position information of a target.

In the example shown in FIG. 63, reception signals from channels $Ch_1$ to $Ch_M$ corresponding to the respective antenna elements $\mathbf{11}_1$ to $\mathbf{11}_M$ are each amplified by an amplifier, and input to the corresponding mixers 584. Each mixer 584 mixes the transmission signal into the amplified reception signal. Through this mixing, a beat signal is generated corresponding to the frequency difference between the reception signal and the transmission signal. The generated beat signal is fed to the corresponding filter 585. The filters 585 apply bandwidth control to the beat signals on the channels $Ch_1$ to $Ch_M$, and supply bandwidth-controlled beat signals to the switch 586.

The switch 586 performs switching in response to a sampling signal which is input from the controller 588. The controller 588 may be composed of a microcomputer, for example. Based on a computer program which is stored in a memory such as a ROM, the controller 588 controls the entire transmission/reception circuit 580. The controller 588 does not need to be provided inside the transmission/reception circuit 580, but may be provided inside the signal processing circuit 560. In other words, the transmission/ reception circuit 580 may operate in accordance with a control signal from the signal processing circuit 560. Alternatively, some or all of the functions of the controller 588 may be realized by a central processing unit which controls the entire transmission/reception circuit 580 and signal processing circuit 560.

The beat signals on the channels $Ch_1$ to $Ch_M$ having passed through the respective filters 585 are consecutively supplied to the A/D converter 587 via the switch 586. In synchronization with the sampling signal, the A/D converter 587 converts the beat signals on the channels $Ch_1$ to $Ch_M$, which are input from the switch 586, into digital signals.

Hereinafter, the construction and operation of the signal processing circuit 560 will be described in detail. In this Application Example, the distance to the target and the relative velocity of the target are estimated by the FMCW method. Without being limited to the FMCW method as described below, the radar system can also be implemented by using other methods, e.g., 2 frequency CW and spread spectrum methods.

In the example shown in FIG. 63, the signal processing circuit 560 includes a memory 531, a reception intensity calculation section 532, a distance detection section 533, a velocity detection section 534, a DBF (digital beam forming) processing section 535, an azimuth detection section 536, a target link processing section 537, a matrix generation section 538, a target output processing section 539, and an arriving wave estimation unit AU. As mentioned earlier, a part or a whole of the signal processing circuit 560 may be implemented by FPGA, or by a set of a general-purpose processor(s) and a main memory device(s). The memory 531, the reception intensity calculation section 532, the DBF processing section 535, the distance detection section 533, the velocity detection section 534, the azimuth detection section 536, the target link processing section 537, and the arriving wave estimation unit AU may be individual parts that are implemented in distinct pieces of hardware, or functional blocks of a single signal processing circuit.

Figure 66:
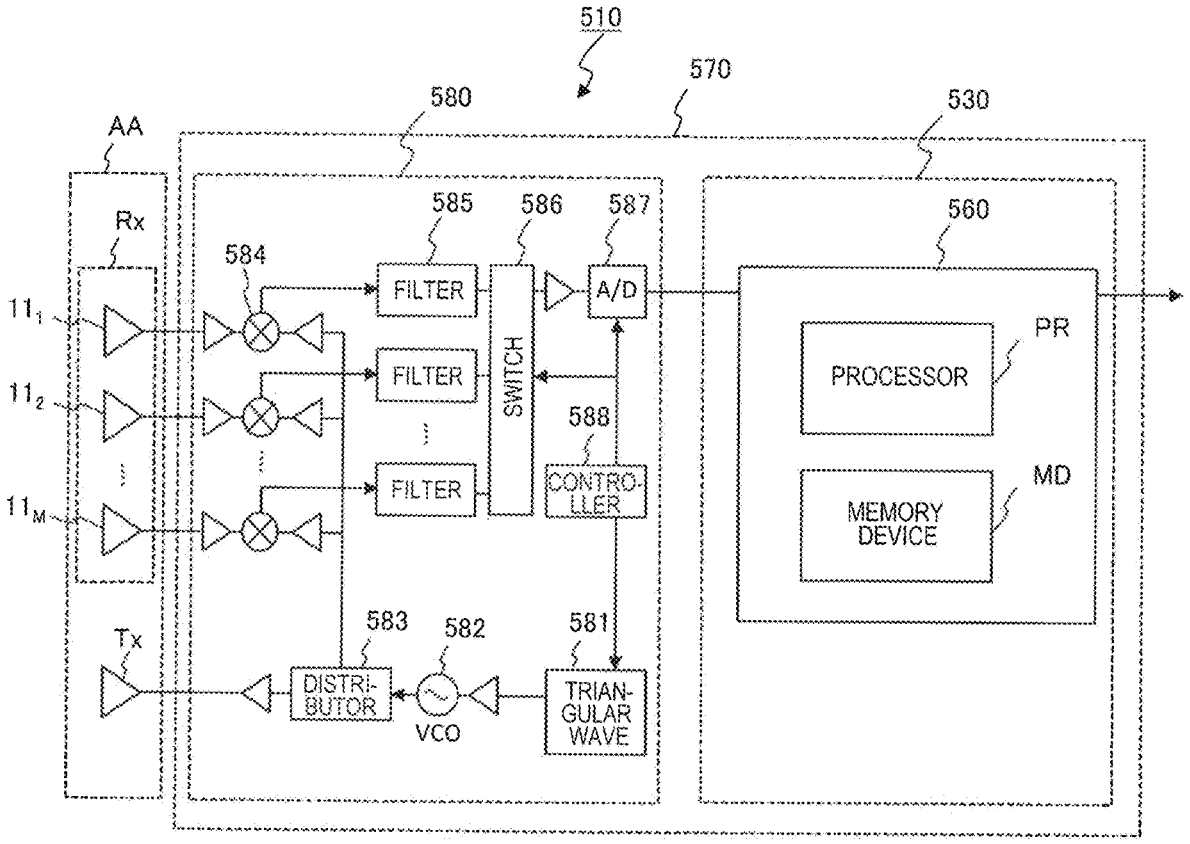

FIG. 66 shows an exemplary implementation in which the signal processing circuit 560 is implemented in hardware including a processor PR and a memory device MD. In the signal processing circuit 560 with this construction, too, a computer program that is stored in the memory device MD may fulfill the functions of the reception intensity calculation section 532, the DBF processing section 535, the distance detection section 533, the velocity detection section 534, the azimuth detection section 536, the target link processing section 537, the matrix generation section 538, and the arriving wave estimation unit AU shown in FIG. 63.

The signal processing circuit 560 in this Application Example is configured to estimate the position information of a preceding vehicle by using each beat signal converted into a digital signal as a secondary signal of the reception signal, and output a signal indicating the estimation result. Hereinafter, the construction and operation of the signal processing circuit 560 in this Application Example will be described in detail.

For each of the channels $Ch_1$ to $Ch_M$, the memory 531 in the signal processing circuit 560 stores a digital signal which is output from the A/D converter 587. The memory 531 may be composed of a generic storage medium such as a semiconductor memory or a hard disk and/or an optical disk.

The reception intensity calculation section 532 applies Fourier transform to the respective beat signals for the channels $Ch_1$ to $Ch_M$ (shown in the lower graph of FIG. 64) that are stored in the memory 531. In the present specification, the amplitude of a piece of complex number data after the Fourier transform is referred to as "signal intensity". The reception intensity calculation section 532 converts the complex number data of a reception signal from one of the plurality of antenna elements, or a sum of the complex number data of all reception signals from the plurality of antenna elements, into a frequency spectrum. In the resultant spectrum, beat frequencies corresponding to respective peak values, which are indicative of presence and distance of targets (preceding vehicles), can be detected. Taking a sum of the complex number data of the reception signals from all antenna elements will allow the noise components to average out, whereby the S/N ratio is improved.

In the case where there is one target, i.e., one preceding vehicle, as shown in FIG. 65, the Fourier transform will produce a spectrum having one peak value in a period of increasing frequency (the "ascent" period) and one peak value in a period of decreasing frequency ("the descent" period). The beat frequency of the peak value in the "ascent" period is denoted by "fu", whereas the beat frequency of the peak value in the "descent" period is denoted by "fd".

From the signal intensities of beat frequencies, the reception intensity calculation section 532 detects any signal intensity that exceeds a predefined value (threshold value), thus determining the presence of a target. Upon detecting a signal intensity peak, the reception intensity calculation section 532 outputs the beat frequencies (fu, fd) of the peak values to the distance detection section 533 and the velocity detection section 534 as the frequencies of the object of interest. The reception intensity calculation section 532 outputs information indicating the frequency modulation width Δf to the distance detection section 533, and outputs information indicating the center frequency f0 to the velocity detection section 534.

In the case where signal intensity peaks corresponding to plural targets are detected, the reception intensity calculation section 532 find associations between the ascents peak values and the descent peak values based on predefined conditions. Peaks which are determined as belonging to signals from the same target are given the same number, and thus are fed to the distance detection section 533 and the velocity detection section 534.

When there are plural targets, after the Fourier transform, as many peaks as there are targets will appear in the ascent portions and the descent portions of the beat signal. In proportion to the distance between the radar and a target, the reception signal will become more delayed and the reception signal in FIG. 64 will shift more toward the right. Therefore, a beat signal will have a greater frequency as the distant between the target and the radar increases.

Based on the beat frequencies fu and fd which are input from the reception intensity calculation section 532, the distance detection section 533 calculates a distance R through the equation below, and supplies it to the target link processing section 537.

$$R=\{c\cdot T/(2\cdot\Delta f)\}\cdot\{(fu+fd)/2\}$$

Moreover, based on the beat frequencies fu and fd being input from the reception intensity calculation section 532, the velocity detection section 534 calculates a relative velocity V through the equation below, and supplies it to the target link processing section 537.

$$V=\{c/(2\cdot f0)\}\cdot\{(fu-fd)/2\}$$

In the equation which calculates the distance R and the relative velocity V, c is velocity of light, and T is the modulation period.

Note that the lower limit resolution of distance R is expressed as c/(2Δf). Therefore, as Δf increases, the resolution of distance R increases. In the case where the frequency f0 is in the 76 GHz band, when Δf is set on the order of 660 megahertz (MHz), the resolution of distance R will be on the order of 0.23 meters (m), for example. Therefore, if two preceding vehicles are traveling abreast of each other, it may be difficult with the FMCW method to identify whether there is one vehicle or two vehicles. In such a case, it might be possible to run an algorithm for direction-of-arrival estimation that has an extremely high angular resolution to separate between the azimuths of the two preceding vehicles and enable detection.

By utilizing phase differences between signals from the antenna elements $\mathbf{11}_1$, $\mathbf{11}_2$, . . . , $\mathbf{11}_M$, the DBF processing section 535 allows the incoming complex data corresponding to the respective antenna elements, which has been Fourier transformed with respect to the time axis, to be Fourier transformed with respect to the direction in which the antenna elements are arrayed. Then, the DBF processing section 535 calculates spatial complex number data indicating the spectrum intensity for each angular channel as determined by the angular resolution, and outputs it to the azimuth detection section 536 for the respective beat frequencies.

The azimuth detection section 536 is provided for the purpose of estimating the azimuth of a preceding vehicle. Among the values of spatial complex number data that has been calculated for the respective beat frequencies, the azimuth detection section 536 chooses an angle θ that takes the largest value, and outputs it to the target link processing section 537 as the azimuth at which an object of interest exists.

Note that the method of estimating the angle θ indicating the direction of arrival of an arriving wave is not limited to this example. Various algorithms for direction-of-arrival estimation that have been mentioned earlier can be employed.

The target link processing section 537 calculates absolute values of the differences between the respective values of distance, relative velocity, and azimuth of the object of interest as calculated in the current cycle and the respective values of distance, relative velocity, and azimuth of the object of interest as calculated 1 cycle before, which are read from the memory 531. Then, if the absolute value of each difference is smaller than a value which is defined for the respective value, the target link processing section 537 determines that the target that was detected 1 cycle before and the target detected in the current cycle are an identical target. In that case, the target link processing section 537 increments the count of target link processes, which is read from the memory 531, by one.

If the absolute value of a difference is greater than predetermined, the target link processing section 537 determines that a new object of interest has been detected. The target link processing section 537 stores the respective values of distance, relative velocity, and azimuth of the object of interest as calculated in the current cycle and also the count of target link processes for that object of interest to the memory 531.

In the signal processing circuit 560, the distance to the object of interest and its relative velocity can be detected by using a spectrum which is obtained through a frequency analysis of beat signals, which are signals generated based on received reflected waves.

The matrix generation section 538 generates a spatial covariance matrix by using the respective beat signals for the channels $Ch_1$ to $Ch_M$ (lower graph in FIG. 64) stored in the memory 531. In the spatial covariance matrix of Math. 4, each component is the value of a beat signal which is expressed in terms of real and imaginary parts. The matrix generation section 538 further determines eigenvalues of the spatial covariance matrix Rxx, and inputs the resultant eigenvalue information to the arriving wave estimation unit AU.

When a plurality of signal intensity peaks corresponding to plural objects of interest have been detected, the reception intensity calculation section 532 numbers the peak values respectively in the ascent portion and in the descent portion, beginning from those with smaller frequencies first, and output them to the target output processing section 539. In the ascent and descent portions, peaks of any identical number correspond to the same object of interest. The identification numbers are to be regarded as the numbers assigned to the objects of interest. For simplicity of illustration, a leader line from the reception intensity calculation section 532 to the target output processing section 539 is conveniently omitted from FIG. 63.

When the object of interest is a structure ahead, the target output processing section 539 outputs the identification number of that object of interest as indicating a target. When receiving results of determination concerning plural objects of interest, such that all of them are structures ahead, the target output processing section 539 outputs the identification number of an object of interest that is in the lane of the driver's vehicle as the object position information indicating where a target is. Moreover, When receiving results of determination concerning plural objects of interest, such that all of them are structures ahead and that two or more objects of interest are in the lane of the driver's vehicle, the target output processing section 539 outputs the identification number of an object of interest that is associated with the largest count of target being read from the link processes memory 531 as the object position information indicating where a target is.

Referring back to FIG. 62, an example where the onboard radar system 510 is incorporated in the exemplary construction shown in FIG. 62 will be described. The image processing circuit 720 acquires information of an object from the video, and detects target position information from the object information. For example, the image processing circuit 720 is configured to estimate distance information of an object by detecting the depth value of an object within an acquired video, or detect size information and the like of an object from characteristic amounts in the video, thus detecting position information of the object.

The selection circuit 596 selectively feeds position information which is received from the signal processing circuit 560 or the image processing circuit 720 to the travel assistance electronic control apparatus 520. For example, the selection circuit 596 compares a first distance, i.e., the distance from the driver's vehicle to a detected object as contained in the object position information from the signal processing circuit 560, against a second distance, i.e., the distance from the driver's vehicle to the detected object as contained in the object position information from the image processing circuit 720, and determines which is closer to the driver's vehicle. For example, based on the result of determination, the selection circuit 596 may select the object position information which indicates a closer distance to the driver's vehicle, and output it to the travel assistance electronic control apparatus 520. If the result of determination indicates the first distance and the second distance to be of the same value, the selection circuit 596 may output either one, or both of them, to the travel assistance electronic control apparatus 520.

If information indicating that there is no prospective target is input from the reception intensity calculation section 532, the target output processing section 539 (FIG. 63) outputs zero, indicating that there is no target, as the object position information. Then, on the basis of the object position information from the target output processing section 539, through comparison against a predefined threshold value, the selection circuit 596 chooses either the object position information from the signal processing circuit 560 or the object position information from the image processing circuit 720 to be used.

Based on predefined conditions, the travel assistance electronic control apparatus 520 having received the position information of a preceding object from the object detection apparatus 570 performs control to make the operation safer or easier for the driver who is driving the driver's vehicle, in accordance with the distance and size indicated by the object position information, the velocity of the driver's vehicle, road surface conditions such as rainfall, snowfall or clear weather, or other conditions. For example, if the object position information indicates that no object has been detected, the travel assistance electronic control apparatus 520 may send a control signal to an accelerator control circuit 526 to increase speed up to a predefined velocity, thereby controlling the accelerator control circuit 526 to make an operation that is equivalent to stepping on the accelerator pedal.

In the case where the object position information indicates that an object has been detected, if it is found to be at a predetermined distance from the driver's vehicle, the travel assistance electronic control apparatus 520 controls the brakes via a brake control circuit 524 through a brake-by-wire construction or the like. In other words, it makes an operation of decreasing the velocity to maintain a constant vehicular gap. Upon receiving the object position information, the travel assistance electronic control apparatus 520 sends a control signal to an alarm control circuit 522 so as to control lamp illumination or control audio through a loudspeaker which is provided within the vehicle, so that the driver is informed of the nearing of a preceding object. Upon receiving object position information including a spatial distribution of preceding vehicles, the travel assistance electronic control apparatus 520 may, if the traveling velocity is within a predefined range, automatically make the steering wheel easier to operate to the right or left, or control the hydraulic pressure on the steering wheel side so as to force a change in the direction of the wheels, thereby providing assistance in collision avoidance with respect to the preceding object.

The object detection apparatus 570 may be arranged so that, if a piece of object position information which was being continuously detected by the selection circuit 596 for a while in the previous detection cycle but which is not detected in the current detection cycle becomes associated with a piece of object position information from a camera-detected video indicating a preceding object, then continued tracking is chosen, and object position information from the signal processing circuit 560 is output with priority.

An exemplary specific construction and an exemplary operation for the selection circuit 596 to make a selection between the outputs from the signal processing circuit 560 and the image processing circuit 720 are disclosed in the specification of U.S. Pat. No. 8,446,312, the specification of U.S. Pat. No. 8,730,096, and the specification of U.S. Pat. No. 8,730,099. The entire disclosure thereof is incorporated herein by reference.

[First Variant]

In the radar system for onboard use of the above Application Example, the (sweep) condition for a single instance of FMCW (Frequency Modulated Continuous Wave) frequency modulation, i.e., a time span required for such a modulation (sweep time), is e.g. 1 millisecond, although the sweep time could be shortened to about 100 microseconds.

However, in order to realize such a rapid sweep condition, not only the constituent elements involved in the radiation of a transmission wave, but also the constituent elements involved in the reception under that sweep condition must also be able to rapidly operate. For example, an A/D converter 587 (FIG. 63) which rapidly operates under that sweep condition will be needed. The sampling frequency of the A/D converter 587 may be 10 MHz, for example. The sampling frequency may be faster than 10 MHz.

In the present variant, a relative velocity with respect to a target is calculated without utilizing any Doppler shift-based frequency component. In this variant, the sweep time is Tm=100 microseconds, which is very short. The lowest frequency of a detectable beat signal, which is 1/Tm, equals 10 kHz in this case. This would correspond to a Doppler shift of a reflected wave from a target which has a relative velocity of approximately 20 m/second. In other words, so long as one relies on a Doppler shift, it would be impossible to detect relative velocities that are equal to or smaller than this. Thus, a method of calculation which is different from a Doppler shift-based method of calculation is preferably adopted.

As an example, this variant illustrates a process that utilizes a signal (upbeat signal) representing a difference between a transmission wave and a reception wave which is obtained in an upbeat (ascent) portion where the transmission wave increases in frequency. A single sweep time of FMCW is 100 microseconds, and its waveform is a sawtooth shape which is composed only of an upbeat portion. In other words, in this variant, the signal wave which is generated by the triangular wave/CW wave generation circuit 581 has a sawtooth shape. The sweep width in frequency is 500 MHz. Since no peaks are to be utilized that are associated with Doppler shifts, the process is not one that generates an upbeat signal and a downbeat signal to utilize the peaks of both, but will rely on only one of such signals. Although a case of utilizing an upbeat signal will be illustrated herein, a similar process can also be performed by using a downbeat signal.

The A/D converter 587 (FIG. 63) samples each upbeat signal at a sampling frequency of 10 MHz, and outputs several hundred pieces of digital data (hereinafter referred to as "sampling data"). The sampling data is generated based on upbeat signals after a point in time where a reception wave is obtained and until a point in time at which a transmission wave completes transmission, for example. Note that the process may be ended as soon as a certain number of pieces of sampling data are obtained.

In this variant, 128 upbeat signals are transmitted/received in series, for each of which some several hundred pieces of sampling data are obtained. The number of upbeat signals is not limited to 128. It may be 256, or 8. An arbitrary number may be selected depending on the purpose.

The resultant sampling data is stored to the memory 531. The reception intensity calculation section 532 applies a two-dimensional fast Fourier transform (FFT) to the sampling data. Specifically, first, for each of the sampling data pieces that have been obtained through a single sweep, a first FFT process (frequency analysis process) is performed to generate a power spectrum. Next, the velocity detection section 534 performs a second FFT process for the processing results that have been collected from all sweeps.

When the reflected waves are from the same target, peak components in the power spectrum to be detected in each sweep period will be of the same frequency. On the other hand, for different targets, the peak components will differ in frequency. Through the first FFT process, plural targets that are located at different distances can be separated.

In the case where a relative velocity with respect to a target is non-zero, the phase of the upbeat signal changes slightly from sweep to sweep. In other words, through the second FFT process, a power spectrum whose elements are the data of frequency components that are associated with such phase changes will be obtained for the respective results of the first FFT process.

The reception intensity calculation section 532 extracts peak values in the second power spectrum above, and sends them to the velocity detection section 534.

The velocity detection section 534 determines a relative velocity from the phase changes. For example, suppose that a series of obtained upbeat signals undergo phase changes by every phase θ [RXd]. Assuming that the transmission wave has an average wavelength λ, this means there is a $\lambda/(4\eta/\theta)$ change in distance every time an upbeat signal is obtained. Since this change has occurred over an interval of upbeat signal transmission Tm (=100 microseconds), the relative velocity is determined to be $\{\lambda/(4\eta/\theta)\}/Tm$.

Through the above processes, a relative velocity with respect to a target as well as a distance from the target can be obtained.

[Second Variant]

The radar system 510 is able to detect a target by using a continuous wave(s) CW of one or plural frequencies. This method is especially useful in an environment where a multitude of reflected waves impinge on the radar system 510 from still objects in the surroundings, e.g., when the vehicle is in a tunnel.

The radar system 510 has an antenna array for reception purposes, including five channels of independent reception elements. In such a radar system, the azimuth-of-arrival estimation for incident reflected waves is only possible if there are four or fewer reflected waves that are simultaneously incident. In an FMCW-type radar, the number of reflected waves to be simultaneously subjected to an azimuth-of-arrival estimation can be reduced by exclusively selecting reflected waves from a specific distance. However, in an environment where a large number of still objects exist in the surroundings, e.g., in a tunnel, it is as if there were a continuum of objects to reflect radio waves; therefore, even if one narrows down on the reflected waves based on distance, the number of reflected waves may still not be equal to or smaller than four. However, any such still object in the surroundings will have an identical relative velocity with respect to the driver's vehicle, and the relative velocity will be greater than that associated with any other vehicle that is traveling ahead. On this basis, such still objects can be distinguished from any other vehicle based on the magnitudes of Doppler shifts.

Therefore, the radar system 510 performs a process of: radiating continuous waves CW of plural frequencies; and, while ignoring Doppler shift peaks that correspond to still objects in the reception signals, detecting a distance by using a Doppler shift peak(s) of any smaller shift amount(s). Unlike in the FMCW method, in the CW method, a frequency difference between a transmission wave and a reception wave is ascribable only to a Doppler shift. In other words, any peak frequency that appears in a beat signal is ascribable only to a Doppler shift.

In the description of this variant, too, a continuous wave to be used in the CW method will be referred to as a "continuous wave CW". As described above, a continuous wave CW has a constant frequency; that is, it is unmodulated.

Suppose that the radar system 510 has radiated a continuous wave CW of a frequency fp, and detected a reflected wave of a frequency fq that has been reflected off a target. The difference between the transmission frequency fp and the reception frequency fq is called a Doppler frequency, which approximates to $fp-fq=2\cdot Vr\cdot fp/c$. Herein, Vr is a relative velocity between the radar system and the target, and c is the velocity of light. The transmission frequency fp, the Doppler frequency (fp−fq), and the velocity of light c are known. Therefore, from this equation, the relative velocity $Vr=(fp-fq)\cdot c/2fp$ can be determined. The distance to the target is calculated by utilizing phase information as will be described later.

In order to detect a distance to a target by using continuous waves CW, a 2 frequency CW method is adopted. In the 2 frequency CW method, continuous waves CW of two frequencies which are slightly apart are radiated each for a certain period, and their respective reflected waves are acquired. For example, in the case of using frequencies in the 76 GHz band, the difference between the two frequencies would be several hundred kHz. As will be described later, it is more preferable to determine the difference between the two frequencies while taking into account the minimum distance at which the radar used is able to detect a target.

Suppose that the radar system 510 has sequentially radiated continuous waves CW of frequencies fp1 and fp2 ($fp1<fp2$), and that the two continuous waves CW have been reflected off a single target, resulting in reflected waves of frequencies fq1 and fq2 being received by the radar system 510.

Based on the continuous wave CW of the frequency fp1 and the reflected wave (frequency fq1) thereof, a first Doppler frequency is obtained. Based on the continuous wave CW of the frequency fp2 and the reflected wave (frequency fq2) thereof, a second Doppler frequency is obtained. The two Doppler frequencies have substantially the same value. However, due to the difference between the frequencies fp1 and fp2, the complex signals of the respective reception waves differ in phase. By utilizing this phase information, a distance (range) to the target can be calculated.

Specifically, the radar system 510 is able to determine the distance R as $R=c\cdot\Delta\varphi/4\eta(fp2-fp1)$. Herein, Δφ denotes the phase difference between two beat signals, i.e., beat signal 1 which is obtained as a difference between the continuous wave CW of the frequency fp1 and the reflected wave (frequency fq1) thereof and beat signal 2 which is obtained as a difference between the continuous wave CW of the frequency fp2 and the reflected wave (frequency fq2) thereof. The method of identifying the frequency fb1 of beat signal 1 and the frequency fb2 of beat signal 2 is identical to that in the aforementioned instance of a beat signal from a continuous wave CW of a single frequency.

Note that a relative velocity Vr under the 2 frequency CW method is determined as follows.

$$Vr=fb1\cdot c/2\cdot fp1 \text{ or } Vr=fb2\cdot c/2\cdot fp2$$

Moreover, the range in which a distance to a target can be uniquely identified is limited to the range defined by Rmax<c/2(fp2−fp1). The reason is that beat signals resulting from a reflected wave from any farther target would produce a Δφ which is greater than 2n, such that they are indistinguishable from beat signals associated with targets at closer positions. Therefore, it is more preferable to adjust the difference between the frequencies of the two continuous waves CW so that Rmax becomes greater than the minimum detectable distance of the radar. In the case of a radar whose minimum detectable distance is 100 m, fp2−fp1 may be made e.g. 1.0 MHz. In this case, Rmax=150 m, so that a signal from any target from a position beyond Rmax is not detected. In the case of mounting a radar which is capable of detection up to 250 m, fp2−fp1 may be made e.g. 500 kHz. In this case, Rmax=300 m, so that a signal from any target from a position beyond Rmax is not detected, either. In the case where the radar has both of an operation mode in which the minimum detectable distance is 100 m and the horizontal viewing angle is 120 degrees and an operation mode in which the minimum detectable distance is 250 m and the horizontal viewing angle is 5 degrees, it is preferable to switch the fp2−fp1 value be 1.0 MHz and 500 kHz for operation in the respective operation modes.

A detection approach is known which, by transmitting continuous waves CW at N different frequencies (where N is an integer of 3 or more), and utilizing phase information of the respective reflected waves, detects a distance to each target. Under this detection approach, distance can be properly recognized up to N−1 targets. As the processing to enable this, a fast Fourier transform (FFT) is used, for example. Given N=64 or 128, an FFT is performed for sampling data of a beat signal as a difference between a transmission signal and a reception signal for each frequency, thus obtaining a frequency spectrum (relative velocity). Thereafter, at the frequency of the CW wave, a further FFT is performed for peaks of the same frequency, thus to derive distance information.

Hereinafter, this will be described more specifically.

Figure 67:
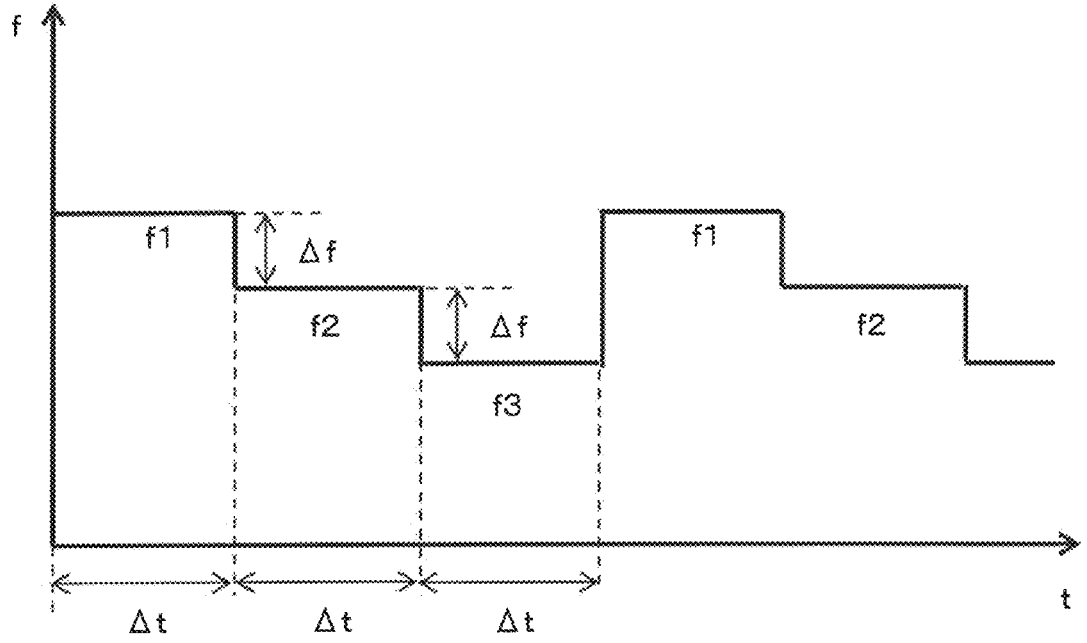

For ease of explanation, first, an instance will be described where signals of three frequencies f1, f2 and f3 are transmitted while being switched over time. It is assumed that f1>f2>f3, and f1−f2=f2−f3=Δf. A transmission time Δt is assumed for the signal wave for each frequency. FIG. 67 shows a relationship between three frequencies f1, f2 and f3.

Via the transmission antenna Tx, the triangular wave/CW wave generation circuit 581 (FIG. 63) transmits continuous waves CW of frequencies f1, f2 and f3, each lasting for the time Δt. The reception antennas Rx receive reflected waves resulting by the respective continuous waves CW being reflected off one or plural targets.

Each mixer 584 mixes a transmission wave and a reception wave to generate a beat signal. The A/D converter 587 converts the beat signal, which is an analog signal, into several hundred pieces of digital data (sampling data), for example.

Using the sampling data, the reception intensity calculation section 532 performs FFT computation. Through the FFT computation, frequency spectrum information of reception signals is obtained for the respective transmission frequencies f1, f2 and f3.

Thereafter, the reception intensity calculation section 532 separates peak values from the frequency spectrum information of the reception signals. The frequency of any peak value which is predetermined or greater is in proportion to a relative velocity with respect to a target. Separating a peak value(s) from the frequency spectrum information of reception signals is synonymous with separating one or plural targets with different relative velocities.

Next, with respect to each of the transmission frequencies f1 to f3, the reception intensity calculation section 532 measures spectrum information of peak values of the same relative velocity or relative velocities within a predefined range.

Now, consider a scenario where two targets A and B exist which have about the same relative velocity but are at respectively different distances. A transmission signal of the frequency f1 will be reflected from both of targets A and B to result in reception signals being obtained. The reflected waves from targets A and B will result in substantially the same beat signal frequency. Therefore, the power spectra at the Doppler frequencies of the reception signals, corresponding to their relative velocities, are obtained as a synthetic spectrum F1 into which the power spectra of two targets A and B have been merged.

Similarly, for each of the frequencies f2 and f3, the power spectra at the Doppler frequencies of the reception signals, corresponding to their relative velocities, are obtained as a synthetic spectrum F1 into which the power spectra of two targets A and B have been merged.

Figure 68:
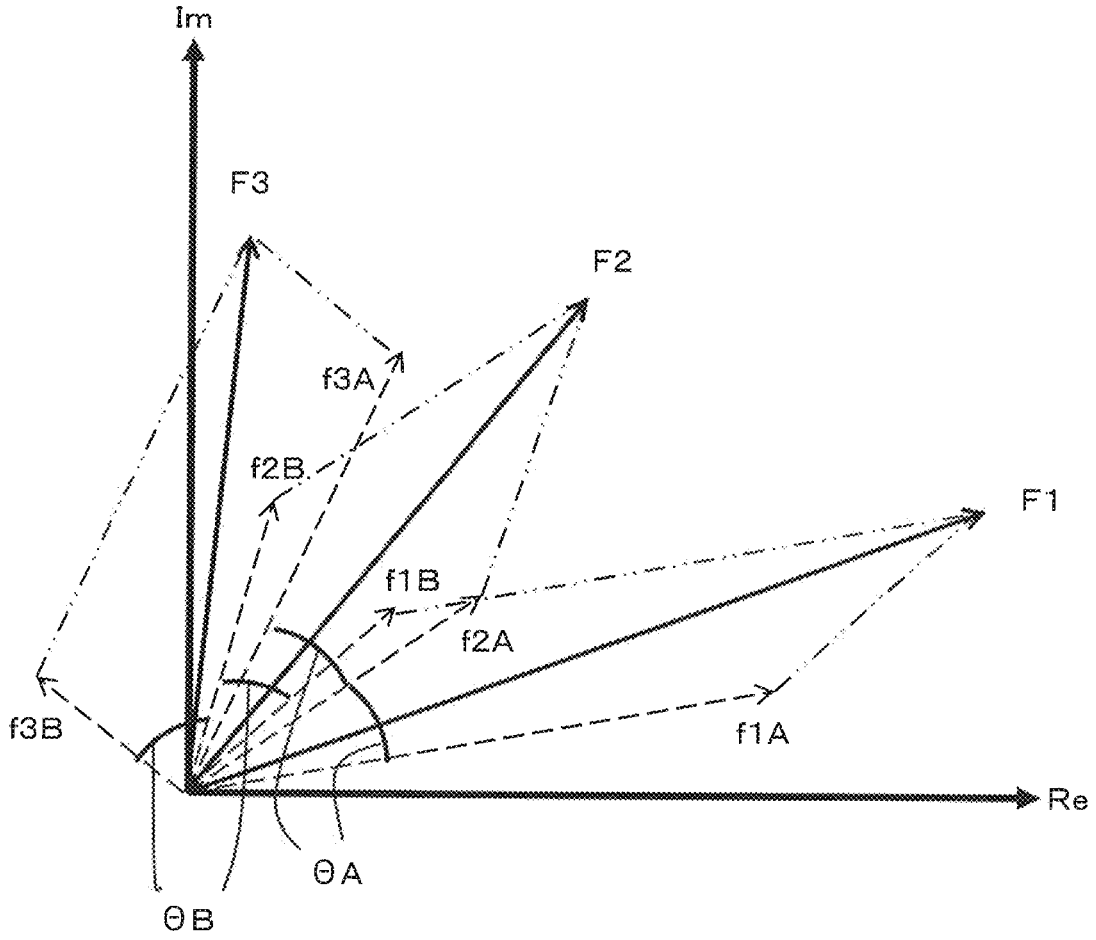

FIG. 68 shows a relationship between synthetic spectra F1 to F3 on a complex plane. In the directions of the two vectors composing each of the synthetic spectra F1 to F3, the right vector corresponds to the power spectrum of a reflected wave from target A; i.e., vectors f1A, f2A and f3A, in FIG. 68. On the other hand, in the directions of the two vectors composing each of the synthetic spectra F1 to F3, the left vector corresponds to the power spectrum of a reflected wave from target B; i.e., vectors f1B, f2B and f3B in FIG. 68.

Under a constant difference Δf between the transmission frequencies, the phase difference between the reception signals corresponding to the respective transmission signals of the frequencies f1 and f2 is in proportion to the distance to a target. Therefore, the phase difference between the vectors f1A and f2A and the phase difference between the vectors f2A and f3A are of the same value θA, this phase difference θA being in proportion to the distance to target A. Similarly, the phase difference between the vectors f1B and f2B and the phase difference between the vectors f2B and f3B are of the same value θB, this phase difference θB being in proportion to the distance to target B.

By using a well-known method, the respective distances to targets A and B can be determined from the synthetic spectra F1 to F3 and the difference Δf between the transmission frequencies. This technique is disclosed in U.S. Pat. No. 6,703,967, for example. The entire disclosure of this publication is incorporated herein by reference.

Similar processing is also applicable when the transmitted signals have four or more frequencies.

Note that, before transmitting continuous wave CWs at N different frequencies, a process of determining the distance to and relative velocity of each target may be performed by the 2 frequency CW method. Then, under predetermined conditions, this process may be switched to a process of transmitting continuous waves CW at N different frequencies. For example, FFT computation may be performed by using the respective beat signals at the two frequencies, and if the power spectrum of each transmission frequency undergoes a change over time of 30% or more, the process may be switched. The amplitude of a reflected wave from each target undergoes a large change over time due to multipath influences and the like. When there exists a change of a predetermined magnitude or greater, it may be considered that plural targets may exist.

Moreover, the CW method is known to be unable to detect a target when the relative velocity between the radar system and the target is zero, i.e., when the Doppler frequency is zero. However, when a pseudo Doppler signal is determined by the following methods, for example, it is possible to detect a target by using that frequency.

(Method 1) A mixer that causes a certain frequency shift in the output of a receiving antenna is added. By using a transmission signal and a reception signal with a shifted frequency, a pseudo Doppler signal can be obtained.

(Method 2) A variable phase shifter to introduce phase changes continuously over time is inserted between the output of a receiving antenna and a mixer, thus adding a pseudo phase difference to the reception signal. By using a transmission signal and a reception signal with an added phase difference, a pseudo Doppler signal can be obtained.

An example of specific construction and operation of inserting a variable phase shifter to generate a pseudo Doppler signal under Method 2 is disclosed in Japanese Laid-Open Patent Publication No. 2004-257848. The entire disclosure of this publication is incorporated herein by reference.

When targets with zero or very little relative velocity need to be detected, the aforementioned processes of generating a pseudo Doppler signal may be adopted, or the process may be switched to a target detection process under the FMCW method.

Next, with reference to FIG. 69, a procedure of processing to be performed by the object detection apparatus 570 of the onboard radar system 510 will be described.

The example below will illustrate a case where continuous waves CW are transmitted at two different frequencies fp1 and fp2 (fp1<fp2), and the phase information of each reflected wave is utilized to respectively detect a distance with respect to a target.

Figure 69:
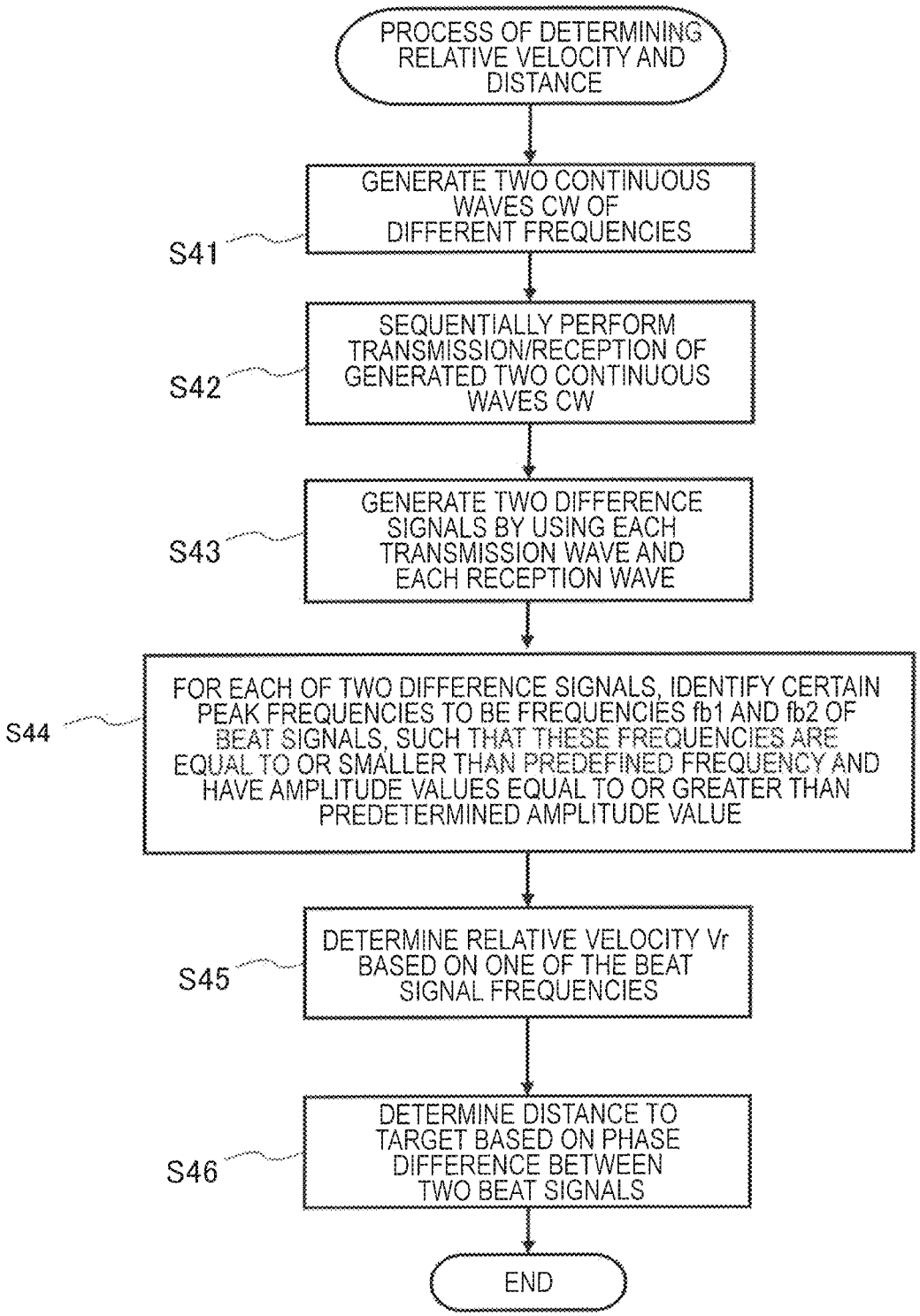

FIG. 69 is a flowchart showing the procedure of a process of determining relative velocity and distance according to this variant.

At step S41, the triangular wave/CW wave generation circuit 581 generates two continuous waves CW of frequencies which are slightly apart, i.e., frequencies fp1 and fp2.

At step S42, the transmission antenna Tx and the reception antennas Rx perform transmission/reception of the generated series of continuous waves CW. Note that the process of step S41 and the process of step S42 are to be performed in parallel fashion respectively by the triangular wave/CW wave generation circuit 581 and the transmission antenna element Tx/reception antenna Rx, rather than step S42 following only after completion of step S41.

At step S43, each mixer 584 generates a difference signal by utilizing each transmission wave and each reception wave, whereby two difference signals are obtained. Each reception wave is inclusive of a reception wave emanating from a still object and a reception wave emanating from a target. Therefore, next, a process of identifying frequencies to be utilized as the beat signals is performed. Note that the process of step S41, the process of step S42, and the process of step S43 are to be performed in parallel fashion by the triangular wave/CW wave generation circuit 581, the transmission antenna Tx/reception antenna Rx, and the mixers 584, rather than step S42 following only after completion of step S41, or step S43 following only after completion of step S42.

At step S44, for each of the two difference signals, the object detection apparatus 570 identifies certain peak frequencies to be frequencies fb1 and fb2 of beat signals, such that these frequencies are equal to or smaller than a frequency which is predefined as a threshold value and yet they have amplitude values which are equal to or greater than a predetermined amplitude value, and that the difference between the two frequencies is equal to or smaller than a predetermined value.

At step S45, based on one of the two beat signal frequencies identified, the reception intensity calculation section 532 detects a relative velocity. The reception intensity calculation section 532 calculates the relative velocity according to $Vr=fb1\cdot c/2\cdot fp1$, for example. Note that a relative velocity may be calculated by utilizing each of the two beat signal frequencies, which will allow the reception intensity calculation section 532 to verify whether they match or not, thus enhancing the precision of relative velocity calculation.

At step S46, the reception intensity calculation section 532 determines a phase difference $\Delta\varphi$ between two beat signals 1 and 2, and determines a distance $R=c\cdot\Delta\varphi/4\eta(fp2-fp1)$ to the target.

Through the above processes, the relative velocity and distance to a target can be detected.

Note that continuous waves CW may be transmitted at N different frequencies (where N is 3 or more), and by utilizing phase information of the respective reflected wave, distances to plural targets which are of the same relative velocity but at different positions may be detected.

In addition to the radar system 510, the vehicle 500 described above may further include another radar system. For example, the vehicle 500 may further include a radar system having a detection range toward the rear or the sides of the vehicle body. In the case of incorporating a radar system having a detection range toward the rear of the vehicle body, the radar system may monitor the rear, and if there is any danger of having another vehicle bump into the rear, make a response by issuing an alarm, for example. In the case of incorporating a radar system having a detection range toward the sides of the vehicle body, the radar system may monitor an adjacent lane when the driver's vehicle changes its lane, etc., and make a response by issuing an alarm or the like as necessary.

The applications of the above-described radar system 510 are not limited to onboard use only. Rather, the radar system 510 may be used as sensors for various purposes. For example, it may be used as a radar for monitoring the surroundings of a house or any other building.

Alternatively, it may be used as a sensor for detecting the presence or absence of a person at a specific indoor place, or whether or not such a person is undergoing any motion, etc., without utilizing any optical images.

[Supplementary Details of Processing]

Other embodiments will be described in connection with the 2 frequency CW or FMCW techniques for array antennas as described above. As described earlier, in the example of FIG. 31, the reception intensity calculation section 532 applies a Fourier transform to the respective beat signals for the channels $Ch_1$ to $Ch_M$ (lower graph in FIG. 32) stored in the memory 531. These beat signals are complex signals, in order that the phase of the signal of computational interest be identified. This allows the direction of an arriving wave to be accurately identified. In this case, however, the computational load for Fourier transform increases, thus calling for a larger-scaled circuit.

In order to solve this problem, a scalar signal may be generated as a beat signal. For each of a plurality of beat signals that have been generated, two complex Fourier transforms may be performed with respect to the spatial axis direction, which conforms to the antenna array, and to the time axis direction, which conforms to the lapse of time, thus to obtain results of frequency analysis. As a result, with only a small amount of computation, beam formation can eventually be achieved so that directions of arrival of reflected waves can be identified, whereby results of frequency analysis can be obtained for the respective beams. As a patent document related to the present disclosure, the entire disclosure of the specification of U.S. Pat. No. 6,339,395 is incorporated herein by reference.

[Optical Sensor, e.g., Camera, and Millimeter Wave Radar]

Next, a comparison between the above-described array antenna and conventional antennas, as well as an exemplary application in which both of the present array antenna and an optical sensor (e.g., a camera) are utilized, will be described. Note that LIDAR or the like may be employed as the optical sensor.

A millimeter wave radar is able to directly detect a distance (range) to a target and a relative velocity thereof. Another characteristic is that its detection performance is not much deteriorated in the nighttime (including dusk), or in bad weather, e.g., rainfall, fog, or snowfall. On the other hand, it is believed that it is not just as easy for a millimeter wave radar to take a two-dimensional grasp of a target as it is for a camera. On the other hand, it is relatively easy for a camera to take a two-dimensional grasp of a target and recognize its shape. However, a camera may not be able to image a target in nighttime or bad weather, which presents a considerable problem. This problem is particularly outstanding when droplets of water have adhered to the portion through which to ensure lighting, or the eyesight is narrowed by a fog. This problem similarly exists for LIDAR or the like, which also pertains to the realm of optical sensors.

In these years, in answer to increasing demand for safer vehicle operation, driver assist systems for preventing collisions or the like are being developed. A driver assist system acquires an image in the direction of vehicle travel with a sensor such as a camera or a millimeter wave radar, and when any obstacle is recognized that is predicted to hinder vehicle travel, brakes or the like are automatically applied to prevent collisions or the like. Such a function of collision avoidance is expected to operate normally, even in nighttime or bad weather.

Hence, driver assist systems of a so-called fusion construction are gaining prevalence, where, in addition to a conventional optical sensor such as a camera, a millimeter wave radar is mounted as a sensor, thus realizing a recognition process that takes advantage of both. Such a driver assist system will be discussed later.

On the other hand, higher and higher functions are being required of the millimeter wave radar itself. A millimeter wave radar for onboard use mainly uses electromagnetic waves of the 76 GHz band. The antenna power of its antenna is restricted to below a certain level under each country's law or the like. For example, it is restricted to 0.01 W or below in Japan. Under such restrictions, a millimeter wave radar for onboard use is expected to satisfy the required performance that, for example, its detection range is 200 m or more; the antenna size is 60 mm×60 mm or less; its horizontal detection angle is 90 degrees or more; its range resolution is 20 cm or less; it is capable of short-range detection within 10 m; and so on. Conventional millimeter wave radars have used microstrip lines as waveguides, and patch antennas as antennas (hereinafter, these will both be referred to as "patch antennas"). However, with a patch antenna, it has been difficult to attain the aforementioned performance.

By using a slot array antenna to which the technique of the present disclosure is applied, the inventors have successfully achieved the aforementioned performance. As a result, a millimeter wave radar has been realized which is smaller in size, more efficient, and higher-performance than are conventional patch antennas and the like. In addition, by combining this millimeter wave radar and an optical sensor such as a camera, a small-sized, highly efficient, and high-performance fusion apparatus has been realized which has existed never before. This will be described in detail below.

FIG. 70 is a diagram concerning a fusion apparatus in a vehicle 500, the fusion apparatus including an onboard camera system 700 and a radar system 510 (hereinafter referred to also as the millimeter wave radar 510) having a slot array antenna to which the technique of the present disclosure is applied. With reference to this figure, various embodiments will be described below.

[Installment of Millimeter Wave Radar within Vehicle Room]

A conventional patch antenna-based millimeter wave radar 510' is placed behind and inward of a grill 512 which is at the front nose of a vehicle. An electromagnetic wave that is radiated from an antenna goes through the apertures in the grill 512, and is radiated ahead of the vehicle 500. In this case, no dielectric layer, e.g., glass, exists that decays or reflects electromagnetic wave energy, in the region through which the electromagnetic wave passes. As a result, an electromagnetic wave that is radiated from the patch antenna-based millimeter wave radar 510' reaches over a long range, e.g., to a target which is 150 m or farther away. By receiving with the antenna the electromagnetic wave reflected therefrom, the millimeter wave radar 510' is able to detect a target. In this case, however, since the antenna is placed behind and inward of the grill 512 of the vehicle, the radar may be broken when the vehicle collides into an obstacle. Moreover, it may be soiled with mud or the like in rain, etc., and the soil that has adhered to the antenna may hinder radiation and reception of electromagnetic waves.

Similarly to the conventional manner, the millimeter wave radar 510 incorporating a slot array antenna according to an embodiment of the present disclosure may be placed behind the grill 512, which is located at the front nose of the vehicle (not shown). This allows the energy of the electromagnetic wave to be radiated from the antenna to be utilized by 100%, thus enabling long-range detection beyond the conventional level, e.g., detection of a target which is at a distance of 250 m or more.

Furthermore, the millimeter wave radar 510 according to an embodiment of the present disclosure can also be placed within the vehicle room, i.e., inside the vehicle. In that case, the millimeter wave radar 510 is placed inward of the windshield 511 of the vehicle, to fit in a space between the windshield 511 and a face of the rearview mirror (not shown) that is opposite to its specular surface. On the other hand, the conventional patch antenna-based millimeter wave radar 510' cannot be placed inside the vehicle room mainly for the two following reasons. A first reason is its large size, which prevents itself from being accommodated within the space between the windshield 511 and the rearview mirror. A second reason is that an electromagnetic wave that is radiated ahead reflects off the windshield 511 and decays due to dielectric loss, thus becoming unable to travel the desired distance. As a result, if a conventional patch antenna-based millimeter wave radar is placed within the vehicle room, only targets which are 100 m ahead or less can be detected, for example. On the other hand, a millimeter wave radar according to an embodiment of the present disclosure is able to detect a target which is at a distance of 200 m or more, despite reflection or decay at the windshield 511. This performance is equivalent to, or even greater than, the case where a conventional patch antenna-based millimeter wave radar is placed outside the vehicle room.

[Fusion Construction Based on Millimeter Wave Radar and Camera, Etc., being Placed within Vehicle Room]

Currently, an optical imaging device such as a CCD camera is used as the main sensor in many a driver assist system (Driver Assist System). Usually, a camera or the like is placed within the vehicle room, inward of the windshield 511, in order to account for unfavorable influences of the external environment, etc. In this context, in order to minimize the optical effect of raindrops and the like, the camera or the like is placed in a region which is swept by the wipers (not shown) but is inward of the windshield 511.

In recent years, due to needs for improved performance of a vehicle in terms of e.g. automatic braking, there has been a desire for automatic braking or the like that is guaranteed to work regardless of whatever external environment may exist. In this case, if the only sensor in the driver assist system is an optical device such as a camera, a problem exists in that reliable operation is not guaranteed in nighttime or bad weather. This has led to the need for a driver assist system that incorporates not only an optical sensor (such as a camera) but also a millimeter wave radar, these being used for cooperative processing, so that reliable operation is achieved even in nighttime or bad weather.

As described earlier, a millimeter wave radar incorporating the present slot array antenna permits itself to be placed within the vehicle room, due to downsizing and remarkable enhancement in the efficiency of the radiated electromagnetic wave over that of a conventional patch antenna. By taking advantage of these properties, as shown in FIG. 70, the millimeter wave radar 510, which incorporates not only an optical sensor (onboard camera system) 700 such as a camera but also a slot array antenna according to the present disclosure, allows both to be placed inward of the windshield 511 of the vehicle 500. This has created the following novel effects.

(1) It is easier to install the driver assist system on the vehicle 500. The conventional patch antenna-based millimeter wave radar 510' has required a space behind the grill 512, which is at the front nose, in order to accommodate the radar. Since this space may include some sites that affect the structural design of the vehicle, if the size of the radar device is changed, it may have been necessary to reconsider the structural design. This inconvenience is avoided by placing the millimeter wave radar within the vehicle room.

(2) Free from the influences of rain, nighttime, or other external environment factors to the vehicle, more reliable operation can be achieved. Especially, as shown in FIG. 71, by placing the millimeter wave radar (onboard camera system) 510 and the camera at substantially the same position within the vehicle room, they can attain an identical field of view and line of sight, thus facilitating the "matching process" which will be described later, i.e., a process through which to establish that respective pieces of target information captured by them actually come from an identical object. On the other hand, if the millimeter wave radar 510' were placed behind the grill 512, which is at the front nose outside the vehicle room, its radar line of sight L would differ from a radar line of sight M of the case where it was placed within the vehicle room, thus resulting in a large offset with the image to be acquired by the onboard camera system 700.

(3) Reliability of the millimeter wave radar device is improved. As described above, since the conventional patch antenna-based millimeter wave radar 510' is placed behind the grill 512, which is at the front nose, it is likely to gather soil, and may be broken even in a minor collision accident or the like. For these reasons, cleaning and functionality checks are always needed. Moreover, as will be described below, if the position or direction of attachment of the millimeter wave radar becomes shifted due to an accident or the like, it is necessary to reestablish alignment with respect to the camera. The chances of such occurrences are reduced by placing the millimeter wave radar within the vehicle room, whereby the aforementioned inconveniences are avoided.

In a driver assist system of such fusion construction, the optical sensor, e.g., a camera, and the millimeter wave radar 510 incorporating the present slot array antenna may have an integrated construction, i.e., being in fixed position with respect to each other. In that case, certain relative positioning should be kept between the optical axis of the optical sensor such as a camera and the directivity of the antenna of the millimeter wave radar, as will be described later. When this driver assist system having an integrated construction is fixed within the vehicle room of the vehicle 500, the optical axis of the camera, etc., should be adjusted so as to be oriented in a certain direction ahead of the vehicle. For these matters, see the specification of US Patent Application Publication No. 2015/0264230, the specification of US Patent Application Publication No. 2016/0264065, U.S. patent application Ser. No. 15/248,141, U.S. patent application Ser. No. 15/248,149, and U.S. patent application Ser. No. 15/248,156, which are incorporated herein by reference. Related techniques concerning the camera are described in the specification of U.S. Pat. No. 7,355,524, and the specification of U.S. Pat. No. 7,420,159, the entire disclosure of each which is incorporated herein by reference.

Regarding placement of an optical sensor such as a camera and a millimeter wave radar within the vehicle room, see, for example, the specification of U.S. Pat. No. 8,604,968, the specification of U.S. Pat. No. 8,614,640, and the specification of U.S. Pat. No. 7,978,122, the entire disclosure of each which is incorporated herein by reference. However, at the time when these patents were filed for, only conventional antennas with patch antennas were the known millimeter wave radars, and thus observation was not possible over sufficient distances. For example, the distance that is observable with a conventional millimeter wave radar is considered to be at most 100 m to 150 m. Moreover, when a millimeter wave radar is placed inward of the windshield, the large radar size inconveniently blocks the driver's field of view, thus hindering safe driving. On the other hand, a millimeter wave radar incorporating a slot array antenna according to an embodiment of the present disclosure is capable of being placed within the vehicle room because of its small size and remarkable enhancement in the efficiency of the radiated electromagnetic wave over that of a conventional patch antenna. This enables a long-range observation over 200 m, while not blocking the driver's field of view.

[Adjustment of Position of Attachment Between Millimeter Wave Radar and Camera, Etc.,]

In the processing under fusion construction (which hereinafter may be referred to as a "fusion process"), it is desired that an image which is obtained with a camera or the like and the radar information which is obtained with the millimeter wave radar map onto the same coordinate system because, if they differ as to position and target size, cooperative processing between both will be hindered.

This involves adjustment from the following three standpoints.

(1) The optical axis of the camera or the like and the antenna directivity of the millimeter wave radar must have a certain fixed relationship.

It is required that the optical axis of the camera or the like and the antenna directivity of the millimeter wave radar are matched. Alternatively, a millimeter wave radar may include two or more transmission antennas and two or more reception antennas, the directivities of these antennas being intentionally made different. Therefore, it is necessary to guarantee that at least a certain known relationship exists between the optical axis of the camera or the like and the directivities of these antennas.

In the case where the camera or the like and the millimeter wave radar have the aforementioned integrated construction, i.e., being in fixed position to each other, the relative positioning between the camera or the like and the millimeter wave radar stays fixed. Therefore, the aforementioned requirements are satisfied with respect to such an integrated construction. On the other hand, in a conventional patch antenna or the like, where the millimeter wave radar is placed behind the grill 512 of the vehicle 500, the relative positioning between them is usually to be adjusted according to (2) below.

(2) A certain fixed relationship exists between an image acquired with the camera or the like and radar information of the millimeter wave radar in an initial state (e.g., upon shipment) of having been attached to the vehicle.

The positions of attachment of the optical sensor such as a camera and the millimeter wave radar 510 or 510' on the vehicle 500 will finally be determined in the following manner. At a predetermined position 800 ahead of the vehicle 500, a chart to serve as a reference or a target which is subject to observation by the radar (which will hereinafter be referred to as, respectively, a "reference chart" and a "reference target", and collectively as the "benchmark") is accurately positioned. This is observed with an optical sensor such as a camera or with the millimeter wave radar 510. The observation information regarding the observed benchmark is compared against previously-stored shape information or the like of the benchmark, and the current offset information is quantitated. Based on this offset information, by at least one of the following means, the positions of attachment of an optical sensor such as a camera and the millimeter wave radar 510 or 510' are adjusted or corrected. Any other means may also be employed that can provide similar results.

(i) Adjust the positions of attachment of the camera and the millimeter wave radar so that the benchmark will come at a midpoint between the camera and the millimeter wave radar. This adjustment may be done by using a jig or tool, etc., which is separately provided.

(ii) Determine an offset amounts of the camera and the axis/directivity of the millimeter wave radar relative to the benchmark, and through image processing of the camera image and radar processing, correct for these offset amounts in the axis/directivity.

What is to be noted is that, in the case where the optical sensor such as a camera and the millimeter wave radar 510 incorporating a slot array antenna according to an embodiment of the present disclosure have an integrated construction, i.e., being in fixed position to each other, adjusting an offset of either the camera or the radar with respect to the benchmark will make the offset amount known for the other as well, thus making it unnecessary to check for the other's offset with respect to the benchmark.

Specifically, with respect to the onboard camera system 700, a reference chart may be placed at a predetermined position 750, and an image taken by the camera is compared against advance information indicating where in the field of view of the camera the reference chart image is supposed to be located, thereby detecting an offset amount. Based on this, the camera is adjusted by at least one of the above means (i) and (ii). Next, the offset amount which has been ascertained for the camera is translated into an offset amount of the millimeter wave radar. Thereafter, an offset amount adjustment is made with respect to the radar information, by at least one of the above means (i) and (ii).

Alternatively, this may be performed on the basis of the millimeter wave radar 510. In other words, with respect to the millimeter wave radar 510, a reference target may be placed at a predetermined position 800, and the radar information thereof is compared against advance information indicating where in the field of view of the millimeter wave radar 510 the reference target is supposed to be located, thereby detecting an offset amount. Based on this, the millimeter wave radar 510 is adjusted by at least one of the above means (i) and (ii). Next, the offset amount which has been ascertained for the millimeter wave radar is translated into an offset amount of the camera. Thereafter, an offset amount adjustment is made with respect to the image information obtained by the camera, by at least one of the above means (i) and (ii).

(3) Even after an initial state of the vehicle, a certain relationship is maintained between an image acquired with the camera or the like and radar information of the millimeter wave radar.

Usually, an image acquired with the camera or the like and radar information of the millimeter wave radar are supposed to be fixed in the initial state, and hardly vary unless in an accident of the vehicle or the like. However, if an offset in fact occurs between these, an adjustment is possible by the following means.

The camera is attached in such a manner that portions 513 and 514 (characteristic points) that are characteristic of the driver's vehicle fit within its field of view, for example. The positions at which these characteristic points are actually imaged by the camera are compared against the information of the positions to be assumed by these characteristic points when the camera is attached accurately in place, and an offset amount(s) is detected therebetween. Based on this detected offset amount(s), the position of any image that is taken thereafter may be corrected, whereby an offset of the physical position of attachment of the camera can be corrected for. If this correction sufficiently embodies the performance that is required of the vehicle, then the adjustment per the above (2) may not be needed. By regularly performing this adjustment during startup or operation of the vehicle 500, even if an offset of the camera or the like occurs anew, it is possible to correct for the offset amount, thus helping safe travel.

However, this means is generally considered to result in poorer accuracy of adjustment than with the above means (2). When making an adjustment based on an image which is obtained by imaging a benchmark with the camera, the azimuth of the benchmark can be determined with a high precision, whereby a high accuracy of adjustment can be easily achieved. However, since this means utilizes a part of the vehicle body for the adjustment instead of a benchmark, it is rather difficult to enhance the accuracy of azimuth determination. Thus, the resultant accuracy of adjustment will be somewhat inferior. However, it may still be effective as a means of correction when the position of attachment of the camera or the like is considerably altered for reasons such as an accident or a large external force being applied to the camera or the like within the vehicle room, etc.

[Mapping of Target as Detected by Millimeter Wave Radar and Camera or the Like: Matching Process]

In a fusion process, for a given target, it needs to be established that an image thereof which is acquired with a camera or the like and radar information which is acquired with the millimeter wave radar pertain to "the same target". For example, suppose that two obstacles (first and second obstacles), e.g., two bicycles, have appeared ahead of the vehicle 500. These two obstacles will be captured as camera images, and detected as radar information of the millimeter wave radar. At this time, the camera image and the radar information with respect to the first obstacle need to be mapped to each other so that they are both directed to the same target. Similarly, the camera image and the radar information with respect to the second obstacle need to be mapped to each other so that they are both directed to the same target. If the camera image of the first obstacle and the radar information of the second obstacle are mistakenly recognized to pertain to an identical object, a considerable accident may occur. Hereinafter, in the present specification, such a process of determining whether a target in the camera image and a target in the radar image pertain to the same target may be referred to as a "matching process".

This matching process may be implemented by various detection devices (or methods) described below. Hereinafter, these will be specifically described. Note that the each of the following detection devices is to be installed in the vehicle, and at least includes a millimeter wave radar detection section, an image detection section (e.g., a camera) which is oriented in a direction overlapping the direction of detection by the millimeter wave radar detection section, and a matching section. Herein, the millimeter wave radar detection section includes a slot array antenna according to any of the embodiments of the present disclosure, and at least acquires radar information in its own field of view. The image acquisition section at least acquires image information in its own field of view. The matching section includes a processing circuit which matches a result of detection by the millimeter wave radar detection section against a result of detection by the image detection section to determine whether or not the same target is being detected by the two detection sections. Herein, the image detection section may be composed of a selected one of, or selected two or more of, an optical camera, LIDAR, an infrared radar, and an ultrasonic radar. The following detection devices differ from one another in terms of the detection process at their respective matching section.

In a first detection device, the matching section performs two matches as follows. A first match involves, for a target of interest that has been detected by the millimeter wave radar detection section, obtaining distance information and lateral position information thereof, and also finding a target that is the closest to the target of interest among a target or two or more targets detected by the image detection section, and detecting a combination(s) thereof. A second match involves, for a target of interest that has been detected by the image detection section, obtaining distance information and lateral position information thereof, and also finding a target that is the closest to the target of interest among a target or two or more targets detected by the millimeter wave radar detection section, and detecting a combination(s) thereof. Furthermore, this matching section determines whether there is any matching combination between the combination(s) of such targets as detected by the millimeter wave radar detection section and the combination(s) of such targets as detected by the image detection section. Then, if there is any matching combination, it is determined that the same object is being detected by the two detection sections. In this manner, a match is attained between the respective targets that have been detected by the millimeter wave radar detection section and the image detection section.

A related technique is described in the specification of U.S. Pat. No. 7,358,889, the entire disclosure of which is incorporated herein by reference. In this publication, the image detection section is illustrated by way of a so-called stereo camera that includes two cameras. However, this technique is not limited thereto. In the case where the image detection section includes a single camera, detected targets may be subjected to an image recognition process or the like as appropriate, in order to obtain distance information and lateral position information of the targets. Similarly, a laser sensor such as a laser scanner may be used as the image detection section.

In a second detection device, the matching section matches a result of detection by the millimeter wave radar detection section and a result of detection by the image detection section every predetermined period of time. If the matching section determines that the same target was being detected by the two detection sections in the previous result of matching, it performs a match by using this previous result of matching. Specifically, the matching section matches a target which is currently detected by the millimeter wave radar detection section and a target which is currently detected by the image detection section, against the target which was determined in the previous result of matching to be being detected by the two detection sections. Then, based on the result of matching for the target which is currently detected by the millimeter wave radar detection section and the result of matching for the target which is currently detected by the image detection section, the matching section determines whether or not the same target is being detected by the two detection sections. Thus, rather than directly matching the results of detection by the two detection sections, this detection device performs a chronological match between the two results of detection and a previous result of matching. Therefore, the accuracy of detection is improved over the case of only performing a momentary match, whereby stable matching is realized. In particular, even if the accuracy of the detection section drops momentarily, matching is still possible because of utilizing past results of matching. Moreover, by utilizing the previous result of matching, this detection device is able to easily perform a match between the two detection sections.

In the current match which utilizes the previous result of matching, if the matching section of this detection device determines that the same object is being detected by the two detection sections, then the matching section of this detection device excludes this determined object in performing matching between objects which are currently detected by the millimeter wave radar detection section and objects which are currently detected by the image detection section. Then, this matching section determines whether there exists any identical object that is currently detected by the two detection sections. Thus, while taking into account the result of chronological matching, the detection device also makes a momentary match based on two results of detection that are obtained from moment to moment. As a result, the detection device is able to surely perform a match for any object that is detected during the current detection.

A related technique is described in the specification of U.S. Pat. No. 7,417,580, the entire disclosure of which is incorporated herein by reference. In this publication, the image detection section is illustrated by way of a so-called stereo camera that includes two cameras. However, this technique is not limited thereto. In the case where the image detection section includes a single camera, detected targets may be subjected to an image recognition process or the like as appropriate, in order to obtain distance information and lateral position information of the targets. Similarly, a laser sensor such as a laser scanner may be used as the image detection section.

In a third detection device, the two detection sections and matching section perform detection of targets and performs matches therebetween at predetermined time intervals, and the results of such detection and the results of such matching are chronologically stored to a storage medium, e.g., memory. Then, based on a rate of change in the size of a target in the image as detected by the image detection section, and on a distance to a target from the driver's vehicle and its rate of change (relative velocity with respect to the driver's vehicle) as detected by the millimeter wave radar detection section, the matching section determines whether the target which has been detected by the image detection section and the target which has been detected by the millimeter wave radar detection section are an identical object.

When determining that these targets are an identical object, based on the position of the target in the image as detected by the image detection section, and on the distance to the target from the driver's vehicle and/or its rate of change as detected by the millimeter wave radar detection section, the matching section predicts a possibility of collision with the vehicle.

A related technique is described in the specification of U.S. Pat. No. 6,903,677, the entire disclosure of which is incorporated herein by reference.

As described above, in a fusion process of a millimeter wave radar and an imaging device such as a camera, an image which is obtained with the camera or the like and radar information which is obtained with the millimeter wave radar are matched against each other. A millimeter wave radar incorporating the aforementioned array antenna according to an embodiment of the present disclosure can be constructed so as to have a small size and high performance. Therefore, high performance and downsizing, etc., can be achieved for the entire fusion process including the aforementioned matching process. This improves the accuracy of target recognition, and enables safer travel control for the vehicle.

[Other Fusion Processes]

In a fusion process, various functions are realized based on a matching process between an image which is obtained with a camera or the like and radar information which is obtained with the millimeter wave radar detection section. Examples of processing apparatuses that realize representative functions of a fusion process will be described below.

Each of the following processing apparatuses is to be installed in a vehicle, and at least includes: a millimeter wave radar detection section to transmit or receive electromagnetic waves in a predetermined direction; an image acquisition section, such as a monocular camera, that has a field of view overlapping the field of view of the millimeter wave radar detection section; and a processing section which obtains information therefrom to perform target detection and the like. The millimeter wave radar detection section acquires radar information in its own field of view. The image acquisition section acquires image information in its own field of view. A selected one, or selected two or more of, an optical camera, LIDAR, an infrared radar, and an ultrasonic radar may be used as the image acquisition section. The processing section can be implemented by a processing circuit which is connected to the millimeter wave radar detection section and the image acquisition section. The following processing apparatuses differ from one another with respect to the content of processing by this processing section.

In a first processing apparatus, the processing section extracts, from an image which is captured by the image acquisition section, a target which is recognized to be the same as the target which is detected by the millimeter wave radar detection section. In other words, a matching process according to the aforementioned detection device is performed. Then, it acquires information of a right edge and a left edge of the extracted target image, and derives locus approximation lines, which are straight lines or predetermined curved lines for approximating loci of the acquired right edge and the left edge, are derived for both edges. The edge which has a larger number of edges existing on the locus approximation line is selected as a true edge of the target. The lateral position of the target is derived on the basis of the position of the edge that has been selected as a true edge. This permits a further improvement on the accuracy of detection of a lateral position of the target.

A related technique is described in the specification of U.S. Pat. No. 8,610,620, the entire disclosure of which is incorporated herein by reference.

In a second processing apparatus, in determining the presence of a target, the processing section alters a determination threshold to be used in checking for a target presence in radar information, on the basis of image information. Thus, if a target image that may be an obstacle to vehicle travel has been confirmed with a camera or the like, or if the presence of a target has been estimated, etc., for example, the determination threshold for the target detection by the millimeter wave radar detection section can be optimized so that more accurate target information can be obtained. In other words, if the possibility of the presence of an obstacle is high, the determination threshold is altered so that this processing apparatus will surely be activated. On the other hand, if the possibility of the presence of an obstacle is low, the determination threshold is altered so that unwanted activation of this processing apparatus is prevented. This permits appropriate activation of the system.

Furthermore in this case, based on radar information, the processing section may designate a region of detection for the image information, and estimate a possibility of the presence of an obstacle on the basis of image information within this region. This makes for a more efficient detection process.

A related technique is described in the specification of U.S. Pat. No. 7,570,198, the entire disclosure of which is incorporated herein by reference.

In a third processing apparatus, the processing section performs combined displaying where images obtained from a plurality of different imaging devices and a millimeter wave radar detection section and an image signal based on radar information are displayed on at least one display device. In this displaying process, horizontal and vertical synchronizing signals are synchronized between the plurality of imaging devices and the millimeter wave radar detection section, and among the image signals from these devices, selective switching to a desired image signal is possible within one horizontal scanning period or one vertical scanning period. This allows, on the basis of the horizontal and vertical synchronizing signals, images of a plurality of selected image signals to be displayed side by side; and, from the display device, a control signal for setting a control operation in the desired imaging device and the millimeter wave radar detection section is sent.

When a plurality of different display devices display respective images or the like, it is difficult to compare the respective images against one another. Moreover, when display devices are provided separately from the third processing apparatus itself, there is poor operability for the device. The third processing apparatus would overcome such shortcomings.

A related technique is described in the specification of U.S. Pat. No. 6,628,299 and the specification of U.S. Pat. No. 7,161,561, the entire disclosure of each of which is incorporated herein by reference.

In a fourth processing apparatus, with respect to a target which is ahead of a vehicle, the processing section instructs an image acquisition section and a millimeter wave radar detection section to acquire an image and radar information containing that target. From within such image information, the processing section determines a region in which the target is contained. Furthermore, the processing section extracts radar information within this region, and detects a distance from the vehicle to the target and a relative velocity between the vehicle and the target. Based on such information, the processing section determines a possibility that the target will collide against the vehicle. This enables an early detection of a possible collision with a target.

A related technique is described in the specification of U.S. Pat. No. 8,068,134, the entire disclosure of which is incorporated herein by reference.

In a fifth processing apparatus, based on radar information or through a fusion process which is based on radar information and image information, the processing section recognizes a target or two or more targets ahead of the vehicle. The "target" encompasses any moving entity such as other vehicles or pedestrians, traveling lanes indicated by white lines on the road, road shoulders and any still objects (including gutters, obstacles, etc.), traffic lights, pedestrian crossings, and the like that may be there. The processing section may encompass a GPS (Global Positioning System) antenna. By using a GPS antenna, the position of the driver's vehicle may be detected, and based on this position, a storage device (referred to as a map information database device) that stores road map information may be searched in order to ascertain a current position on the map. This current position on the map may be compared against a target or two or more targets that have been recognized based on radar information or the like, whereby the traveling environment may be recognized. On this basis, the processing section may extract any target that is estimated to hinder vehicle travel, find safer traveling information, and display it on a display device, as necessary, to inform the driver.

A related technique is described in the specification of U.S. Pat. No. 6,191,704, the entire disclosure of which is incorporated herein by reference.

The fifth processing apparatus may further include a data communication device (having communication circuitry) that communicates with a map information database device which is external to the vehicle. The data communication device may access the map information database device, with a period of e.g. once a week or once a month, to download the latest map information therefrom. This allows the aforementioned processing to be performed with the latest map information.

Furthermore, the fifth processing apparatus may compare between the latest map information that was acquired during the aforementioned vehicle travel and information that is recognized of a target or two or more targets based on radar information, etc., in order to extract target information (hereinafter referred to as "map update information") that is not included in the map information. Then, this map update information may be transmitted to the map information database device via the data communication device. The map information database device may store this map update information in association with the map information that is within the database, and update the current map information itself, if necessary. In performing the update, respective pieces of map update information that are obtained from a plurality of vehicles may be compared against one another to check certainty of the update.

Note that this map update information may contain more detailed information than the map information which is carried by any currently available map information database device. For example, schematic shapes of roads may be known from commonly-available map information, but it typically does not contain information such as the width of the road shoulder, the width of the gutter that may be there, any newly occurring bumps or dents, shapes of buildings, and so on. Neither does it contain heights of the roadway and the sidewalk, how a slope may connect to the sidewalk, etc. Based on conditions which are separately set, the map information database device may store such detailed information (hereinafter referred to as "map update details information") in association with the map information. Such map update details information provides a vehicle (including the driver's vehicle) with information which is more detailed than the original map information, thereby rending itself available for not only the purpose of ensuring safe vehicle travel but also some other purposes. As used herein, a "vehicle (including the driver's vehicle)" may be e.g. an automobile, a motorcycle, a bicycle, or any autonomous vehicle to become available in the future, e.g., an electric wheelchair. The map update details information is to be used when any such vehicle may travel.

(Recognition Via Neural Network)

Each of the first to fifth processing apparatuses may further include a sophisticated apparatus of recognition. The sophisticated apparatus of recognition may be provided external to the vehicle. In that case, the vehicle may include a high-speed data communication device that communicates with the sophisticated apparatus of recognition. The sophisticated apparatus of recognition may be constructed from a neural network, which may encompass so-called deep learning and the like. This neural network may include a convolutional neural network (hereinafter referred to as "CNN"), for example. A CNN, a neural network that has proven successful in image recognition, is characterized by possessing one or more sets of two layers, namely, a convolutional layer and a pooling layer.

There exists at least three kinds of information as follows, any of which may be input to a convolutional layer in the processing apparatus:

(1) information that is based on radar information which is acquired by the millimeter wave radar detection section;

(2) information that is based on specific image information which is acquired, based on radar information, by the image acquisition section; or (3) fusion information that is based on radar information and image information which is acquired by the image acquisition section, or information that is obtained based on such fusion information.

Based on information of any of the above kinds, or information based on a combination thereof, product-sum operations corresponding to a convolutional layer are performed. The results are input to the subsequent pooling layer, where data is selected according to a predetermined rule. In the case of max pooling where a maximum value among pixel values is chosen, for example, the rule may dictate that a maximum value be chosen for each split region in the convolutional layer, this maximum value being regarded as the value of the corresponding position in the pooling layer.

A sophisticated apparatus of recognition that is composed of a CNN may include a single set of a convolutional layer and a pooling layer, or a plurality of such sets which are cascaded in series. This enables accurate recognition of a target, which is contained in the radar information and the image information, that may be around a vehicle.

Related techniques are described in the U.S. Pat. No. 8,861,842, the specification of U.S. Pat. No. 9,286,524, and the specification of US Patent Application Publication No. 2016/0140424, the entire disclosure of each of which is incorporated herein by reference.

In a sixth processing apparatus, the processing section performs processing that is related to headlamp control of a vehicle. When a vehicle travels in nighttime, the driver may check whether another vehicle or a pedestrian exists ahead of the driver's vehicle, and control a beam(s) from the headlamp(s) of the driver's vehicle to prevent the driver of the other vehicle or the pedestrian from being dazzled by the headlamp(s) of the driver's vehicle. This sixth processing apparatus automatically controls the headlamp(s) of the driver's vehicle by using radar information, or a combination of radar information and an image taken by a camera or the like.

Based on radar information, or through a fusion process based on radar information and image information, the processing section detects a target that corresponds to a vehicle or pedestrian ahead of the vehicle. In this case, a vehicle ahead of a vehicle may encompass a preceding vehicle that is ahead, a vehicle or a motorcycle in the oncoming lane, and so on. When detecting any such target, the processing section issues a command to lower the beam(s) of the headlamp(s). Upon receiving this command, the control section (control circuit) which is internal to the vehicle may control the headlamp(s) to lower the beam(s) therefrom.

Related techniques are described in the specification of U.S. Pat. No. 6,403,942, the specification of U.S. Pat. No. 6,611,610, the specification of U.S. Pat. No. 8,543,277, the specification of U.S. Pat. No. 8,593,521, and the specification of U.S. Pat. No. 8,636,393, the entire disclosure of each of which is incorporated herein by reference.

According to the above-described processing by the millimeter wave radar detection section, and the above-described fusion process by the millimeter wave radar detection section and an imaging device such as a camera, the millimeter wave radar can be constructed so as to have a small size and high performance, whereby high performance and downsizing, etc., can be achieved for the radar processing or the entire fusion process. This improves the accuracy of target recognition, and enables safer travel control for the vehicle.

<Application Example 2: Various Monitoring Systems (Natural Elements, Buildings, Roads, Watch, Security)>

A millimeter wave radar (radar system) incorporating an array antenna according to an embodiment of the present disclosure also has a wide range of applications in the fields of monitoring, which may encompass natural elements, weather, buildings, security, nursing care, and the like. In a monitoring system in this context, a monitoring apparatus that includes the millimeter wave radar may be installed e.g. at a fixed position, in order to perpetually monitor a subject(s) of monitoring. Regarding the given subject(s) of monitoring, the millimeter wave radar has its resolution of detection adjusted and set to an optimum value.

A millimeter wave radar incorporating an array antenna according to an embodiment of the present disclosure is capable of detection with a radio frequency electromagnetic wave exceeding e.g. 100 GHz. As for the modulation band in those schemes which are used in radar recognition, e.g., the FMCW method, the millimeter wave radar currently achieves a wide band exceeding 4 GHz, which supports the aforementioned Ultra Wide Band (UWB). Note that the modulation band is related to the range resolution. In a conventional patch antenna, the modulation band was up to about 600 MHz, thus resulting in a range resolution of 25 cm. On the other hand, a millimeter wave radar associated with the present array antenna has a range resolution of 3.75 cm, indicative of a performance which rivals the range resolution of conventional LIDAR. Whereas an optical sensor such as LIDAR is unable to detect a target in nighttime or bad weather as mentioned above, a millimeter wave radar is always capable of detection, regardless of daytime or nighttime and irrespective of weather. As a result, a millimeter wave radar associated with the present array antenna is available for a variety of applications which were not possible with a millimeter wave radar incorporating any conventional patch antenna.

FIG. 72 is a diagram showing an exemplary construction for a monitoring system 1500 based on millimeter wave radar. The monitoring system 1500 based on millimeter wave radar at least includes a sensor section 1010 and a main section 1100. The sensor section 1010 at least includes an antenna 1011 which is aimed at the subject of monitoring 1015, a millimeter wave radar detection section 1012 which detects a target based on a transmitted or received electromagnetic wave, and a communication section (communication circuit) 1013 which transmits detected radar information. The main section 1100 at least includes a communication section (communication circuit) 1103 which receives radar information, a processing section (processing circuit) 1101 which performs predetermined processing based on the received radar information, and a data storage section (storage medium) 1102 in which past radar information and other information that is needed for the predetermined processing, etc., are stored. Telecommunication lines 1300 exist between the sensor section 1010 and the main section 1100, via which transmission and reception of information and commands occur between them. As used herein, the telecommunication lines may encompass any of a general-purpose communications network such as the Internet, a mobile communications network, dedicated telecommunication lines, and so on, for example. Note that the present monitoring system 1500 may be arranged so that the sensor section 1010 and the main section 1100 are directly connected, rather than via telecommunication lines. In addition to the millimeter wave radar, the sensor section 1010 may also include an optical sensor such as a camera. This will permit target recognition through a fusion process which is based on radar information and image information from the camera or the like, thus enabling a more sophisticated detection of the subject of monitoring 1015 or the like.

Hereinafter, examples of monitoring systems embodying these applications will be specifically described.

[Natural Element Monitoring System]

A first monitoring system is a system that monitors natural elements (hereinafter referred to as a "natural element monitoring system"). With reference to FIG. 72, this natural element monitoring system will be described. Subjects of monitoring 1015 of the natural element monitoring system 1500 may be, for example, a river, the sea surface, a mountain, a volcano, the ground surface, or the like. For example, when a river is the subject of monitoring 1015, the sensor section 1010 being secured to a fixed position perpetually monitors the water surface of the river 1015. This water surface information is perpetually transmitted to a processing section 1101 in the main section 1100. Then, if the water surface reaches a certain height or above, the processing section 1101 informs a distinct system 1200 which separately exists from the monitoring system (e.g., a weather observation monitoring system), via the telecommunication lines 1300. Alternatively, the processing section 1101 may send information to a system (not shown) which manages the water gate, whereby the system if instructed to automatically close a water gate, etc. (not shown) which is provided at the river 1015.

The natural element monitoring system 1500 is able to monitor a plurality of sensor sections 1010, 1020, etc., with the single main section 1100. When the plurality of sensor sections are distributed over a certain area, the water levels of rivers in that area can be grasped simultaneously. This allows to make an assessment as to how the rainfall in this area may affect the water levels of the rivers, possibly leading to disasters such as floods. Information concerning this can be conveyed to the distinct system 1200 (e.g., a weather observation monitoring system) via the telecommunication lines 1300. Thus, the distinct system 1200 (e.g., a weather observation monitoring system) is able to utilize the conveyed information for weather observation or disaster prediction in a wider area.

The natural element monitoring system 1500 is also similarly applicable to any natural element other than a river. For example, the subject of monitoring of a monitoring system that monitors tsunamis or storm surges is the sea surface level. It is also possible to automatically open or close the water gate of a seawall in response to a rise in the sea surface level. Alternatively, the subject of monitoring of a monitoring system that monitors landslides to be caused by rainfall, earthquakes, or the like may be the ground surface of a mountainous area, etc.

[Traffic Monitoring System]

A second monitoring system is a system that monitors traffic (hereinafter referred to as a "traffic monitoring system"). The subject of monitoring of this traffic monitoring system may be, for example, a railroad crossing, a specific railroad, an airport runway, a road intersection, a specific road, a parking lot, etc.

For example, when the subject of monitoring is a railroad crossing, the sensor section 1010 is placed at a position where the inside of the crossing can be monitored. In this case, in addition to the millimeter wave radar, the sensor section 1010 may also include an optical sensor such as a camera, which will allow a target (subject of monitoring) to be detected from more perspectives, through a fusion process based on radar information and image information. The target information which is obtained with the sensor section 1010 is sent to the main section 1100 via the telecommunication lines 1300. The main section 1100 collects other information (e.g., train schedule information) that may be needed in a more sophisticated recognition process or control, and issues necessary control instructions or the like based thereon. As used herein, a necessary control instruction may be, for example, an instruction to stop a train when a person, a vehicle, etc. is found inside the crossing when it is closed.

If the subject of monitoring is a runway at an airport, for example, a plurality of sensor sections 1010, 1020, etc., may be placed along the runway so as to set the runway to a predetermined resolution, e.g., a resolution that allows any foreign object on the runway that is 5 cm by 5 cm or larger to be detected. The monitoring system 1500 perpetually monitors the runway, regardless of daytime or nighttime and irrespective of weather. This function is enabled by the very ability of the millimeter wave radar according to an embodiment of the present disclosure to support UWB. Moreover, since the present millimeter wave radar device can be embodied with a small size, a high resolution, and a low cost, it provides a realistic solution for covering the entire runway surface from end to end. In this case, the main section 1100 keeps the plurality of sensor sections 1010, 1020, etc., under integrated management. If a foreign object is found on the runway, the main section 1100 transmits information concerning the position and size of the foreign object to an air-traffic control system (not shown). Upon receiving this, the air-traffic control system temporarily prohibits takeoff and landing on that runway. In the meantime, the main section 1100 transmits information concerning the position and size of the foreign object to a separately-provided vehicle, which automatically cleans the runway surface, etc., for example. Upon receive this, the cleaning vehicle may autonomously move to the position where the foreign object exists, and automatically remove the foreign object. Once removal of the foreign object is completed, the cleaning vehicle transmits information of the completion to the main section 1100. Then, the main section 1100 again confirms that the sensor section 1010 or the like which has detected the foreign object now reports that "no foreign object exists" and that it is safe now, and informs the air-traffic control system of this. Upon receiving this, the air-traffic control system may lift the prohibition of takeoff and landing from the runway.

Furthermore, in the case where the subject of monitoring is a parking lot, for example, it may be possible to automatically recognize which position in the parking lot is currently vacant. A related technique is described in the specification of U.S. Pat. No. 6,943,726, the entire disclosure of which is incorporated herein by reference.

[Security Monitoring System]

A third monitoring system is a system that monitors a trespasser into a piece of private land or a house (hereinafter referred to as a "security monitoring system"). The subject of monitoring of this security monitoring system may be, for example, a specific region within a piece of private land or a house, etc.

For example, if the subject of monitoring is a piece of private land, the sensor section(s) 1010 may be placed at one position, or two or more positions where the sensor section(s) 1010 is able to monitor it. In this case, in addition to the millimeter wave radar, the sensor section(s) 1010 may also include an optical sensor such as a camera, which will allow a target (subject of monitoring) to be detected from more perspectives, through a fusion process based on radar information and image information. The target information which was obtained by the sensor section 1010(*s*) is sent to the main section 1100 via the telecommunication lines 1300. The main section 1100 collects other information (e.g., reference data or the like needed to accurately recognize whether the trespasser is a person or an animal such as a dog or a bird) that may be needed in a more sophisticated recognition process or control, and issues necessary control instructions or the like based thereon. As used herein, a necessary control instruction may be, for example, an instruction to sound an alarm or activate lighting that is installed in the premises, and also an instruction to directly report to a person in charge of the premises via mobile telecommunication lines or the like, etc. The processing section 1101 in the main section 1100 may allow an internalized, sophisticated apparatus of recognition (that adopts deep learning or a like technique) to recognize the detected target. Alternatively, such a sophisticated apparatus of recognition may be provided externally, in which case the sophisticated apparatus of recognition may be connected via the telecommunication lines 1300.

A related technique is described in the specification of U.S. Pat. No. 7,425,983, the entire disclosure of which is incorporated herein by reference.

Another embodiment of such a security monitoring system may be a human monitoring system to be installed at a boarding gate at an airport, a station wicket, an entrance of a building, or the like. The subject of monitoring of such a human monitoring system may be, for example, a boarding gate at an airport, a station wicket, an entrance of a building, or the like.

If the subject of monitoring is a boarding gate at an airport, the sensor section(s) 1010 may be installed in a machine for checking personal belongings at the boarding gate, for example. In this case, there may be two checking methods as follows. In a first method, the millimeter wave radar transmits an electromagnetic wave, and receives the electromagnetic wave as it reflects off a passenger (which is the subject of monitoring), thereby checking personal belongings or the like of the passenger. In a second method, a weak millimeter wave which is radiated from the passenger's own body is received by the antenna, thus checking for any foreign object that the passenger may be hiding. In the latter method, the millimeter wave radar preferably has a function of scanning the received millimeter wave. This scanning function may be implemented by using digital beam forming, or through a mechanical scanning operation. Note that the processing by the main section 1100 may utilize a communication process and a recognition process similar to those in the above-described examples.

[Building Inspection System (Non-Destructive Inspection)]

A fourth monitoring system is a system that monitors or checks the concrete material of a road, a railroad overpass, a building, etc., or the interior of a road or the ground, etc., (hereinafter referred to as a "building inspection system"). The subject of monitoring of this building inspection system may be, for example, the interior of the concrete material of an overpass or a building, etc., or the interior of a road or the ground, etc.

For example, if the subject of monitoring is the interior of a concrete building, the sensor section 1010 is structured so that the antenna 1011 can make scan motions along the surface of a concrete building. As used herein, "scan motions" may be implemented manually, or a stationary rail for the scan motion may be separately provided, upon which to cause the movement by using driving power from an electric motor or the like. In the case where the subject of monitoring is a road or the ground, the antenna 1011 may be installed face-down on a vehicle or the like, and the vehicle may be allowed to travel at a constant velocity, thus creating a "scan motion". The electromagnetic wave to be used by the sensor section 1010 may be a millimeter wave in e.g. the so-called terahertz region, exceeding 100 GHz. As described earlier, even with an electromagnetic wave over e.g. 100 GHz, an array antenna according to an embodiment of the present disclosure can be adapted to have smaller losses than do conventional patch antennas or the like. An electromagnetic wave of a higher frequency is able to permeate deeper into the subject of checking, such as concrete, thereby realizing a more accurate non-destructive inspection. Note that the processing by the main section 1100 may also utilize a communication process and a recognition process similar to those in the other monitoring systems described above.

A related technique is described in the specification of U.S. Pat. No. 6,661,367, the entire disclosure of which is incorporated herein by reference.

[Human Monitoring System]

A fifth monitoring system is a system that watches over a person who is subject to nursing care (hereinafter referred to as a "human watch system"). The subject of monitoring of this human watch system may be, for example, a person under nursing care or a patient in a hospital, etc.

For example, if the subject of monitoring is a person under nursing care within a room of a nursing care facility, the sensor section(s) 1010 is placed at one position, or two or more positions inside the room where the sensor section(s) 1010 is able to monitor the entirety of the inside of the room. In this case, in addition to the millimeter wave radar, the sensor section 1010 may also include an optical sensor such as a camera. In this case, the subject of monitoring can be monitored from more perspectives, through a fusion process based on radar information and image information. On the other hand, when the subject of monitoring is a person, from the standpoint of privacy protection, monitoring with a camera or the like may not be appropriate. Therefore, sensor selections must be made while taking this aspect into consideration. Note that target detection by the millimeter wave radar will allow a person, who is the subject of monitoring, to be captured not by his or her image, but by a signal (which is, as it were, a shadow of the person). Therefore, the millimeter wave radar may be considered as a desirable sensor from the standpoint of privacy protection.

Information of the person under nursing care which has been obtained by the sensor section(s) 1010 is sent to the main section 1100 via the telecommunication lines 1300. The main section 1100 collects other information (e.g., reference data or the like needed to accurately recognize target information of the person under nursing care) that may be needed in a more sophisticated recognition process or control, and issues necessary control instructions or the like based thereon. As used herein, a necessary control instruction may be, for example, an instruction to directly report a person in charge based on the result of detection, etc. The processing section 1101 in the main section 1100 may allow an internalized, sophisticated apparatus of recognition (that adopts deep learning or a like technique) to recognize the detected target. Alternatively, such a sophisticated apparatus of recognition may be provided externally, in which case the sophisticated apparatus of recognition may be connected via the telecommunication lines 1300.

In the case where a person is the subject of monitoring of the millimeter wave radar, at least the two following functions may be added.

A first function is a function of monitoring the heart rate and/or the respiratory rate. In the case of a millimeter wave radar, an electromagnetic wave is able to see through the clothes to detect the position and motions of the skin surface of a person's body. First, the processing section 1101 detects a person who is the subject of monitoring and an outer shape thereof. Next, in the case of detecting a heart rate, for example, a position on the body surface where the heartbeat motions are easy to detect may be identified, and the motions there may be chronologically detected. This allows a heart rate per minute to be detected, for example. The same is also true when detecting a respiratory rate. By using this function, the health status of a person under nursing care can be perpetually checked, thus enabling a higher-quality watch over a person under nursing care.

A second function is a function of fall detection. A person under nursing care such as an elderly person may fall from time to time, due to weakened legs and feet. When a person falls, the velocity or acceleration of a specific site of the person's body, e.g., the head, will reach a certain level or greater. When the subject of monitoring of the millimeter wave radar is a person, the relative velocity or acceleration of the target of interest can be perpetually detected. Therefore, by identifying the head as the subject of monitoring, for example, and chronologically detecting its relative velocity or acceleration, a fall can be recognized when a velocity of a certain value or greater is detected. When recognizing a fall, the processing section 1101 can issue an instruction or the like corresponding to pertinent nursing care assistance, for example.

Note that the sensor section(s) 1010 is secured to a fixed position(s) in the above-described monitoring system or the like. However, the sensor section(s) 1010 can also be installed on a moving entity, e.g., a robot, a vehicle, a flying object such as a drone. As used herein, the vehicle or the like may encompass not only an automobile, but also a smaller sized moving entity such as an electric wheelchair, for example. In this case, this moving entity may include an internal GPS unit which allows its own current position to be always confirmed. In addition, this moving entity may also have a function of further improving the accuracy of its own current position by using map information and the map update information which has been described with respect to the aforementioned fifth processing apparatus.

Furthermore, in any device or system that is similar to the above-described first to third detection devices, first to sixth processing apparatuses, first to fifth monitoring systems, etc., a like construction may be adopted to utilize an array antenna or a millimeter wave radar according to an embodiment of the present disclosure.

<Application Example 3: Communication System>

[First Example of Communication System]

The waveguide device and antenna device (array antenna) according to the present disclosure can be used for the transmitter and/or receiver with which a communication system (telecommunication system) is constructed. The waveguide device and antenna device according to the present disclosure are composed of layered conductive members, and therefore are able to keep the transmitter and/or receiver size smaller than in the case of using a hollow waveguide. Moreover, there is no need for dielectric, and thus the dielectric loss of electromagnetic waves can be kept smaller than in the case of using a microstrip line. Therefore, a communication system including a small and highly efficient transmitter and/or receiver can be constructed.

Such a communication system may be an analog type communication system which transmits or receives an analog signal that is directly modulated. However, a digital communication system may be adopted in order to construct a more flexible and higher-performance communication system.

Hereinafter, with reference to FIG. 73, a digital communication system 800A in which a waveguide device and an antenna device according to an embodiment of the present disclosure are used will be described.

FIG. 73 is a block diagram showing a construction for the digital communication system 800A. The communication system 800A includes a transmitter 810A and a receiver 820A. The transmitter 810A includes an analog to digital (A/D) converter 812, an encoder 813, a modulator 814, and a transmission antenna 815. The receiver 820A includes a reception antenna 825, a demodulator 824, a decoder 823, and a digital to analog (D/A) converter 822. The at least one of the transmission antenna 815 and the reception antenna 825 may be implemented by using an array antenna according to an embodiment of the present disclosure. In this exemplary application, the circuitry including the modulator 814, the encoder 813, the A/D converter 812, and so on, which are connected to the transmission antenna 815, is referred to as the transmission circuit. The circuitry including the demodulator 824, the decoder 823, the D/A converter 822, and so on, which are connected to the reception antenna 825, is referred to as the reception circuit. The transmission circuit and the reception circuit may be collectively referred to as the communication circuit.

With the analog to digital (A/D) converter 812, the transmitter 810A converts an analog signal which is received from the signal source 811 to a digital signal. Next, the digital signal is encoded by the encoder 813. As used herein, "encoding" means altering the digital signal to be transmitted into a format which is suitable for communication. Examples of such encoding include CDM (Code-Division Multiplexing) and the like. Moreover, any conversion for effecting TDM (Time-Division Multiplexing) or FDM (Frequency Division Multiplexing), or OFDM (Orthogonal Frequency Division Multiplexing) is also an example of encoding. The encoded signal is converted by the modulator 814 into a radio frequency signal, so as to be transmitted from the transmission antenna 815.

In the field of communications, a wave representing a signal to be superposed on a carrier wave may be referred to as a "signal wave"; however, the term "signal wave" as used in the present specification does not carry that definition. A "signal wave" as referred to in the present specification is broadly meant to be any electromagnetic wave to propagate in a waveguide, or any electromagnetic wave for transmission/reception via an antenna element.

The receiver 820A restores the radio frequency signal that has been received by the reception antenna 825 to a low-frequency signal at the demodulator 824, and to a digital signal at the decoder 823. The decoded digital signal is restored to an analog signal by the digital to analog (D/A) converter 822, and is sent to a data sink (data receiver) 821. Through the above processes, a sequence of transmission and reception processes is completed.

When the communicating agent is a digital appliance such as a computer, analog to digital conversion of the transmission signal and digital to analog conversion of the reception signal are not needed in the aforementioned processes. Thus, the analog to digital converter 812 and the digital to analog converter 822 in FIG. 73 may be omitted. A system of such construction is also encompassed within a digital communication system.

In a digital communication system, in order to ensure signal intensity or expand channel capacity, various methods may be adopted. Many such methods are also effective in a communication system which utilizes radio waves of the millimeter wave band or the terahertz band.

Radio waves in the millimeter wave band or the terahertz band have higher straightness than do radio waves of lower frequencies, and undergoes less diffraction, i.e., bending around into the shadow side of an obstacle. Therefore, it is not uncommon for a receiver to fail to directly receive a radio wave that has been transmitted from a transmitter. Even in such situations, reflected waves may often be received, but a reflected wave of a radio wave signal is often poorer in quality than is the direct wave, thus making stable reception more difficult. Furthermore, a plurality of reflected waves may arrive through different paths. In that case, the reception waves with different path lengths might differ in phase from one another, thus causing multi-path fading.

As a technique for improving such situations, a so-called antenna diversity technique may be used. In this technique, at least one of the transmitter and the receiver includes a plurality of antennas. If the plurality of antennas are parted by distances which differ from one another by at least about the wavelength, the resulting states of the reception waves will be different. Accordingly, the antenna that is capable of transmission/reception with the highest quality among all is selectively used, thereby enhancing the reliability of communication. Alternatively, signals which are obtained from more than one antenna may be merged for an improved signal quality.

In the communication system 800A shown in FIG. 73, for example, the receiver 820A may include a plurality of reception antennas 825. In this case, a switcher exists between the plurality of reception antennas 825 and the demodulator 824. Through the switcher, the receiver 820A connects the antenna that provides the highest-quality signal among the plurality of reception antennas 825 to the demodulator 824. In this case, the transmitter 810A may also include a plurality of transmission antennas 815.

[Second Example of Communication System]

FIG. 74 is a block diagram showing an example of a communication system 800B including a transmitter 810B which is capable of varying the radiation pattern of radio waves. In this exemplary application, the receiver is identical to the receiver 820A shown in FIG. 73; for this reason, the receiver is omitted from illustration in FIG. 74. In addition to the construction of the transmitter 810A, the transmitter 810B also includes an antenna array 815*b*, which includes a plurality of antenna elements 8151. The antenna array 815*b* may be an array antenna according to an embodiment of the present disclosure. The transmitter 810B further includes a plurality of phase shifters (PS) 816 which are respectively connected between the modulator 814 and the plurality of antenna elements 8151. In the transmitter 810B, an output of the modulator 814 is sent to the plurality of phase shifters 816, where phase differences are imparted and the resultant signals are led to the plurality of antenna elements 8151. In the case where the plurality of antenna elements 8151 are disposed at equal intervals, if a radio frequency signal whose phase differs by a certain amount with respect to an adjacent antenna element is fed to each antenna element 8151, a main lobe 817 of the antenna array 815*b* will be oriented in an azimuth which is inclined from the front, this inclination being in accordance with the phase difference. This method may be referred to as beam forming.

The azimuth of the main lobe 817 may be altered by allowing the respective phase shifters 816 to impart varying phase differences. This method may be referred to as beam steering. By finding phase differences that are conducive to the best transmission/reception state, the reliability of communication can be enhanced. Although the example here illustrates a case where the phase difference to be imparted by the phase shifters 816 is constant between any adjacent antenna elements 8151, this is not limiting. Moreover, phase differences may be imparted so that the radio wave will be radiated in an azimuth which allows not only the direct wave but also reflected waves to reach the receiver.

A method called null steering can also be used in the transmitter 810B. This is a method where phase differences are adjusted to create a state where the radio wave is radiated in no specific direction. By performing null steering, it becomes possible to restrain radio waves from being radiated toward any other receiver to which transmission of the radio wave is not intended. This can avoid interference. Although a very broad frequency band is available to digital communication utilizing millimeter waves or terahertz waves, it is nonetheless preferable to make as efficient a use of the bandwidth as possible. By using null steering, plural instances of transmission/reception can be performed within the same band, whereby efficiency of utility of the bandwidth can be enhanced. A method which enhances the efficiency of utility of the bandwidth by using techniques such as beam forming, beam steering, and null steering may sometimes be referred to as SDMA (Spatial Division Multiple Access).

[Third Example of Communication System]

In order to increase the channel capacity in a specific frequency band, a method called MIMO (Multiple-Input and Multiple-Output) may be adopted. Under MIMO, a plurality of transmission antennas and a plurality of reception antennas are used. A radio wave is radiated from each of the plurality of transmission antennas. In one example, respectively different signals may be superposed on the radio waves to be radiated. Each of the plurality of reception antennas receives all of the transmitted plurality of radio waves. However, since different reception antennas will receive radio waves that arrive through different paths, differences will occur among the phases of the received radio waves. By utilizing these differences, it is possible to, at the receiver side, separate the plurality of signals which were contained in the plurality of radio waves.

The waveguide device and antenna device according to the present disclosure can also be used in a communication system which utilizes MIMO. Hereinafter, an example such a communication system will be described.

FIG. 75 is a block diagram showing an example of a communication system 800C implementing a MIMO function. In the communication system 800C, a transmitter 830 includes an encoder 832, a TX-MIMO processor 833, and two transmission antennas 8351 and 8352. A receiver 840 includes two reception antennas 8451 and 8452, an RX-MIMO processor 843, and a decoder 842. Note that the number of transmission antennas and the number of reception antennas may each be greater than two. Herein, for ease of explanation, an example where there are two antennas of each kind will be illustrated. In general, the channel capacity of an MIMO communication system will increase in proportion to the number of whichever is the fewer between the transmission antennas and the reception antennas.

Having received a signal from the data signal source 831, the transmitter 830 encodes the signal at the encoder 832 so that the signal is ready for transmission. The encoded signal is distributed by the TX-MIMO processor 833 between the two transmission antennas 8351 and 8352.

In a processing method according to one example of the MIMO method, the TX-MIMO processor 833 splits a sequence of encoded signals into two, i.e., as many as there are transmission antennas 8352, and sends them in parallel to the transmission antennas 8351 and 8352. The transmission antennas 8351 and 8352 respectively radiate radio waves containing information of the split signal sequences. When there are N transmission antennas, the signal sequence is split into N. The radiated radio waves are simultaneously received by the two reception antennas 8451 and 8452. In other words, in the radio waves which are received by each of the reception antennas 8451 and 8452, the two signals which were split at the time of transmission are mixedly contained. Separation between these mixed signals is achieved by the RX-MIMO processor 843.

The two mixed signals can be separated by paying attention to the phase differences between the radio waves, for example. A phase difference between two radio waves of the case where the radio waves which have arrived from the transmission antenna 8351 are received by the reception antennas 8451 and 8452 is different from a phase difference between two radio waves of the case where the radio waves which have arrived from the transmission antenna 8352 are received by the reception antennas 8451 and 8452. That is, the phase difference between reception antennas differs depending on the path of transmission/reception. Moreover, unless the spatial relationship between a transmission antenna and a reception antenna is changed, the phase difference therebetween remains unchanged. Therefore, based on correlation between reception signals received by the two reception antennas, as shifted by a phase difference which is determined by the path of transmission/reception, it is possible to extract any signal that is received through that path of transmission/reception. The RX-MIMO processor 843 may separate the two signal sequences from the reception signal e.g. by this method, thus restoring the signal sequence before the split. The restored signal sequence still remains encoded, and therefore is sent to the decoder 842 so as to be restored to the original signal there. The restored signal is sent to the data sink 841.

Although the MIMO communication system 800C in this example transmits or receives a digital signal, an MIMO communication system which transmits or receives an analog signal can also be realized. In that case, in addition to the construction of FIG. 75, an analog to digital converter and a digital to analog converter as have been described with reference to FIG. 73 are provided. Note that the information to be used in distinguishing between signals from different transmission antennas is not limited to phase difference information. Generally speaking, for a different combination of a transmission antenna and a reception antenna, the received radio wave may differ not only in terms of phase, but also in scatter, fading, and other conditions. These are collectively referred to as CSI (Channel State Information). CSI may be utilized in distinguishing between different paths of transmission/reception in a system utilizing MIMO.

Note that it is not an essential requirement that the plurality of transmission antennas radiate transmission waves containing respectively independent signals. So long as separation is possible at the reception antenna side, each transmission antenna may radiate a radio wave containing a plurality of signals. Moreover, beam forming may be performed at the transmission antenna side, while a transmission wave containing a single signal, as a synthetic wave of the radio waves from the respective transmission antennas, may be formed at the reception antenna. In this case, too, each transmission antenna is adapted so as to radiate a radio wave containing a plurality of signals.

In this third example, too, as in the first and second examples, various methods such as CDM, FDM, TDM, and OFDM may be used as a method of signal encoding.

In a communication system, a circuit board that implements an integrated circuit (referred to as a signal processing circuit or a communication circuit) for processing signals may be stacked as a layer on the waveguide device and antenna device according to an embodiment of the present disclosure. Since the waveguide device and antenna device according to an embodiment of the present disclosure is structured so that plate-like conductive members are layered therein, it is easy to further stack a circuit board thereupon. By adopting such an arrangement, a transmitter and a receiver which are smaller in volume than in the case where a hollow waveguide or the like is employed can be realized.

In the first to third examples of the communication system as described above, each element of a transmitter or a receiver, e.g., an analog to digital converter, a digital to analog converter, an encoder, a decoder, a modulator, a demodulator, a TX-MIMO processor, or an RX-MIMO processor, is illustrated as one independent element in FIGS. 73, 74, and 75; however, these do not need to be discrete. For example, all of these elements may be realized by a single integrated circuit. Alternatively, some of these elements may be combined so as to be realized by a single integrated circuit. Either case qualifies as an embodiment of the present invention so long as the functions which have been described in the present disclosure are realized thereby.

As described above, the present disclosure encompasses antenna arrays, waveguide devices, antenna devices, radars, radar systems, and communication systems as recited in the following Items.

[Item 1]

An antenna array comprising an electrically conductive member having a first electrically conductive surface on a front side and a second electrically conductive surface on a rear side, wherein, the electrically conductive member has a plurality of slots forming a row along a first direction;

the first electrically conductive surface of the electrically conductive member is shaped so as to define a plurality of horns each communicating with a corresponding one of the plurality of slots;

E planes of the plurality of slots are on a same plane, or on a plurality of planes which are substantially parallel to one another;

the plurality of slots include a first slot and a second slot which are adjacent to each other;

the plurality of horns include a first horn communicating with the first slot and a second horn communicating with the second slot;

in an E-plane cross section of the first horn, a length from one of two intersections between the E plane and an edge of the first slot to one of two intersections between the E plane and an edge of the aperture plane of the first horn is longer than a length from the other intersection between the E plane and the edge of the first slot to the other intersection between the E plane and the edge of the aperture plane of the first horn, the lengths extending along an inner wall surface of the first horn;

in an E-plane cross section of the second horn, a length from one of two intersections between the E plane and an edge of the second slot to one of two intersections between the E plane and an edge of the aperture plane of the second horn is equal to or less than a length from the other intersection between the E plane and the edge of the second slot to the other intersection between the E plane and the edge of the aperture plane of the second horn, the lengths extending along an inner wall surface of the second horn; and an axis which passes through a center of the first slot and through a center of the aperture plane of the first horn and an axis which passes through a center of the second slot and through a center of the aperture plane of the second horn are oriented in different directions.

[Item 2]

The antenna array of Item 1, wherein a distance between the centers of the aperture planes of the first and second horns is shorter than a distance between centers of the first and second slots.

[Item 3]

The antenna array of Item 1 or 2, wherein each of the plurality of horns has a shape which is symmetric with respect to the E plane thereof, the E plane passing through a center of the horn.

[Item 4]

The antenna array of any of Items 1 to 3, wherein, the plurality of slots include a third slot;

the plurality of horns include a third horn communicating with the third slot;

the first horn has a shape which is asymmetric with respect to a plane which passes through the center of the first slot and which is perpendicular to both of the E plane of the first slot and the aperture plane of the first horn;

the second horn has a shape which is asymmetric with respect to a plane which passes through the center of the second slot and which is perpendicular to both of the E plane of the second slot and the aperture plane of the second horn; and the third horn has a shape which is symmetric with respect to a plane which passes through a center of the third slot communicating with the third horn and which is perpendicular to both of the E plane of the third slot and the aperture plane of the third horn.

[Item 5]

The antenna array of Item 4, wherein, the third slot is adjacent to the second slot;

the plurality of slots include a fourth slot which is adjacent to the first slot, a fifth slot which is adjacent to the fourth slot, and a sixth slot which is adjacent to the fifth slot;

the plurality of horns include fourth to sixth horns respectively communicating with the fourth to sixth slots; and the fourth to sixth horns have shapes obtained by inverting the first to third horns, respectively, with respect to a plane which extends through a midpoint between the first horn and the fourth horn and is perpendicular to the E plane thereof.

[Item 6]

The antenna array of Items 1 to 5, wherein, the antenna array is used for at least one of transmission and reception of an electromagnetic wave of a frequency band having a center frequency f0;

an electromagnetic wave with the center frequency f0 has a free-space wavelength λ0;

in the E-plane cross section of the first horn, there is a difference of not less than λ0/32 and not more than λ0/4 between the length from the one intersection between the E plane and the edge of the first slot to the one intersection between the E plane and the edge of the aperture plane of the first horn and the length from the other intersection between the E plane and the edge of the first slot to the other intersection between the E plane and the edge of the aperture plane of the first horn, the lengths extending along the inner wall surface of the first horn; and in the E-plane cross section of the second horn, there is a difference of not less than λ0/32 and not more than λ0/4 between the length from the one intersection between the E plane and the edge of the second slot to the one intersection between the E plane and the edge of the aperture plane of the second horn and the length from the other intersection between the E plane and the edge of the second slot to the other intersection between the E plane and the edge of the aperture plane of the second horn, the lengths extending along the inner wall surface of the second horn.

[Item 7]

The antenna array of any of Items 1 to 6, wherein, the antenna array is used for at least one of transmission and reception of an electromagnetic wave of a frequency band having a center frequency f0;

an electromagnetic wave with the center frequency f0 has a free-space wavelength λ0; and the aperture plane of each horn has a width which is smaller than λ0 along the E plane.

[Item 8]

The antenna array of any of Items 1 to 7, wherein at least one inner wall surface extending in a direction which intersects the E plane of at least one of the plurality of horns has a projection protruding toward a central portion of the slot communicating with the at least one horn as viewed from a direction perpendicular to the aperture plane of the horn.

[Item 9]

The antenna array of any of Items 1 to 8, wherein the first electrically conductive surface of the electrically conductive member has a flat face continuing from the edge of the aperture plane or planes of a horn or horns at one end or both ends of a row constituted by the plurality of horns.

[Item 10]

The antenna array of any of Items 1 to 9, further comprising a waveguide member provided at the rear side of the electrically conductive member, the waveguide member having an electrically-conductive waveguide face of a stripe shape that opposes the second electrically conductive surface, the waveguide member extending in a manner of following along the second electrically conductive surface, a second electrically conductive member provided at the rear side of the electrically conductive member, the second electrically conductive member supporting the waveguide member, the second electrically conductive member having a third electrically conductive surface on the front side that opposes the second electrically conductive surface and a fourth electrically conductive surface on the rear side, and an artificial magnetic conductor extending on both sides of the waveguide member, the artificial magnetic conductor being provided on at least one of the second electrically conductive surface and the third electrically conductive surface, wherein, the second electrically conductive surface, the waveguide face, and the artificial magnetic conductor define a waveguide extending in a gap between the second electrically conductive surface and the waveguide face; and the plurality of slots each oppose the waveguide face.

[Item 11]

The antenna array of any of Items 1 to 9, further comprising a hollow waveguide, wherein the plurality of slots are connected to the hollow waveguide.

[Item 12]

The antenna array of Item 11, wherein, at least a portion of the electrically conductive member comprises a longitudinal wall of the hollow waveguide; and the plurality of slots and the plurality of horns are provided in or on the longitudinal wall of the hollow waveguide.

[Item 13]

The antenna array of Item 11, wherein, the hollow waveguide includes a stem and a plurality of branches emerging from the stem via at least one branching portion; and terminal ends of the plurality of branches are respectively connected to the plurality of slots.

[Item 14]

The antenna array of any of Items 1 to 13, wherein each horn has a pyramidal shape.

[Item 15]

The antenna array of any of Items 1 to 13, wherein each horn is a box horn having an internal cavity of a rectangular solid shape or a cube shape.

[Item 16]

An antenna array comprising an electrically conductive member having a first electrically conductive surface on a front side and a second electrically conductive surface on a rear side, wherein, the electrically conductive member has a plurality of slots forming a row along a first direction;

the first electrically conductive surface of the electrically conductive member is shaped so as to define a plurality of horns each communicating with a corresponding one of the plurality of slots;

E planes of the plurality of slots are on a same plane, or on a plurality of planes which are substantially parallel to one another;

the plurality of horns include a first horn, a second horn, and a third horn forming a row along the first direction; and when electromagnetic waves are supplied to first to third slots respectively communicating with the first to third horns, three main lobes respectively radiated from the first to third horns overlap one another, center axes of the three main lobes are oriented in respectively different directions, and differences among the directions of the center axes of the three main lobes are smaller than a width of each of the three main lobes.

[Item 17]

A waveguide device comprising:

a first electrically conductive member having a first electrically conductive surface on a front side and a second electrically conductive surface on a rear side;

a waveguide member provided at the rear side of the first electrically conductive member, the waveguide member having an electrically-conductive waveguide face of a stripe shape that opposes the second electrically conductive surface, the waveguide member extending in a manner of following along the second electrically conductive surface; and a second electrically conductive member provided at the rear side of the first electrically conductive member, the second electrically conductive member supporting the waveguide member, the second electrically conductive member having a third electrically conductive surface on the front side that opposes the second electrically conductive surface, and a fourth electrically conductive surface on the rear side; and an artificial magnetic conductor extending on both sides of the waveguide member, the artificial magnetic conductor being provided on at least one of the second electrically conductive surface and the third electrically conductive surface, wherein, the second electrically conductive surface, the waveguide face, and the artificial magnetic conductor define a waveguide extending in a gap between the second electrically conductive surface and the waveguide face;

the second electrically conductive member includes a port at a position adjacent to one end of the waveguide member, the port communicating from the fourth electrically conductive surface to the waveguide, and a choke structure at a position opposing the one end of the waveguide member via the port;

the choke structure includes an electrically-conductive ridge at a position adjacent to the port and includes one or more electrically conductive rods provided on the third electrically conductive surface with a gap from a farther end of the ridge from the port; and when an electromagnetic wave propagating in the waveguide has a central wavelength $\lambda 0$ in free space, the ridge has a length equal to or greater than $\lambda 0/16$ and less than $\lambda 0/4$ in a direction along the waveguide.

[Item 18]

A waveguide device comprising:

a first electrically conductive member having a first electrically conductive surface on a front side and a second electrically conductive surface on a rear side;

a waveguide member provided at the rear side of the first electrically conductive member, the waveguide member having an electrically-conductive waveguide face of a stripe shape that opposes the second electrically conductive surface, the waveguide member extending in a manner of following along the second electrically conductive surface;

a second electrically conductive member provided at the rear side of the first electrically conductive member, the second electrically conductive member supporting the waveguide member, the second electrically conductive member having a third electrically conductive surface on the front side that opposes the second electrically conductive surface, and a fourth electrically conductive surface on the rear side; and an artificial magnetic conductor extending on both sides of the waveguide member, the artificial magnetic conductor being provided on at least one of the second electrically conductive surface and the third electrically conductive surface, wherein, the second electrically conductive surface, the waveguide face, and the artificial magnetic conductor define a waveguide extending in a gap between the second electrically conductive surface and the waveguide face;

the first electrically conductive member includes a port provided at a position opposing a portion of the waveguide face adjacent to one end of the waveguide member, the port communicating from the first electrically conductive surface to the second electrically conductive surface;

the second electrically conductive member includes a choke structure in a region containing the one end of the waveguide member;

the choke structure comprises a waveguide member end portion and one or more electrically conductive rods, the waveguide member end portion spanning from an edge of an opening of the port to an edge of the one end of the waveguide member as projected onto the waveguide face, the one or more electrically conductive rods being provided on the third electrically conductive surface with a gap from the one end of the waveguide member; and when an electromagnetic wave propagating in the waveguide has a central wavelength λ0 in free space, the waveguide member end portion has a length equal to or greater than λ0/16 and less than λ0/4 in a direction along the waveguide.

[Item 19]

A waveguide device comprising:

a first electrically conductive member having a first electrically conductive surface on a front side and a second electrically conductive surface on a rear side;

a waveguide member provided at the rear side of the first electrically conductive member, the waveguide member having an electrically-conductive waveguide face of a stripe shape that opposes the second electrically conductive surface, the waveguide member extending in a manner of following along the second electrically conductive surface;

a second electrically conductive member provided at the rear side of the first electrically conductive member, the second electrically conductive member supporting the waveguide member, the second electrically conductive member having a third electrically conductive surface on the front side that opposes the second electrically conductive surface, and a fourth electrically conductive surface on the rear side; and an artificial magnetic conductor extending on both sides of the waveguide member, the artificial magnetic conductor being provided on at least one of the second electrically conductive surface and the third electrically conductive surface, wherein, the second electrically conductive surface, the waveguide face, and the artificial magnetic conductor define a waveguide extending in a gap between the second electrically conductive surface and the waveguide face;

the second electrically conductive member includes a port at a position adjacent to one end of the waveguide member, the port communicating from the fourth electrically conductive surface to the waveguide, and a choke structure at a position opposing the one end of the waveguide member via the port;

the choke structure includes an electrically-conductive ridge at a position adjacent to the port and includes one or more electrically conductive rods provided on the third electrically conductive surface with a gap from a farther end of the ridge from the port;

the ridge includes a first portion adjacent to the port and a second portion adjacent to the first portion; and a distance between the first portion and the second electrically conductive surface is longer than a distance between the second portion and the second electrically conductive surface.

[Item 20]

The waveguide device of Item 19, wherein, the waveguide member includes a gap enlargement at a site adjacent to the port; and a distance between the gap enlargement and the second electrically conductive surface is larger than a distance between the second electrically conductive surface and a site of the waveguide member adjoining the gap enlargement on the opposite side from the port.

[Item 21]

The waveguide device of Item 20, wherein the waveguide member has a slope at the gap enlargement.

[Item 22]

The waveguide device of any of Items 19 to 21, wherein the ridge of the choke structure has a slope at the first portion.

[Item 23]

A waveguide device comprising:

a first electrically conductive member having a first electrically conductive surface on a front side and a second electrically conductive surface on a rear side;

a waveguide member provided at the rear side of the first electrically conductive member, the waveguide member having an electrically-conductive waveguide face of a stripe shape that opposes the second electrically conductive surface, the waveguide member extending in a manner of following along the second electrically conductive surface;

a second electrically conductive member provided at the rear side of the first electrically conductive member, the second electrically conductive member supporting the waveguide member, the second electrically conductive member having a third electrically conductive surface on the front side that opposes the second electrically conductive surface, and a fourth electrically conductive surface on the rear side; and an artificial magnetic conductor extending on both sides of the waveguide member, the artificial magnetic conductor being provided on at least one of the second electrically conductive surface and the third electrically conductive surface, wherein, the second electrically conductive surface, the waveguide face, and the artificial magnetic conductor define a waveguide extending in a gap between the second electrically conductive surface and the waveguide face;

the first electrically conductive member includes a port provided at a position opposing a portion of the waveguide face adjacent to one end of the waveguide member, the port communicating from the first electrically conductive surface to the second electrically conductive surface;

the second electrically conductive member includes a choke structure in a region containing the one end of the waveguide member;

the choke structure comprises a waveguide member end portion and one or more electrically conductive rods, the waveguide member end portion spanning from an edge of an opening of the port to an edge of the one end of the waveguide member as projected onto the waveguide face, the one or more electrically conductive rods being provided on the third electrically conductive surface with a gap from the one end of the waveguide member;

at a site opposing the waveguide member end portion, the second electrically conductive surface of the first electrically conductive member includes a first portion adjacent to the port and a second portion adjacent to the first portion; and a distance between the first portion and the waveguide face is longer than a distance between the second portion and the waveguide face.

[Item 24]

The waveguide device of Item 23, wherein, the second electrically conductive surface of the first electrically conductive member includes a gap enlargement at a site adjacent to the port on a farther side from the choke structure; and a distance between the gap enlargement and the waveguide face is longer than a distance between the waveguide face and a site of the second electrically conductive surface adjacent to the gap enlargement on an opposite side from the port.

[Item 25]

The waveguide device of Item 24, wherein the first electrically conductive member has a slope at the gap enlargement.

[Item 26]

The waveguide device of any of Items 23 to 25, wherein the waveguide member has a slope at the one end.

[Item 27]

A waveguide device comprising:

a first electrically conductive member having a first electrically conductive surface on a front side and a second electrically conductive surface on a rear side;

a waveguide member provided at the rear side of the first electrically conductive member, the waveguide member having an electrically-conductive waveguide face of a stripe shape that opposes the second electrically conductive surface, the waveguide member extending in a manner of following along the second electrically conductive surface;

a second electrically conductive member provided at the rear side of the first electrically conductive member, the second electrically conductive member supporting the waveguide member, the second electrically conductive member having a third electrically conductive surface on the front side that opposes the second electrically conductive surface, and a fourth electrically conductive surface on the rear side; and an artificial magnetic conductor extending on both sides of the waveguide member, the artificial magnetic conductor being provided on at least one of the second electrically conductive surface and the third electrically conductive surface, wherein, the second electrically conductive surface, the waveguide face, and the artificial magnetic conductor define a waveguide extending in a gap between the second electrically conductive surface and the waveguide face;

the second electrically conductive member includes a port communicating from the fourth electrically conductive surface to the waveguide;

the waveguide member is spatially separated into a first portion and a second portion at the port;

a portion of an inner wall of the port connects to one end of the first portion of the waveguide member;

another portion of the inner wall of the port connects to one end the second portion of the waveguide member; and an intra-waveguide member gap defined between two opposing end faces at the one end of the first portion and the one end of the second portion of the waveguide member includes a narrow portion which is smaller in size than a gap between the portion of the inner wall of the port that connects to the first portion of the waveguide member and the other portion of the inner wall of the port that connects to the second portion of the waveguide member.

[Item 28]

The waveguide device of Item 27, wherein a cross section of the port taken orthogonal to a center axis of the port has an H-shape.

[Item 29]

The waveguide device Item 27 or 28, wherein the narrow portion reaches the waveguide face of the waveguide member.

[Item 30]

The waveguide device of any of Items 27 to 29, wherein the narrow portion reaches inside the port.

[Item 31]

An array antenna device comprising:

a first electrically conductive member having a first electrically conductive surface on a front side and a second electrically conductive surface on a rear side, the first electrically conductive member having a plurality of slots;

a waveguide member provided at the rear side of the first electrically conductive member, the waveguide member having an electrically-conductive waveguide face of a stripe shape that opposes the second electrically conductive surface, the waveguide member extending in a manner of following along the second electrically conductive surface;

a second electrically conductive member provided at the rear side of the first electrically conductive member, the second electrically conductive member supporting the waveguide member, the second electrically conductive member having a third electrically conductive surface on the front side that opposes the second electrically conductive surface, and a fourth electrically conductive surface on the rear side; and an artificial magnetic conductor extending on both sides of the waveguide member, the artificial magnetic conductor being provided on at least one of the second electrically conductive surface and the third electrically conductive surface, wherein, the second electrically conductive surface, the waveguide face, and the artificial magnetic conductor define a waveguide extending in a gap between the second electrically conductive surface and the waveguide face;

the second electrically conductive member includes a port communicating from the fourth electrically conductive surface to the waveguide;

on the second electrically conductive surface, a first slot and a second slot which are adjacent to each other among the plurality of slots are at symmetric positions with respect to a center of the port;

the waveguide member includes a pair of impedance matching structures adjoining the port, each of the pair of impedance matching structures having a flat portion adjoining the port and a dent adjoining the flat portion, and partly opposes one of the first and second slots.

[Item 32]

The array antenna device of Item 31, wherein, when a signal wave propagating in the waveguide has a central wavelength $\lambda 0$ while propagating in a vacuum, a length of the flat portion along a direction that the waveguide member extends is longer than $\lambda 0/4$, and a length of the dent along the direction that the waveguide member extends is shorter than $\lambda 0/4$.

[Item 33]

The array antenna device of Item 32, wherein a distance on the second electrically conductive surface from a center of the first slot to a center of the second slot is shorter than $2\lambda 0$, and longer than $\lambda 0$.

[Item 34]

The array antenna device of any of Items 31 to 33, wherein at least a portion of the dent of each of the pair of impedance matching structures opposes one of the first and second slots.

[Item 35]

The array antenna device of any of Items 31 to 34, wherein the plurality of slots include a third slot which is adjacent to the first slot and a fourth slot which is adjacent to the second slot, and the third and fourth slots are at symmetric positions with respect to the center of the port on the second electrically conductive surface.

[Item 36]

The array antenna device of Item 35, wherein, at least one of a distance from the second electrically conductive surface to the waveguide face and a width of the waveguide face varies along the waveguide; and on the second electrically conductive surface, a distance from a center of the first slot to a center of the third slot is shorter than a distance from the center of the first slot to a center of the second slot.

[Item 37]

The array antenna device of Item 35 or 36, wherein, on the second electrically conductive surface, a distance from a center of the first slot to a center of the third slot is equal to a wavelength, as taken within the waveguide, of a signal wave propagating in the waveguide.

[Item 38]

An array antenna device comprising:

a first electrically conductive member having a first electrically conductive surface on a front side and a second electrically conductive surface on a rear side;

a waveguide member provided at the rear side of the first electrically conductive member, the waveguide member having an electrically-conductive waveguide face of a stripe shape that opposes the second electrically conductive surface, the waveguide member extending in a manner of following along the second electrically conductive surface;

a second electrically conductive member provided at the rear side of the first electrically conductive member, the second electrically conductive member supporting the waveguide member, the second electrically conductive member having a third electrically conductive surface on the front side that opposes the second electrically conductive surface, and a fourth electrically conductive surface on the rear side; and an artificial magnetic conductor extending on both sides of the waveguide member, the artificial magnetic conductor being provided on at least one of the second electrically conductive surface and the third electrically conductive surface, wherein, the second electrically conductive surface, the waveguide face, and the artificial magnetic conductor define a waveguide extending in a gap between the second electrically conductive surface and the waveguide face;

the second electrically conductive member includes a port communicating from the fourth electrically conductive surface to the waveguide;

the waveguide member is spatially separated into a first portion and a second portion at the port;

a portion of an inner wall of the port connects to one end of the first portion of the waveguide member;

another portion of the inner wall of the port connects to one end the second portion of the waveguide member;

a distance between two opposing end faces at the one end of the first portion and the one end of the second portion of the waveguide member is different from a distance between the portion of the inner wall of the port that connects to the first portion of the waveguide member and the other portion of the inner wall of the port that connects to the second portion of the waveguide member.

[Item 39]

The array antenna device of Item 38, wherein a cross section of the port taken orthogonal to a center axis of the port has an H-shape.

[Item 40]

The array antenna device of Item 38 or 39, wherein the first portion and the second portion of the waveguide member each include an impedance matching structure adjoining the port, the impedance matching structure having a flat portion adjoining the port and a dent adjoining the flat portion.

[Item 41]

An array antenna device comprising:

a first electrically conductive member having a first electrically conductive surface on a front side and a second electrically conductive surface on a rear side, the first electrically conductive member having a plurality of slots;

a waveguide member provided at the rear side of the first electrically conductive member, the waveguide member having an electrically-conductive waveguide face of a stripe shape that opposes the second electrically conductive surface, the waveguide member extending in a manner of following along the second electrically conductive surface;

a second electrically conductive member provided at the rear side of the first electrically conductive member, the second electrically conductive member supporting the waveguide member, the second electrically conductive member having a third electrically conductive surface on the front side that opposes the second electrically conductive surface, and a fourth electrically conductive surface on the rear side; and an artificial magnetic conductor extending on both sides of the waveguide member, the artificial magnetic conductor being provided on at least one of the second electrically conductive surface and the third electrically conductive surface, wherein, the second electrically conductive surface, the waveguide face, and the artificial magnetic conductor define a waveguide extending in a gap between the second electrically conductive surface and the waveguide face;

the second electrically conductive member includes a port communicating from the fourth electrically conductive surface to the waveguide;

the plurality of slots opposes the waveguide face;

on the second electrically conductive surface, a first slot and a second slot which are adjacent to each other among the plurality of slots are at symmetric positions with respect to a center of the port;

the first electrically conductive surface of the first electrically conductive member is shaped so as to define a plurality of horns respectively communicating with the plurality of slots; and among the plurality of horns, a distance between centers of the openings of two adjacent horns is shorter than a distance on the second electrically conductive surface from a center of the first slot to a center of the second slot.

[Item 42]

The array antenna device of Item 41, wherein the plurality of slots include a third slot which is adjacent to the first slot and a fourth slot which is adjacent to the second slot, and the third and fourth slots are at symmetric positions with respect to the center of the port on the second electrically conductive surface.

[Item 43]

The array antenna device of Item 41 or 42, wherein each of the plurality of horns has a shape which is asymmetric with respect to a plane that passes through the center of a slot communicating with the horn and is orthogonal to both of the second electrically conductive surface and the waveguide.

[Item 44]

The array antenna device of Item 42, wherein, on the second electrically conductive surface, a distance from a center of the first slot to a center of the third slot is equal to a wavelength, as taken within the waveguide, of a signal wave propagating in the waveguide.

[Item 45]

The array antenna device any of Items 41 to 44, wherein at least one of a distance from the second electrically conductive surface to the waveguide face and a width of the waveguide face varies along the waveguide.

[Item 46]

An array antenna device comprising:

a first electrically conductive member having a first electrically conductive surface on a front side and a second electrically conductive surface on a rear side;

a waveguide member provided at the rear side of the first electrically conductive member, the waveguide member having an electrically-conductive waveguide face of a stripe shape that opposes the second electrically conductive surface, the waveguide member extending in a manner of following along the second electrically conductive surface;

a second electrically conductive member provided at the rear side of the first electrically conductive member, the second electrically conductive member supporting the waveguide member, the second electrically conductive member having a third electrically conductive surface on the front side that opposes the second electrically conductive surface, and a fourth electrically conductive surface on the rear side; and an artificial magnetic conductor extending on both sides of the waveguide member, the artificial magnetic conductor being provided on at least one of the second electrically conductive surface and the third electrically conductive surface, wherein, the second electrically conductive surface, the waveguide face, and the artificial magnetic conductor define a waveguide extending in a gap between the second electrically conductive surface and the waveguide face;

the second electrically conductive member includes a port at a position adjacent to one end of the waveguide member, the port communicating from the fourth electrically conductive surface to the waveguide, and a choke structure at a position opposing the one end of the waveguide member via the port;

the choke structure includes a first portion adjacent to the port and a second portion adjacent to the first portion; and a distance between the first portion and the second electrically conductive surface is longer than a distance between the second portion and the second electrically conductive surface.

[Item 47]

An array antenna device comprising:

a first electrically conductive member having a first electrically conductive surface on a front side and a second electrically conductive surface on a rear side, the first electrically conductive member having $2^N$ (where N is an integer of 2 or greater) ports;

a waveguide member at the rear side of the first electrically conductive member, the waveguide member having an electrically-conductive waveguide face opposing the second electrically conductive surface, the waveguide member extending in a manner of following along the second electrically conductive surface;

a second electrically conductive member at the rear side of the first electrically conductive member, the second electrically conductive member supporting the waveguide member, and the second electrically conductive member having a third electrically conductive surface on the front side that opposes the second electrically conductive surface; and an artificial magnetic conductor extending on both sides of the waveguide member, the artificial magnetic conductor being provided on at least one of the second electrically conductive surface and the third electrically conductive surface, wherein, the second electrically conductive surface, the waveguide face, and the artificial magnetic conductor define a waveguide in a gap between the second electrically conductive surface and the waveguide face;

via combinations among a plurality of T-branching portions, the waveguide member branches from one stem into $2^N$ waveguide terminal sections, the $2^N$ ports respectively opposing the $2^N$ waveguide terminal sections, at least one of the $2^N$ waveguide terminal sections has a shape which is different from the shape of another.

[Item 48]

The array antenna device of Item 47, wherein, among the $2^N$ waveguide terminal sections, at least two waveguide terminal sections that are located central have a shape which is different from a shape of at least two waveguide terminal sections located outward of the two waveguide terminal sections.

[Item 49]

The array antenna device of Item 48, wherein, N≥3 is satisfied; and among the $2^N$ waveguide terminal sections, at least four waveguide terminal sections that are located central have a shape which is different from a shape of at least four waveguide terminal sections located outward of the four waveguide terminal sections.

[Item 50]

The array antenna device of any of Items 47 to 49, wherein,

N=3 is satisfied; and the plurality of T-branching portions include a first branching portion at which the stem of the waveguide member branches into two first branches, two second branching portions at each of which each first branch branches into two second branches, and four third branching portions at each of which each second branch branches into two third branches, the eight third branches functioning as the waveguide terminal sections.

[Item 51]

The array antenna device of Item 50, wherein, among the eight waveguide terminal sections, four waveguide terminal sections located central have a shape which is different from a shape of four waveguide terminal sections located outward of the four waveguide terminal sections.

[Item 52]

The array antenna device of Item 51, wherein, each of the eight waveguide terminal sections has a bend where the waveguide terminal section is connected to the second branch; and the bends of the four waveguide terminal sections located central are dented.

[Item 53]

The array antenna device of Item 51 or 52, wherein the bends of the four waveguide terminal sections located outward of the four waveguide terminal sections located central each have a bump.

[Item 54]

The array antenna device of any of Items 57 to 53, wherein the second electrically conductive member has a fourth electrically conductive surface on the rear side, and, at a position adjacent to one end of the stem of the waveguide member, the second electrically conductive member has a port communicating from the fourth electrically conductive surface to the waveguide.

[Item 55]

An array antenna device comprising:

a first electrically conductive member having a first electrically conductive surface on a front side and a second electrically conductive surface on a rear side;

a waveguide member at the rear side of the first electrically conductive member, the waveguide member having an electrically-conductive waveguide face opposing the second electrically conductive surface, the waveguide member extending in a manner of following along the second electrically conductive surface;

a second electrically conductive member at the rear side of the first electrically conductive member, the second electrically conductive member supporting the waveguide member, and the second electrically conductive member having a third electrically conductive surface on the front side that opposes the second electrically conductive surface; and an artificial magnetic conductor extending on both sides of the waveguide member, the artificial magnetic conductor being provided on at least one of the second electrically conductive surface and the third electrically conductive surface, wherein, the second electrically conductive surface, the waveguide face, and the artificial magnetic conductor define a waveguide extending in a gap between the second electrically conductive surface and the waveguide face;

via combinations among a plurality of T-branching portions, the waveguide member branches from one stem into $2^N$ (where N is an integer of 2 or greater) waveguide terminal sections;

on a stem portion adjacent to each of the plurality of T-branching portions, the waveguide member includes a plurality of impedance transforming sections to increase a capacitance of the waveguide; and among the plurality of impedance transforming sections, a length of a first impedance transforming section in a direction along the waveguide is shorter than a length of a second impedance transforming section in a direction along the waveguide, the first impedance transforming section being relatively far from the waveguide terminal section, the second impedance transforming section being relatively close to the waveguide terminal section.

[Item 56]

The array antenna device of Item 55, wherein,

N=3 is satisfied; and the plurality of T-branching portions include a first branching portion at which the stem of the waveguide member branches into two first branches, two second branching portions at each of which each first branch branches into two second branches, and four third branching portions at each of which each second branch branches into two third branches, the eight third branches functioning as the waveguide terminal sections.

[Item 57]

The array antenna device of Item 56, wherein the first impedance transforming section is located at the first branch, and the second impedance transforming section is located at the second branch.

[Item 58]

The array antenna device of any of Items 55 to 57, wherein, each of the first impedance transforming section and the second impedance transforming section includes a first transforming subsection being adjacent to one of the plurality of T-branching portions and having a constant height or width, and a second transforming subsection adjoining the first transforming subsection on an opposite side from the one of the plurality of T-branching portions and having a constant height or width; and a distance between the waveguide face and the second electrically conductive surface at the first transforming subsection is smaller than a distance between the waveguide face and the second electrically conductive surface at the second transforming subsection, or a width of the waveguide face at the first transforming subsection is larger than a width of the waveguide face at the second transforming subsection.

[Item 59]

The array antenna device of Item 58, wherein, in a direction along the waveguide, the first transforming subsection of the first impedance transforming section is shorter than the first transforming subsection of the second impedance transforming section.

[Item 60]

The array antenna device of Item 58 or 59, wherein, in a direction along the waveguide, the first transforming subsection of the first impedance transforming section is shorter than the second transforming subsection of the first impedance transforming section; and in a direction along the waveguide, the first transforming subsection of the second impedance transforming section is longer than the second transforming subsection of the second impedance transforming section.

[Item 61]

An array antenna device comprising:

a first electrically conductive member having a first electrically conductive surface on a front side and a second electrically conductive surface on a rear side;

a waveguide member at the rear side of the first electrically conductive member, the waveguide member having an electrically-conductive waveguide face opposing the second electrically conductive surface, the waveguide member extending in a manner of following along the second electrically conductive surface;

a second electrically conductive member provided at the rear side of the first electrically conductive member, the second electrically conductive member supporting the waveguide member, the second electrically conductive member having a third electrically conductive surface on the front side that opposes the second electrically conductive surface, and a fourth electrically conductive surface on the rear side; and an artificial magnetic conductor extending on both sides of the waveguide member, the artificial magnetic conductor having a plurality of electrically conductive rods on the third electrically conductive surface, wherein, the second electrically conductive surface, the waveguide face, and the artificial magnetic conductor define a waveguide extending in a gap between the second electrically conductive surface and the waveguide face;

the second electrically conductive member includes a rectangular hollow-waveguide at a position adjacent to one end of the waveguide member, the rectangular hollow-waveguide communicating from the fourth electrically conductive surface to the waveguide, and a choke structure at a position opposing the one end of the waveguide member via the rectangular hollow-waveguide;

the plurality of electrically conductive rods include at least two rows of electrically conductive rods that are arrayed on both sides of the waveguide member and extending along the waveguide member; and, as viewed from a normal direction of the third electrically conductive surface, the rectangular hollow-waveguide has a rectangular shape which is defined by a pair of longer sides and a pair of shorter sides orthogonal to the longer sides, one of the pair of longer sides being in contact with the one end of the waveguide member, and a length of each longer side of the rectangular hollow-waveguide is longer than twice a shortest distance between centers of the at least two rows of electrically conductive rods, and shorter than 3.5 times the shortest distance between the centers.

[Item 62]

The array antenna device of Item 61, wherein a length of each shorter side of the rectangular hollow-waveguide is shorter than 1.5 times the shortest distance between the centers of.

[Item 63]

An array antenna device comprising:

a first electrically conductive member having a first electrically conductive surface on a front side and a second electrically conductive surface on a rear side, the first electrically conductive member having a plurality of slots;

a waveguide member at the rear side of the first electrically conductive member, having an electrically-conductive waveguide face in a stripe shape opposing the second electrically conductive surface and at least one of the plurality of slots, the waveguide member extending in a manner of following along the second electrically conductive surface; and a second electrically conductive member at the rear side of the first electrically conductive member, the second electrically conductive member supporting the waveguide member, and the second electrically conductive member having a third electrically conductive surface on the front side that opposes the second electrically conductive surface; and an artificial magnetic conductor extending on both sides of the waveguide member and being provided on the third electrically conductive surface, the artificial magnetic conductor having a plurality of electrically conductive rods on the third electrically conductive surface, wherein, the second electrically conductive surface, the waveguide face, and the artificial magnetic conductor define a waveguide extending in a gap between the second electrically conductive surface and the waveguide face;

at least one of a distance from the second electrically conductive surface to the waveguide face and a width of the waveguide face varies along the waveguide;

among the plurality of electrically conductive rods, a plurality of first electrically conductive rods adjacent to the waveguide member are in a periodic array with a first period in a direction along the waveguide; and among the plurality of electrically conductive rods, a plurality of second electrically conductive rods not adjacent to the waveguide member are in a periodic array with a second period in a direction along the waveguide, the second period being longer than the first period.

[Item 64]

The array antenna device of Item 63, wherein, in a direction along the waveguide, a width of each first electrically conductive rod is shorter than a width of each second electrically conductive rod.

[Item 65]

The array antenna device of Item 64, wherein, in a direction along the waveguide, an interval between two adjacent first electrically conductive rods is equal to an interval between two adjacent second electrically conductive rods.

[Item 66]

The array antenna device of any of Items 63 to 65, wherein, when a signal wave propagating in the waveguide has a central wavelength $\lambda 0$ while propagating in a vacuum, on a plane which is parallel to the second electrically conductive member, each of the plurality of first electrically conductive rods has a width less than $\lambda 0/4$ as taken along a direction perpendicular to a direction along the waveguide.

[Item 67]

The array antenna device of Item 66, further comprising a further waveguide member adjacent to the plurality of second electrically conductive rods, wherein a distance between each of the plurality of first electrically conductive rods and the waveguide member is longer than a distance between each of the plurality of second electrically conductive rods and the further waveguide member.

[Item 68]

The array antenna device of Item 63, wherein, each of the plurality of first electrically conductive rods and each of the plurality of second electrically conductive rods have prismatic shapes; and as viewed from a normal direction of the third electrically conductive surface, each of the plurality of first electrically conductive rods is a non-square whose polygonal side in a direction along the waveguide is longer than another polygonal side, and each of the plurality of second electrically conductive rods is a square.

[Item 69]

An array antenna device comprising:

a first electrically conductive member having a first electrically conductive surface on a front side and a second electrically conductive surface on a rear side, the first electrically conductive member having a plurality of slots;

a waveguide member at the rear side of the first electrically conductive member, having an electrically-conductive waveguide face in a stripe shape opposing the second electrically conductive surface and at least one of the plurality of slots, the waveguide member extending in a manner of following along the second electrically conductive surface;

a second electrically conductive member at the rear side of the first electrically conductive member, the second electrically conductive member supporting the waveguide member, and the second electrically conductive member having a third electrically conductive surface on the front side that opposes the second electrically conductive surface; and an artificial magnetic conductor extending on both sides of the waveguide member and being provided on the third electrically conductive surface, the artificial magnetic conductor having a plurality of electrically conductive rods on the third electrically conductive surface, wherein, the second electrically conductive surface, the waveguide face, and the artificial magnetic conductor define a waveguide extending in a gap between the second electrically conductive surface and the waveguide face;

in a plane which is parallel to the second electrically conductive member, a first direction is defined as a direction extending along the waveguide, and a second direction is defined perpendicular to the first direction; and among the plurality of electrically conductive rods, a group of rods adjacent to the waveguide member each have a dimension along the first direction which is larger than a dimension along the second direction.

[Item 70]

The array antenna device of Item 69, wherein, at least a portion of the waveguide member is surrounded by plural rows of rods provided along the first direction, the plural rows of rods including the group of rods adjacent to the waveguide member, and electrically conductive rods in the plural rows of rods have identical dimensions.

[Item 71]

The array antenna device of Item 70, wherein, the second electrically conductive member has a further waveguide member thereon, the further waveguide member being different from the waveguide member;

the second electrically conductive surface, a waveguide face of the further waveguide member, and the artificial magnetic conductor define a further waveguide in a gap between the second electrically conductive surface and the waveguide face of the further waveguide member;

the plurality of electrically conductive rods include a first rod group and a second rod group, the first rod group being the group of rods adjacent to the waveguide member, and the second rod group being adjacent to the further waveguide member;

at least a portion of the further waveguide member is surrounded by plural rows of rods including the second rod group, the plural rows of rods being provided along the further waveguide; and an interval between two adjacent electrically conductive rods in the first rod group is equal to an interval between two adjacent electrically conductive rods in the second rod group.

[Item 72]

An antenna device comprising:

the waveguide device of any of Items 1 to 30; and at least one antenna element connected to the waveguide device.

[Item 73]

A radar comprising:

an antenna array of any of Items 1 to 16; and a microwave integrated circuit connected to the antenna array.

[Item 74]

A radar comprising:

the antenna device of Item 72; and a microwave integrated circuit connected to the antenna device.

[Item 75]

A radar comprising:

the array antenna device of any of Items 31 to 71; and a microwave integrated circuit connected to the array antenna device.

[Item 76]

A radar system comprising:

the radar of any of Items 73 to 75; and a signal processing circuit connected to the microwave integrated circuit of the radar.

[Item 77]

A wireless communication system comprising:

the antenna array of any of Items 1 to 16; and a communication circuit connected to the antenna array.

[Item 78]

A wireless communication system comprising:

the antenna device of Item 72; and a communication circuit connected to the antenna device.

[Item 79]

A wireless communication system comprising:

the array antenna device of any of Items 31 to 71; and a communication circuit connected to the array antenna device.

While the present invention has been described with respect to exemplary embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

This application is based on Japanese Patent Application No. 2016-075684 filed Apr. 5, 2016, the entire contents of which are hereby incorporated by reference.

A waveguide device and an antenna device according to the present disclosure are usable in any technological field that makes use of an antenna. For example, they are available to various applications where transmission/reception of electromagnetic waves of the gigahertz band or the terahertz band is performed. In particular, they are suitably used in onboard radar systems, various types of monitoring systems, indoor positioning systems, and wireless communication systems where downsizing is desired.

What is claimed is:

1. An array antenna device comprising:

a first conductive member having a first electrically conductive surface on a front side and a second electrically conductive surface on a rear side;

a waveguide member provided at the rear side of the first electrically conductive member, the waveguide member having an electrically-conductive waveguide face of a stripe shape that opposes the second electrically conductive surface, the waveguide member extending in a manner of following along the second electrically conductive surface;

a second electrically conductive member provided at the rear side of the first electrically conductive member, the second electrically conductive member supporting the waveguide member, the second electrically conductive member having a third electrically conductive surface on the front side that opposes the second electrically conductive surface, and a fourth electrically conductive surface on the rear side; and an artificial magnetic conductor extending on both sides of the waveguide member, the artificial magnetic conductor being provided on at least one of the second electrically conductive surface and the third electrically conductive surface; wherein, the second electrically conductive member includes a port that extends from the fourth conductive surface to the waveguide face and separate the waveguide member to a first portion and a second portion, one end of the first portion and one end of the second portion opposing each other;

the first electrically conductive member includes a first slot and a second slot;

the first slot couples to a first waveguide portion defined by the waveguide face of a first portion, the second electrically conductive surface and the artificial magnetic conductor;

the second slot couples to a second waveguide portion defined by the waveguide face of a second portion, the second electrically conductive surface and the artificial magnetic conductor;

each of the one end of the first portion and the one end of the second portion have a dent to provide a broad portion for a gap between the one end of the first portion and the one end of the second portion;

both of the dent of the first portion and the dent of the second portion reach the waveguide face;

a first choke structure is provided at another end of the first portion on the second conductive member; and a second choke structure is provided at another end of the second portion on the second conductive member.

2. The array antenna device of claim 1, wherein, the first choke structure includes a first additional ridge disposed at the other end of the first portion separated by a groove between the first additional ridge and the other end of the first portion;

the second choke structure includes a second additional ridge disposed at the other end of the second portion separated by a groove between the second additional ridge and the other end of the second portion; and when an electromagnetic wave propagating in the waveguide has a central wavelength λ0 in free space, the length of at least one of the first additional ridge and the second additional ridge is shorter than λ0/4 in a direction along the waveguide.

3. The array antenna device of claim 1, wherein, viewing from a direction perpendicular to the waveguide face, portions of both of the first slot and the second slot each overlap the waveguide face.

4. The array antenna device of claim 1, wherein, the first choke structure includes a first additional ridge disposed at the other end of the first portion separated by a groove between the first additional ridge and the other end of the first portion;

the second choke structure includes a second additional ridge disposed at the other end of the second portion separated by a groove between the second additional ridge and the other end of the second portion;

when an electromagnetic wave propagating in the waveguide has a central wavelength λ0 in free space, the length of at least one of the first additional ridge and the second additional ridge is shorter than λ0/4 in a direction along the waveguide; and viewing from a direction perpendicular to the waveguide face, portions of both of the first slot and the second slot each overlap the waveguide face.

5. The array antenna device of claim 1, wherein, the first slot and the second slot are at symmetric positions with respect to a center of the port.

6. The array antenna device of claim 1, wherein, the first choke structure includes a first additional ridge disposed at the other end of the first portion separated by a groove between the first additional ridge and the other end of the first portion;

the second choke structure includes a second additional ridge disposed at the other end of the second portion separated by a groove between the second additional ridge and the other end of the second portion;

when an electromagnetic wave propagating in the waveguide has a central wavelength λ0 in free space, the length of at least one of the first additional ridge and the second additional ridge is shorter than λ0/4 in a direction along the waveguide; and the first slot and the second slot are at symmetric positions with respect to a center of the port.

7. The array antenna device of claim 1, wherein, viewing from a direction perpendicular to the waveguide face, portions of both of the first slot and the second slot each overlap the waveguide face; and the first slot and the second slot are at symmetric positions with respect to a center of the port.

8. The array antenna device of claim 3, wherein, the first choke structure includes a first additional ridge disposed at the other end of the first portion separated by a groove between the first additional ridge and the other end of the first portion;

the second choke structure includes a second additional ridge disposed at the other end of the second portion separated by a groove between the second additional ridge and the other end of the second portion;

when an electromagnetic wave propagating in the waveguide has a central wavelength λ0 in free space, the length of at least one of the first additional ridge and the second additional ridge is shorter than λ0/4 in a direction along the waveguide; and the first slot and the second slot are at symmetric positions with respect to a center of the port.

9. The array antenna device of claim 1, wherein, the port includes a pair of vertical portions and a lateral portion which interconnects the pair of vertical portions;

the lateral portion extends in a direction crossing a direction along the waveguide; and the pair of vertical portions both extend in the direction along the waveguide.

10. The array antenna device of claim 3, wherein, the first choke structure includes a first additional ridge disposed at the other end of the first portion separated by a groove between the first additional ridge and the other end of the first portion;

the second choke structure includes a second additional ridge disposed at the other end of the second portion separated by a groove between the second additional ridge and the other end of the second portion;

when an electromagnetic wave propagating in the waveguide has a central wavelength λ0 in free space, the length of at least one of the first additional ridge and the second additional ridge is shorter than λ0/4 in a direction along the waveguide;

the port includes a pair of vertical portions and a lateral portion which interconnects the pair of vertical portions;

the lateral portion extends in a direction crossing a direction along the waveguide; and the pair of vertical portions both extend in the direction along the waveguide.

11. The array antenna device of claim 2, wherein, viewing from a direction perpendicular to the waveguide face, portions of both of the first slot and the second slot each overlap the waveguide face;

the first slot and the second slot are at symmetric positions with respect to a center of the port;

the port includes a pair of vertical portions and a lateral portion which interconnects the pair of vertical portions;

the lateral portion extends in a direction crossing a direction along the waveguide; and the pair of vertical portions both extend in the direction along the waveguide.

12. The array antenna device of claim 1, wherein, the first electrically conductive surface has a shape defining a plurality of horns; and the first slot opens in one of the plurality of horns, and the second slot opens in another one of the plurality of horns.

13. The array antenna device of claim 4, wherein, the first slot and the second slot are at symmetric positions with respect to a center of the port;

the port includes a pair of vertical portions and a lateral portion which interconnects the pair of vertical portions;

the lateral portion extends in a direction crossing a direction along the waveguide;

the pair of vertical portions both extend in the direction along the waveguide;

the first electrically conductive surface has a shape defining a plurality of horns; and the first slot opens in one of the plurality of horns, and the second slot opens in another one of the plurality of horns.

14. The array antenna device of claim 1, wherein, the each dent has a bottom face and a vertical face which is substantially perpendicular to the bottom face.

15. The array antenna device of claim 13, wherein, the each dent has a bottom face and a vertical face which is substantially perpendicular to the bottom face.

16. A radar system comprising:

the array antenna device of claim 1;

at least one of a transmitter and a receiver that is connected to the antenna device;

at least one of a D/A converter that is connected to the transmitter and an A/D converter that is connected to the receiver; and a signal processing circuit that is connected to the at least one of the D/A converter and the A/D converter, wherein, the at least one of the transmitter and the receiver comprises a microwave integrated circuit; and the signal processing circuit performs at least one of direction-of-arrival estimation and distance estimation.

17. A radar system comprising:

the array antenna device of claim 8;

at least one of a transmitter and a receiver that is connected to the antenna device;

at least one of a D/A converter that is connected to the transmitter and an A/D converter that is connected to the receiver; and a signal processing circuit that is connected to the at least one of the D/A converter and the A/D converter, wherein, the at least one of the transmitter and the receiver comprises a microwave integrated circuit; and the signal processing circuit performs at least one of direction-of-arrival estimation and distance estimation.

18. A radar system comprising:

the array antenna device of claim 11;

at least one of a transmitter and a receiver that is connected to the antenna device;

at least one of a D/A converter that is connected to the transmitter and an A/D converter that is connected to the receiver; and a signal processing circuit that is connected to the at least one of the D/A converter and the A/D converter, wherein, the at least one of the transmitter and the receiver comprises a microwave integrated circuit; and the signal processing circuit performs at least one of direction-of-arrival estimation and distance estimation.

19. A communication system comprising:

the array antenna device of claim 1;

at least one of a transmitter and a receiver that is connected to the antenna device;

at least one of a D/A converter that is connected to the transmitter and an A/D converter that is connected to the receiver; and a signal processing circuit that is connected to the at least one of the D/A converter and the A/D converter, wherein the signal processing circuit performs at least one of encoding of a digital signal and decoding of a digital signal.

20. A communication system comprising:

the array antenna device of claim 11;

at least one of a transmitter and a receiver that is connected to the antenna device;

at least one of a D/A converter that is connected to the transmitter and an A/D converter that is connected to the receiver; and a signal processing circuit that is connected to the at least one of the D/A converter and the A/D converter, wherein the signal processing circuit performs at least one of encoding of a digital signal and decoding of a digital signal.

* * * * *